US006154625A

United States Patent [19]

Saiki et al.

[11] Patent Number: 6,154,625

[45] Date of Patent: Nov. 28, 2000

[54] DEVELOPING APPARATUS, APPARATUS UNIT, AND IMAGE FORMING METHOD

[75] Inventors: Kazunori Saiki; Yasuhide Goseki; Masayoshi Shimamura; Kenji Fujishima, all of Yokohama; Satoshi Otake; Naoki Okamoto, both of Numazu, all of Japan

[73] Assignee: Canon Kabushiki Kaisha, Tokyo, Japan

[21] Appl. No.: 09/213,264

[22] Filed: Dec. 17, 1998

[30] Foreign Application Priority Data

Dec. 19, 1997 [JP] Japan ..... 9-350352

[51] Int. Cl.[7] ..... G03G 15/09; G03G 13/09

[52] U.S. Cl. ..... 399/276; 430/122

[58] Field of Search ..... 399/276, 286; 430/120, 122

[56] References Cited

U.S. PATENT DOCUMENTS 5,911,099 6/1999 Nakajima et al. ..... 399/286

FOREIGN PATENT DOCUMENTS 1-112253 4/1989 Japan .
1-277256 11/1989 Japan .
2-284158 11/1990 Japan .
3-36570 2/1991 Japan .
3-192377 8/1991 Japan .
5-232793 9/1993 Japan .
7-114270 5/1995 Japan .
8-179617 7/1996 Japan .
10-326040 12/1998 Japan .

*Primary Examiner*—Joan Pendegrass
*Attorney, Agent, or Firm*—Fitzpatrick, Cella, Harper & Scinto

[57] ABSTRACT

A developing apparatus is disclosed which has a developer container, a developer carrying member for carrying a positively chargeable developer held in the developer container and transporting the developer to a developing zone, and a developer layer-thickness regulating member for regulating the thickness of a developer layer formed on the developer carrying member. The developer carrying member has a resin coat layer formed of a resin composition containing at least a resin selected from the group consisting of a phenol resin and a polyamide resin, a conductive material and a quaternary ammonium salt compound which is positively chargeable to iron powder. The resin composition may contain a urethane resin in place of the phenol resin and polyamide resin.

198 Claims, 61 Drawing Sheets

DEVELOPING APPARATUS, APPARATUS UNIT, AND IMAGE FORMING METHOD

BACKGROUND OF THE INVENTION

1. Field of the Invention

This invention relates to a developing apparatus, an apparatus unit and an image forming method which are used when a latent image formed on an image bearing member such as an electrophotographic photosensitive member or an electrostatic recording dielectric member is developed to render it visible by the use of a developer carried and transported on a developer carrying member.

2. Related Background Art

Developing apparatus conventionally used when electrostatic latent images formed on, e.g., a photosensitive drum serving as a latent image bearing member are rendered visible by the use of a toner which is a one-component type developer may include those of the following system: Positive or negative electric charges are imparted to toner particles by the mutual friction between toner particles, the friction between a developing sleeve as a developer carrying member and the toner particles and the friction between a member for regulating toner coat quantity on the developing sleeve (developer layer-thickness regulating member) and the toner particles. The toner thus charged is coated very thin on the developing sleeve and then transported to a developing zone at which the photosensitive drum and the developing sleeve face each other. In the developing zone, the toner is caused to fly and adhere to the electrostatic latent image formed on the surface of the photosensitive drum, to make the electrostatic latent image into a visible image.

As the developer carrying member used in such a conventional developing system, a member is used which is produced by molding, e.g., a metal, an alloy or a metal compound into a cylinder and treating its surface by electrolysis, blasting or filing so as to have a stated surface roughness.

When, however, such a developer carrying member is used, in the developer layer formed by the developer layer-thickness regulating member on the developer carrying member surface, the developer which is present in the developer layer on the developer carrying member surface and in the vicinity thereof comes to have a very high electric charge, so that it is strongly attracted to the developer carrying member surface by the action of mirror force. This makes the toner particles have no opportunity of their friction with the developer carrying member, and hence the developer may come to have no preferable electric charges. Thus, if images are formed under such a condition, no satisfactory development and transfer can be carried out, resulting in images with much uneven image density and many black spots around line images.

In recent years, toners are sought to have a smaller particle diameter so that the developer can be fixed at a lower temperature for the purpose of energy saving and highly minute images can be formed. Then, in the case when the above conventional developer carrying member is used in a machine of the type making use of a toner having such a small particle diameter, it has been difficult, as explained below, to well realize the fixing of developer at a low temperature and the formation of highly minute images. For example, there is a tendency that, for the purpose of low-temperature fixing of a developer, glass transition temperature Tg of the developer is set a little lower or a low-melting substance such as wax is added in toner particles in a little larger quantity. However, the developer having such toner particles may be affected by temperature rise of the body of an apparatus such as an electrophotographic apparatus, and tends to melt-adhere to the surface of the developer carrying member to cause a decrease in image density, white lines and blotchy images (caused by an uneven coat of the coat layer on the developer carrying member) in some cases.

Japanese Patent Applications Laid-open No. 1-112253 and No. 2-284158 disclose a proposal of using toners having small particle diameters so that image quality can be made higher and images can be made more highly minute. Such toners having small particle diameters have a larger surface area per unit weight, and hence tend to have a larger electric charge on the surface, where the toner may stick or adhere to the surface of the developer carrying member because of the phenomenon of what is called "charge-up", so that the developer fed afresh onto the developer carrying member can be charged with difficulty and the developer tends to have a non-uniform charge quantity. This tends to cause sleeve ghost on images, and the resultant images tend to be formed as non-uniform images such as images with lines and fogged images in solid black images and halftone images.

In order to prevent occurrence of such a developer having excessive electric charges and prevent strong adhesion of the developer, in Japanese Patent Applications Laid-open No. 1-277256 and No. 3-36570 a method is proposed in which a coat layer of a resin with a conductive material such as carbon black or graphite powder or a solid lubricant dispersed therein is formed on the surface of the developer carrying member. However, with regard to the resin that forms such a coat layer, only a few resins have properties which can impart positive triboelectric charges to toners, in particular, positively chargeable developers. Hence, although excessive charging of the toner can be prevented, it is difficult to make the toner retain the charge quantity at a higher level.

In Japanese Patent Application Laid-open No. 8-179617, a method is also proposed in which a coat layer of a resin to which particles chargeable to a polarity opposite to that of a toner have been added is formed on the above developer carrying member. In this method, however, the particles are further added to the resin incorporated with carbon or graphite, and hence the coat layer may have a low strength. In such an instance, it is difficult to provide images with good quality over a long period of time.

Japanese Patent Application Laid-open No. 5-232793 discloses a developing apparatus comprising a developer carrying member having as a surface layer a resin coat layer which contains at least resin, graphite and carbon black and is so formed that a charge control agent is present at the surface and the vicinity thereof, in order to control the chargeability to toner. As the charge control agent, exemplified are various charge control agents including quaternary ammonium salts. As the resin, exemplified are various resins including phenol resins, polyamide resins and polyurethane resins.

However, this prior art shows an Example in which specifically development is carried out using a negatively chargeable toner on a resin coat layer employing a phenol resin as the resin and nigrosine as the charge control agent, and has no disclosure at all as to positively chargeable toners and how positive triboelectric charges can be imparted preferably when in what combination the resin and the charge control agent are used.

For the purpose of imparting a high positive charge to toner, Japanese Patent Application Laid-open No. 7-114270 discloses a charge-providing member for developing electrostatic latent images which has at least at part of the surface a quaternary ammonium salt compound having a specific structure. It discloses that the above compound is used together with optionally a binder resin or molding resin component to form a coat layer. As the binder resin or molding resin component, used are styrene resins, styrene-acrylic copolymer resins, polyester resins, epoxy resins and mixed resins of any of these, or any of these having an amino group on the alkyl side chain. In its Examples, styrene-acrylate resin is used.

According to studies made by the present inventors, however, in the case of a developer carrying member on which such a coat layer is formed using the quaternary ammonium salt compound and the styrene-acrylate resin in combination, the quaternary ammonium salt compound is present only in the state it is dispersed merely in the styrene-acrylate resin. Thus, as shown in Comparative Examples given later in the part of Examples, the charging property of this coat layer is positive chargeability, and hence the ability to impart positive triboelectric charges to positively chargeable toners is also not sufficient.

SUMMARY OF THE INVENTION

Accordingly, an object of the present invention is to provide a developing apparatus, an apparatus unit and an image forming method that can prevent any excessive charging of toner from being caused in the developing apparatus, can keep the charging of toner at a higher level, may hardly cause melt-adhesion of toner onto the developer carrying member, and can prevent effectively the image density decrease, white lines and blotchy images which may otherwise be caused.

Another object of the present invention is to provide a developing apparatus, an apparatus unit and an image forming method that can achieve a superior wear resistance and can form stable images even in long-term running in every environment.

Still another object of the present invention is to provide a developing apparatus, an apparatus unit and an image forming method that make it possible to cause no sleeve ghost.

To achieve the above objects, the present invention provides a developing apparatus comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein the developer carrying member has at least a substrate and a resin coat layer formed of a resin composition on the surface of the substrate;

the resin composition containing at least (i) a resin selected from the group consisting of a phenol resin and a polyamide resin, (ii) a conductive material and (iii) a quaternary ammonium salt compound which is positively chargeable to iron powder.

The present invention also provides a developing apparatus comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein the developer carrying member has at least a substrate and a resin coat layer formed of a resin composition on the surface of the substrate;

the resin composition containing at least (i) a urethane resin, (ii) a conductive material and (iii) a quaternary ammonium salt compound which is positively chargeable to iron powder.

The present invention still also provides an apparatus unit detachably mountable on the main assembly of an image forming apparatus, comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein the developer carrying member has at least a substrate and a resin coat layer formed of a resin composition on the surface of the substrate;

the resin composition containing at least (i) a resin selected from the group consisting of a phenol resin and a polyamide resin, (ii) a conductive material and (iii) a quaternary ammonium salt compound which is positively chargeable to iron powder.

The present invention further provides an apparatus unit detachably mountable on the main assembly of an image forming apparatus, comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein the developer carrying member has at least a substrate and a resin coat layer formed of a resin composition on the surface of the substrate;

the resin composition containing at least (i) a urethane resin, (ii) a conductive material and (iii) a quaternary ammonium salt compound which is positively chargeable to iron powder.

The present invention still further provides an image forming method comprising the steps of;

a latent image forming step of forming an electrostatic latent image on a latent image bearing member; and a developing step of developing the electrostatic latent image by the use of a positively chargeable developer of a developing apparatus;

wherein, in the developing step, the electrostatic latent image is developed by means of the developing apparatus, which comprises;

a developer container for holding a developer;

a developer carrying member for carrying a positively chargeable developer held in the developer container and transporting the developer to a developing zone;

wherein the developer carrying member has at least a substrate and a resin coat layer formed of a resin composition on the surface of the substrate;

the resin composition containing at least (i) a resin selected from the group consisting of a phenol resin and a polyamide resin, (ii) a conductive material and (iii) a quaternary ammonium salt compound which is positively chargeable to iron powder; and a developer layer-thickness regulating member for regulating the thickness of a positively chargeable developer layer to be formed on the developer carrying member;

the positively chargeable developer being triboelectrically charged by its friction with the surface of the developer carrying member so that positive triboelectric charges are imparted to the positively chargeable developer, and the electrostatic latent image being developed by the use of the positively chargeable developer to which the positive triboelectric charges have been imparted.

The present invention still further provides an image forming method comprising the steps of;

a latent image forming step of forming an electrostatic latent image on a latent image bearing member; and a developing step of developing the electrostatic latent image by the use of a positively chargeable developer of a developing apparatus;

wherein, in the developing step, the electrostatic latent image is developed by means of the developing apparatus, which comprises;

a developer container for holding a developer;

a developer carrying member for carrying a positively chargeable developer held in the developer container and transporting the developer to a developing zone;

wherein the developer carrying member has at least a substrate and a resin coat layer formed of a resin composition on the surface of the substrate;

the resin composition containing at least (i) a urethane resin, (ii) a conductive material and (iii) a quaternary ammonium salt compound which is positively chargeable to iron powder; and a developer layer-thickness regulating member for regulating the thickness of a positively chargeable developer layer to be formed on the developer carrying member;

the positively chargeable developer being triboelectrically charged by its friction with the surface of the developer carrying member so that positive triboelectric charges are imparted to the positively chargeable developer, and the electrostatic latent image being developed by the use of the positively chargeable developer to which the positive triboelectric charges have been imparted.

DESCRIPTION OF THE PREFERRED EMBODIMENTS

The present invention will be described below in detail by giving preferred embodiments.

First, the developer carrying member that characterizes the present invention will be described. The developer carrying member used in the present invention has a cylindrical substrate made of a metal, like the one conventionally used, but in the present invention it is characterized in that a resin coat layer formed of a resin composition containing at least a conductive material, a phenol resin, polyamide resin or urethane resin, and a quaternary ammonium salt compound which is positively chargeable to iron powder is provided on the surface of the substrate.

Figure 1:
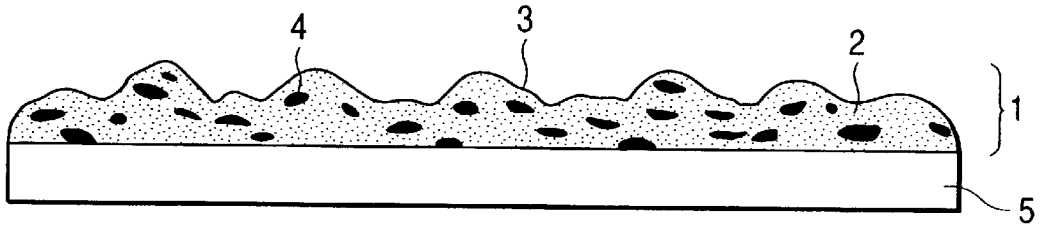
FIG. 1 is a schematic partial cross-sectional view showing an example of a developer carrying member used in the present invention.

The resin coat layer (hereinafter often simply "coat layer") on the surface of the developer carrying member used in the present invention will be described on its operation, with reference to FIG. 1. As shown in FIG. 1, a coat layer 1 formed on a cylindrical substrate 5 made of a metal is formed on the periphery of the cylindrical substrate 5 by using a phenol resin, polyamide resin or urethane resin as a binder resin 3. In this coat layer 1, a conductive material 2 is contained, and a solid lubricant 4 may optionally be contained together with the conductive material 2, like the one shown in FIG. 1.

The present inventors made extensive studies on the constitution of this coat layer 1. As the result, they have discovered that the charge-providing properties of the binder resin itself can be improved when a phenol resin, polyamide resin or urethane resin, containing a quaternary ammonium salt compound which is positively chargeable for itself to iron powder, is used as a binder resin which is a film forming material, and hence the charge quantity of toner can be kept at a higher level; that the occurrence of a developer having excessive charges and the strong adhesion of developer to the developer carrying member can be prevented effectively when a conductive material and a solid lubricant are used; and also that such a coat layer itself is more improved in its mechanical strength or wear resistance than instances where charge-providing particles are added as conventionally done, and hence can endure long-term running, making it possible to provide good images stably over a long period of time. Thus, they have accomplished the present invention.

The reason is unclear why in the present invention the coat layer can be a good charge-providing material for developers having positively chargeable toners, when the resin composition used to form a coat layer on the developer carrying member is constituted as described above. The present inventors presume it as follows:

When the quaternary ammonium salt compound used in the present invention, which is positively chargeable for itself to iron powder, is added in a phenol resin, it is dispersed uniformly in the phenol resin, and is further incorporated into the structure of the phenol resin in the course the resin is heated to harden to form the coat layer, so that such a phenol resin composition itself containing the above compound changes into a material having negative chargeability.

When the quaternary ammonium salt compound used in the present invention, which is positively chargeable for itself to iron powder, is added in a polyamide resin, it is dispersed uniformly in the polyamide resin, and is further incorporated into the structure of the polyamide resin in the course the resin is heated and dried to form the coat layer, so that such a polyamide resin composition itself containing the above compound comes to be readily chargeable to the polarity opposite to the positively chargeable developer.

When the quaternary ammonium salt compound used in the present invention, which is positively chargeable for itself to iron powder, is used in a urethane resin coat layer and is added in a urethane resin, it is first dispersed uniformly in the urethane resin, and is further readily incorporated into the structure of the urethane resin in the course the resin is heated to harden to form the coat layer. In that course, the original structure of the quaternary ammonium salt compound having a positive polarity is lost, and the urethane resin incorporated with the quaternary ammonium salt compound comes to have a uniform and sufficient negative chargeability, so that such a urethane resin composition itself containing the above compound comes to be readily chargeable to the polarity opposite to the positively chargeable developer.

Hence, the use of the developer carrying member having a coat layer formed using such a resin composition makes it possible to charge the developer preferably to the positive polarity.

The quaternary ammonium salt compound preferably used in the present invention, which has the function stated above, may include any quaternary ammonium salt compounds so long as they are positively chargeable to iron powder, including, e.g., compounds represented by the following general formula:

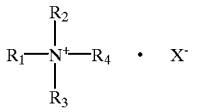

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

In the above general formula, as examples of the anion represented by $X^-$, it may include organic sulfate ions, organic sulfonate ions, organic phosphate ions, molybdate ions, tungstate ions, and heteropolyacid ions containing molybdenum atoms or tungsten atoms.

On the other hand, fluorine-containing quaternary ammonium salt compounds which are negatively chargeable to iron powder for themselves, like a compound represented by the following formula, were also studied. It, however, was found that the object of the present invention was not achievable by the use of such compounds. More specifically, since the compound represented by the following formula has in the structure the strongly electron-withdrawing fluorine atom, it is negatively chargeable for itself to iron powder. However, when a resin composition prepared by dispersing this compound in a phenol resin, polyamide resin or urethane resin used as the binder resin and this was heated to harden, or heated and dried, to form a coat layer on the developer carrying member as in the case of the present invention, the performance to impart positive triboelectric charges to the positively chargeable developer was not so highly obtainable as in the case of the present invention in which the phenol resin, polyamide resin or urethane resin incorporated with the quaternary ammonium salt compound which is positively chargeable for itself to iron powder is used as the resin composition.

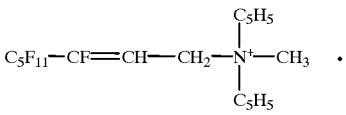

-continued

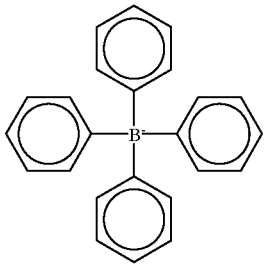

As additives for improving the performance to impart positive triboelectric charges to the positively chargeable developer which are added in the phenol resin, polyamide resin or urethane resin which is a film forming material used to form the coat layer, those other than the quaternary ammonium salt compound which is positively chargeable for itself to iron powder, used in the present invention, may be considered also usable, as exemplified by negative particles such as negative silica and negative Teflon. In such an instance, however, any of these must be added in a large quantity in order to attain the desired performance to impart positive triboelectric charges, tending to cause a decrease in strength of the coat layer. Also when a chromium complex of azonaphthol which contains chlorophenol, a iron complex of azonaphthol which contains chlorophenol and anilide or a di-tert-butyl salicylic acid chromium complex is added, which is a negative charge control agent, the coat layer having the phenol resin, polyamide resin or urethane resin may more or less be improved in the performance to impart positive triboelectric charges, but improved not so effectively as in the case of the quaternary ammonium salt compound which is positively chargeable for itself to iron powder, used in the present invention. Moreover, the negative charge control agents given above may be dispersed with difficulty in the phenol resin, polyamide resin or urethane resin, depending on the materials, so that, like the above instance, this tends to cause a decrease in strength of the coat layer.

In contrast, in forming the coat layer by using the resin composition prepared by adding to the phenol resin, polyamide resin or urethane resin the specific quaternary ammonium salt compound used in the present invention, the quaternary ammonium salt compound is, as stated previously, incorporated into the structure of the phenol resin, polyamide resin or urethane resin when the binder resin phenol resin or urethane resin is heated to harden to form the coat layer or when the binder resin polyamide resin is heated and dried to form the coat layer. Thus, different from the above instance where the negative particles such as negative silica and negative Teflon are added, the performance to impart positive triboelectric charges to the positively chargeable developer is improved not partly but on the whole coat layer. Moreover, different from films of such particle-addition type, this may neither damage workability nor cause a decrease in strength of the coat layer.

Hence, the use of a developing apparatus having the developer carrying member provided with the coat layer formed using the binder resin described above makes it possible to provide good images in an environment of normal temperature and normal humidity as a matter of course and also in an environment of high temperature and high humidity and an environment of low humidity. It also makes it possible to provide stable images in long-term running.

The quaternary ammonium salt compound which is positively chargeable for itself to iron powder, used in the present invention, may include specifically the following. Of course, the present invention is by no means limited to these.

(1)

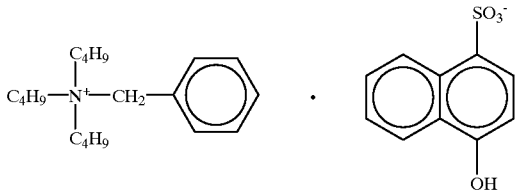

(2)

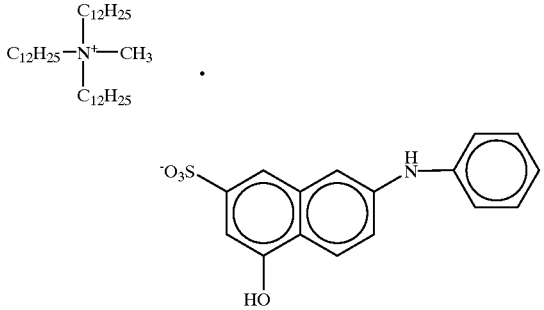

(3)

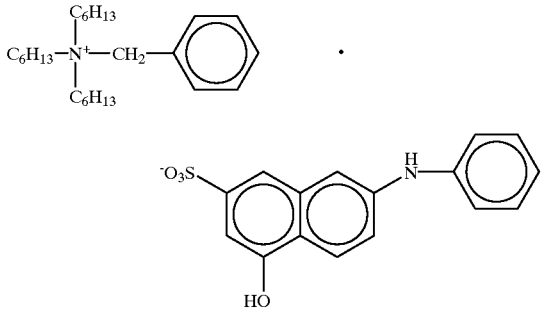

(4)

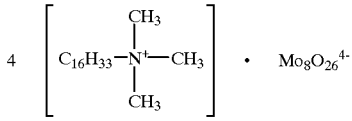

(5)

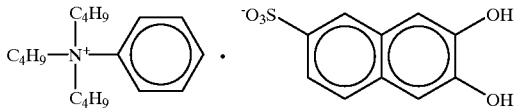

(6)

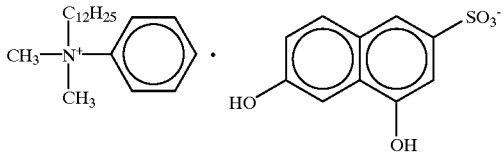

(7)

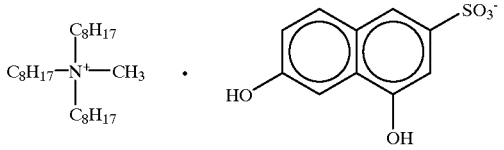

-continued (8)

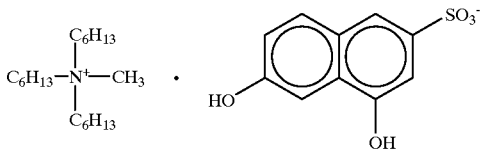

The quaternary ammonium salt compound used in the present invention, as exemplified above, may preferably be added in an amount of from 1 part by weight to 100 parts by weight based on 100 parts by weight of the phenol resin, polyamide resin or urethane resin. In an amount less than 1 part by weight, its addition may bring about no improvement in charge-providing performance. If added in an amount more than 100 parts by weight, the compound may be dispersed poorly in the binder resin, tending to cause a decrease in film strength.

As a result of extensive studies made by the present inventors, it has also been found that, as the phenol resin used in the present invention, a phenol resin produced in the presence of a nitrogen-containing compound as a catalyst in its production process may preferably be used especially because the quaternary ammonium salt compound can be incorporated readily into the structure of the phenol resin at the time of heating and hardening. Accordingly, in the present invention, such a phenol resin produced in the presence of a nitrogen-containing compound as a catalyst in its production process, having such action, may be used as one of materials constituting the coat layer formed on the developer carrying member, whereby a developing apparatus having a good positive charge-providing performance can be materialized.

The nitrogen-containing compound used as a catalyst in the production process for the phenol resin and is usable preferably in the present invention may include, e.g., as acidic catalysts, ammonium salts such as ammonium sulfate, ammonium phosphate, ammonium sulfaminate, ammonium carbonate, ammonium acetate and ammonium maleate, or amine salts; as basic catalysts, ammonia, and amino compounds such as dimethylamine, diethylamine, diisopropylamine, diisobutylamine, diamylamine, trimethylamine, triethylamine, tri-n-butyamine, triamylamine, dimethylbenzylamine, diethylbenzylamine, dimethylaniline, diethylaniline, N,N-di-n-butylaniline, N,N-diamylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine; and nitrogen-containing heterocyclic compounds. The nitrogen-containing heterocyclic compounds may include pyridine and derivatives thereof such as α-picoline, β-picoline, γ-picoline, 2,4-lutidine and 2,6-lutidine; quinoline compounds; and imidazole and derivatives thereof such as 2-methylimidazole, 2,4-dimethylimidazole, 2-ethyl-4-methylimidazole, 2-phenylimidazole, 2-phenyl-4-methylimidazole and 2-heptadecylimidazole.

The polyamide resin used in the present invention may include, e.g., nylons such as nylon 6, nylon 66, nylon 610, nylon 11, nylon 12, nylon 9, nylon 13, and nylon Q2, and copolymer nylons composed chiefly of any of these, N-alkyl-modified nylons, and N-alkoxyalkyl-modified nylons, any of which may preferably be used. It may also include various resins modified with polyamide, such as polyamide-modified phenol resins, and resins containing a polyamide resin component, such as epoxy resins making use of a polyamide resin as a curing agent, any of which may also preferably be used. In the present invention, the above nylons and copolymer nylons composed chiefly of any of them may particularly preferably be used.

As the urethane resin used in the present invention, any resins may preferably be used so long as they are resins containing a urethane linkage. The urethane linkage can be obtained by polyaddition reaction of a polyisocyanate with a polyol.

The polyisocyanate, a chief material of the urethane resin, may include aromatic polyisocyanates such as TDI (tolylene diisocyanate), pure MDI (diphenylmethane diisocyanate), polymeric MDI (polymethylene polyphenyl polyisocyanate), TODI (tolidine diisocyanate) and NDI (naphthalene diisocyanate); and aliphatic polyisocyanates such as HMDI (hexamethylene diisocyanate), IPDI (isophorone diisocyanate), XDI (xylylene diisocyanate), hydrogenated XDI (hydrogenated xylylene diisocyanate) and hydrogenated MDI (dicyclohexylmethane diisocyanate).

The polyol which reacts with the above polyisocyanate may include polyether polyols such as PPG (polyoxypropylene glycol), polymer polyol and polytetramethylene glycol (PTMG); polyester polyols such as adipate, polycaprolactone and polycarbonate polyol; polyether type modified polyols such as PHD polyol and polyether ester polyol; epoxy-modified polyols; partially saponified polyols of ethylene-vinyl acetate copolymer (saponified EVA); and flame-retardant polyols.

In the present invention, the coat layer formed on the developer carrying member by the use of the forming materials described above may preferably be electroconductive in order to prevent the developer from adhering onto the developer carrying member as a result of the charge-up, or prevent electric charges from being imparted poorly from the surface of the developer carrying member to the developer as being caused concurrently with the charge-up. The coat layer formed on the surface of the developer carrying member may preferably have a volume resistivity of from $10^{-2}$ to $10^{5}$ Ω·cm, more preferably from $10^{-2}$ to $10^{3}$ Ω·cm, and still more preferably from $10^{-2}$ to $10^{2}$ Ω·cm.

If the coat layer has a volume resistivity higher than $10^{5}$ Ω·cm, electric charges tend to be imparted poorly to the developer, so that blotchy images tend to occur. If it has a volume resistivity lower than $10^{-2}$ Ω·cm, electric charges imparted to the developer may be too low to obtain a sufficient quantity of triboelectricity, resulting in a decrease in image density.

In the present invention, in order to control the volume resistivity of the coat layer to the above values, a conductive material shown below may preferably be added in the coat layer. The conductive material used here may include, e.g., powders of metals such as aluminum, copper, nickel and silver, metal oxides such antimony oxide, indium oxide and tinoxide, and carbonaceous materials such as carbon fiber, carbon black and graphite. In the present invention, among these, carbon black, in particular, conductive amorphous carbon may preferably be used because it has especially a superior electrical conductivity and can attain any desired conductivity to a certain extent, only by filling a polymeric material with it to impart a conductivity or by controlling its amount. Also, any of these conductive materials preferably used in the present invention may preferably be added in an amount of from 1 to 100 parts by weight based on 100 parts by weight of the binder resin.

In the present invention, in order to make the developer much less adhere to the surface of the developer carrying member, a solid lubricant may further be mixed. Such a solid lubricant may include, e.g., molybdenum disulfide, boron nitride, graphite, graphite fluoride, silver-selenium-niobium, calcium chloride graphite, and talc. Any of these solid lubricants usable in the present invention may preferably be added in an amount of from 1 to 100 parts by weight based on 100 parts by weight of the binder resin.

If the solid lubricant is added in an amount less than 1 part by weight, the object of the solid lubricant can not be achieved sufficiently, so that the developer tends to adhere to the developer carrying member, tending to cause deterioration of images. If added in an amount more than 100 parts by weight, the coat layer on the surface of the developer carrying member may have a low strength, so that the coat layer tends to come off.

The coat layer on the surface of the developer carrying member used in the present invention and constituted as described above may preferably have a surface roughness in the range of from 0.1 to 3.5 $\mu$m, and more preferably from 0.2 to 2.0 $\mu$m, as JIS center-line average roughness (Ra). If the coat layer has an Ra smaller than 0.1 $\mu$m, the toner may have a too high charge quantity on the developer carrying member to make developing performance satisfactory, or the developer may be transported to the developing zone in a poor performance, making it difficult to obtain a sufficient image density. If it has an Ra larger than 3.5 $\mu$m, the developer coat layer formed on the developer carrying member tends to have a non-uniformity to cause uneven density on the images formed.

An example of the developing apparatus of the present invention in which the developer carrying member that can exhibit the advantages as described above is incorporated to constitute the apparatus will be described below.

Figure 2:
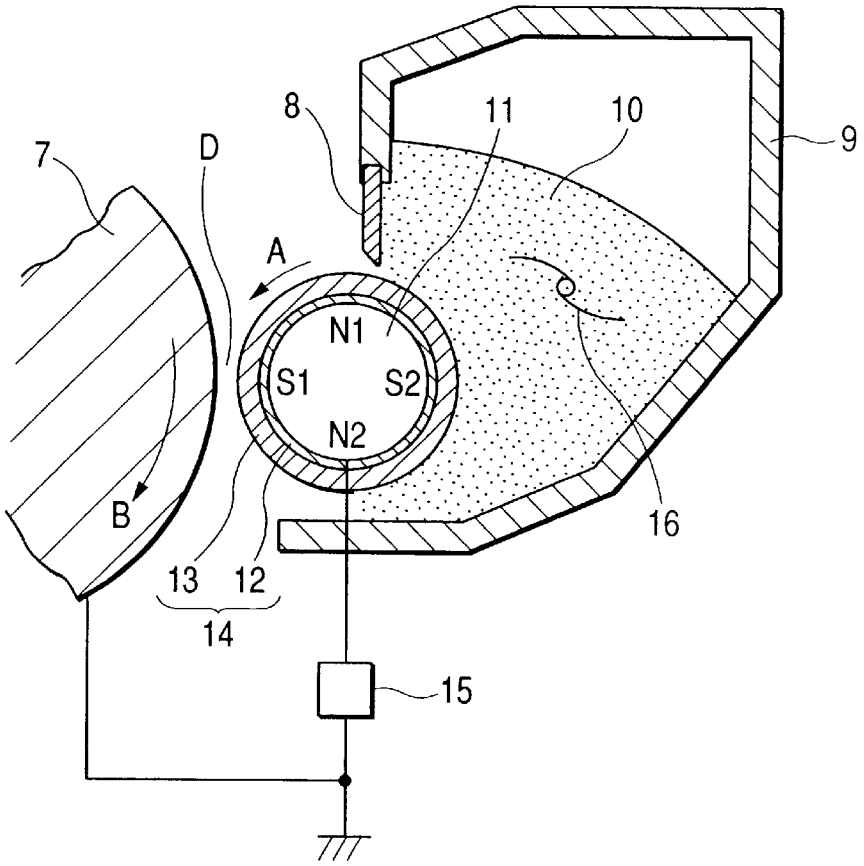
FIG. 2 illustrates schematically an example of the developing apparatus of the present invention.

FIG. 2 diagrammatically illustrates the constitution of an embodiment of the developing apparatus of the present invention.

As shown in FIG. 2, a latent image bearing member, e.g., an electrophotographic photosensitive drum 7, holding thereon an electrostatic latent image formed by a known process is rotated in the direction of an arrow B. A developing sleeve 14 as the developer carrying member carries a one-component type developer, magnetic toner 10 fed by a hopper 9 serving as the developer container, and is rotated in the direction of an arrow A. Thus, the magnetic toner 10 is transported to the developing area D (developing zone) where the developing sleeve 14 and the photosensitive drum 7 face each other. Inside the developing sleeve 14, a magnet 11 is provided so that the magnetic toner 10 is magnetically attracted and held onto the developing sleeve 14. The magnetic toner 10 carried on such a developing sleeve 14 gains triboelectric charges enabling development of the electrostatic latent image on the photosensitive drum 7, as a result of its friction with the developing sleeve 14. The magnetic toner 10 in the hopper 9 is agitated by an agitator 16.

In the developing apparatus exemplified in FIG. 2, in order to control the layer thickness of the magnetic toner 10 transported to the developing zone D, a regulating blade 8 made of a ferromagnetic metal, serving as the developer layer-thickness regulating member, extends downwards vertically from the developer container, hopper 9, in such a manner that it faces on the developing sleeve 14, leaving a gap of about 200 to 300 $\mu$m wide between them. Thus, the magnetic line of force exerted from a magnetic pole N1 of the magnet 11 in the developing sleeve 14 is converged to the blade 8 to thereby form on the developing sleeve 14 a thin layer of the magnetic toner 10. A non-magnetic blade may also be used in place of the blade 8.

In the present invention, the thickness of the thin layer of the magnetic toner 10, thus formed on the developing sleeve 14, may preferably be smaller than the minimum gap between the developing sleeve 14 and the photosensitive drum 7 at the developing zone D. The present invention is especially effective in the developing apparatus of the type the electrostatic latent image is developed through such a toner thin layer, i.e., a non-contact type developing apparatus.

However, of course, the present invention may also be applied in a developing apparatus of the type the thickness of the developer layer is larger than the minimum gap between the developing sleeve 14 and the photosensitive drum 7 at the developing zone D, i.e., a contact type developing apparatus. To avoid complicacy of description, the non-contact developing apparatus is taken as an example in the following description.

In the developing sleeve 14 preferred in the present invention, constituted as described above, in order to cause to fly the magnetic toner 10 carried thereon, a development bias voltage is applied thereto through a power source 15. In the present invention, when a DC voltage is used as the development bias voltage, a voltage having a value intermediate between the potential at electrostatic latent image areas (the region rendered visible upon attraction of the magnetic toner 10) and the potential at back ground areas may preferably be applied to the developing sleeve 14. Meanwhile, in order to enhance the density of developed images or improve the gradation thereof, an alternating bias voltage may be applied to the developing sleeve 14 to form in the developing zone D a vibrating electric field whose direction alternately reverses. In such a case, an alternating bias voltage formed by superimposing the above DC voltage component having a value intermediate between the potential at image areas and the potential at back ground areas may preferably be applied to the developing sleeve 14. In place of the alternating bias voltage, a pulse bias voltage may be applied.

In the case of what is called regular development, where a toner is attracted to high-potential areas of an electrostatic latent image having high-potential areas and low-potential areas, a toner chargeable to a polarity reverse to the polarity of the electrostatic latent image may preferably be used. On the other hand, in the case of what is called reverse development, where a toner is attracted to low-potential areas of an electrostatic latent image having high-potential areas and low-potential areas, a toner chargeable to the same polarity as the polarity of the electrostatic latent image may preferably be used. Incidentally, what is meant by the high-potential areas or the low-potential areas is expressed by the absolute value. In either case, the magnetic toner 10 is charged electrostatically to the polarity for developing the electrostatic latent image, upon its friction with the developing sleeve 14. Silica added externally to the magnetic toner 10 is also charged upon its friction with the developing sleeve 14.

An example of the image forming apparatus employing the developing apparatus of the present invention, exemplified in FIG. 2, will be described below with reference to FIG. 4.

Reference numeral 7 denotes a rotary drum type photosensitive member serving as the latent image bearing member. The photosensitive member 7 is constituted basically of a conductive substrate layer 7*b* formed of, e.g., aluminum and a photoconductive layer 7*a* formed on its periphery. The surface layer portion of the photoconductive layer 7*a* is constituted of a polycarbonate resin containing a charge-transporting material and 8% by weight of a fluorine type fine resin powder. The photosensitive member is driven rotatingly in the clockwise direction as viewed in the drawing, at a peripheral speed of 200 mm/second.

Reference numeral 24 denotes a charging roller, a contact charging member, serving as the primary charging means, which is constituted basically of a mandrel 24*b* at the center and provided on its periphery a conductive elastic layer 24*a* formed of epichlorohydrin rubber containing carbon black.

The charging roller 24 is brought into pressure contact with the surface of the photosensitive member 7 under a pressure of 40 g/cm in linear pressure, and is follow-up rotated with the rotation of the photosensitive member 7. As a cleaning member 26, a felt pad is also brought into touch with the charging roller 24.

Reference numeral 25 denotes a charging bias power source for applying a voltage to the charging roller 24, and the surface of the photosensitive member 7 is charged uniformly to a polarity-potential of about −700 V upon application of a bias voltage of DC −1.4 kV to the charging roller 24.

Subsequently, electrostatic latent images are formed by imagewise exposure 20 as a latent image forming means. The electrostatic latent images formed are developed by a one-component type developer 10 held in a hopper 9 of the developing apparatus and are rendered visible one after another as toner images. Reference numeral 17 denotes a transfer roller as a contact transfer member, which is constituted basically of a mandrel 17*b* at the center and provided on its periphery a conductive elastic layer 17*a* formed of an ethylene-propylene-butadiene copolymer containing carbon black.

The transfer roller 17 is brought into pressure contact with the surface of the photosensitive member under a pressure of 20 g/cm in linear pressure, and is rotated at the same speed as the peripheral speed of the photosensitive member 7. As a cleaning member 19, a felt pad is also brought into touch with the transfer roller 17.

As a recording medium P, an A4-size sheet of paper is used. This paper is fed to be held between the photosensitive member 7 and the transfer roller 17, and simultaneously a bias of DC −5 kV with a polarity reverse to that of the toner is applied from a transfer bias power source 18, so that the toner images on the photosensitive member 7 are transferred to the surface of the recording medium P. Thus, at the time of transfer, the transfer roller 17 is brought into pressure contact with the photosensitive member 1 via the recording medium P.

Next, the recording medium P is transported to a fixing assembly 22 as a fixing means, which is constituted basically of a fixing roller 22 a provided internally with a halogen heater, and an elastic material pressure roller 22*b* brought into contact therewith under pressure, and is passed between the fixing roller 22*a* and the pressure roller 22*b*, whereupon the toner images are fixed on to the recording medium P, and then put out as an image-formed matter.

After the toner images have been transferred, the surface of the photosensitive member 7 is cleaned to remove the adherent contaminants such as toner remaining after transfer, by means of a cleaning device 23 having an elastic cleaning blade 23*a* formed of polyurethane rubber as a basic material, which is brought into pressure contact with the photosensitive member 7 in the counter direction under a linear pressure of 25 g/cm. The surface is further destatized by means of a charge eliminating exposure device 21. Then, images are repeatedly formed thereon.

Figure 3:
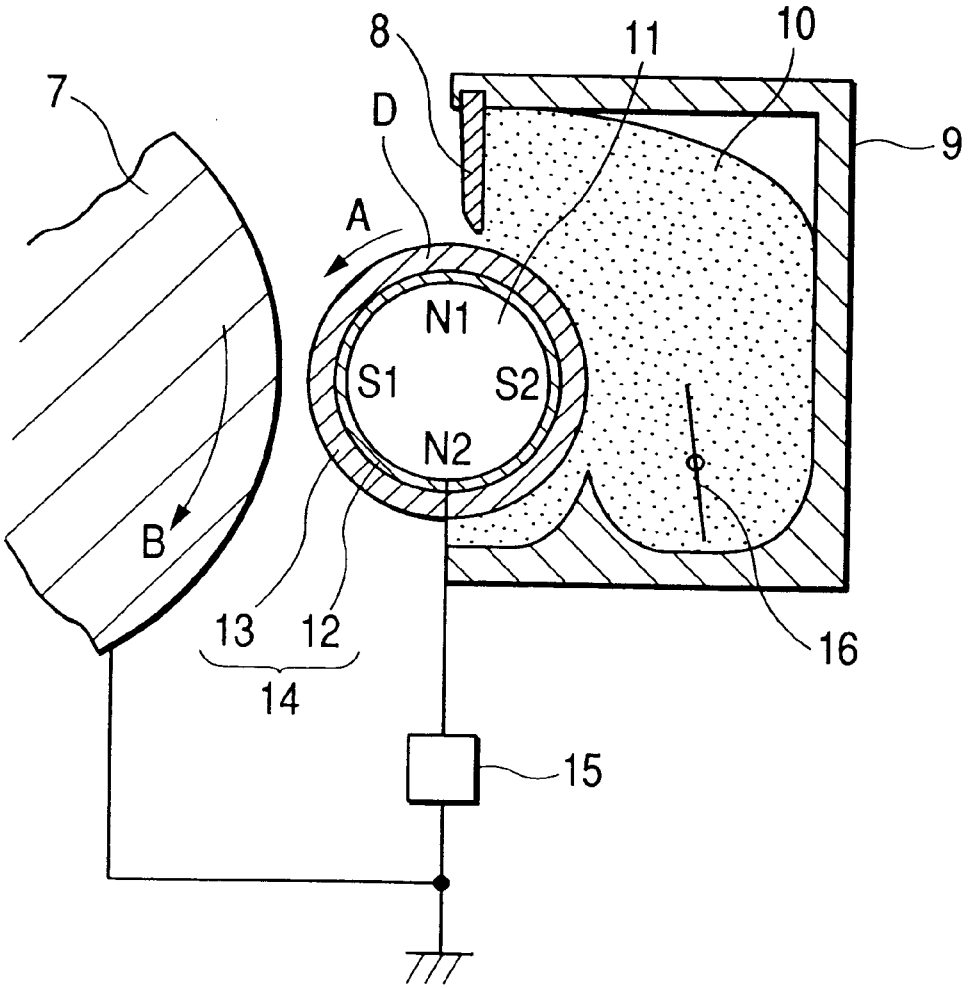
FIG. 3 illustrates schematically another example of the developing apparatus of the present invention.

A developing apparatus shown in FIG. 3 is another embodiment of the developing apparatus shown in FIG. 2, in which the shape of the hopper 9 is changed as shown by reference numeral 9 and concurrently therewith the position of an agitator 16 is changed. Like members shown in FIG. 2 are denoted by like reference numerals.

In the present invention, the apparatus unit comprises the developing apparatus as shown in FIG. 2 or 3, which is mounted detachably to the body of an image forming apparatus (e.g., a copying machine, a laser beam printer or a facsimile machine).

As the apparatus unit, in addition to the developing apparatus shown in FIG. 2 or 3, at least one constituent members selected from a drum type latent image bearing member 7 (photosensitive drum), a cleaning means 22 having a cleaning blade 22*a* and a contact (roller) charging means as a primary charging means may be provided as one unit.

Here, any constituents not selected from the above group e.g., the charging means and/or the cleaning means may be set up on the side of the body of the apparatus.

Figure 5:
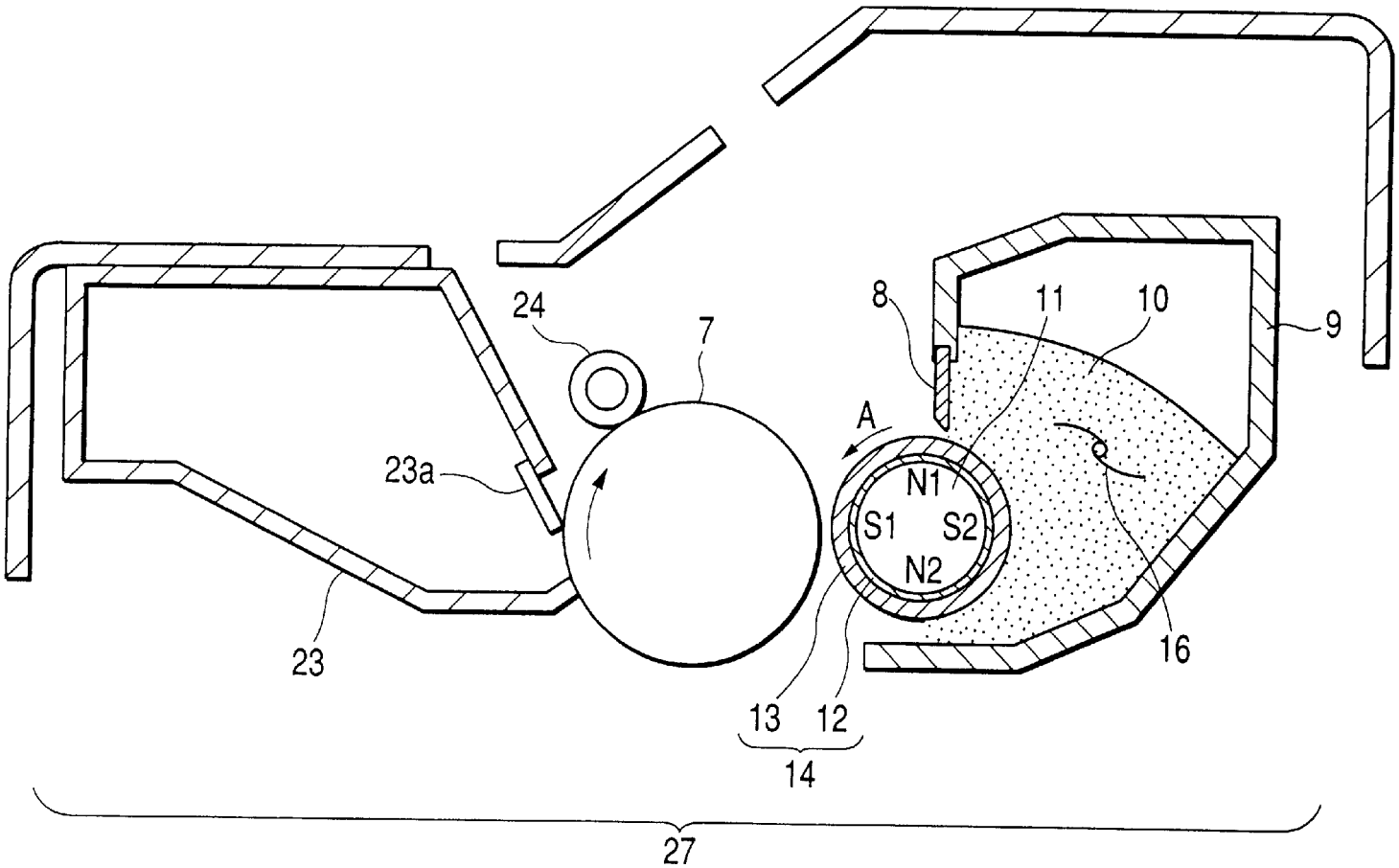
FIG. 5 illustrates schematically an example of the apparatus unit of the present invention.

FIG. 5 illustrates an example of a process cartridge as the apparatus unit of the present invention.

Figure 4:
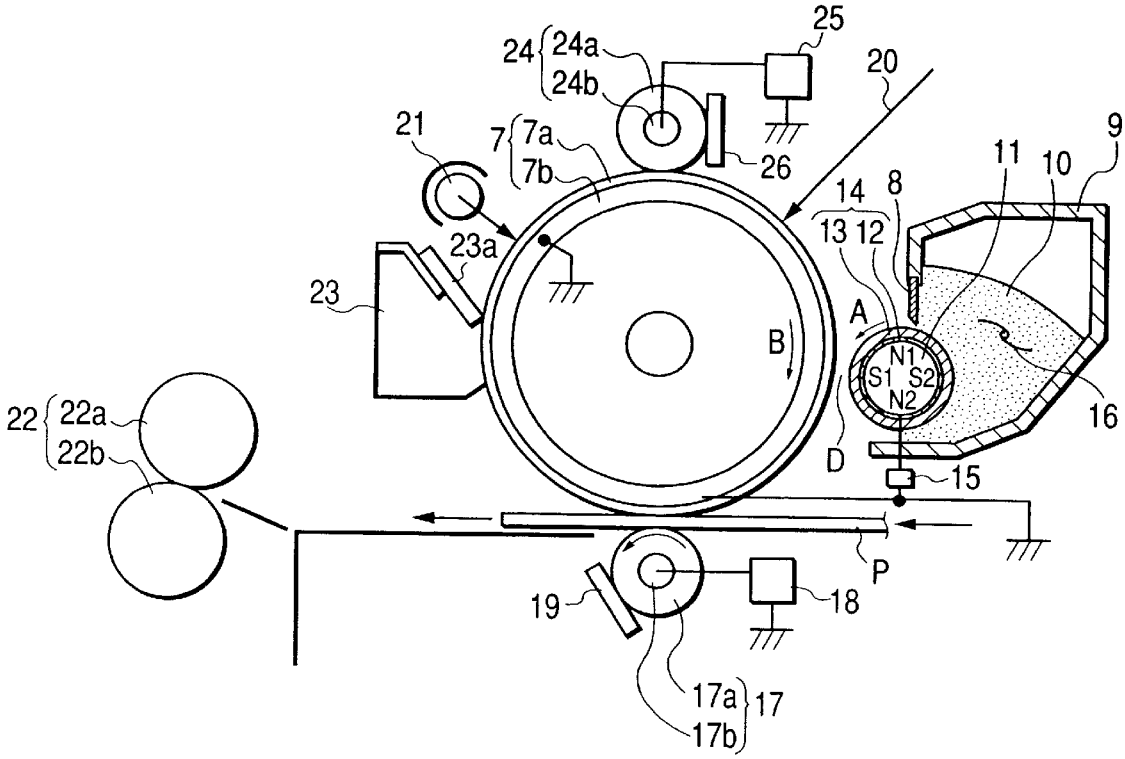
FIG. 4 illustrates schematically an example of an image forming apparatus used in the present invention.

In the following description of the process cartridge, constituent members having the same functions as those in the image forming apparatus described with reference to FIG. 4 are denoted by the like reference numerals.

In the process cartridge of the present invention, at least the developing means and the latent image bearing member are joined into one unit as a cartridge, and the process cartridge is so constituted as to be detachably mountable to the body of the image forming apparatus (e.g., a copying machine, a laser beam printer or a facsimile machine).

In the embodiment shown in FIG. 5, a process cartridge 27 as the apparatus unit is exemplified in which a developing apparatus, a drum type latent image bearing member (photosensitive drum) 7, a cleaning means 23 having a cleaning blade 23*a* and a contact (roller) charging means 24 as a primary charging means are joined into one unit.

In this embodiment, the developing apparatus has a magnetic blade 8 and in a hopper 9 as the developer container a one-component type developer 10 having a magnetic toner. At the time of development, a given electric field is formed across the photosensitive drum 7 and a developing sleeve 14 by applying a development bias voltage from a bias applying means, to carry out the developing step using the developer 10. In order to carry out this developing step preferably, the distance between the photosensitive drum 7 and the developing sleeve 14 is very important.

In the above, an embodiment has been described in which the four constituents, the developing apparatus, the latent image bearing member 7, the cleaning means 23 and the primary charging means 24 are joined into one unit as a cartridge. As the process cartridge, at least two constituents, the developing apparatus and the latent image bearing member, may be joined into one unit as a cartridge. Thus, it is also possible to use three constituents, the developing means, the latent image bearing member and the cleaning means, and three constituents, the developing means, the latent image bearing member and the primary charging means, or to add other constituent(s), so as to be joined together into one unit as a cartridge.

Figure 6:
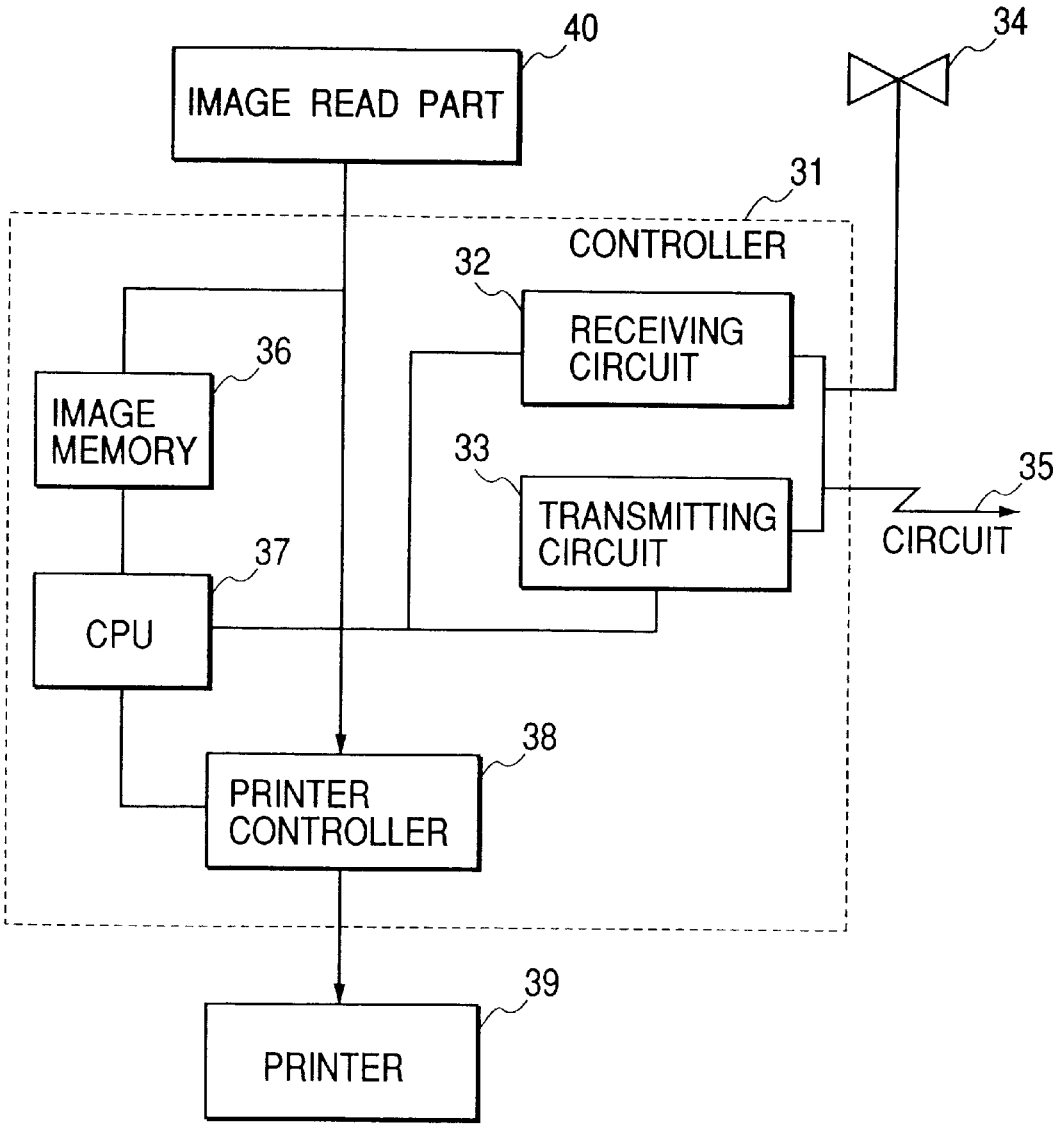
FIG. 6 is a block diagram of an instance where the image forming apparatus in the present invention is used as a printer of a facsimile transmission system.

When the image forming method of the present invention is applied to a printer of a facsimile machine, the photoimagewise exposing light L serves as exposing light used for the printing of received data. FIG. 6 illustrates an example thereof in the form of a block diagram.

A controller 31 controls an image reading part 40 and a printer 39. The whole of the controller 31 is controlled by CPU 37. Image data outputted from the image reading part are sent to the other facsimile station through a transmitting circuit 33. Data received from the other station is sent to a printer 39 through a receiving circuit 32. Stated image data are stored in an image memory 36. A printer controller 38 controls the printer 39. The numeral 34 denotes a telephone.

Images received from a circuit 35 (image information from a remote terminal connected through the circuit) are demodulated in the receiving circuit 32, and then successively stored in an image memory 36 after the image information is decoded by the CPU 37. Then, when images for at least one page have been stored in the memory 36, the image recording for that page is performed. The CPU 37 reads out the image information for one page from the memory 36 and sends the coded image information for one page to the printer controller 38. The printer controller 38, having received the image information for one page from the CPU 37, controls the printer 39 so that the image information for one page is recorded.

The CPU 37 receives image information for next page in the course of the recording by the printer 39.

Images are received and recorded in the manner as described above.

The positively chargeable developer (positively chargeable toner) used in the present invention to obtain a visible image from the electrostatic latent image will be described below.

Positively chargeable toners to be contained in positively chargeable developers are roughly grouped into dry process toners and wet process toners. The wet process toners had a serious problem of evaporation of solvents. Hence, at present, the dry process toners are prevailing. Positively chargeable toner is a fine powder obtained chiefly by melt-kneading materials such as a binder resin, a release agent, a charge control agent and a colorant, and cooling the kneaded product to solidify, followed by pulverization and further followed by classification to make particle size distribution uniform.

The binder resin used in the positively chargeable toner may include, for example, styrene, homopolymers of styrene or derivatives thereof such as α-methylstyrene and p-chlorostyrene; styrene copolymers such as a styrene-propylene copolymer, a styrene-vinyltoluene copolymer, a styrene-ethyl acrylate copolymer, a styrene-butyl acrylate copolymer, a styrene-octyl acrylate copolymer, a styrene-dimethylaminoethyl copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-methyl vinyl ketone copolymer, a styrene-butadiene copolymer, a styrene-isoprene copolymer, a styrene-maleic acid copolymer, and a styrene-maleic acid ester copolymer; polymethyl methacrylate; polybutyl methacrylate; polyvinyl acetate; polyethylene; polypropylene; polyvinyl butyral; polyacrylic resins; rosin; modified rosins; terpene resins; phenol resins; aliphatic or alicyclic hydrocarbon resins; aromatic petroleum resins; paraffin wax; and carnauba wax. Any of these may be used alone or in the form of a mixture.

When the positively chargeable toner is used as a color toner (a non-magnetic toner), a dye or pigment may be contained as a colorant in the toner. The dye or pigment may include, for example, carbon black, Nigrosine dyes, lamp black, Sudan Black SM, Fast Yellow G, Benzidine Yellow, Pigment Yellow, Indian First Orange, Irgazine Red, Para Nitroaniline Red, Toluidine Red, Carmine FB, Permanent Bordeaux FRR, Pigment Orange R, Lithol Red 2G, Lake Red 2C, Rhodamine FB, Rhodamine B Lake, Methyl Violet B lake, Phthalocyanine Blue, Pigment Blue, Brilliant Green B, Phthalocyanine Green, Oil Yellow GG, Zapon First Yellow CGG, Kayaset Y963, Kayaset YG, Zapon First Orange RR, Oil Scarlet, Aurazole Brown B, Zapon First Scarlet CG, and Oil Pink OP. Any of these may be used under appropriate selection.

When the positively chargeable toner is used as a magnetic toner, a magnetic powder is incorporated in the toner. As the magnetic powder, a material magnetizable when placed in a magnetic field is used. The magnetic powder may include, e.g.,, powders of ferromagnetic metals such as iron, cobalt and nickel; and alloys or compounds such as magnetite, hematite and ferrite. Such a magnetic powder may preferably be in a content of approximately from 15 to 70% by weight based on the weight of the toner.

In some cases, a release agent of various types is added and incorporated in the toner. Such a release agent may include polyfluoroethylene, fluorine resins, fluorocarbon oil, silicone oil, low-molecular weight polyethylene, low-molecular weight polypropylene and various types of waxes.

For the purposes of improving releasability and fixing performance at the time of fixing, the toner may be incorporated with a wax. Such a wax may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products. Besides, alcohols, fatty acids, acid amides, esters, ketones, hardened caster oil and derivatives thereof, vegetable waxes, animal waxes, mineral waxes or petrolatum may be used.

In the present invention, a charge control agent of various types may preferably be added in order to make the toner readily chargeable to the positive polarity.

Charge control agents for making the toner readily chargeable to the positive polarity may include, e.g., Nigrosine and modified products thereof, modified with a fatty acid metal salt; quaternary ammonium salts such as tributylbenzylammonium 1-hydroxy-4-naphthosulfonate, tetrabutylammonium tetrafluoroborate, and analogues of these, onium salts such as phosphonium salts, and lake pigments of these; triphenylmethane dyes and lake pigments of these (a lake forming agent may include tungstophosphoric acid, molybdophosphoric acid, tungstomolybdophosphoric acid, tannic acid, lauric acid, gallic acid, ferricyanides and ferrocyanides); metal salts of higher fatty acid; diorganotin oxides such as dibutyltin oxide, dioctyltin oxide and dicyclohexyltin oxide; and diorganotin borates such as dibutyltin borate, dioctyltin borate and dicyclohexyltin borate; and nitrogen-containing heterocyclic compounds. Any of these may be used alone or in combination of two or more kinds.

For the purpose of improving fluidity, powder such as a fine powder may optionally be added to the toner. As the fine powder, an inorganic fine powder may preferably be used. Such an inorganic fine powder may include, e.g., fine silica powder, and powders of metal oxides such as alumina, titania, germanium oxide and zirconium oxide; carbides such as silicon carbide and titanium carbide; and nitrides such as silicon nitride and germanium nitride.

These inorganic fine powders may be used after their organic treatment with an organic treating agent such as an organosilicon compound or a titanium coupling agent. For example, the organosilicon compound may include silane coupling agents such as hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

The inorganic fine powder may be treated with the above silane coupling agent by a method including, e.g., spraying, organic solvent treatment and aqueous solution treatment. The treatment by spraying is commonly a method in which a pigment is agitated and an aqueous solution or solvent solution of the coupling agent is sprayed on the pigment being agitated, followed by drying at about 120 to 130° C. to remove the water or solvent. The organic solvent treatment is a method in which the coupling agent is dissolved in an organic solvent (e.g., alcohol, benzene, halogenated hydrocarbons) containing a hydrolysis catalyst together with a small quantity of water, and the pigment is immersed in the resultant solution, followed by filtration or pressing to effect solid-liquid separation and then drying at about 120 to 130° C. The aqueous solution treatment is a method in which about 0.5% of the coupling agent is hydrolyzed in water or in a water-solvent mixture with a stated pH and the pigment is immersed in the resultant hydrolyzate, similarly followed by solid-liquid separation and then drying.

As other organic treatment, it is also possible to use a fine powder treated with silicone oil. The silicone oil may commonly include those represented by the following formula:

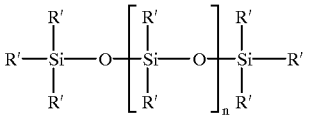

wherein $R^1$ represents an alkyl group (e.g., a methyl group) or an aryl group, and n represents an integer.

As a preferred silicone oil, a silicone oil having a viscosity at 25° C. of from about 0.5 to 10,000 $mm^2/s$, and preferably from 1 to 1,000 $mm^2/s$, may be used, which may include, e.g., methylhydrogensilicone oil, dimethylsilicone oil, phenylmethylsilicone oil, chlorophenylmethylsilicone oil, alkyl-modified silicone oil, fatty-acid-modified silicone oil, polyoxyalkylene-modified silicone oil and fluorine-modified silicone oil.

The treatment with silicone oil may be carried out, e.g., in the following way. The pigment is vigorously kept agitated optionally with heating, and the above silicone oil or its solution is sprayed, or vaporized and then sprayed, or the pigment is made into a slurry and the above silicone oil or its solution is added dropwise while stirring the slurry, whereby the treatment can be made with ease.

Any of these silicone oils may be used alone or in the form of a mixture, or in combination, of two or more, or after their multiple treatment. The silicone oil may also be used in combination with the silane coupling agent.

In view of the advantages that development faithful to the electrostatic latent image can be made and developing performance with superior fine-line reproducibility and half-tone resolution can be achieved, the positively chargeable developer used in the present invention may comprise a toner which may preferably have a weight-average particle diameter of from 3 to 12 μm, and more preferably from 5 to 10 μm, and have a particle size distribution that magnetic toner particles with diameters of 4.0 μm or smaller are preferably in a content of 30% by number or less, and more preferably from 5 to 20% by number, and magnetic toner particles with diameters of 12.7 μm or larger preferably in a content of 12.0% by volume or less, and preferably 10.0% by volume or less.

If the toner particles have a weight-average particle diameter smaller than 3 μm, difficulties such as toner scatter and fog may occur, and, when used in the formation of graphic images or the like having a high image area percentage, problems may occur such that the toner may be laid on recording paper in so small a quantity as to result in a low image density. If the particles have a weight-average particle diameter larger than 12 μm, the reproducibility of minute dots may lower to provide no good resolution, or the toner may scatter at the time of transfer to tend to cause a decrease in image quality as copying is continued, even if the image quality is good at the beginning.

If the magnetic toner particles with diameters of 4 μm or smaller are in a content more than 30% by number, fog tends to occur, and also the magnetic toner particles tend to become aggregated one another to form toner lumps having diameters larger than the original ones, resulting in coarse images and a lowering of resolution, or resulting in a great difference in density between edges and inner areas of latent images to tend to cause somewhat hollow-character images.

If the magnetic toner particles with diameters of 12.7 μm or larger is in a content more than 12.0% by volume, toner scatter tends to occur to not only hinder the fine-line reproduction but also cause poor-transfer images. The latter is caused in the course of transfer, where a little coarse toner particles with diameter larger than 12.7 μm may become present protrudently from the surface of a thin layer of particles of toner images formed by development on the photosensitive member, to make irregular the state of close contact between the photosensitive member and the recording paper through such a toner image layer to cause variations of transfer conditions.

In the case when images are formed using the positively chargeable developer having the toner having a small particle diameter and a specific particle size distribution as stated above, the toner has a larger surface area per unit weight as previously stated, to come to have a large charge quantity per unit weight (Cm/kg). Accordingly, the developer tends to cause sleeve ghost because of the phenomenon of charge-up especially in an environment of low temperature and low humidity.

In the present invention, however, the resin coat layer comprised of the specific resin composition as previously described is formed on the surface of the developer carrying member. Hence, the phenomenon of charge-up in an environment of low temperature and low humidity can be restrained because the resin coat layer on the developer carrying member, containing the conductive material, leaks charges of the toner appropriately. Also, in an environment of high temperature and high humidity, the rise of charging of the toner can be made higher by the resin coat layer having the negative chargeability sufficiently. Thus, the positively chargeable developer having the toner having a small particle diameter and a specific particle size distribution as stated above can be used well and successfully in every environment of normal temperature and normal humidity, low temperature and low humidity, and high temperature and high humidity.

In the present invention, the magnetic toner may be used as a one-component type developer.

In the present invention, the non-magnetic toner may be blended with a carrier so as to be used as a two-component type developer, or, without being blended with a carrier, may be used as a non-magnetic one-component type developer.

Physical properties concerning the present invention are measured by the methods as described below.

(1) Measurement of Center-Line Average Roughness (Ra)

In accordance with the surface roughness in JIS B0601, values at six points each of (axial-direction three points)× (peripheral-direction two points) are measured using Surfcoader SE-3300, manufactured by Kosaka Kenkyusho, and their average value is calculated.

(2) Measurement of Volume Resistivity of Coat Layer

A conductive coat layer of 7 to 20 μm thick is formed on a PET sheet of 100 μm thick, and its resistivity is measured using a voltage drop type digital ohmmeter (manufactured by Kawaguchi Denki Seisakusho), which is in conformity with the ASTM standard (D-991-82) and the Japan Rubber Association standard SRIS (2301-1969), used for measuring volume resistivity of conductive rubbers and plastics, and provided with an electrode of a four-terminal structure. The measurement is made in an environment of 20 to 25° C. and 50 to 60% RH.

Figure 61:
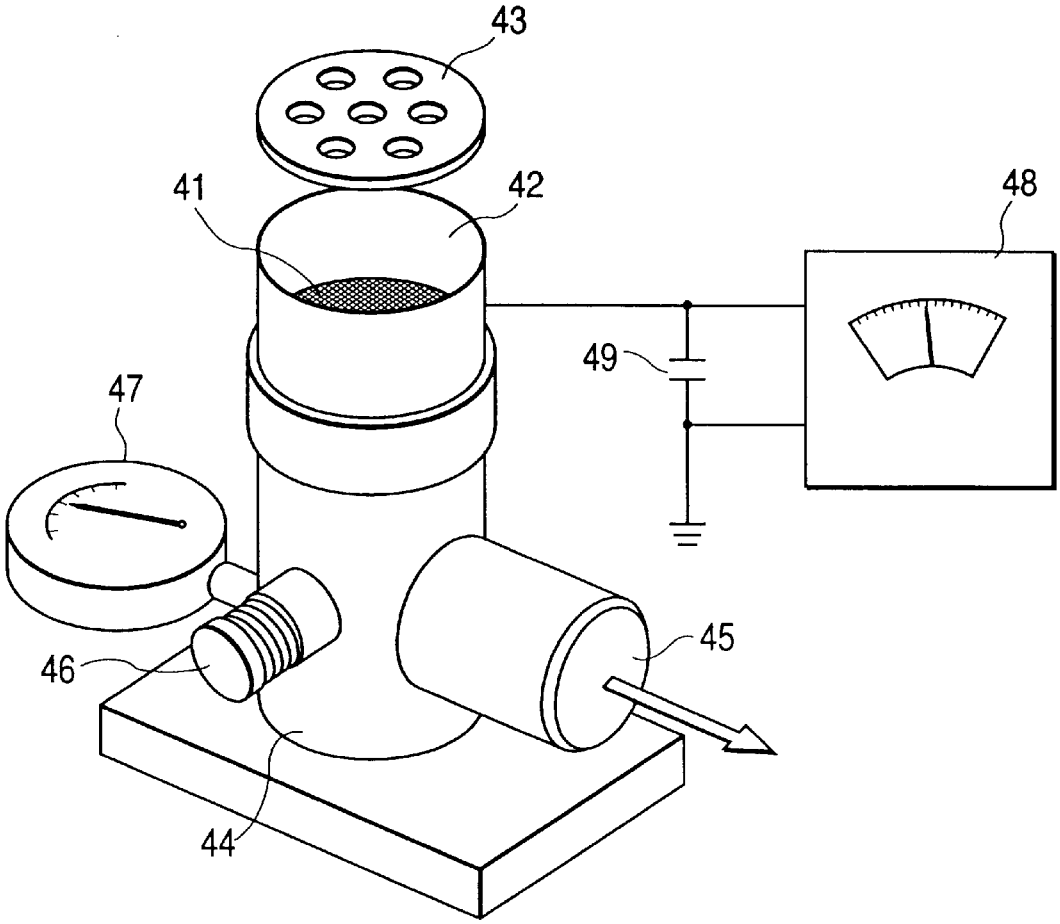
FIG. 61 is a device for measuring the quantity of triboelectricity, used to measure the charge polarity of quaternary ammonium salt compounds to iron powder.

(3) Measurement of Polarity of Triboelectricity of Quaternary Ammonium Salt Compound to Iron Powder The polarity of triboelectricity to iron powder is measured by the blow-off process, using a commercially available triboelectric charge quantity measuring device (Model TB-200, manufactured by Toshiba Chemical Corporation), which is as shown in FIG. 61.

In an environment of 23° C. and relative humidity 60% and using EFV200/300 (available from Powder Teck Co.) as a carrier, a mixture prepared by mixing 0.5 g of a quaternary ammonium salt compound in 9.5 g of the carrier is put in a bottle with a volume of 50 to 100 ml, made of polyethylene, and manually shaked 50 times. Then, 1.0 to 1.2 g of the resultant mixture is put in a measuring container 42 made of a metal at the bottom of which a conductive screen 41 of 500 meshes is provided, and the container is covered with a plate 43 made of a metal. Next, in a suction device 44 (made of an insulating material at least at the part coming into contact with the measuring container 42), air is sucked from a suction opening 45 and an air-flow control valve 46 is operated to control the pressure indicated by a vacuum indicator 47, so as to be 250 mm Aq. In this state, suction is carried out for 1 minute to remove the quaternary ammonium salt compound by suction. Polarity of the potential indicated by a potentiometer 48 at this time is read. Reference numeral 49 denotes a capacitor.

(4) Measurement of Polarity of Triboelectricity of Resin Coat Layer to Iron Powder Preparation of sample plate:

A solution of the resin coat layer whose charge polarity is to be measured (except the conductive agent such as carbon or graphite) is coated on a SUS stainless steel plate by means of a bar coater (#60), the resulting wet coating is dried to form a film (drying temperature and time are those of until the solution evaporates completely in the case of a thermoplastic resin, and until the resin is cross-linked completely in the case of a thermosetting resin) to prepare a sample plate. This sample plate is left overnight in an environment of 23° C. and 60% RH in the state it is grounded.

Preparation of positive toner model particles:

To 100 parts by weight of a styrene/2-ethylhexyl acrylate/divinylbenzene copolymer (copolymerization ratio: 80/17.5/2.5; weight-average molecular weight Mw: 320,000), 10 parts by weight of a toluene fluid in which 2 parts by weight of Copy Blue PR (available from Clariant GmbH) (solid matter concentration: 10% by weight) and 100 parts by weight of spherical ferrite particles (particle diameter: about 90 μm) are added, which are then agitated at 80° C. for 4 hours by means of a Nauta mixer. The resultant mixture is heated at 140° C. for 1 hour to make the solvent volatilize completely, thus resin layers are formed on the ferrite particle surfaces. The resultant particles are disintegrated while they are cooled to a room temperature, followed by sieving with a 83-mesh sieve to remove blocked particles. The resultant particles are left overnight or longer in an environment of 23° C. and 60% RH in the state they are grounded. These are designated as positive toner model particles 51.

Measurement

Figure 62:
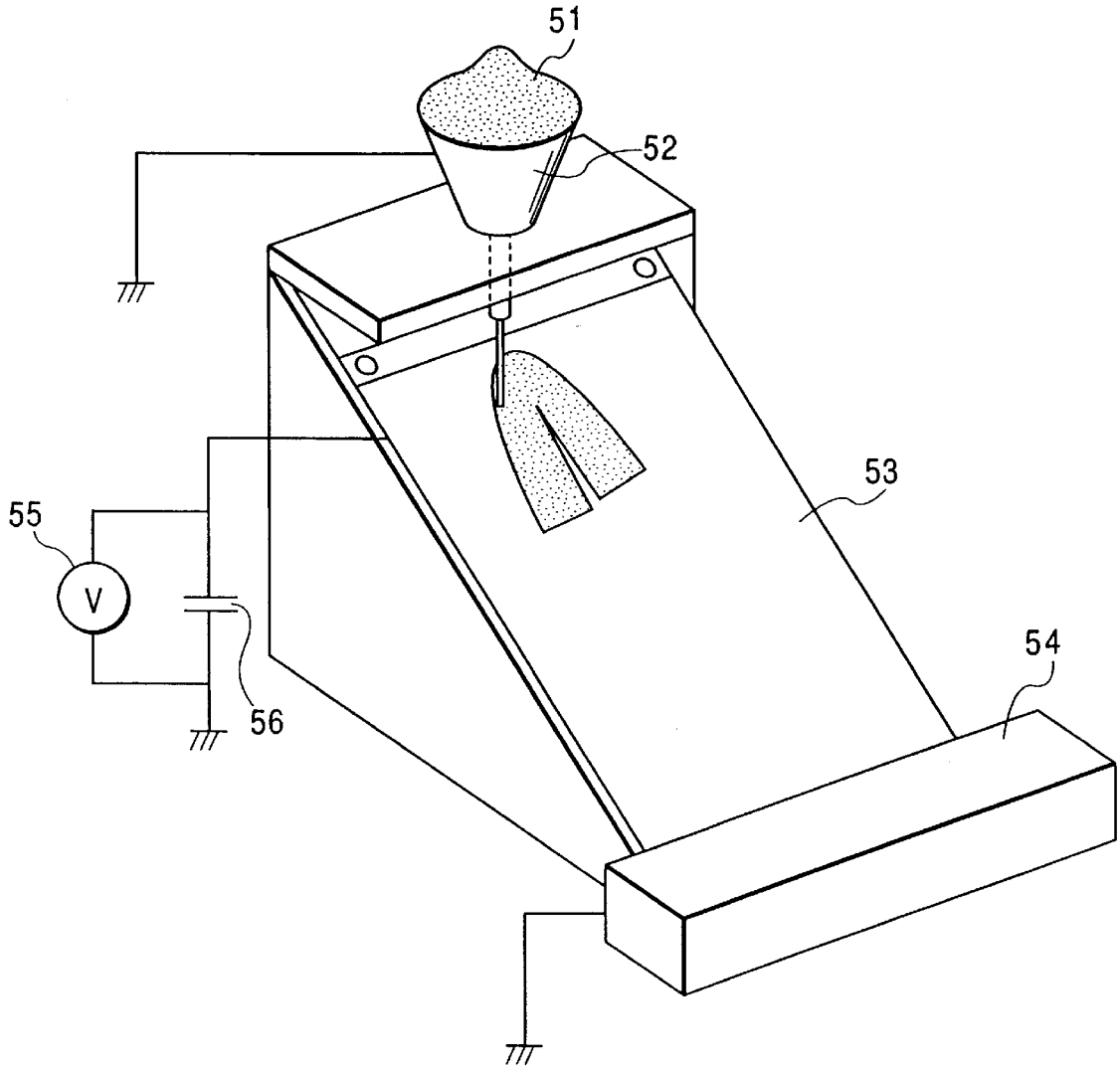
FIG. 62 illustrates a surface charge quantity measuring apparatus used to measure the charge polarity of resin coat layers.

The charge polarity is measured in an environment of 23° C. and 60% RH. First, the sample plate is set on a surface charge quantity measuring device TS-100AS (manufactured by Toshiba Chemical Co., Ltd.), which is as shown in FIG. 62, and a potentiometer 55 is grounded to make its value 0. The above positive toner model particles 51 are put in a dropping container 52. A START switch is pushed to drop the positive toner model particles 51 on the sample plate 53 for 20 seconds, and are received in a receiving container 54 grounded beforehand. The polarity indicated at this time by the potentiometer 55 is read. Reference numeral 56 denotes a capacitor.

(5) Measurement of Particle Size Distribution of Toner

The average particle diameter and particle size distribution of the toner particles may be measured with Coulter Counter TA-II or Coulter Multisizer II (manufactured by Coulter Electronics, Inc.). In the present invention, they are measured using Coulter Counter Multisizer II (manufactured by Coulter Electronics, Inc.). An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersing treatment for about 1 minute to about 3 minutes in an ultrasonic dispersion machine. The volume distribution and number distribution are calculated by measuring the volume and number of toner particles with particle diameters of 2 μm or larger by means of the above Coulter Multisizer, using an aperture of 100 μm as its aperture. Then the weight-based (the representative value of each channel is used as the representative value for each channel), weight average particle diameter (D4) according to the present invention, determined from the volume distribution, the percent by number of toner particles with diameters of 4.0 μm or smaller determined from the number distribution and the percent by volume of toner particles with diameters of 12.7 μm or larger determined from the volume distribution are determined.

As described above, according to the present invention, the resin composition containing at least the conductive material, the phenol resin, polyamide resin or urethane resin and the quaternary ammonium salt compound which is positively chargeable for itself to iron powder is used as a material for forming the resin coat layer provided on the periphery of the developer carrying member. Hence, when the phenol resin coat layer or urethane resin coat layer is formed by heating and hardening the resin composition or when the polyamide resin coat layer is formed by heating and drying the resin composition, the quaternary ammonium salt compound is not dispersed in the phenol resin, polyamide resin or urethane resin but incorporated into its structure. This is different from the instance where charge-providing particles are added as conventionally done. Thus, the coat layer can be dramatically improved in wear resistance, and can endure long-term running.

Moreover, according to the present invention, since the coat layer provided on the periphery of the developer carrying member is formed in the state the quaternary ammonium salt compound is incorporated into the structure of the phenol resin, polyamide resin or urethane resin, the phenol resin, polyamide resin or urethane resin itself is improved in its performance to impart positive triboelectric charges to the developer having a positively chargeable toner.

Accordingly, the use of the above resin composition as a binder resin material of the conductive coat layer formed on the surface of the developer carrying member making use of the developer having a positively chargeable toner makes stable the charge-providing properties to the developer, and also brings about an improvement in wear resistance of the coat layer. As the result, high-quality images free of any decrease in image density and any faulty images such as ghost, blotchy images and solid fog can be obtained over a long period of time in an environment of normal temperature and normal humidity as a matter of course and also in an environment of high temperature and high humidity and an environment of low humidity. Thus, stable and high-quality images can be provided.

Furthermore, since in the present invention the phenol resin, polyamide resin or urethane resin is used as the binder resin to form the coat layer on the periphery of the developer carrying member, its composition can be coated on the developer carrying member with greater ease than resins slightly soluble in various solvents, such as Teflon, having the performance to impart positive triboelectric charges to the developer having a positively chargeable toner.

EXAMPLES

The present invention will be described below in greater detail by giving Examples and Comparative Examples. Constitutions of developer carrying members (developing sleeves) obtained in Examples and Comparative Examples are summarized in Tables 1, 5 and 9.

Example 1

Materials shown below were mixed, and then dispersed for 3 hours by means of a sand mill, using zirconia particles of 2 mm diameter as a packing material. Thereafter, the zirconia particles were separated by sieving, followed by addition of IPA (isopropyl alcohol) to adjust the solid content to 30%, thus a resin composition comprising phenol resin to which the quaternary ammonium salt compound positively chargeable to iron powder has been added was obtained.

| | (by weight) |
|---|---|
| Carbon | 20 parts |
| Graphite | 80 parts |
| Phenol resin produced in the presence of ammonia as a catalyst (solid content: 50%) | 500 parts |
| Quaternary ammonium salt compound represented by formula (1) below | 50 parts |
| Methanol | 150 parts |

(1)

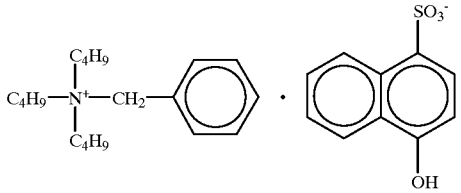

On the quaternary ammonium salt compound represented by the above formula (1), its polarity of triboelectricity to iron powder was measured by the blow-off process, using a commercially available triboelectric charge quantity measuring device (Model TB-200, manufactured by Toshiba Chemical Corporation) to find that it was positive polarity.

The resin composition thus obtained was in the form of a coating material, which was composed of C(carbon)/GF (graphite)/B(phenol resin)/P(quaternary ammonium salt compound)=0.2/0.8/2.5/0.5. Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 1 having a conductive resin coat layer on the surface was produced. To measure the volume resistivity of the coat layer of the resin composition used in the above, the coating material type resin composition was coated on an insulating sheet by means of a bar coater, followed by heating and hardening to form a coating film, which was then cut in a standard form, and its volume resistivity was measured with a low-resistivity meter Loresta (manufactured by Mitsubishi Yuka Co.). As a result, it was found to be 1.5×10 Ω·cm. Also, as to the developing sleeve resin coat layer from which carbon and graphite were removed, its polarity of triboelectricity to positive toner model particles was negative polarity.

The developing sleeve 1 thus obtained was set in a copying machine NP6035 (trade name), manufactured by CANON INC., and images were reproduced in three environments of normal temperature and normal humidity (N/N) of 24° C./65% RH, normal temperature and low humidity (N/L) of 24° C./10% RH and high temperature and high humidity (H/H) of 30° C./80% RH.

Here, as a developer used for the image reproduction, a positively chargeable one-component type magnetic developer was used which was obtained by melt-kneading the materials shown below, followed by pulverization and dispersion to form a positively chargeable toner having a weight-average particle diameter of 8.5 μm, having particles with diameters of 4.0 μm or smaller in a content of 10% by number and particles with diameters of 12.7 μm or larger in a content of 5.0% by volume, and to which 0.9% by weight of colloidal silica treated by coupling with trimethoxysilyl-γ-propylbenzylamine was added externally as a positively chargeable external additive.

| | (by weight) |
|---|---|
| Styrene-acrylic resin (Tg: 56° C.) | 100 parts |
| Magnetite | 80 parts |
| Positive charge control agent (Copy Blue PR) | 2 parts |
| Low-molecular weight polypropylene | 4 parts |

- Evaluation -

Occurrence of blotchy images (caused by an uneven coat of the toner coat layer on the developer carrying member), occurrence of ghost and changes in density of 5 mm diameter images, during the image reproduction running were evaluated in the three environments of normal temperature and normal humidity (N/N), normal temperature and low humidity (N/L) and high temperature and high humidity (H/H), in the manner and ranking as shown below. With regard to reversal fog, evaluation was made in the environment of normal temperature and low humidity (N/L) in the manner and ranking as shown below.

(1) Blotchy Images

Solid black and halftone images formed by the image reproduction test were observed visually, and images formed after image reproduction on 1 sheet, 1,000 sheets and 100,000 sheets were evaluated according to the following ranks. As the result, as shown in Table 2, good results were obtained.

A: Excellent
B: Good
C: Average
D: Poor (2) Ghost

Halftone images of a ghost chart, formed by the image reproduction test were observed visually, and occurrence of ghost on images formed after image reproduction on 1 sheet, 1,000 sheets and 100,000 sheets was evaluated according to the following ranks. As the result, as shown in Table 3, good results were obtained.

A: Excellent
B: Good
C: Average
D: Poor (3) 5 mm Diameter Image Density

Figure 7A:
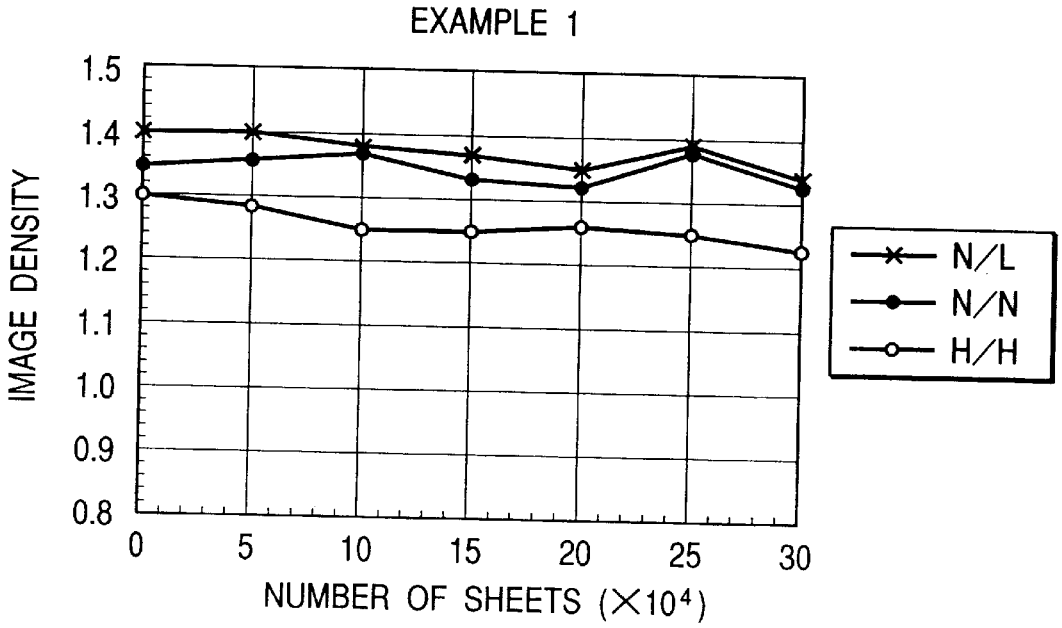
FIGS. 7A and 7B are graphs showing how image density and fog, respectively, undergo changes during running tests made in Example 1.

On 5 mm diameter images, image densities of solid black circles of 5 mm diameter formed after image reproduction on 1 sheet, 50,000 sheets, 100,000 sheets, 150,000 sheets, 200,000 sheets, 250,000 sheets and 300,000 sheets were measured with a reflection densitometer RD918 (manufactured by Macbeth Co.) to examine running performance from the viewpoint of image density. As the result, as shown in FIG. 7A, stable image density was attained also in long-term running.

(4) Reversal Fog

Figure 7B:
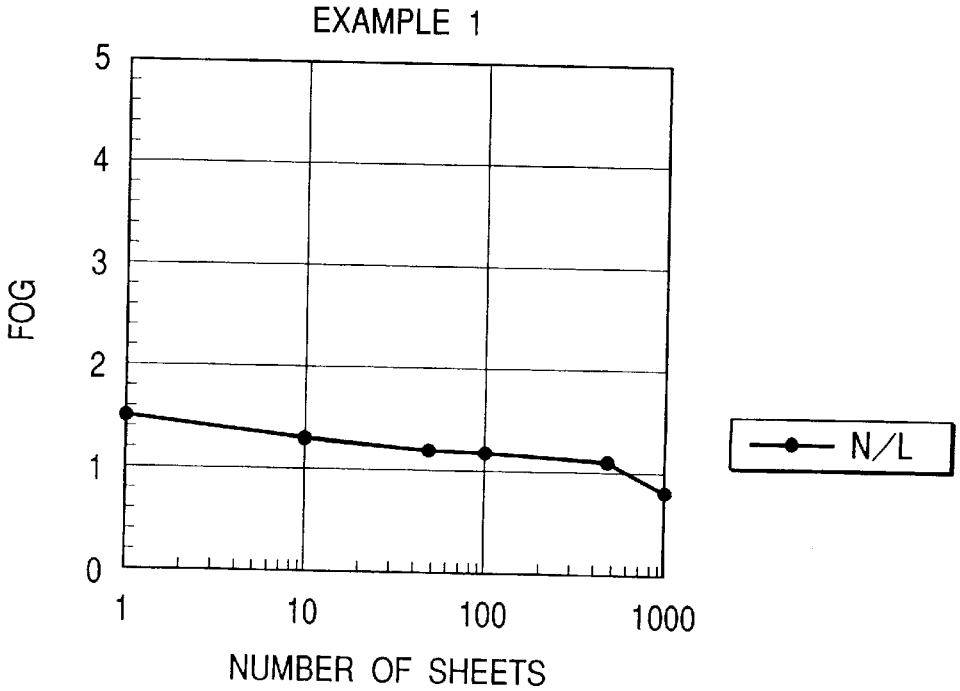

After image reproduction on 1 sheet, 10 sheets, 100 sheets and 1,000 sheets, reversal fog was examined. To examine the reversal fog, reflectance (D1) at solid white areas on a cardboard of 128 g/m$^2$ in basis weight on which images were formed by setting to the lowest density the density adjusting key on the main body of the copying machine was measured, and also reflectance (D2) on a virgin cardboard having the same cut size as the cardboard used in image formation. The value of D2−D1 was found at 5 points, and its average value was regarded as fog density. Here, the reflectance was measured with TC-6 DS (manufactured by Tokyo Denshoku Co.). As the result, as shown in FIG. 7B, good results were obtained.

(5) Triboelectricity

Measurement of the value of triboelectricity by suction on the developer carrying member was made in the following way: Using a measuring container having a cylindrical filter paper, to which a suction tubing made of a metal and having an opening curved after the shape of the developer carrying member surface was attached, its suction pressure was so adjusted as to be able to suck up the developer on the developer carrying member surface in proper quantities and uniformly, immediately (in 5 minutes) after image formation, thus the developer on the developer carrying member surface was sucked up. Quantity Q of electric charges of the developer sucked here was measured with a 616 digital electrometer (manufactured by Keithley Co.), and the mass M of this developer was also measured. The value of triboelectricity of the developer was calculated by Q/M (mC/kg). It was measured after image reproduction on 1,000 sheets. As the result, as shown in Table 1, good results were obtained.

(6) White Lines

Solid black and halftone images formed by the image reproduction test were observed visually, and images formed after image reproduction on 1 sheet, 1,000 sheets and 100,000 sheets were evaluated about white lines according to the following ranks. As the result, as shown in Table 4, good results were obtained.

A: Excellent
B: Good
C: Average
D: Poor

Example 2

A coating material type resin composition was obtained in the same formulation and procedure as in Example 1 except that the quaternary ammonium salt compound used therein, represented by the formula (1), was replaced with a quaternary ammonium salt compound represented by the following formula (2). On the quaternary ammonium salt compound represented by the above formula (2), its polarity of triboelectricity to iron powder was also measured by the blow-off process to find that it was positive polarity as in Example 1.

(2)

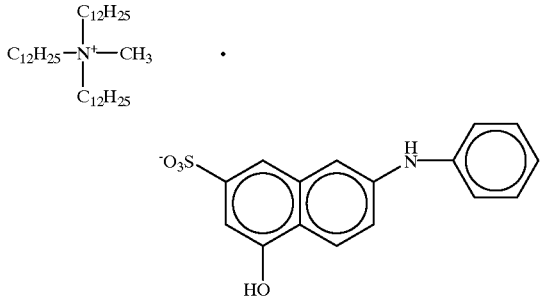

The resin composition thus obtained was composed of C/GF/B/P=0.2/0.8/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 1, followed by heating and hardening. Thus, developing sleeve 2 having a conductive resin coat layer on the surface was produced.

Figure 8A:
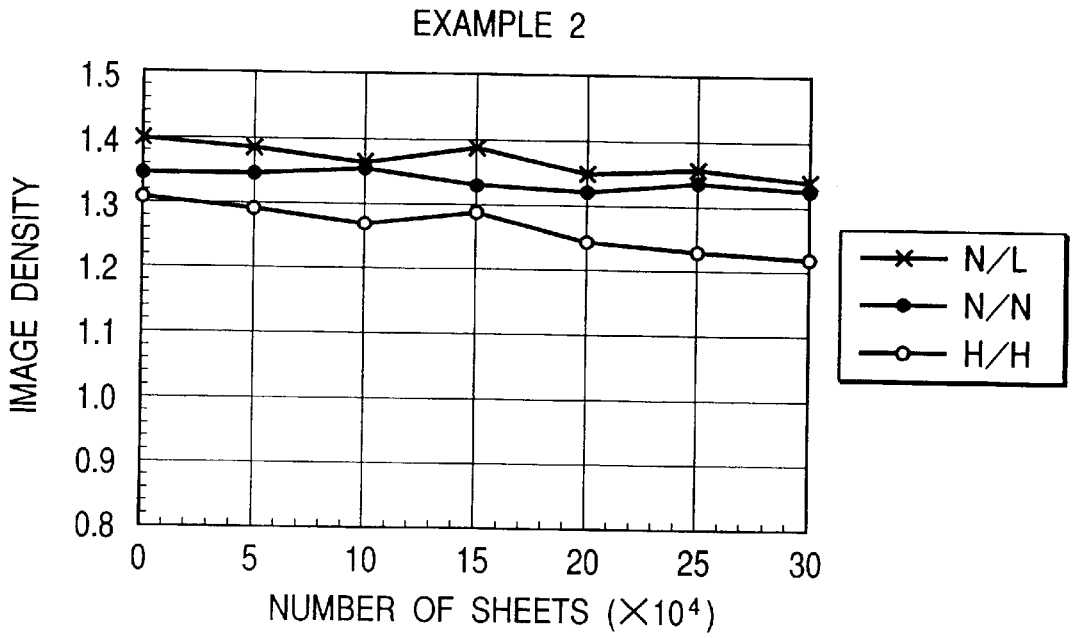
FIGS. 8A and 8B are graphs showing how image density and fog, respectively, undergo changes during running tests made in Example 2.
Figure 8B:
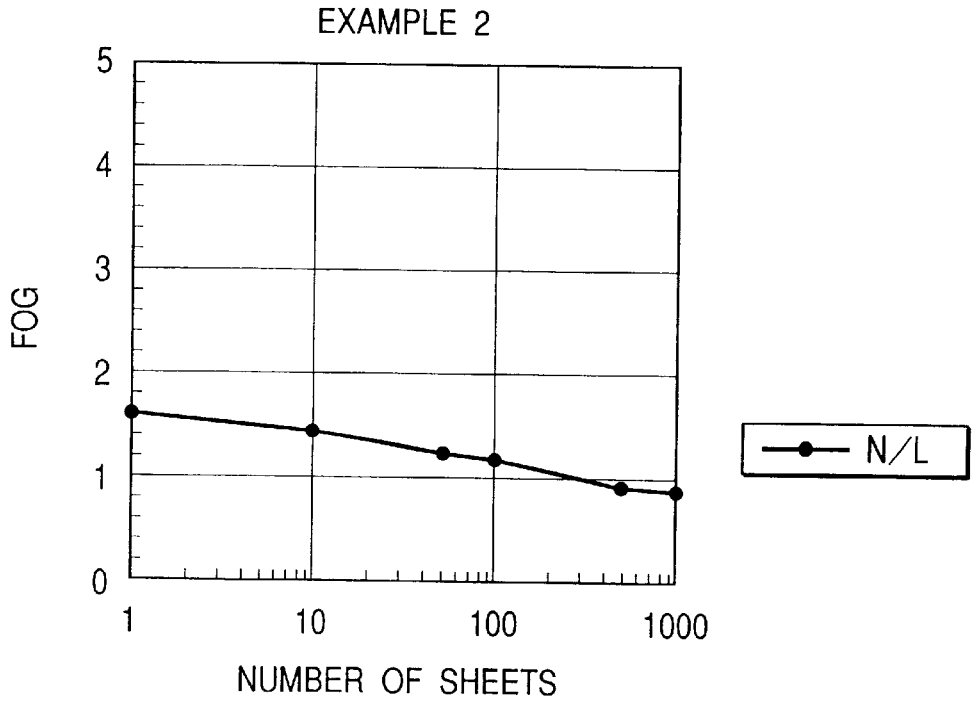

Then, using the developing sleeve 2 thus obtained, images were reproduced and evaluated in the same manner as in Example 1. As the result, as shown in Tables 2, 3 and 4 and FIGS. 8A and 8B, good results were obtained.

Example 3

A coating material type resin composition was obtained in the same formulation and procedure as in Example 1 except that the quaternary ammonium salt compound used therein, represented by the formula (1), was replaced with a quaternary ammonium salt compound represented by the following formula (3). On the quaternary ammonium salt compound represented by the above formula (3), its polarity of triboelectricity to iron powder was also measured by the blow-off process to find that it was positive polarity as in Example 1.

(3)

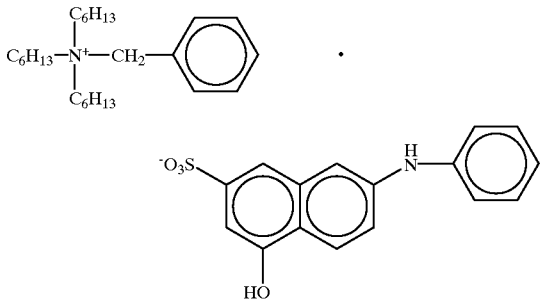

The resin composition thus obtained was composed of C/GF/B/P=0.2/0.8/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 1, followed by heating and hardening. Thus, developing sleeve 3 having a conductive resin coat layer on the surface was produced.

Figure 9A:
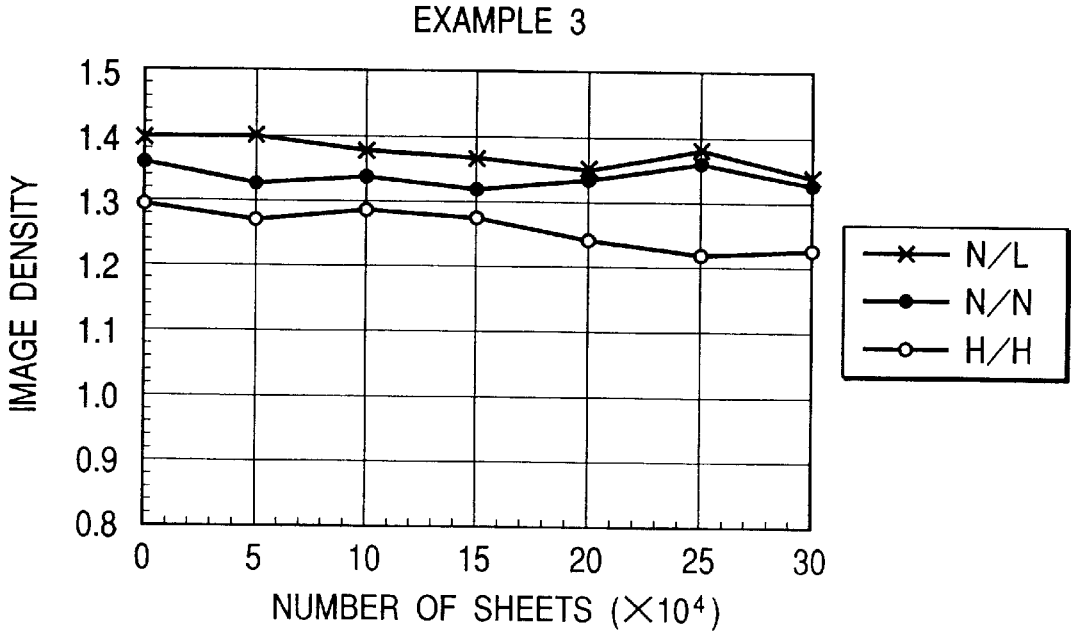
FIGS. 9A and 9B are graphs showing how image density and fog, respectively, undergo changes during running tests made in Example 3.
Figure 9B:
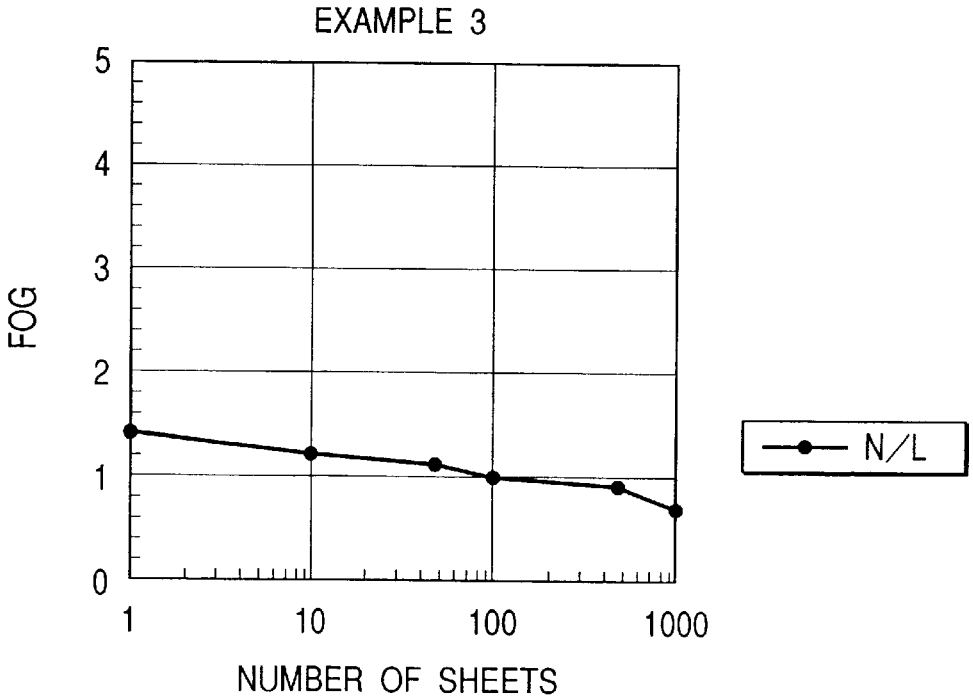

Then, using the developing sleeve 3 thus obtained, images were reproduced and evaluated in the same manner as in Example 1. As the result, as shown in Tables 2, 3 and 4 and FIGS. 9A and 9B, good results were obtained.

Example 4

A coating material type resin composition was obtained in the same formulation and procedure as in Example 1 except that the quaternary ammonium salt compound used therein, represented by the formula (1), was replaced with a quaternary ammonium salt compound represented by the following formula (4). On the quaternary ammonium salt compound represented by the above formula (4), its polarity of triboelectricity to iron powder was also measured by the blow-off process to find that it was positive polarity as in Example 1.

(4)

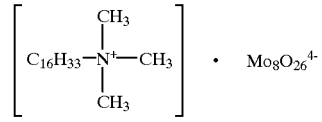

The resin composition thus obtained was composed of C/GF/B/P=0.2/0.8/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 1, followed by heating and hardening. Thus, developing sleeve 4 having a conductive resin coat layer on the surface was produced.

Figure 10A:
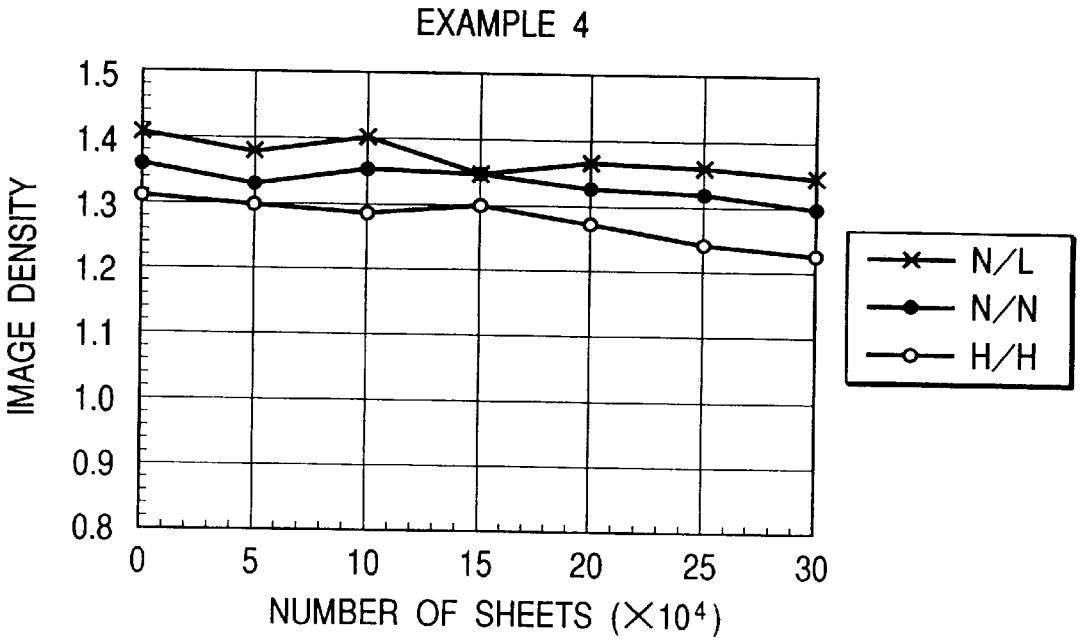
FIGS. 10A and 10B are graphs showing how image density and fog, respectively, undergo changes during running tests made in Example 4.
Figure 10B:
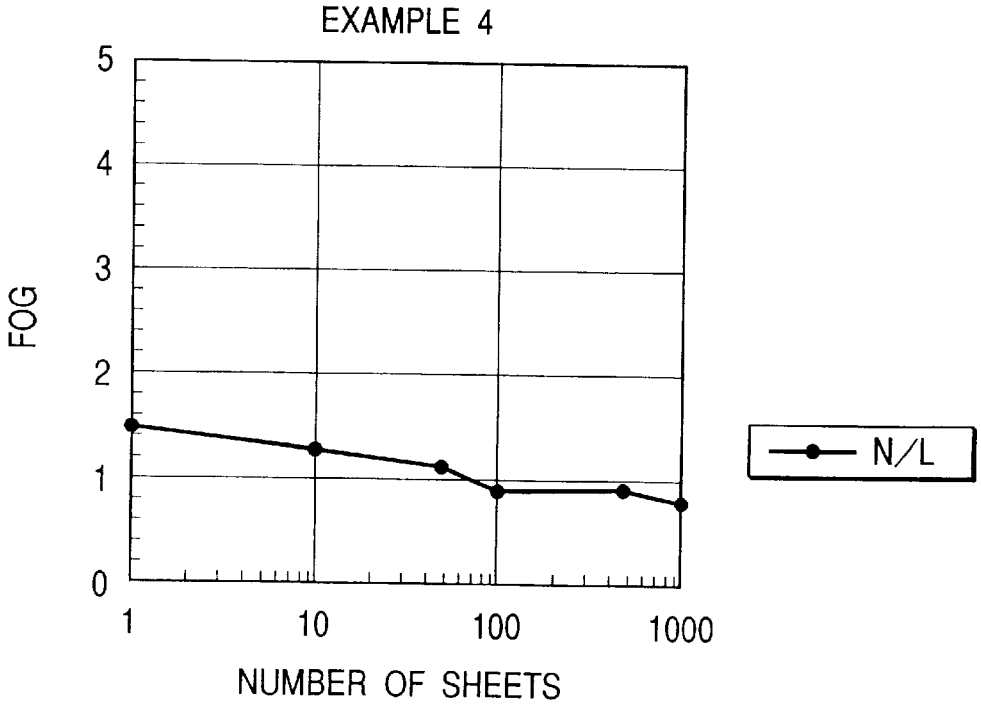

Then, using the developing sleeve 4 thus obtained, images were reproduced and evaluated in the same manner as in Example 1. As the result, as shown in Tables 2, 3 and 4 and FIGS. 10A and 10B, good results were obtained.

Example 5

Materials shown below were mixed, and then dispersed for 3 hours by means of a sand mill, using zirconia particles of 2 mm diameter as a packing material. Thereafter, the zirconia particles were separated by sieving, followed by addition of IPA to adjust the solid content to 30%, thus a resin composition comprising phenol resin to which the quaternary ammonium salt compound positively chargeable to iron powder has been added was obtained.

| | (by weight) |
|---|---|
| Carbon | 20 parts |
| Boron nitride | 160 parts |
| Phenol resin produced in the presence of hexamethylenetetramine as a catalyst (solid content: 50%) | 500 parts |
| Quaternary ammonium salt compound represented by the formula (1) | 50 parts |
| Methanol | 150 parts |

The resin composition thus obtained was in the form of a coating material, which was composed of C(carbon)/BN (boron nitride)/B(phenol resin)/P(quaternary ammonium salt compound)=0.2/1.6/2.5/0.5. On this coating material type resin composition used in the present Example, its coating film volume resistivity was also determined in the same manner as in Example 1 to find that its value was as shown in Table 1.

Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 5 having a conductive resin coat layer on the surface was produced.

Figure 11A:
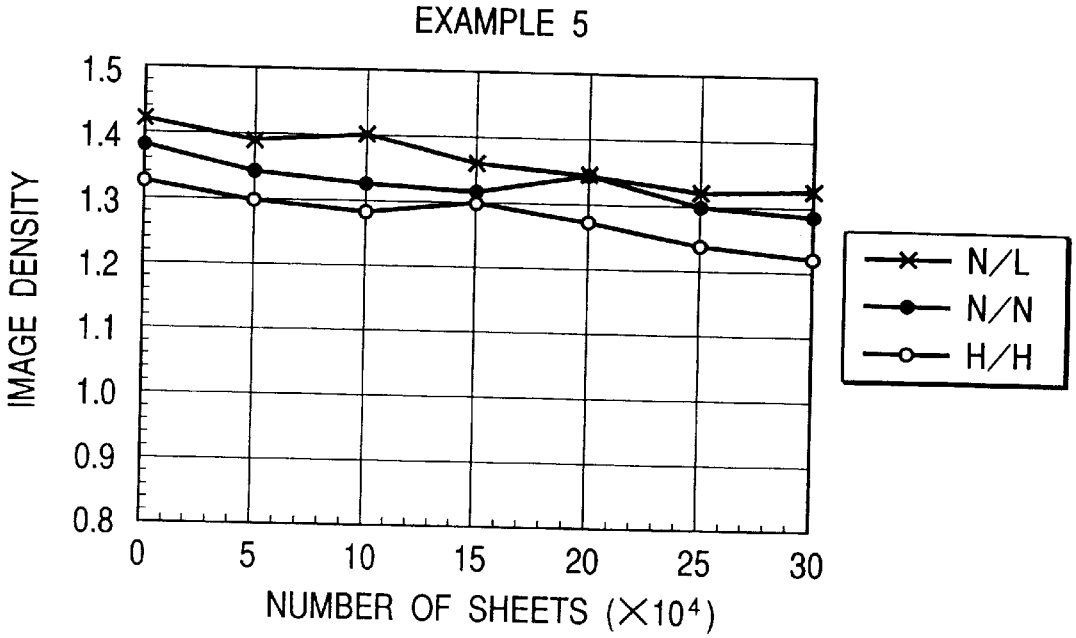
FIGS. 11A and 11B are graphs showing how image density and fog, respectively, undergo changes during running tests made in Example 5.
Figure 11B:
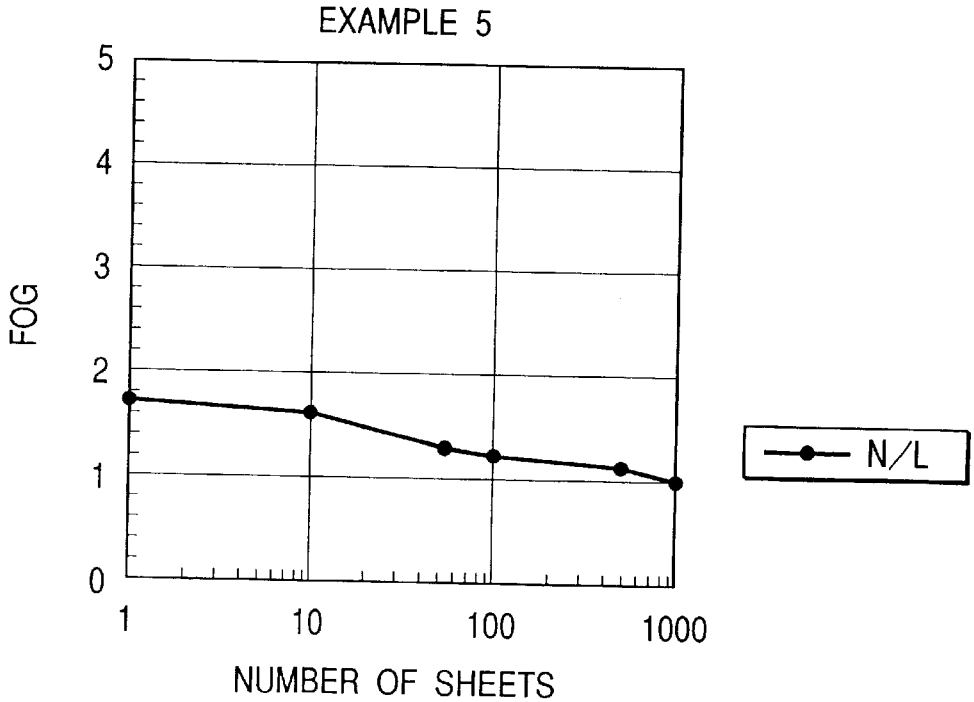

Then, using the developing sleeve 5 thus obtained, images were reproduced and evaluated in the same manner as in Example 1. As the result, as shown in Tables 2, 3 and 4 and FIGS. 11A and 11B, good results were obtained.

Example 6

A coating material type resin composition was obtained in the same formulation and procedure as in Example 5 except that the quaternary ammonium salt compound used therein, represented by the formula (1), was replaced with the quaternary ammonium salt compound positively chargeable to iron powder as used in Example 2, represented by the formula (2), and also the phenol resin produced in the presence of hexamethylenetetramine as a catalyst was replaced with a phenol resin produced in the presence of trimethylamine as a catalyst.

The resin composition thus obtained was composed of C/BN/B/P=0.2/1.6/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 5, followed by heating and hardening. Thus, developing sleeve 6 having a conductive resin coat layer on the surface was produced.

Figure 12A:
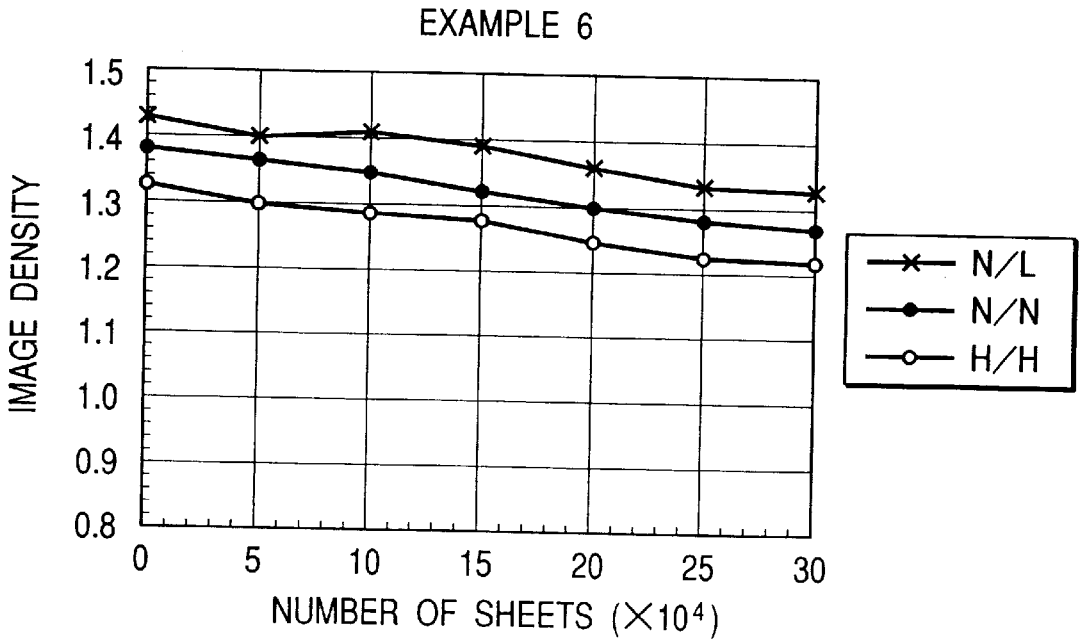
FIGS. 12A and 12B are graphs showing how image density and fog, respectively, undergo changes during running tests made in Example 6.
Figure 12B:
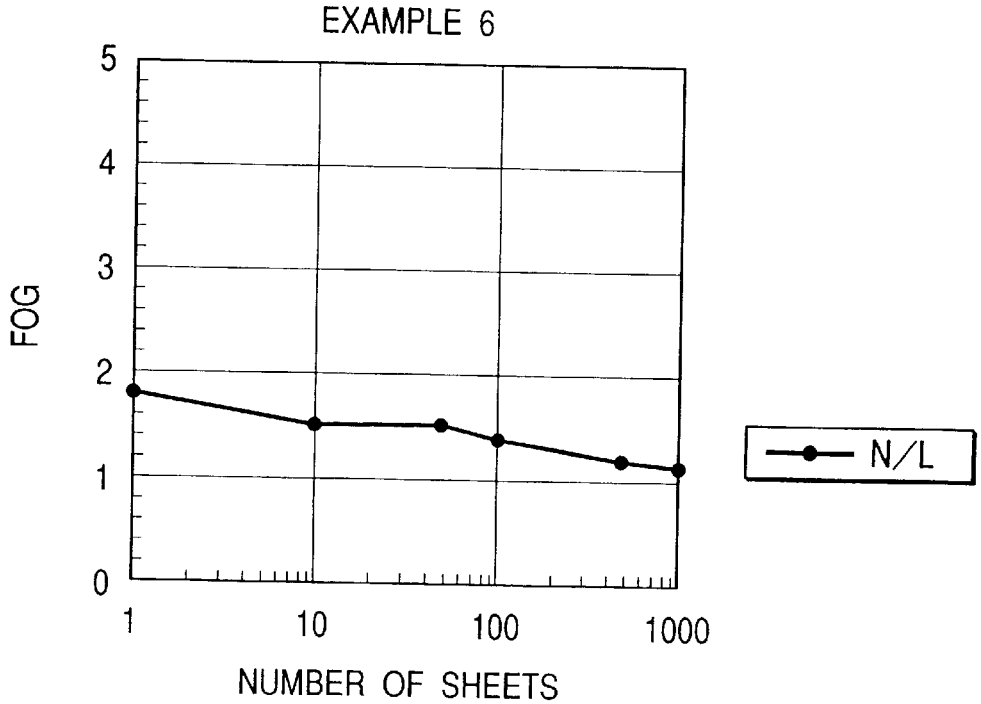

Then, using the developing sleeve 6 thus obtained, images were reproduced and evaluated in the same manner as in Example 1. As the result, as shown in Tables 2, 3 and 4 and FIGS. 12A and 12B, good results were obtained.

Example 7

A coating material type resin composition was obtained in the same formulation and procedure as in Example 5 except that the quaternary ammonium salt compound used therein, represented by the formula (1), was replaced with the quaternary ammonium salt compound used in Example 3, represented by the formula (3), and also the phenol resin produced in the presence of hexamethylenetetramine as a catalyst was replaced with a phenol resin produced in the presence of triethylamine as a catalyst.

The resin composition thus obtained was composed of C/BN/B/P=0.2/1.6/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 5, followed by heating and hardening. Thus, developing sleeve 7 having a conductive resin coat layer on the surface was produced.

Figure 13A:
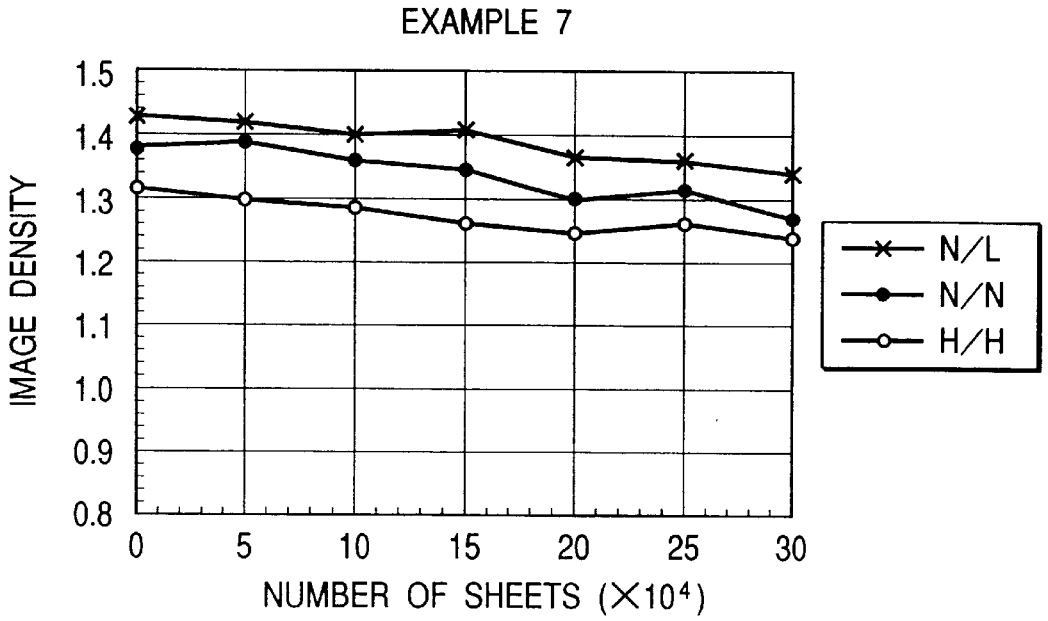
FIGS. 13A and 13B are graphs showing how image density and fog, respectively, undergo changes during running tests made in Example 7.
Figure 13B:
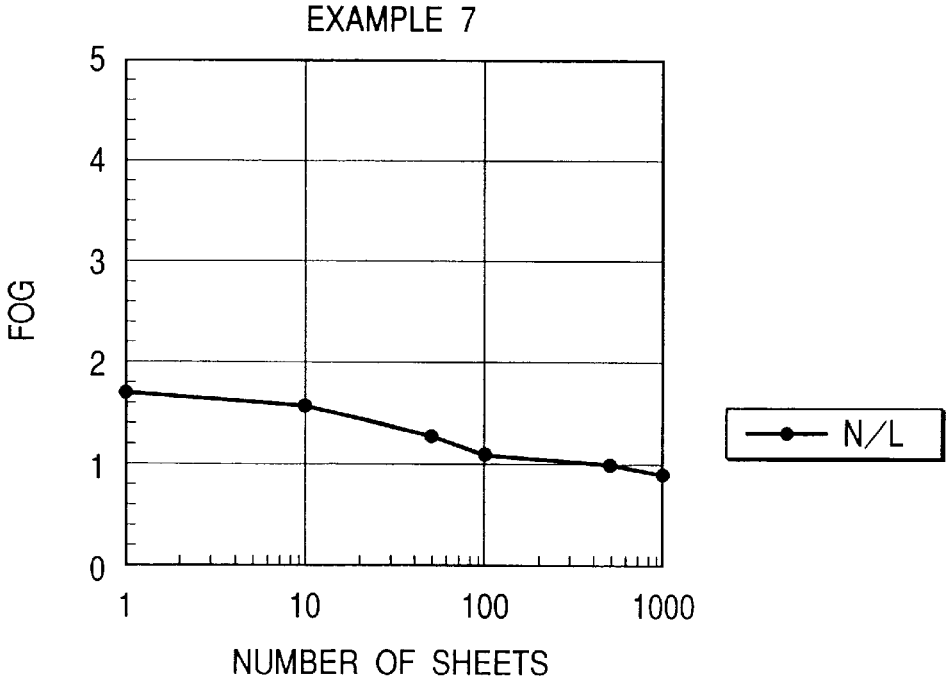

Then, using the developing sleeve 7 thus obtained, images were reproduced and evaluated in the same manner as in Example 1. As the result, as shown in Tables 2, 3 and 4 and FIGS. 13A and 13B, good results were obtained.

Example 8

A coating material type resin composition was obtained in the same formulation and procedure as in Example 5 except that the quaternary ammonium salt compound used therein, represented by the formula (1), was replaced with the quaternary ammonium salt compound used in Example 4, represented by the formula (4), and also the phenol resin produced in the presence of hexamethylenetetramine as a catalyst was replaced with a phenol resin produced in the presence of pyridine as a catalyst.

The resin composition thus obtained was composed of C/BN/B/P=0.2/1.6/2.5/0.5. On this coating material type resin composition used in the present Example, its coating film volume resistivity was also determined in the same manner as in Example 1 to find that its value was as shown in Table 1. This resin composition was coated on the same aluminum substrate as that used in Example 5, followed by heating and hardening. Thus, developing sleeve 8 having a conductive resin coat layer on the surface was produced.

Figure 14A:
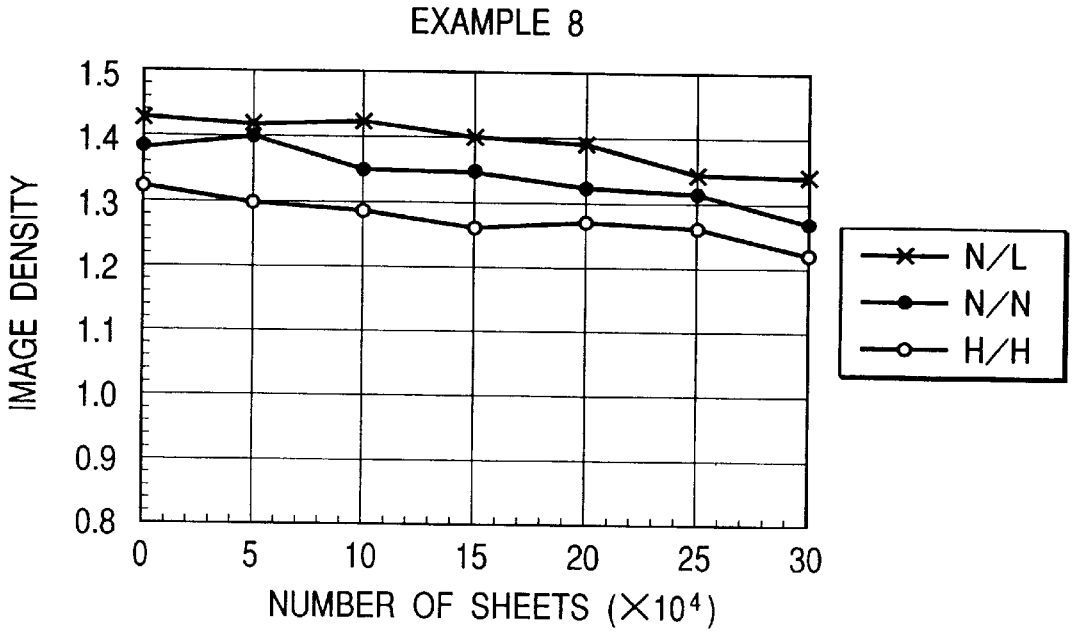
FIGS. 14A and 14B are graphs showing how image density and fog, respectively, undergo changes during running tests made in Example 8.
Figure 14B:
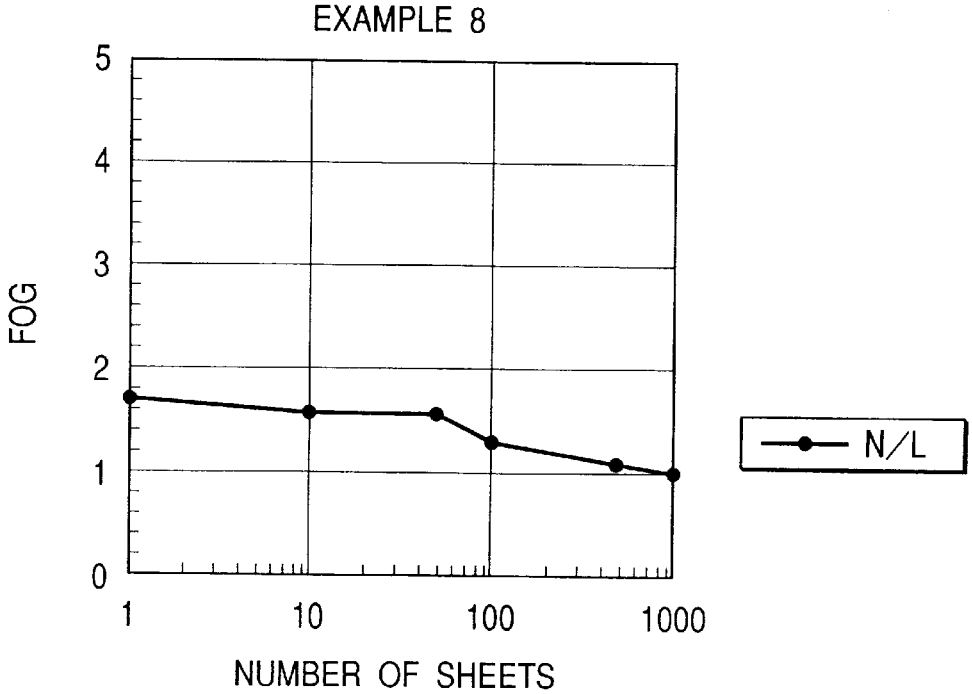

Then, using the developing sleeve 8 thus obtained, images were reproduced and evaluated in the same manner as in Example 1. As the result, as shown in Tables 2, 3 and 4 and FIGS. 14A and 14B, good results were obtained.

Example 9

Materials shown below were mixed, and then dispersed for 3 hours by means of a sand mill, using zirconia particles of 2 mm diameter as a packing material. Thereafter, the zirconia particles were separated by sieving, followed by addition of IPA to adjust the solid content to 35%, thus a resin composition having at least phenol resin and the quaternary ammonium salt compound positively chargeable to iron powder was obtained.

| | (by weight) |
|---|---|
| Carbon | 20 parts |
| Molybdenum disulfide | 160 parts |
| Phenol resin produced in the presence of hexamethylenetetramine as a catalyst (solid content: 50%) | 500 parts |
| Quaternary ammonium salt compound represented by the formula (1) | 50 parts |
| Methanol | 150 parts |

The resin composition thus obtained was in the form of a coating material, which was composed of C(carbon)/$MoS_2$ (molybdenum disulfide)/B(phenol resin)/P(quaternary ammonium salt compound)=0.2/1.6/2.5/0.5. On this coating material type resin composition used in the present Example, its coating film volume resistivity was also determined in the same manner as in Example 1 to find that its value was as shown in Table 1.

Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 9 having a conductive resin coat layer on the surface was produced.

Figure 15A:
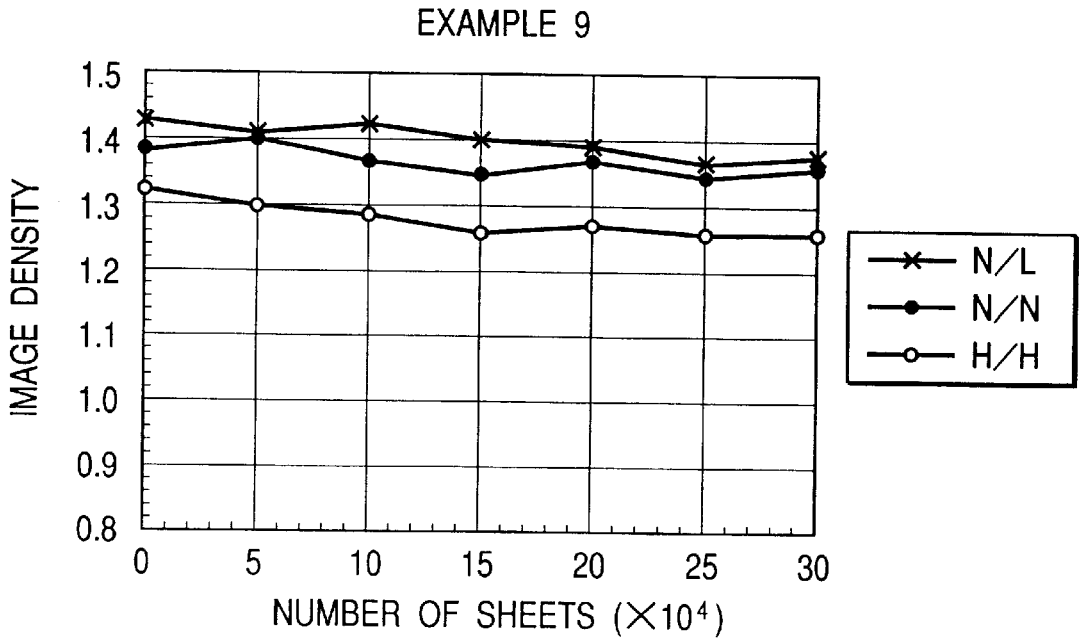
FIGS. 15A and 15B are graphs showing how image density and fog, respectively, undergo changes during running tests made in Example 9.
Figure 15B:
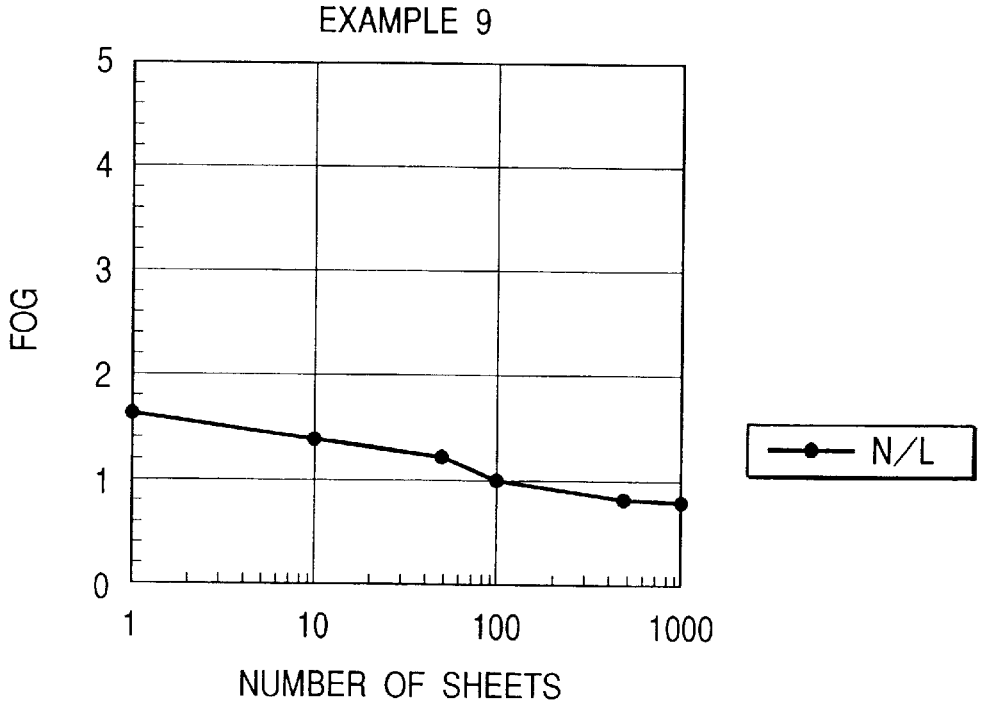

Then, using the developing sleeve 9 thus obtained, images were reproduced and evaluated in the same manner as in Example 1. As the result, as shown in Tables 2, 3 and 4 and FIGS. 15A and 15B, good results were obtained.

Example 10

A coating material type resin composition was obtained in the same formulation and procedure as in Example 9 except that the quaternary ammonium salt compound used therein, represented by the formula (1), was replaced with the quaternary ammonium salt compound positively chargeable to iron powder as used in Example 2, represented by the formula (2), and also the phenol resin produced in the presence of hexamethylenetetramine as a catalyst was replaced with a phenol resin produced in the presence of trimethylamine as a catalyst.

The resin composition thus obtained was composed of $C/MOS_2/B/P=0.2/1.6/2.5/0.5$. On this coating material type resin composition used in the present Example, its coating film volume resistivity was also determined in the same manner as in Example 1 to find that its value was as shown in Table 1. This resin composition was coated on the same aluminum substrate as that used in Example 9, followed by heating and hardening. Thus, developing sleeve 10 having a conductive resin coat layer on the surface was produced.

Figure 16A:
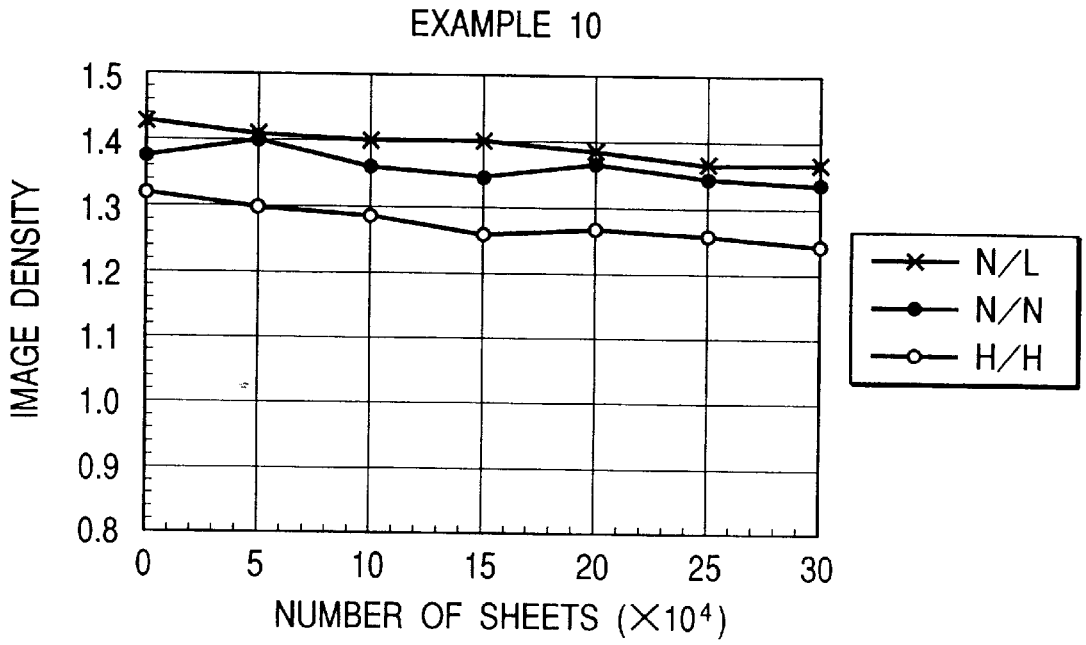
FIGS. 16A and 16B are graphs showing how image density and fog, respectively, undergo changes during running tests made in Example 10.
Figure 16B:
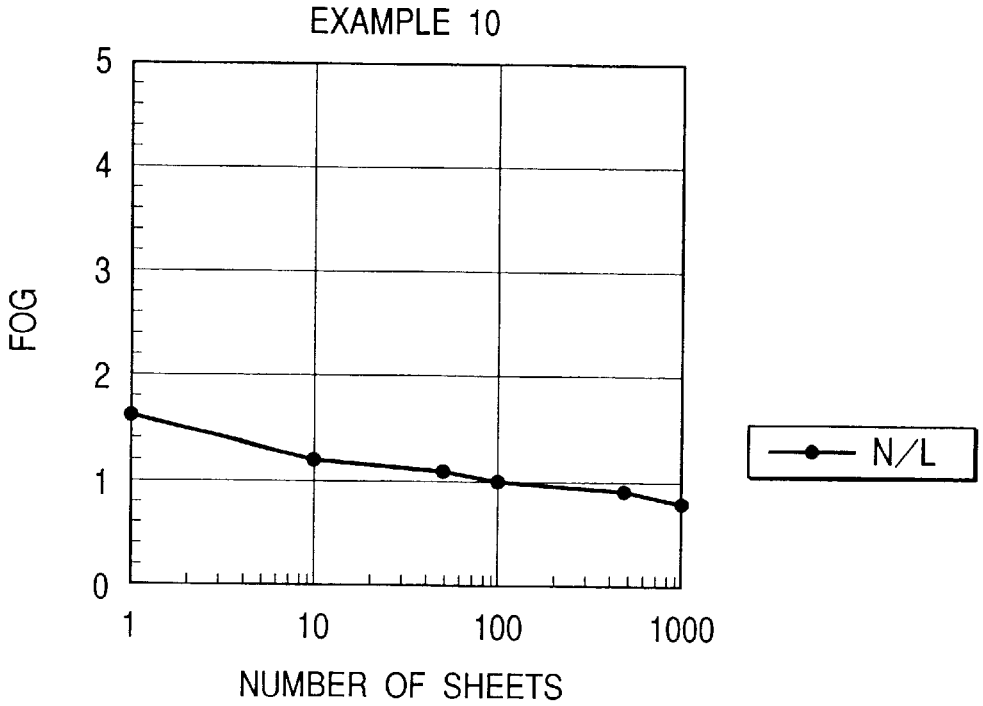

Then, using the developing sleeve 10 thus obtained, images were reproduced and evaluated in the same manner as in Example 1. As the result, as shown in Tables 2, 3 and 4 and FIGS. 16A and 16B, good results were obtained.

Example 11

A coating material type resin composition was obtained in the same formulation and procedure as in Example 9 except that the quaternary ammonium salt compound used therein, represented by the formula (1), was replaced with the quaternary ammonium salt compound positively chargeable to iron powder as used in Example 3, represented by the formula (3), and also the phenol resin produced in the presence of hexamethylenetetramine as a catalyst was replaced with a phenol resin produced in the presence of triethylamine as a catalyst.

The resin composition thus obtained was composed of $C/MOS_2/B/P=0.2/1.6/2.5/0.5$. On this coating material type resin composition used in the present Example, its coating film volume resistivity was also determined in the same manner as in Example 1 to find that its value was as shown in Table 1. This resin composition was coated on the same aluminum substrate as that used in Example 9, followed by heating and hardening. Thus, developing sleeve 11 having a conductive resin coat layer on the surface was produced.

Figure 17A:
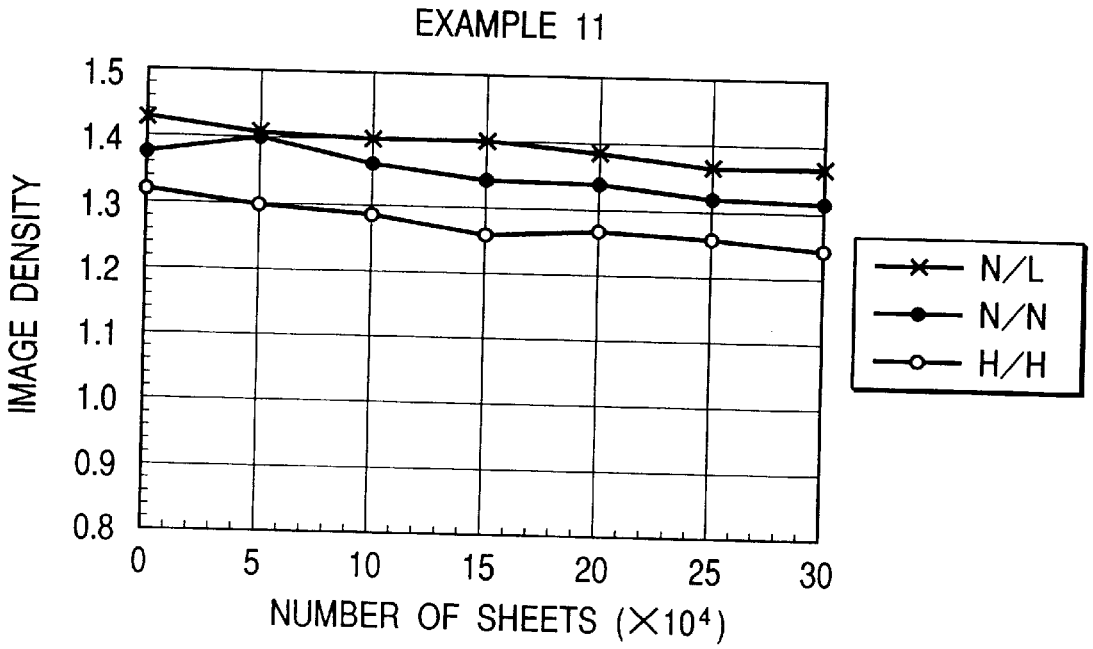
FIGS. 17A and 17B are graphs showing how image density and fog, respectively, undergo changes during running tests made in Example 11.
Figure 17B:
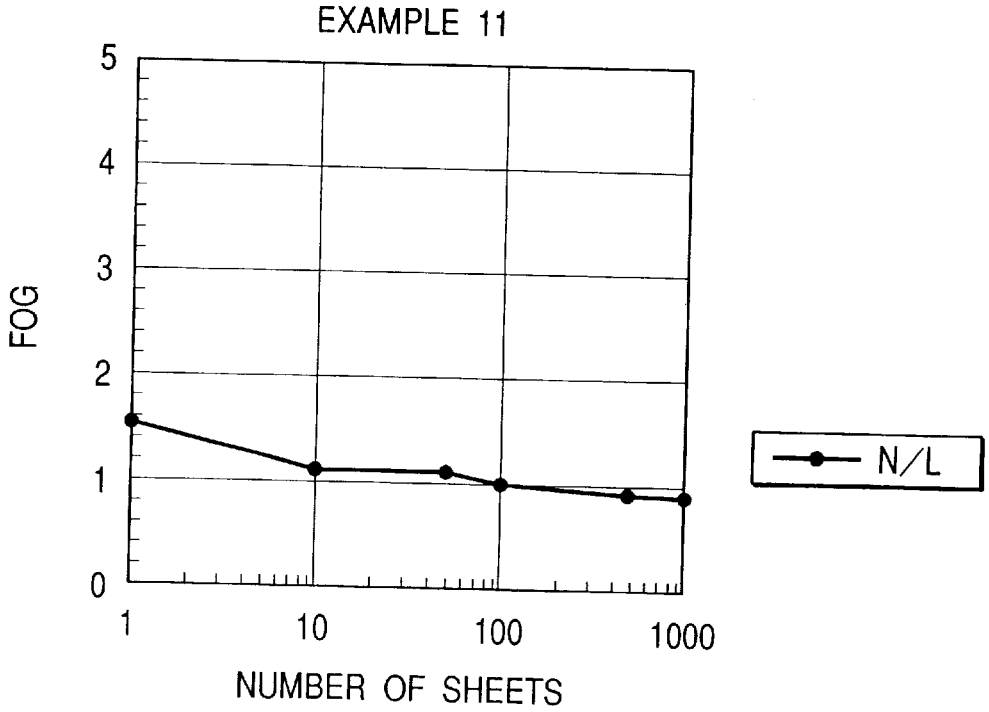

Then, using the developing sleeve 11 thus obtained, images were reproduced and evaluated in the same manner as in Example 1. As the result, as shown in Tables 2, 3 and 4 and FIGS. 17A and 17B, good results were obtained.

Example 12

A coating material type resin composition was obtained in the same formulation and procedure as in Example 9 except that the quaternary ammonium salt compound used therein, represented by the formula (1), was replaced with the quaternary ammonium salt compound positively chargeable to iron powder as used in Example 4, represented by the formula (4), and also the phenol resin produced in the presence of hexamethylenetetramine as a catalyst was replaced with a phenol resin produced in the presence of pyridine as a catalyst.

The resin composition thus obtained was composed of $C/MOS_2/B/P=0.2/1.6/2.5/0.5$. On this coating material type resin composition used in the present Example, its coating film volume resistivity was also determined in the same manner as in Example 1 to find that its value was as shown in Table 1. This resin composition was coated on the same aluminum substrate as that used in Example 9, followed by heating and hardening. Thus, developing sleeve 12 having a conductive resin coat layer on the surface was produced.

Figure 18A:
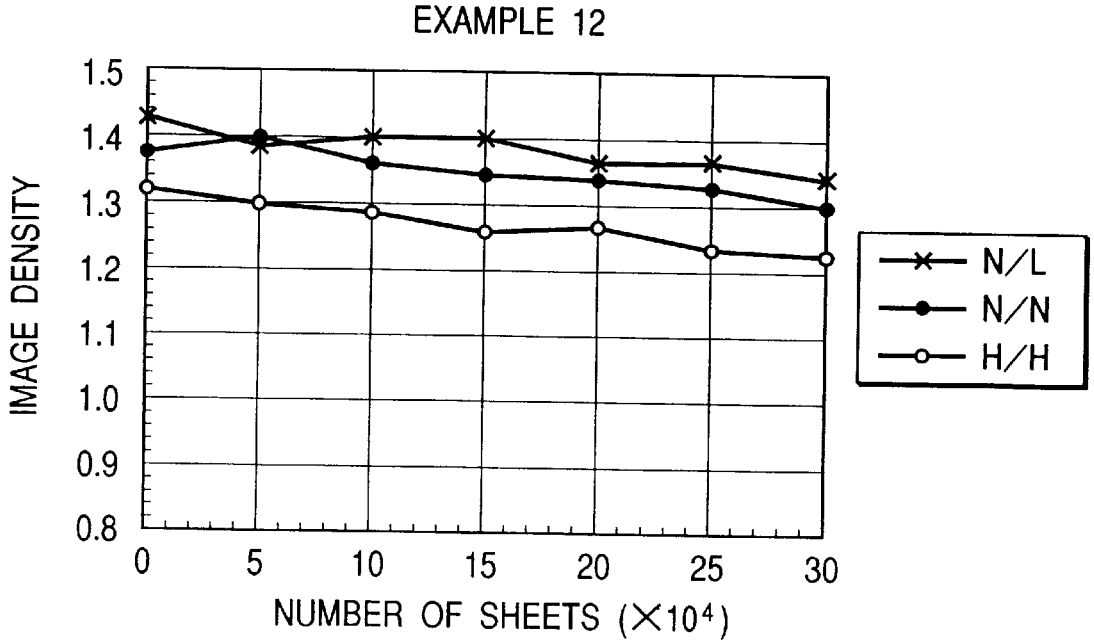
FIGS. 18A and 18B are graphs showing how image density and fog, respectively, undergo changes during running tests made in Example 12.
Figure 18B:
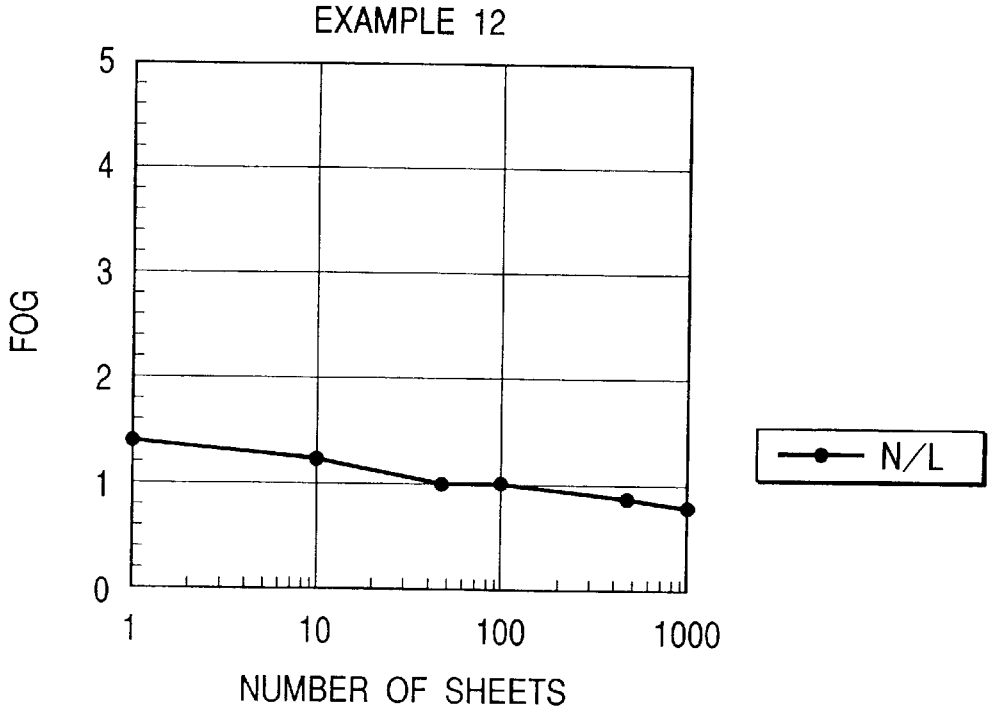

Then, using the developing sleeve 12 thus obtained, images were reproduced and evaluated in the same manner as in Example 1. As the result, as shown in Tables 2, 3 and 4 and FIGS. 18A and 18B, good results were obtained.

Comparative Example 1

The surface of the same cylindrical member of 20 mm diameter made of aluminum as that used in Examples was only treated by sand blasting with FGB#300. This was used as a developing sleeve 13 of Comparative Example 1.

Using this developing sleeve, images were reproduced and evaluated in the same manner as in Example 1. As the result, as shown in Tables 2 and 3, blotchy images occurred, and it was impossible to make image evaluation on the items other than this.

Comparative Example 2

A resin composition was obtained in the same manner as in Example 1 except that it was prepared in the following formulation. The resin composition thus obtained was in the form of a coating material, which was composed of $C/GF/B/P=0.2/0.8/2.5/0$

| | (by weight) |
|---|---|
| Carbon | 20 parts |
| Graphite | 80 parts |
| Phenol resin produced in the presence of ammonia as a catalyst (solid content: 50%) | 500 parts |
| IPA | 100 parts |

Figure 19A:
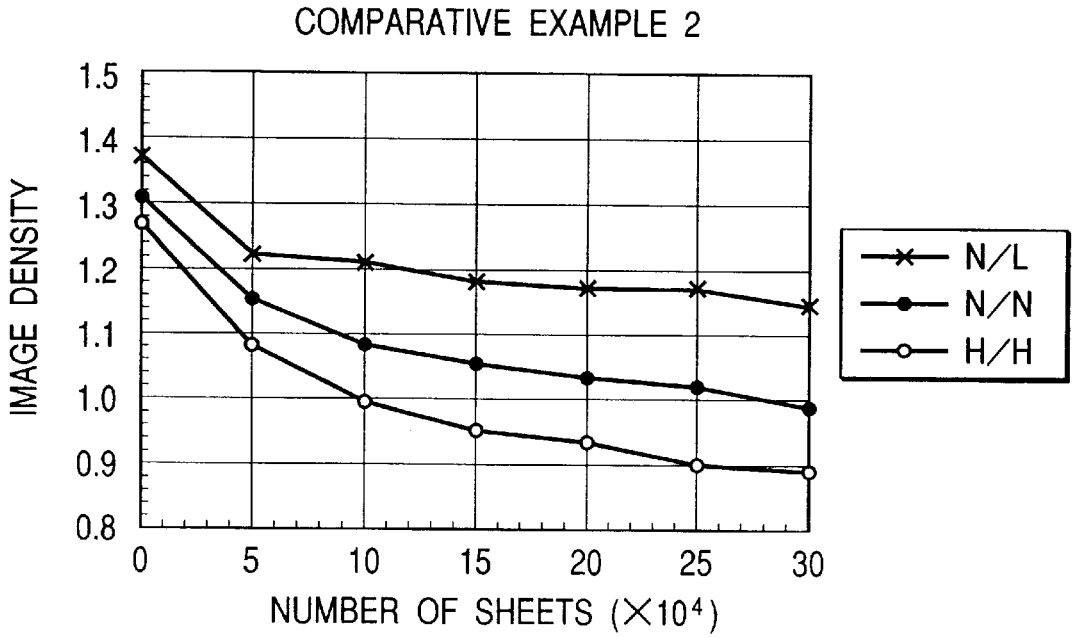
FIGS. 19A and 19B are graphs showing how image density and fog, respectively, undergo changes during running tests made in Comparative Example 2.
Figure 19B:
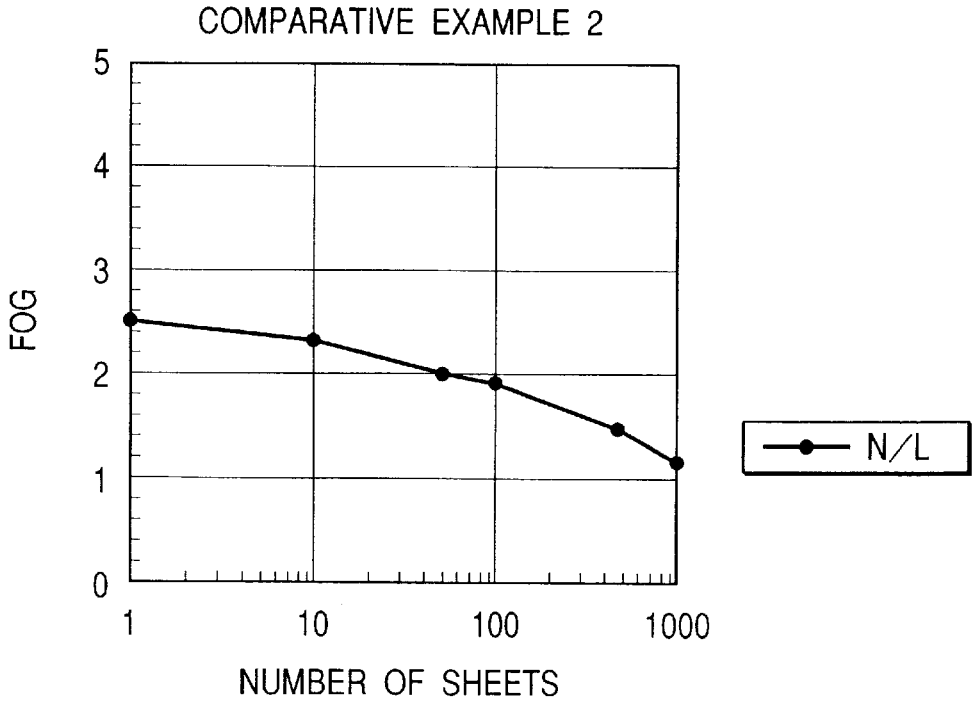

This resin composition was coated on the same aluminum substrate as that used in Example 1, followed by heating and hardening. Thus, developing sleeve 14 having a conductive resin coat layer on the surface was produced. Using the developing sleeve 14 thus obtained, images were reproduced and evaluated in the same manner as in Example 1. As the result, as shown in Tables 2, 3 and 4 and FIGS. 19A and 19B, the result on fog was only a little poor at the initial stage only, but a decrease in image density was seen during running.

On the coating material type resin composition used in the present Example, its coating film volume resistivity was also determined in the same manner as in Example 1 to find that its value was as shown in Table 1.

Comparative Example 3

A coating material resin composition was prepared in the same formulation and procedure as in Example 1 except that the quaternary ammonium salt compound used therein, represented by the formula (1), was replaced with a chromium complex (S) of azonaphthol containing chlorophenol. The resin composition thus obtained was composed of $C/GF/B/S=0.2/0.8/2.5/0.5$. Here, on this chromium complex (S) of azonaphthol containing chlorophenol, its polarity of triboelectricity to iron powder was measured by the blow-off process in the same manner as in Example 1 to find that it was negative polarity.

On the coating material type resin composition used in the present Comparative Example, its coating film volume resistivity was also determined in the same manner as in Example 1 to find that its value was as shown in Table 1.

This resin composition was coated on the same aluminum substrate as that used in Example 1, followed by heating and hardening. Thus, developing sleeve 15 having a conductive resin coat layer on the surface was produced.

Figure 20A:
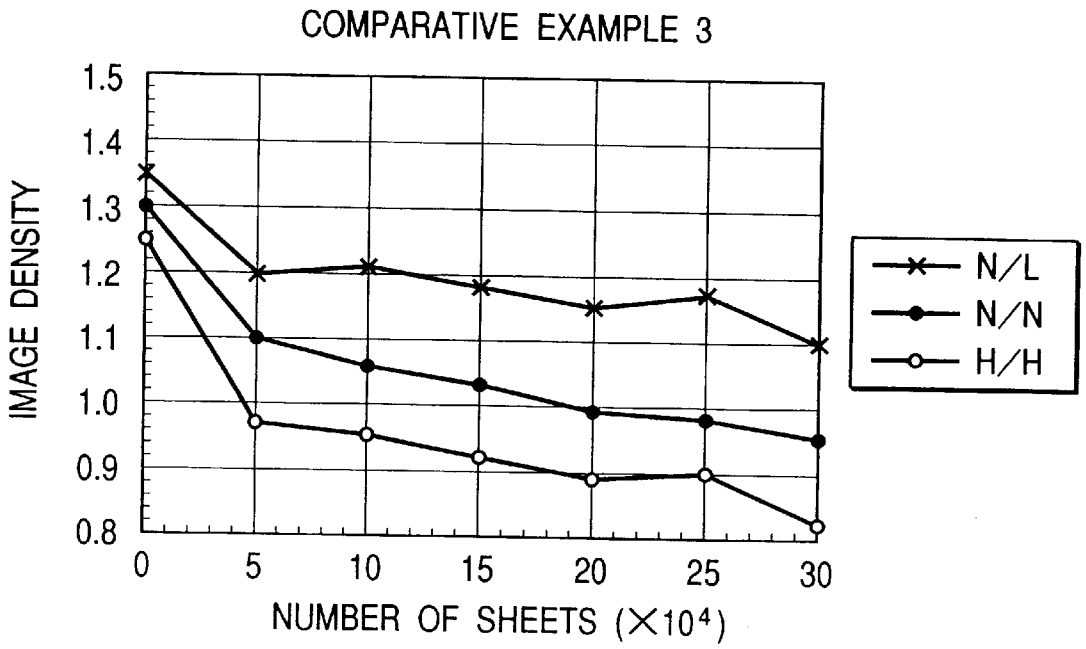
FIGS. 20A and 20B are graphs showing how image density and fog, respectively, undergo changes during running tests made in Comparative Example 3.
Figure 20B:
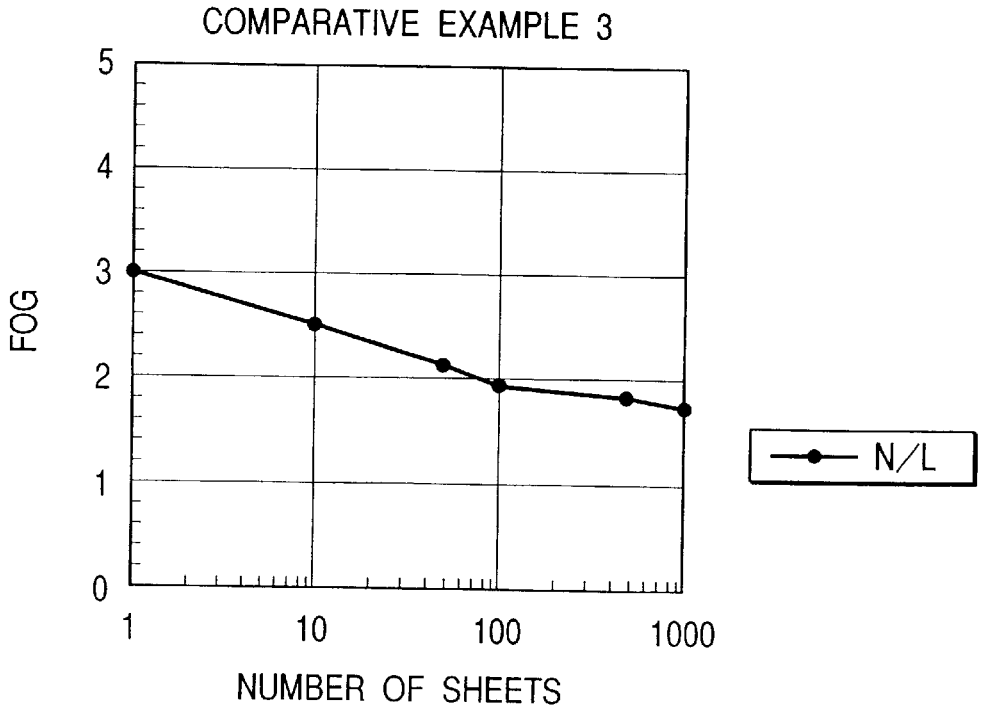

Then, using the developing sleeve 15 thus obtained, images were reproduced and evaluated in the same manner as in Example 1. As the result, as shown in Tables 2, 3 and 4 and FIGS. 20A and 20B, the result on fog was poor until image reproduction on about 50 sheets, and also a decrease in image density was seen during running.

Comparative Example 4

A coating material resin composition was prepared in the same formulation and procedure as in Example 1 except that the quaternary ammonium salt compound used therein, represented by the formula (1), was replaced with Nigrosine (N). The resin composition thus obtained was composed of C/GF/B/N=0.2/0.8/2.5/0.5. Here, on this Nigrosine, its polarity of triboelectricity to iron powder was measured by the blow-off process in the same manner as in Example 1 to find that it was positive polarity.

On the coating material type resin composition used in the present Comparative Example, its coating film volume resistivity was also determined in the same manner as in Example 1 to find that its value was as shown in Table 1.

This resin composition was coated on the same aluminum substrate as that used in Example 1, followed by heating and hardening. Thus, developing sleeve 16 having a conductive resin coat layer on the surface was produced.

Figure 21A:
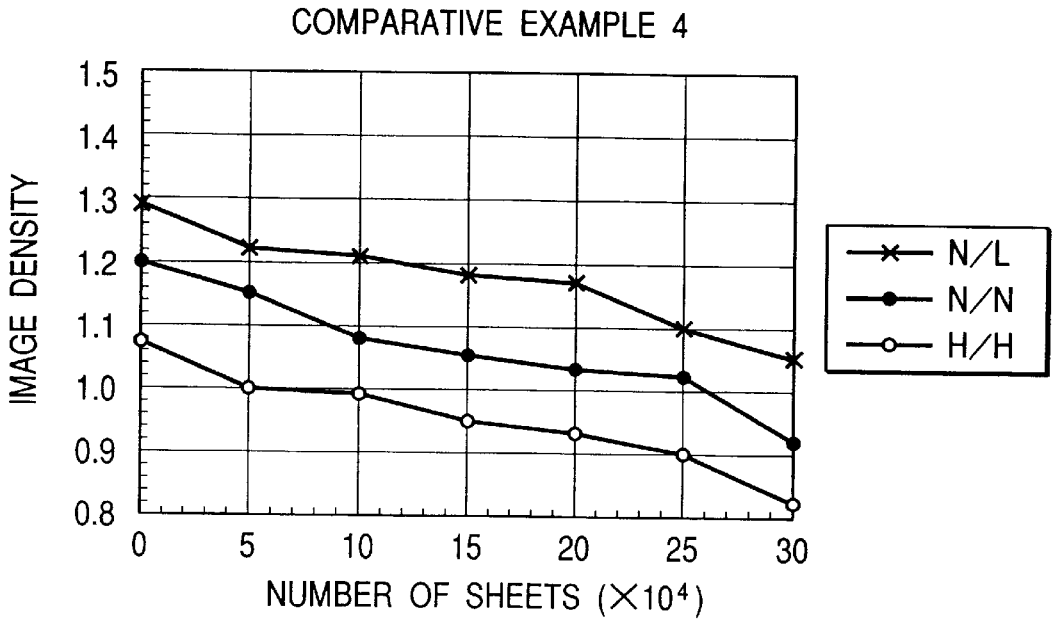
FIGS. 21A and 21B are graphs showing how image density and fog, respectively, undergo changes during running tests made in Comparative Example 4.
Figure 21B:
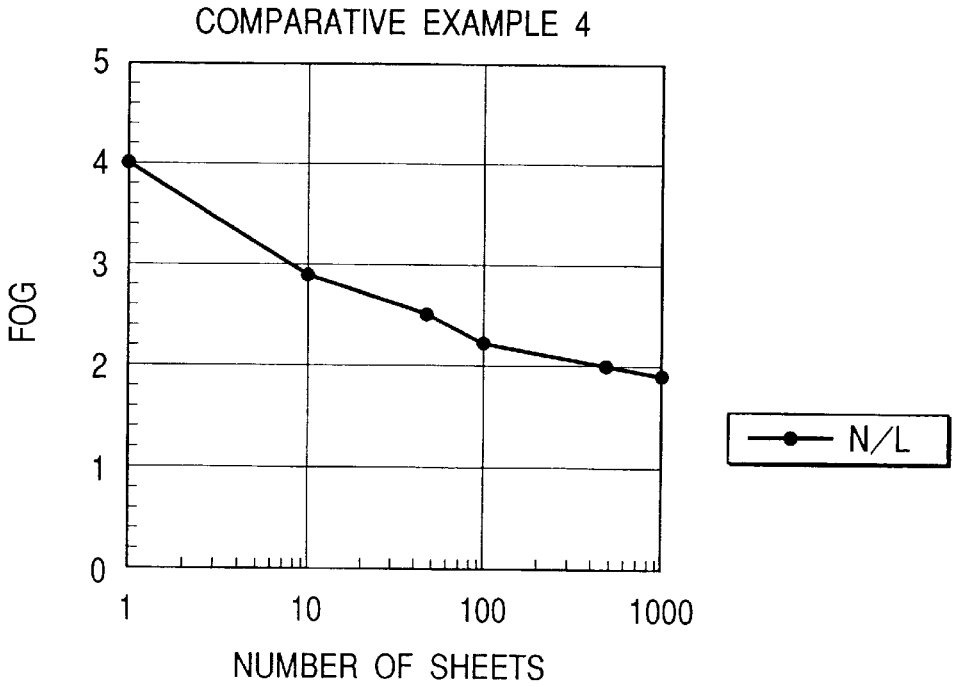

Then, using the developing sleeve 16 thus obtained, images were reproduced and evaluated in the same manner as in Example 1. As the result, as shown in Tables 2, 3 and 4 and FIGS. 21A and 21B, the result on fog was poor until image reproduction on about 1,000 sheets, and also a decrease in image density was seen at an early stage during running.

Comparative Example 5

A coating material resin composition was prepared in the same formulation and procedure as in Example 1 except that the quaternary ammonium salt compound used therein, represented by the formula (1), was replaced with a quaternary ammonium salt compound represented by the following formula (9). The resin composition thus obtained was composed of C/GF/B/P=0.2/0.8/2.5/0.5. Here, on this quaternary ammonium salt compound represented by the following formula (9), its polarity of triboelectricity to iron powder was also measured by the blow-off process in the same manner as in Example 1 to find that it was negative polarity, different from Example 1.

(9)

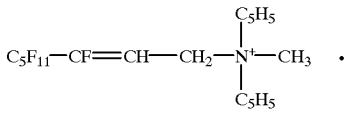

-continued

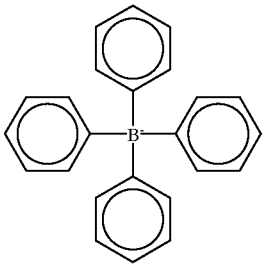

On the coating material type resin composition used in the present Comparative Example, its coating film volume resistivity was also determined in the same manner as in Example 1 to find that its value was as shown in Table 1.

This resin composition was coated on the same aluminum substrate as that used in Example 1, followed by heating and hardening. Thus, developing sleeve 17 having a conductive resin coat layer on the surface was produced.

Figure 22A:
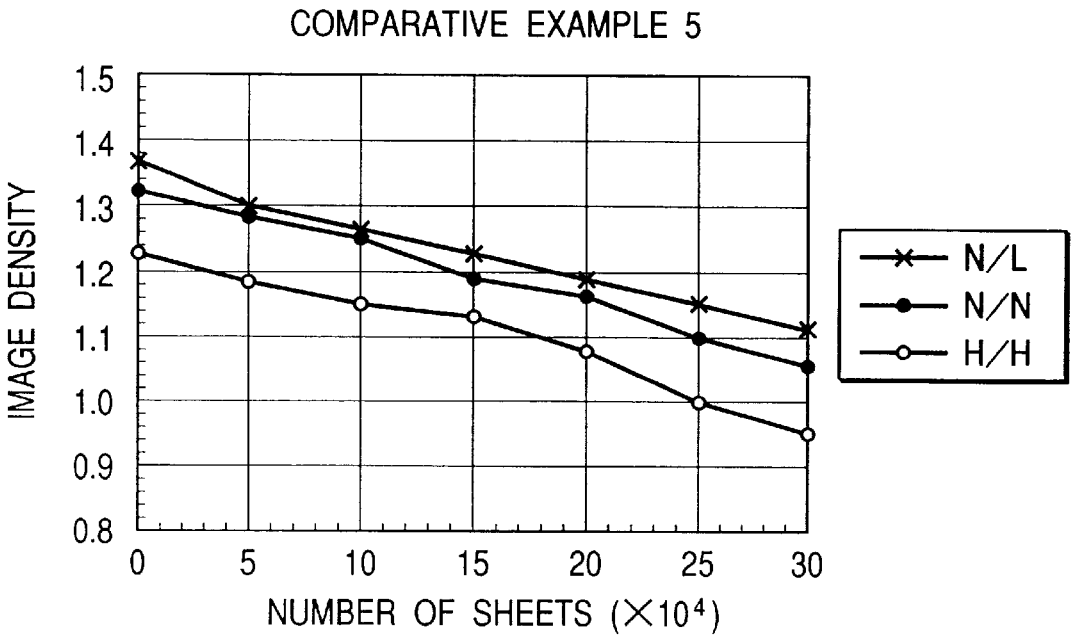
FIGS. 22A and 22B are graphs showing how image density and fog, respectively, undergo changes during running tests made in Comparative Example 5.
Figure 22B:
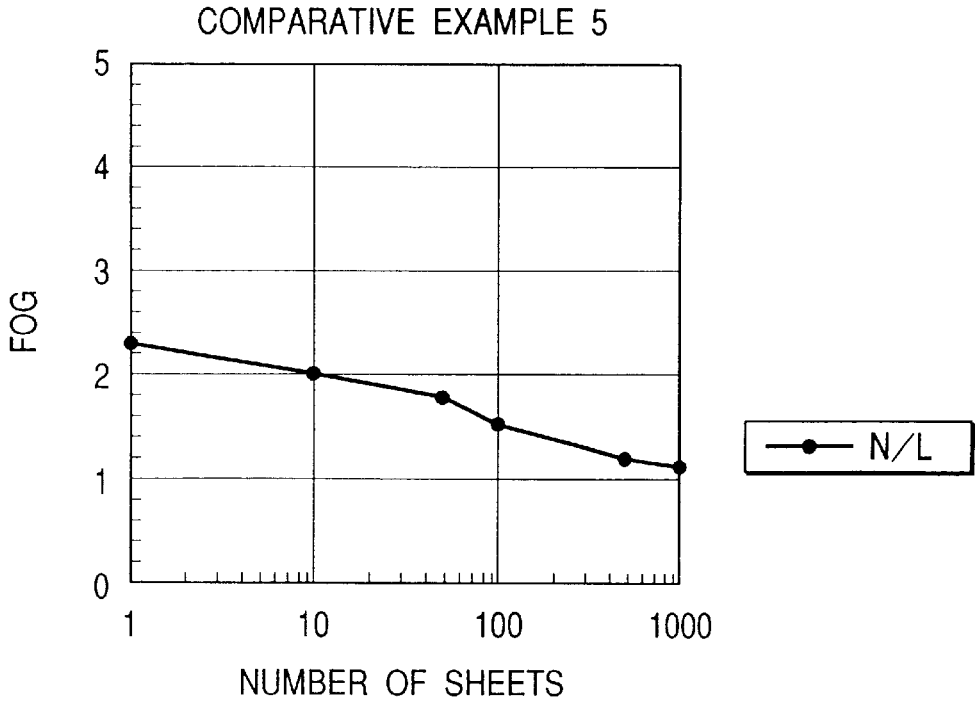

Then, using the developing sleeve 17 thus obtained, images were reproduced and evaluated in the same manner as in Example 1. As the result, as shown in Tables 2, 3 and 4 and FIGS. 22A and 22B, the result on fog was good after image reproduction on 10 sheets, but a decrease in image density was seen.

Comparative Example 6

A coating material resin composition was prepared in the same formulation and procedure as in Example 1 except that the phenol resin produced in the presence of ammonia as a catalyst was replaced with PMMA (polymethyl methacrylate) resin. The resin composition thus obtained was composed of C/GF/B/P=0.2/0.8/2.5/0.5.

On the coating material type resin composition used in the present Comparative Example, its coating film volume resistivity was also determined in the same manner as in Example 1 to find that its value was as shown in Table 1.

This resin composition was coated on the same aluminum substrate as that used in Example 1, followed by heating and hardening. Thus, developing sleeve 18 having a conductive resin coat layer on the surface was produced.

Figure 23A:
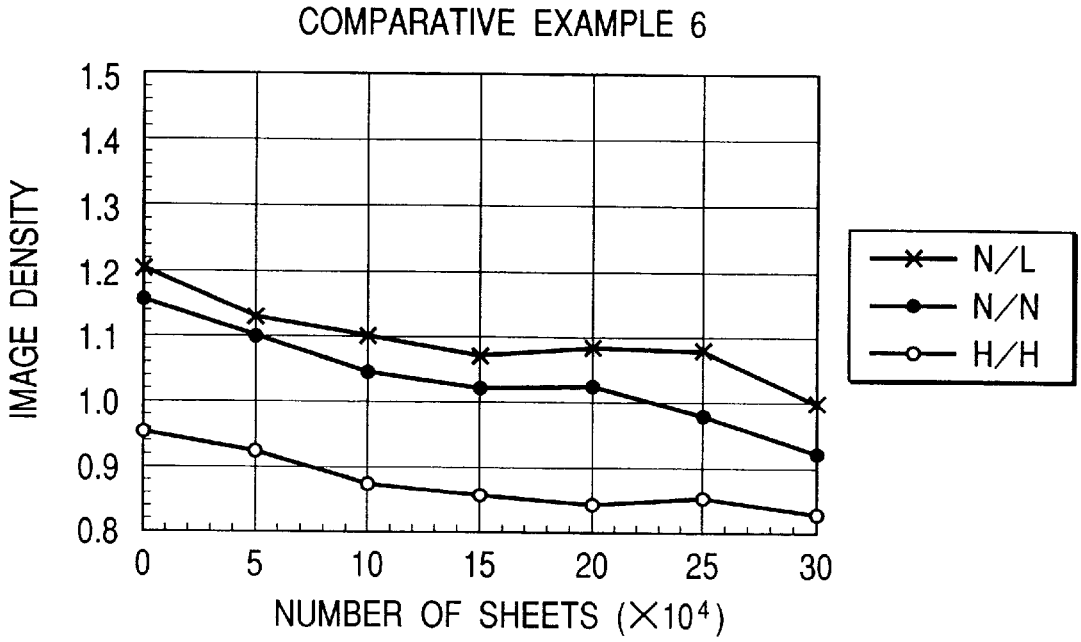
FIGS. 23A and 23B are graphs showing how image density and fog, respectively, undergo changes during running tests made in Comparative Example 6.
Figure 23B:
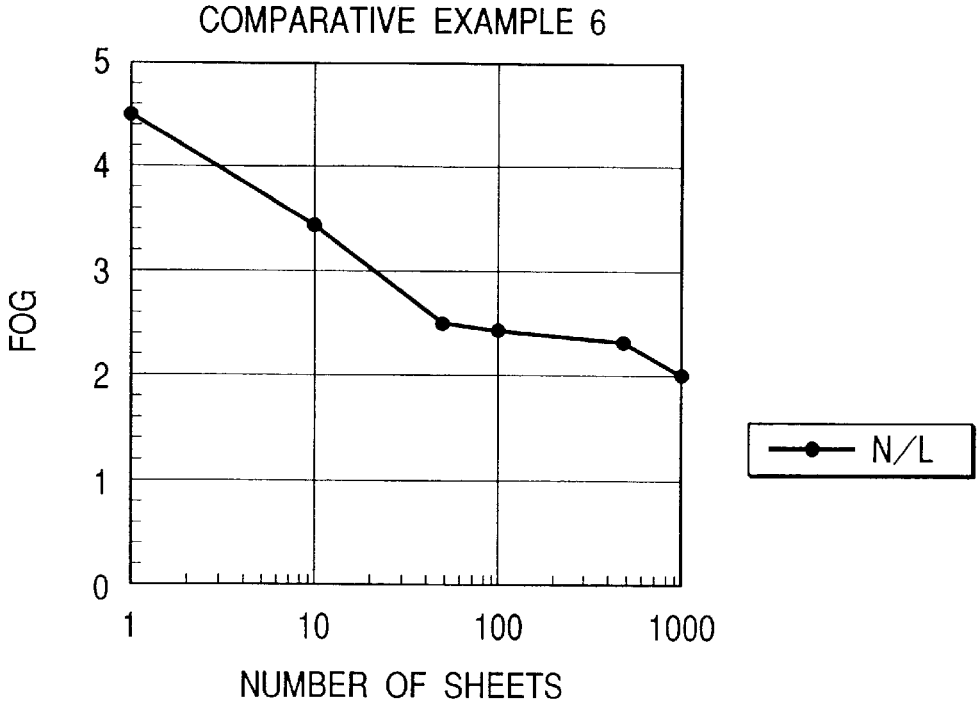

Then, using the developing sleeve 18 thus obtained, images were reproduced and evaluated in the same manner as in Example 1. As the result, as shown in Tables 2, 3 and 4 and FIGS. 23A and 23B, the result on fog was poor until image reproduction on 1,000 sheets, and the image density was poor from the beginning.

Comparative Example 7

A coating material resin composition was prepared in the same formulation and procedure as in Example 1 except that the phenol resin produced in the presence of ammonia as a catalyst was replaced with a styrene-acrylate copolymer. The resin composition thus obtained was composed of C/GF/B/P=0.2/0.8/2.5/0.5.

On the coating material type resin composition used in the present Comparative Example, its coating film volume resistivity was also determined in the same manner as in Example 1 to find that its value was as shown in Table 1.

This resin composition was coated on the same aluminum substrate as that used in Example 1, followed by heating and hardening. Thus, developing sleeve 19 having a conductive resin coat layer on the surface was produced.

Figure 24A:
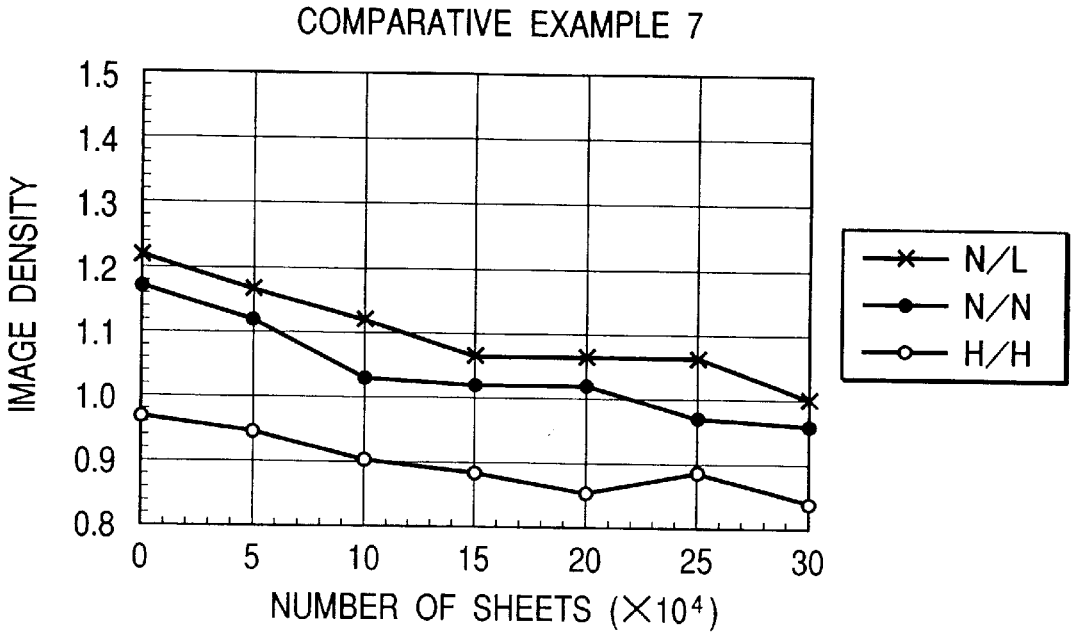
FIGS. 24A and 24B are graphs showing how image density and fog, respectively, undergo changes during running tests made in Comparative Example 7.
Figure 24B:
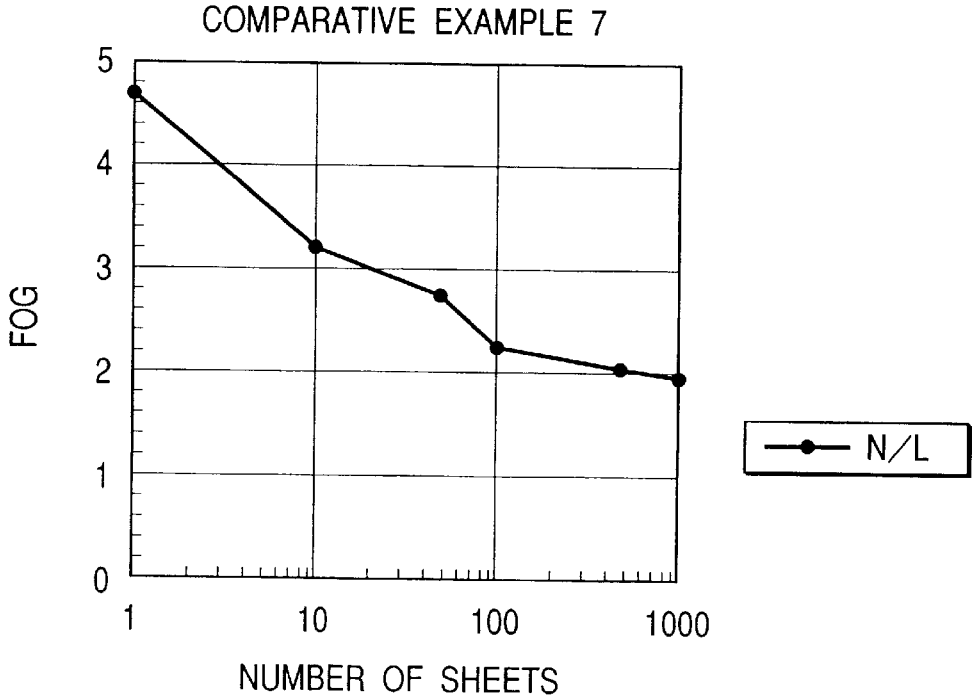

Then, using the developing sleeve 19 thus obtained, images were reproduced and evaluated in the same manner as in Example 1. As the result, as shown in Tables 2, 3 and 4 and FIGS. 24A and 24B, the result on fog was poor until image reproduction on 1,000 sheets, and the image density was poor from the beginning.

Example 13

Materials shown below were mixed, and then dispersed for 3 hours by means of a sand mill, using zirconia particles of 2 mm diameter as a packing material. Thereafter, the zirconia particles were separated by sieving, followed by addition of methanol to adjust the solid content to 20%, thus a resin composition comprising polyamide resin to which the quaternary ammonium salt compound positively chargeable to iron powder has been added was obtained.

| | (by weight) |
|---|---|
| Carbon | 20 parts |
| Graphite | 80 parts |
| Copolymer of nylons composed chiefly of nylon 66 (solid content: 20%) | 1,250 parts |
| Quaternary ammonium salt compound represented by formula (1) below | 50 parts |
| Methanol | 150 parts |

(1)

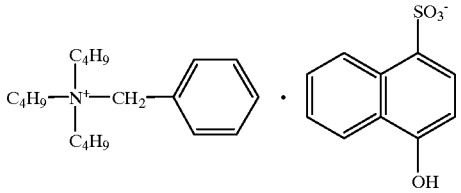

On the quaternary ammonium salt compound represented by the above formula (1), its polarity of triboelectricity to iron powder was measured by the blow-off process, using a commercially available triboelectric charge quantity measuring device (Model TB-200, manufactured by Toshiba Chemical Corporation) to find that it was positive polarity.

The resin composition thus obtained was in the form of a coating material, which was composed of C(carbon)/GF (graphite)/B(polyamide resin)/P(quaternary ammonium salt compound)=0.2/0.8/2.5/0.5. This coating material was coated on an insulating sheet by means of a bar coater, followed by heating and drying to form a coating film, which was then cut in a standard form, and its volume resistivity was measured with a low-resistivity meter Loresta (manufactured by Mitsubishi Yuka Co.). As a result, the volume resistivity was found to be 1.6×10 Ω·cm. Also, as to the developing sleeve resin coat layer from which carbon and graphite were removed, its polarity of triboelectricity to positive toner model particles was negative polarity.

Next, this resin composition was coated by spraying on a cylindrical member of 20 mm diameter made of aluminum, to form a coat layer of 10 μm thick, followed by heating and drying at 150° C. for 30 minutes by means of a hot-air dryer. Thus, developing sleeve 20 having a conductive resin coat layer on the surface was produced.

The developing sleeve 20 thus obtained was set in a copying machine NP6035 (trade name), manufactured by CANON INC., and images were reproduced in three environments of normal temperature and normal humidity (N/N) of 24° C./65% RH, normal temperature and low humidity (N/L) of 24° C./10% RH and high temperature and high humidity (H/H) of 30° C./80% RH.

Here, as a developer used for the image reproduction, a developer was used which was obtained by a conventional method under the following formulation to form a positively chargeable developer having a weight-average particle diameter of 8.5 μm, having particles with diameters of 4.0 μm or smaller in a content of 10% by number and particles with diameters of 12.7 μm or larger in a content of 5.0% by volume, and to which 0.9% by weight of colloidal silica treated by coupling with trimethoxysilyl-γ-propylbenzylamine was further added externally as a positively chargeable external additive.

| | (by weight) |
|---|---|
| Styrene-acrylic resin (Tg: 56° C.) | 100 parts |
| Magnetite | 80 parts |
| Positive charge control agent (Copy Blue PR) | 2 parts |
| Low-molecular weight polypropylene | 4 parts |

- Evaluation -

Occurrence of blotchy images (caused by an uneven coat of the toner coat layer on the developer carrying member), occurrence of ghost and changes in density of 5 mm diameter images, during the image reproduction running were evaluated in the three environments of normal temperature and normal humidity (N/N), normal temperature and low humidity (N/L) and high temperature and high humidity (H/H), in the manner and ranking as shown below. With regard to reversal fog, evaluation was made in the environment of normal temperature and low humidity (N/L) in the manner and ranking as shown below.

(1) Blotchy Images

Solid black and halftone images formed by the image reproduction test were observed visually, and images formed after image reproduction on 1 sheet, 1,000 sheets and 100,000 sheets were evaluated according to the following ranks. As the result, as shown in Table 6, good results were obtained.

A: Excellent
B: Good
C: Average
D: Poor (2) Ghost

Halftone images of a ghost chart, formed by the image reproduction test were observed visually, and occurrence of ghost on images formed after image reproduction on 1 sheet, 1,000 sheets and 100,000 sheets was evaluated according to the following ranks. As the result, as shown in Table 7, good results were obtained.

A: Excellent
B: Good
C: Average
D: Poor (3) 5 mm Diameter Image Density

Figure 25A:
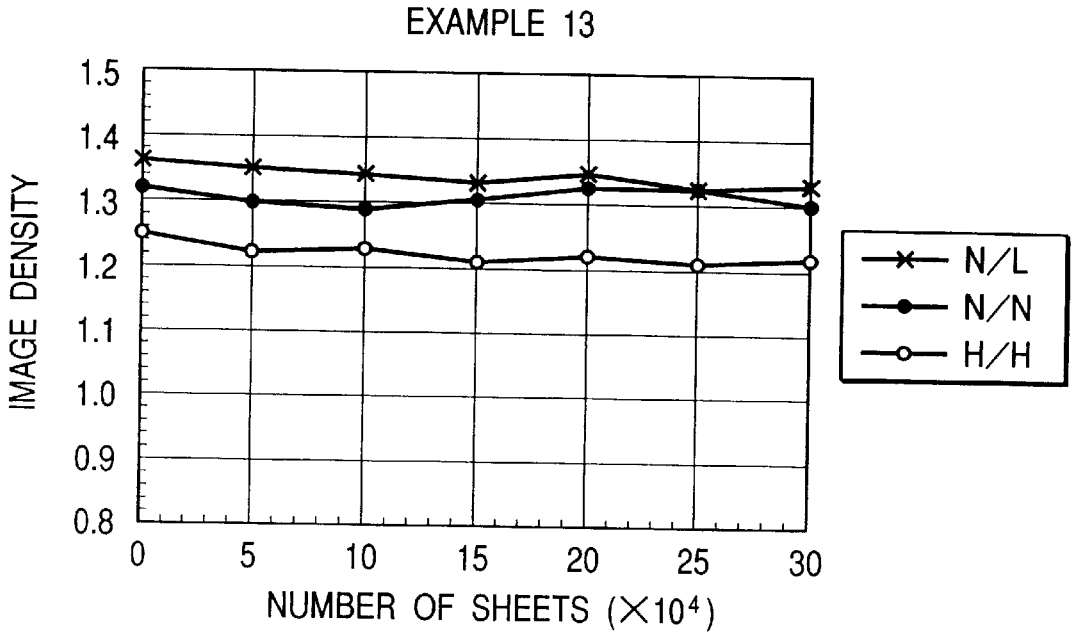
FIGS. 25A and 25B are graphs showing how image density and fog, respectively, undergo changes during running tests made in Example 13.

On 5 mm diameter images, image densities of solid black circles of 5 mm diameter formed after image reproduction on 1 sheet, 50,000 sheets, 100,000 sheets, 150,000 sheets, 200,000 sheets, 250,000 sheets and 300,000 sheets were measured with a reflection densitometer RD918 (manufactured by Macbeth Co.) to examine running performance from the viewpoint of image density. As the result, as shown in FIG. 25A, stable image density was attained also in long-term running.

(4) Reversal Fog

Figure 25B:
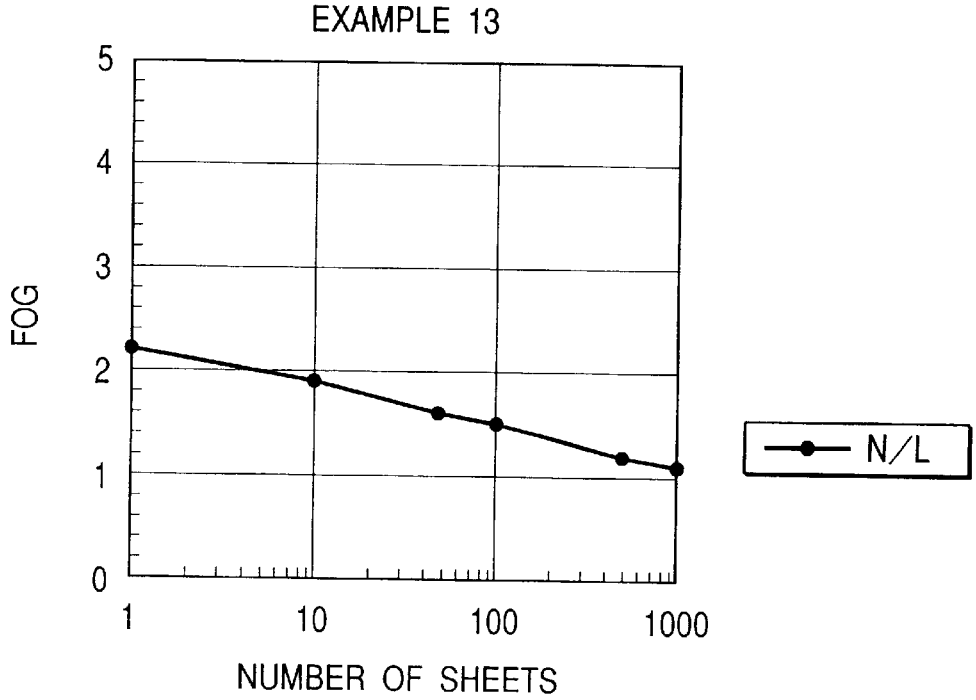

After image reproduction on 1 sheet, 10 sheets, 100 sheets and 1,000 sheets, reversal fog was examined. To examine the reversal fog, reflectance (D1) at solid white areas on a cardboard of 128 g/m$^2$ in basis weight on which images were formed by setting to the lowest density the density adjusting key on the main body of the copying machine was measured, and also reflectance (D2) on a virgin cardboard having the same cut size as the cardboard used in image formation. The value of D2−D1 was found at 5 points, and its average value was regarded as fog density. The reflectance was measured with TC-6 DS (manufactured by Tokyo Denshoku Co.). As the result, as shown in FIG. 25B, good results were obtained.

(5) Triboelectricity

Measurement of the value of triboelectricity by suction on the developer carrying member was made in the following way: Using a measuring container having a cylindrical filter paper, to which a suction tubing made of a metal and having an opening curved after the shape of the developer carrying member surface was attached, its suction pressure was so adjusted as to be able to suck up the developer layer on the developer carrying member surface in proper quantities and uniformly, immediately (preferably in 5 minutes) after image formation, thus the developer layer on the developer carrying member surface was sucked up. Quantity Q of electric charges of the developer sucked here was measured with a 616 digital electrometer (manufactured by Keithley Co.), and the mass M of this developer was also measured. The value of triboelectricity of the developer was calculated by Q/M (mC/kg). It was measured after image reproduction on 1,000 sheets. As the result, as shown in Table 5, good results were obtained.

(6) White Lines

Solid black and halftone images formed by the image reproduction test were observed visually, and images formed after image reproduction on 1 sheet, 1,000 sheets and 100,000 sheets were evaluated according to the following ranks. As the result, as shown in Table 8, good results were obtained.

A: Excellent
B: Good
C: Average
D: Poor

Example 14

A coating material type resin composition was obtained in the same formulation and procedure as in Example 13 except that the quaternary ammonium salt compound used therein, represented by the formula (1), was replaced with a quaternary ammonium salt compound represented by the following formula (2). On the quaternary ammonium salt compound represented by the above formula (2), its polarity of triboelectricity to iron powder was also measured by the blow-off process to find that it was positive polarity as in Example 13.

(2)

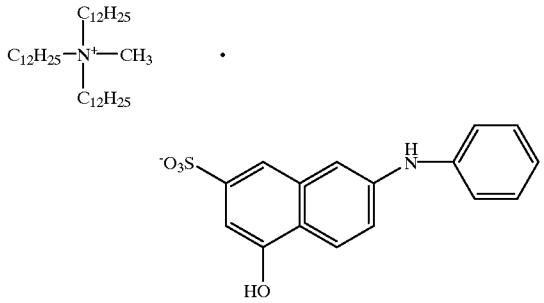

The resin composition thus obtained was composed of C/GF/B/P=0.2/0.8/2.5/0.5. On this coating material type resin composition, its coating film volume resistivity was measured in the same manner as in Example 13 to find that it was 1.9×10 Ω·cm. This resin composition was further coated on the same aluminum substrate as that used in Example 13, followed by heating and drying. Thus, developing sleeve 21 having a conductive resin coat layer on the surface was produced.

Figure 26A:
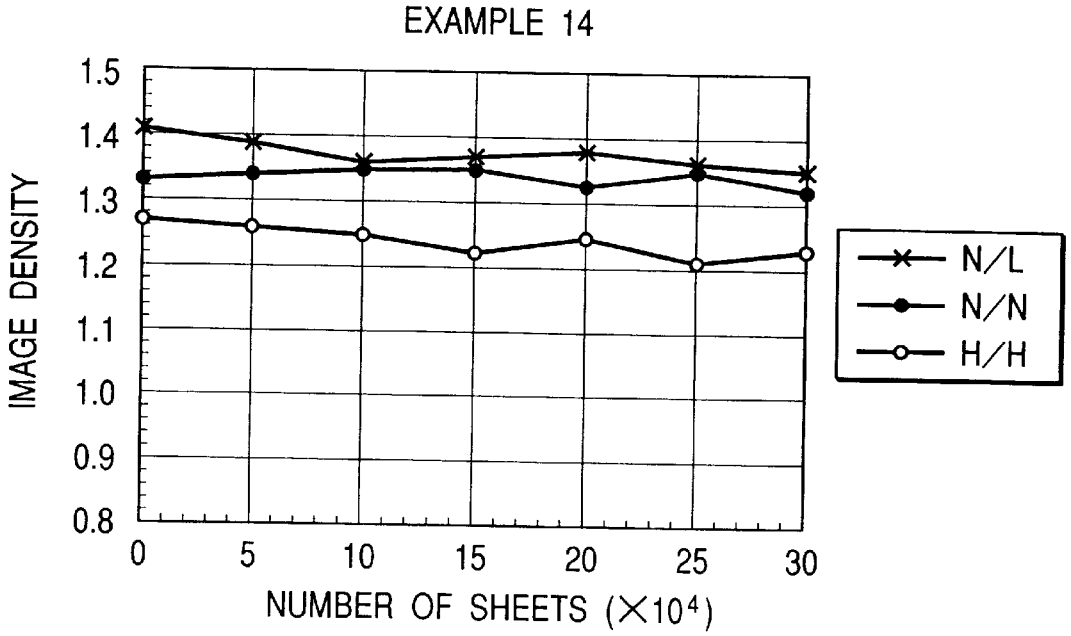
FIGS. 26A and 26B are graphs showing how image density and fog, respectively, undergo changes during running tests made in Example 14.
Figure 26B:
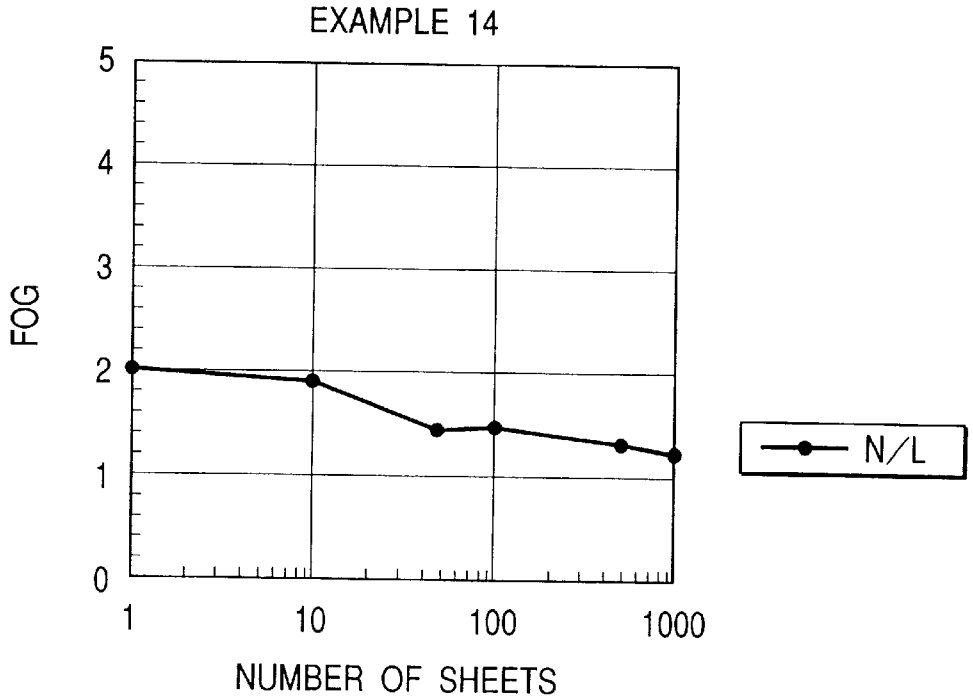

Then, using the developing sleeve 21 thus obtained, images were reproduced and evaluated in the same manner as in Example 13. As the result, as shown in Tables 6, 7 and 8 and FIGS. 26A and 26B, good results were obtained.

Example 15

A coating material type resin composition was obtained in the same formulation and procedure as in Example 13 except that the quaternary ammonium salt compound used therein, represented by the formula (1), was replaced with a quaternary ammonium salt compound represented by the following formula (3). On the quaternary ammonium salt compound represented by the above formula (3), its polarity of triboelectricity to iron powder was also measured by the blow-off process to find that it was positive polarity as in Example 13.

(3)

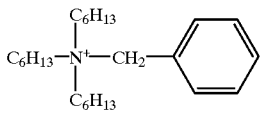

-continued

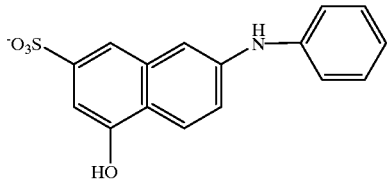

The resin composition thus obtained was composed of C/GF/B/P=0.2/0.8/2.5/0.5. On this coating material type resin composition, its coating film volume resistivity was measured in the same manner as in Example 13 to find that it was 2.1×10 Ω·cm. This resin composition was coated on the same aluminum substrate as that used in Example 13, followed by heating and drying. Thus, developing sleeve 22 having a conductive resin coat layer on the surface was produced.

Figure 27A:
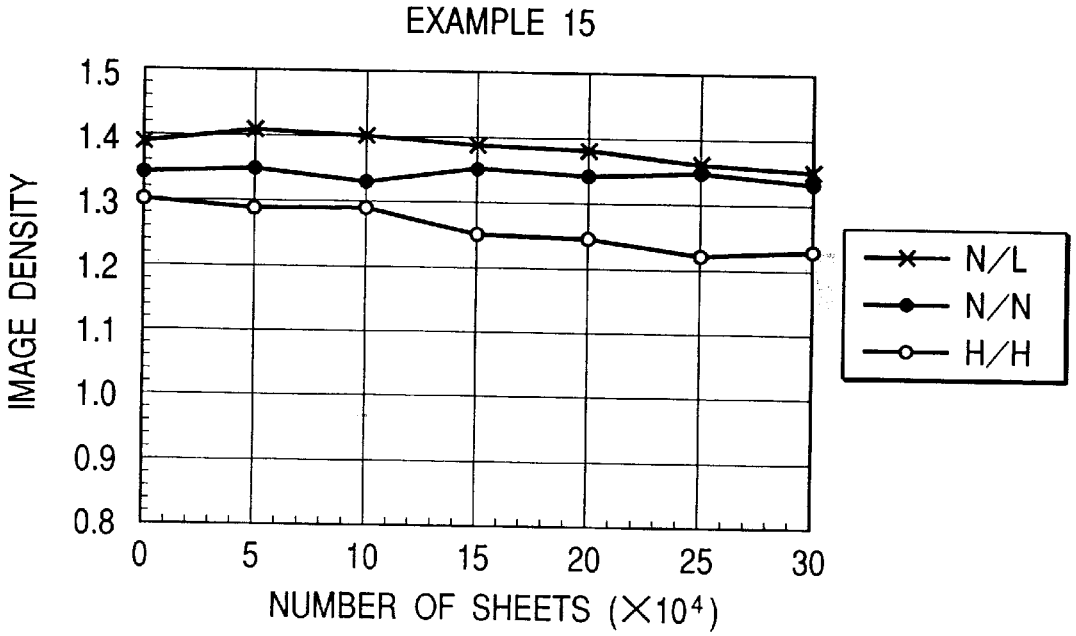
FIGS. 27A and 27B are graphs showing how image density and fog, respectively, undergo changes during running tests made in Example 15.
Figure 27B:
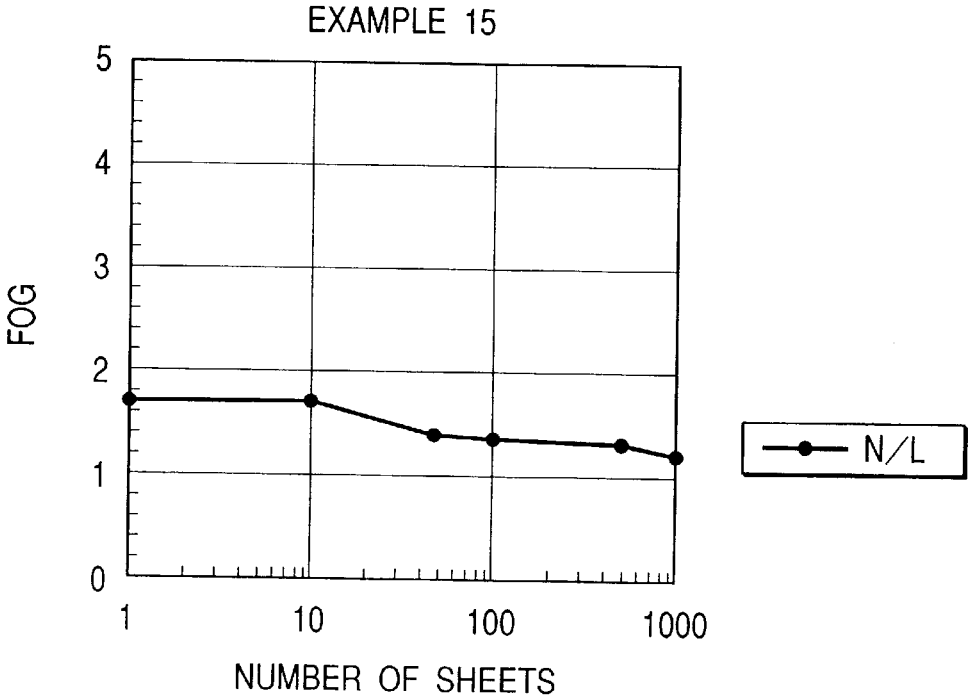

Then, using the developing sleeve 22 thus obtained, images were reproduced and evaluated in the same manner as in Example 13. As the result, as shown in Tables 6, 7 and 8 and FIGS. 27A and 27B, good results were obtained.

Example 16

A coating material type resin composition was obtained in the same formulation and procedure as in Example 13 except that the quaternary ammonium salt compound used therein, represented by the formula (1), was replaced with a quaternary ammonium salt compound represented by the following formula (4). On the quaternary ammonium salt compound represented by the above formula (4), its polarity of triboelectricity to iron powder was also measured by the blow-off process to find that it was positive polarity as in Example 13.

(4)

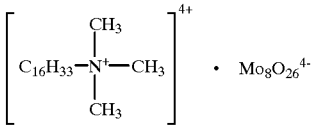

The resin composition thus obtained was composed of C/GF/B/P=0.2/0.8/2.5/0.5. On this coating material type resin composition, its coating film volume resistivity was measured in the same manner as in Example 13 to find that it was 2.7×10 Ω·cm. This resin composition was coated on the same aluminum substrate as that used in Example 13, followed by heating and drying. Thus, developing sleeve 23 having a conductive resin coat layer on the surface was produced.

Figure 28A:
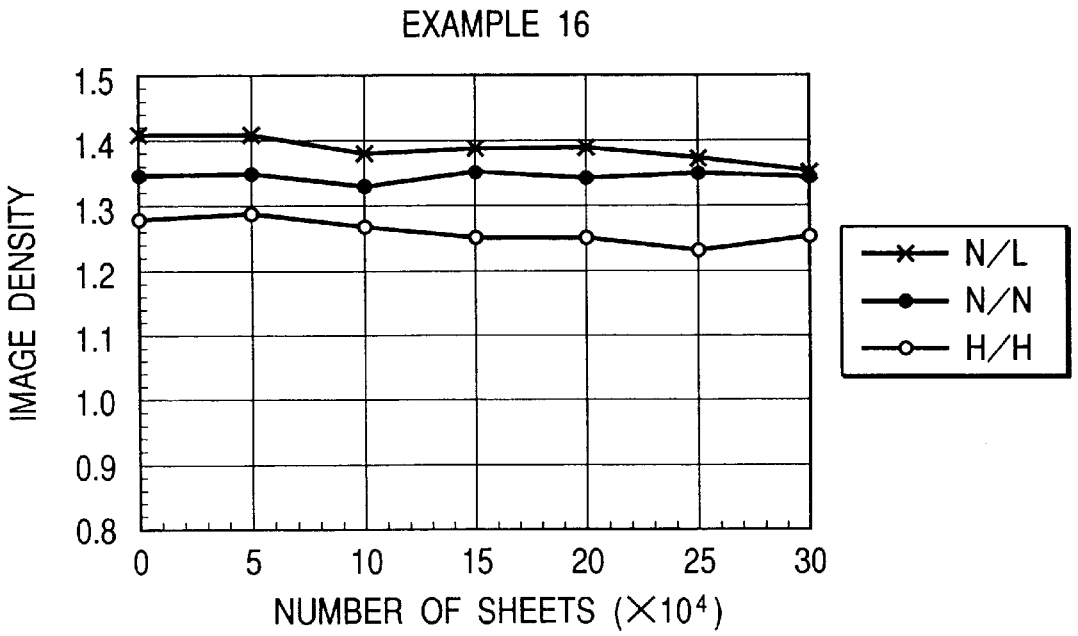
FIGS. 28A and 28B are graphs showing how image density and fog, respectively, undergo changes during running tests made in Example 16.
Figure 28B:
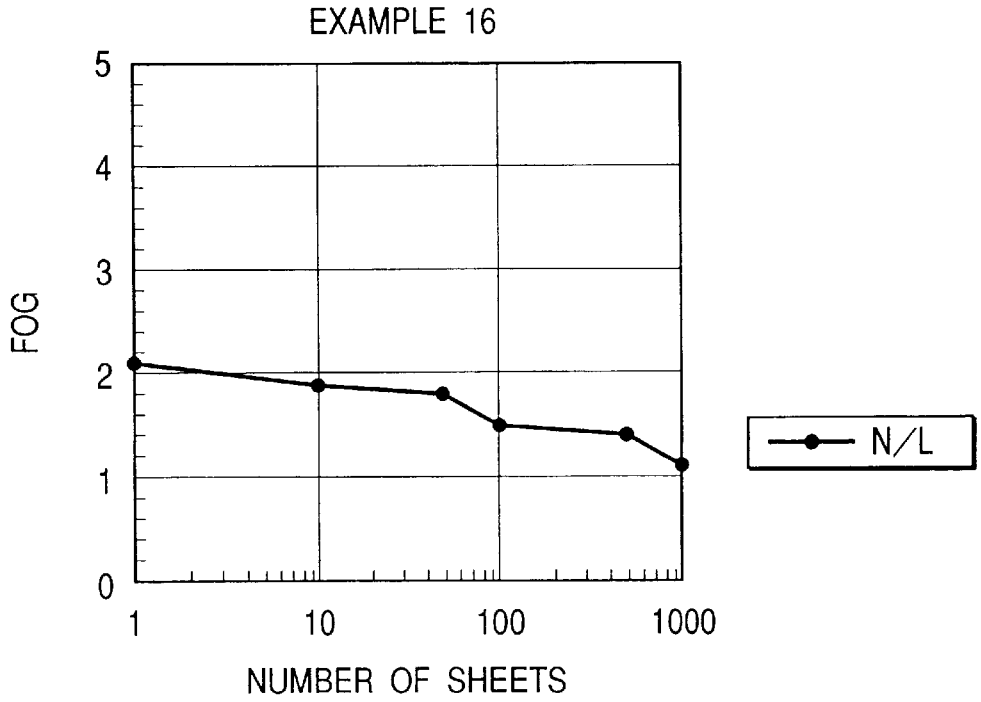

Then, using the developing sleeve 23 thus obtained, images were reproduced and evaluated in the same manner as in Example 13. As the result, as shown in Tables 6, 7 and 8 and FIGS. 28A and 28B, good results were obtained.

Example 17

Materials shown below were mixed, and then dispersed for 3 hours by means of a sand mill, using zirconia particles of 2 mm diameter as a packing material. Thereafter, the zirconia particles were separated by sieving, followed by addition of methanol to adjust the solid content to 20%, thus a resin composition comprising polyamide resin to which the quaternary ammonium salt compound positively chargeable to iron powder has been added was obtained.

| | (by weight) |
|---|---|
| Carbon | 40 parts |
| Boron nitride | 160 parts |
| Copolymer of nylons composed chiefly of nylon 66 (solid content: 20%) | 1,250 parts |
| Quaternary ammonium salt compound represented by the formula (1) | 50 parts |
| Methanol | 100 parts |

The resin composition thus obtained was in the form of a coating material, which was composed of C(carbon)/BN (boron nitride)/B(polyamide resin)/P(quaternary ammonium salt compound)=0.4/1.6/2.5/0.5. This coating material was coated on an insulating sheet by means of a bar coater, followed by heating and drying to form a coating film, which was then cut in a standard form, and its volume resistivity was measured with a low-resistivity meter Loresta (manufactured by Mitsubishi Yuka Co.). As a result, the volume resistivity was found to be $5.4\times10^2$ Ω·cm.

Next, this resin composition was coated by spraying on a cylindrical member of 20 mm diameter made of aluminum, to form a coat layer of 10 μm thick, followed by heating and drying at 150° C. for 30 minutes by means of a hot-air dryer. Thus, developing sleeve 24 having a conductive resin coat layer on the surface was produced.

Figure 29A:
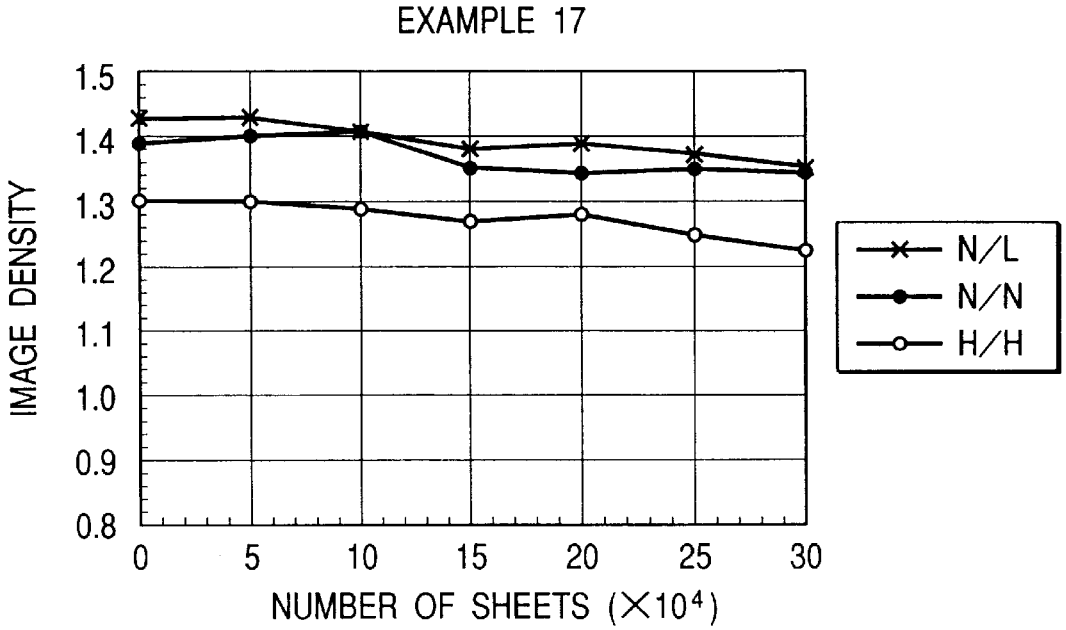
FIGS. 29A and 29B are graphs showing how image density and fog, respectively, undergo changes during running tests made in Example 17.
Figure 29B:
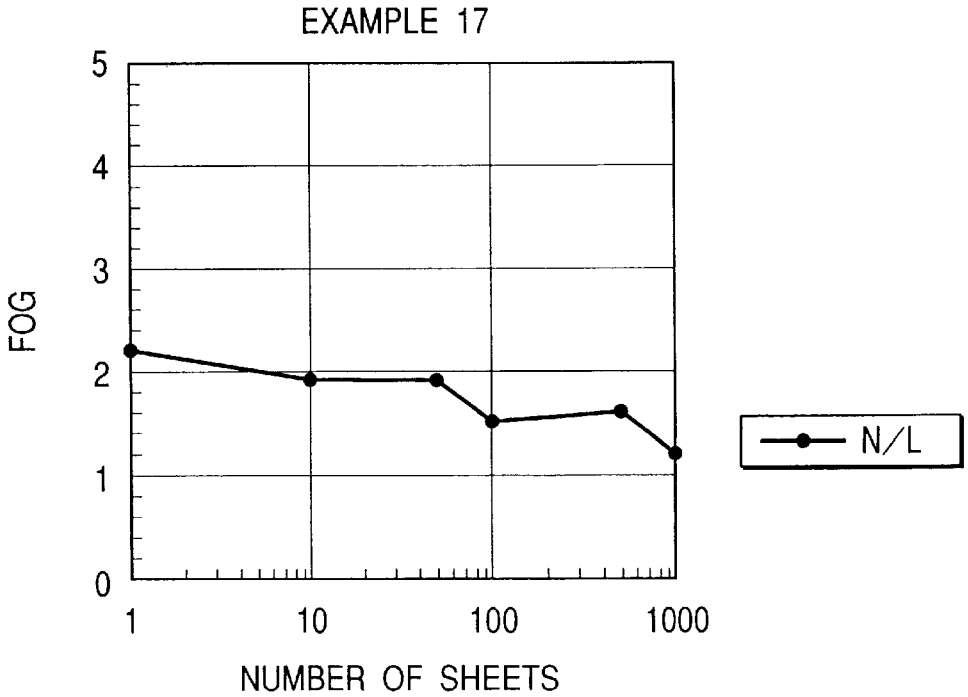

Then, using the developing sleeve 24 thus obtained, images were reproduced and evaluated in the same manner as in Example 13. As the result, as shown in Tables 6, 7 and 8 and FIGS. 29A and 29B, good results were obtained.

Example 18

A coating material type resin composition was obtained in the same formulation and procedure as in Example 17 except that the quaternary ammonium salt compound used therein, represented by the formula (1), was replaced with the quaternary ammonium salt compound positively chargeable to iron powder as used in Example 14, represented by the formula (2).

The resin composition thus obtained was composed of C/BN/B/P=0.4/1.6/2.5/0.5. On this coating material type resin composition, its coating film volume resistivity was measured in the same manner as in Example 13 to find that it was $6.7\times10^2$ Ω·cm. This resin composition was further coated on the same aluminum substrate as that used in Example 17, followed by heating and drying. Thus, developing sleeve 25 having a conductive resin coat layer on the surface was produced.

Figure 30A:
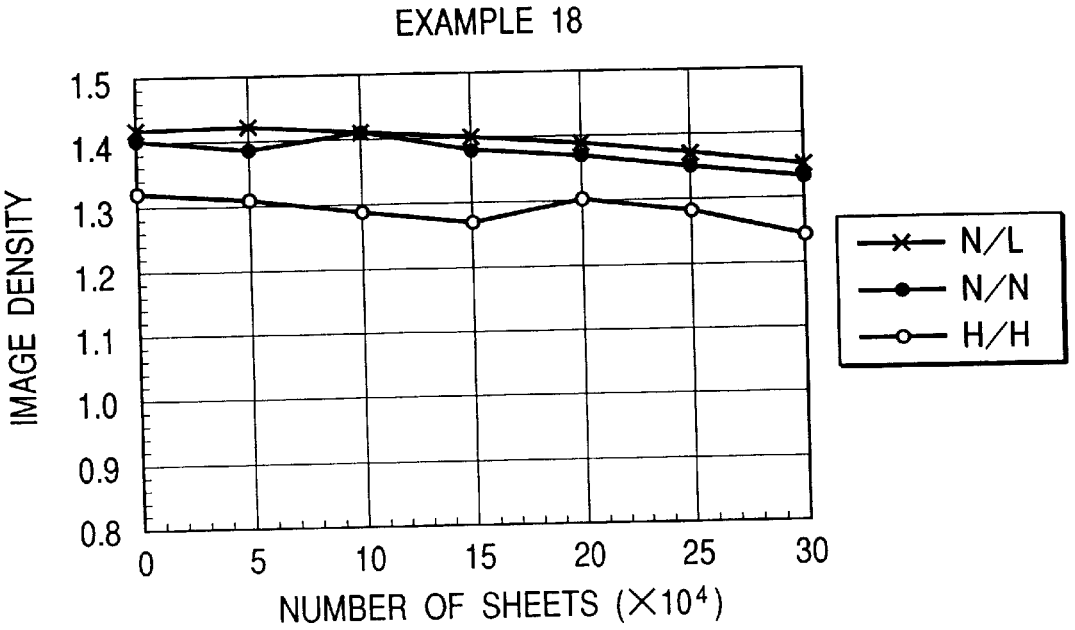
FIGS. 30A and 30B are graphs showing how image density and fog, respectively, undergo changes during running tests made in Example 18.
Figure 30B:
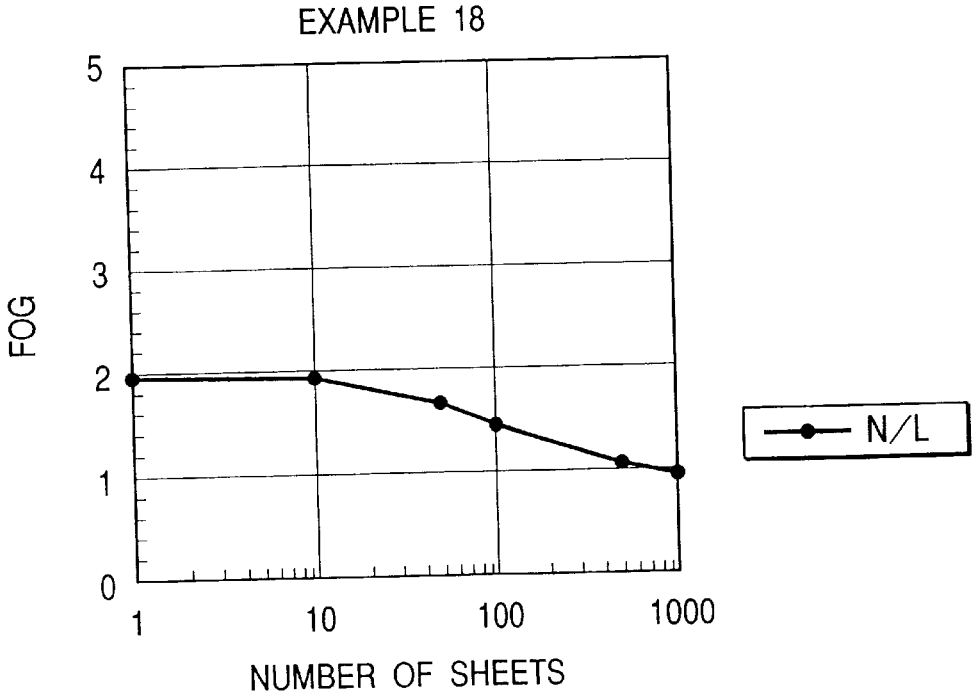

Then, using the developing sleeve 25 thus obtained, images were reproduced and evaluated in the same manner as in Example 13. As the result, as shown in Tables 6, 7 and 8 and FIGS. 30A and 30B, good results were obtained.

Example 19

A coating material type resin composition was obtained in the same formulation and procedure as in Example 17 except that the quaternary ammonium salt compound used therein, represented by the formula (1), was replaced with the quaternary ammonium salt compound used in Example 15, represented by the formula (3).

The resin composition thus obtained was composed of C/BN/B/P=0.4/1.6/2.5/0.5. On this coating material type resin composition, its coating film volume resistivity was measured in the same manner as in Example 13 to find that it was $5.1\times10^2$ Ω·cm. This resin composition was further coated on the same aluminum substrate as that used in Example 17, followed by heating and drying. Thus, developing sleeve 26 having a conductive resin coat layer on the surface was produced.

Figure 31A:
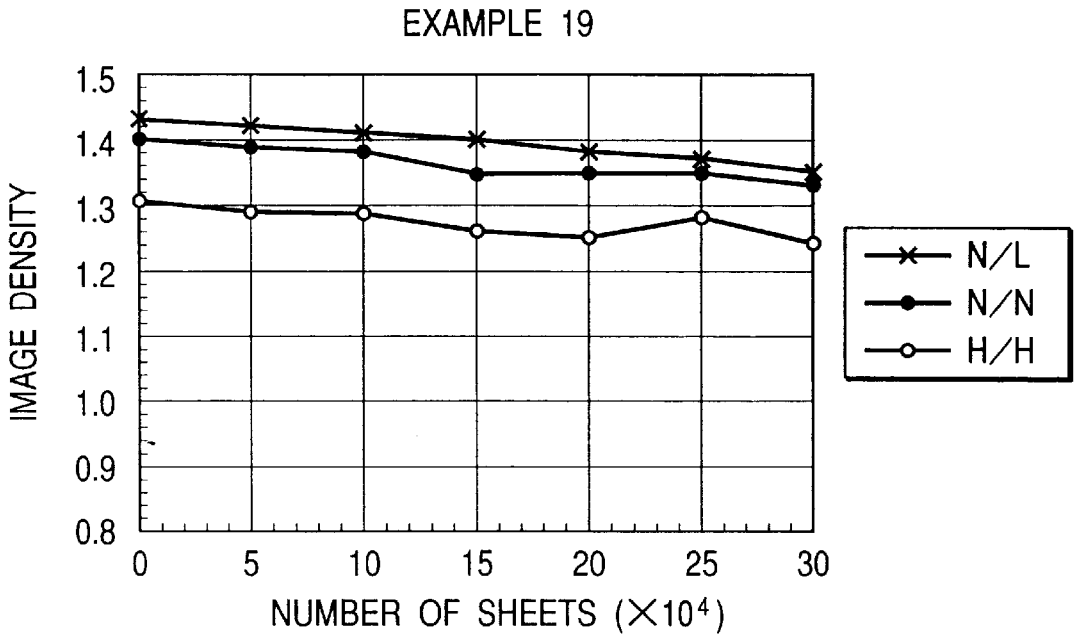
FIGS. 31A and 31B are graphs showing how image density and fog, respectively, undergo changes during running tests made in Example 19.
Figure 31B:
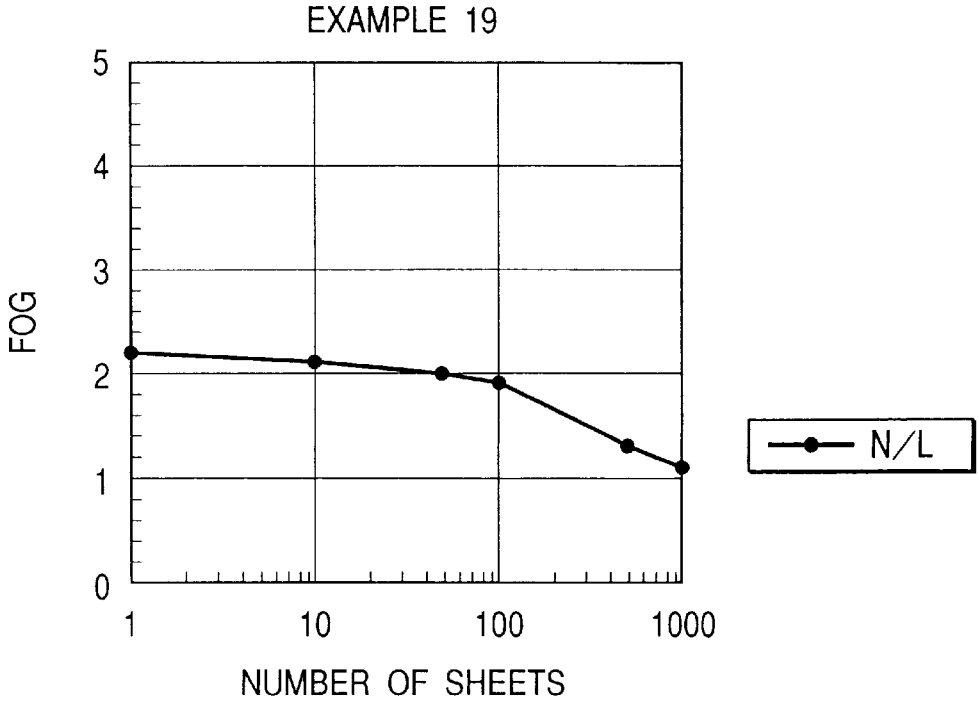

Then, using the developing sleeve 26 thus obtained, images were reproduced and evaluated in the same manner as in Example 13. As the result, as shown in Tables 6, 7 and 8 and FIGS. 31A and 31B, good results were obtained.

Example 20

A coating material type resin composition was obtained in the same formulation and procedure as in Example 17 except that the quaternary ammonium salt compound used therein, represented by the formula (1), was replaced with the quaternary ammonium salt compound used in Example 16, represented by the formula (4).

The resin composition thus obtained was composed of C/BN/B/P=0.4/1.6/2.5/0.5. On this coating material type resin composition, its coating film volume resistivity was measured in the same manner as in Example 13 to find that it was $9.7\times10^2$ Ω·cm. This resin composition was coated on the same aluminum substrate as that used in Example 17, followed by heating and drying. Thus, developing sleeve 27 having a conductive resin coat layer on the surface was produced.

Figure 32A:
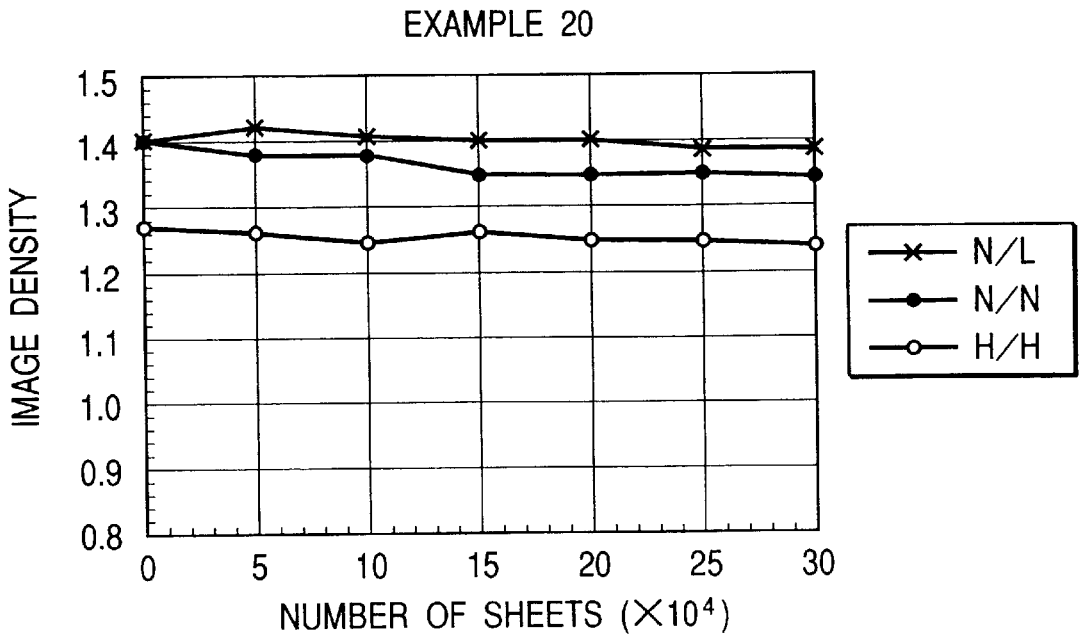
FIGS. 32A and 32B are graphs showing how image density and fog, respectively, undergo changes during running tests made in Example 20.
Figure 32B:
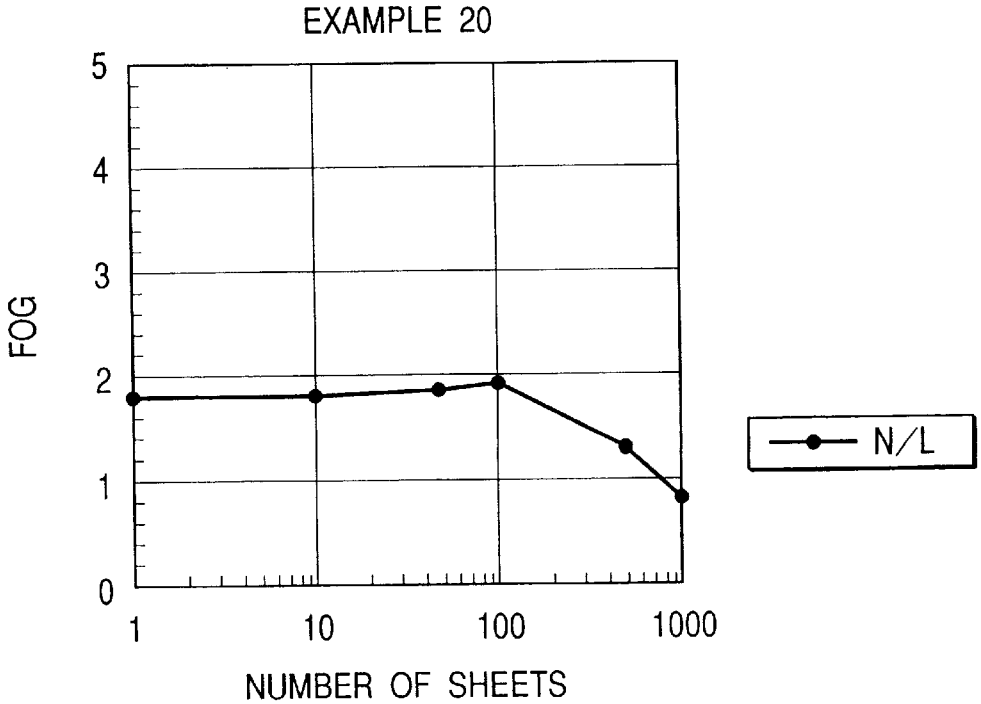

Then, using the developing sleeve 27 thus obtained, images were reproduced and evaluated in the same manner as in Example 13. As the result, as shown in Tables 6, 7 and 8 and FIGS. 32A and 32B, good results were obtained.

Example 21

Materials shown below were mixed, and then dispersed for 3 hours by means of a sand mill, using zirconia particles of 2 mm diameter as a packing material. Thereafter, the zirconia particles were separated by sieving, followed by addition of methanol to adjust the solid content to 20%, thus a resin composition comprising polyamide resin to which the quaternary ammonium salt compound positively chargeable to iron powder has been added was obtained.

| | (by weight) |
|---|---|
| Carbon | 20 parts |
| Molybdenum disulfide | 160 parts |
| Copolymer of nylons composed chiefly of nylon 66 (solid content: 20%) | 1,250 parts |
| Quaternary ammonium salt compound represented by the formula (1) | 50 parts |
| Methanol | 150 parts |

The resin composition thus obtained was in the form of a coating material, which was composed of C(carbon)/$MoS_2$ (molybdenum disulfide)/B(polyamide resin)/P(quaternary ammonium salt compound)=0.2/1.6/2.5/0.5. This coating material was coated on an insulating sheet by means of a bar coater, followed by heating and drying to form a coating film, which was then cut in a standard form, and its volume resistivity was measured with a low-resistivity meter Loresta (manufactured by Mitsubishi Yuka Co.). As a result, the volume resistivity was found to be 8.4×10 Ω·cm.

Next, this resin composition was coated by spraying on a cylindrical member of 20 mm diameter made of aluminum, to form a coat layer of 10 μm thick, followed by heating and drying at 150° C. for 30 minutes by means of a hot-air dryer. Thus, developing sleeve 28 having a conductive resin coat layer on the surface was produced.

Figure 33A:
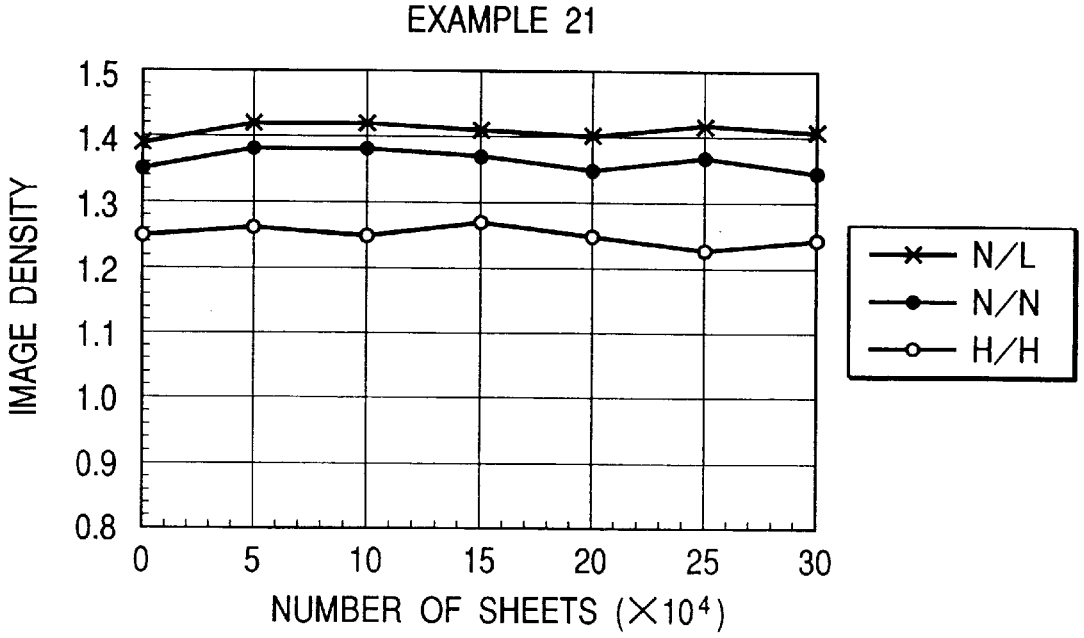
FIGS. 33A and 33B are graphs showing how image density and fog, respectively, undergo changes during running tests made in Example 21.
Figure 33B:
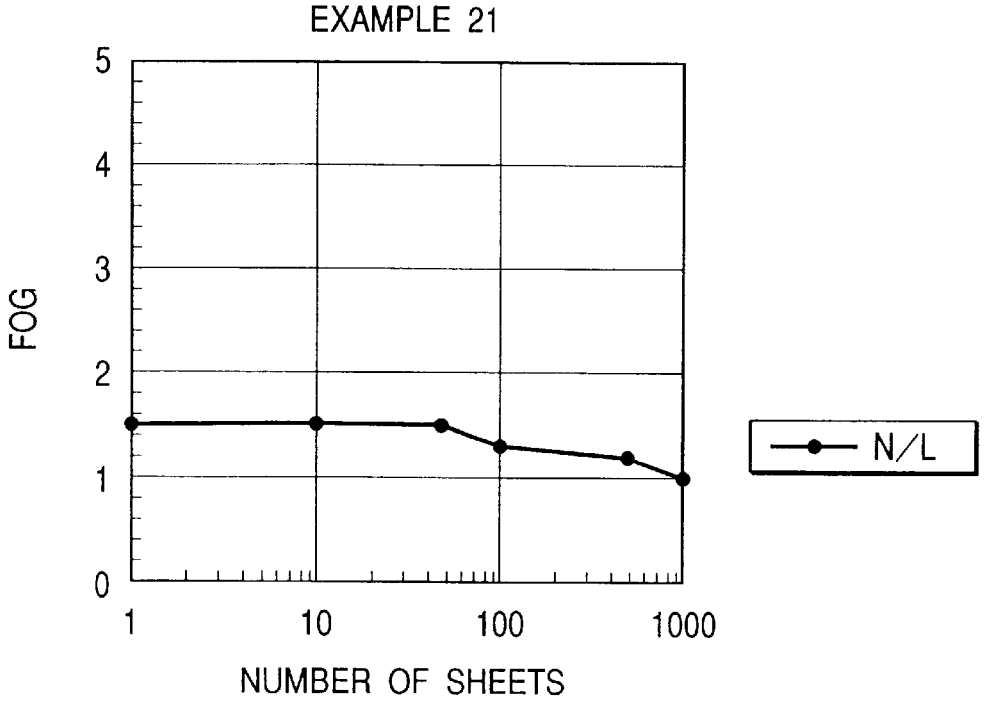

Then, using the developing sleeve 28 thus obtained, images were reproduced and evaluated in the same manner as in Example 13. As the result, as shown in Tables 6, 7 and 8 and FIGS. 33A and 33B, good results were obtained.

Example 22

A coating material type resin composition was obtained in the same formulation and procedure as in Example 21 except that the quaternary ammonium salt compound used therein, represented by the formula (1), was replaced with the quaternary ammonium salt compound positively chargeable to iron powder as used in Example 14, represented by the formula (4).

The resin composition thus obtained was composed of C/$MoS_2$/B/P=0.2/1.6/2.5/0.5. On this coating material type resin composition, its coating film volume resistivity was measured in the same manner as in Example 13 to find that it was 9.9×10 Ω·cm. This resin composition was coated on the same aluminum substrate as that used in Example 21, followed by heating and drying. Thus, developing sleeve 29 having a conductive resin coat layer on the surface was produced.

Figure 34A:
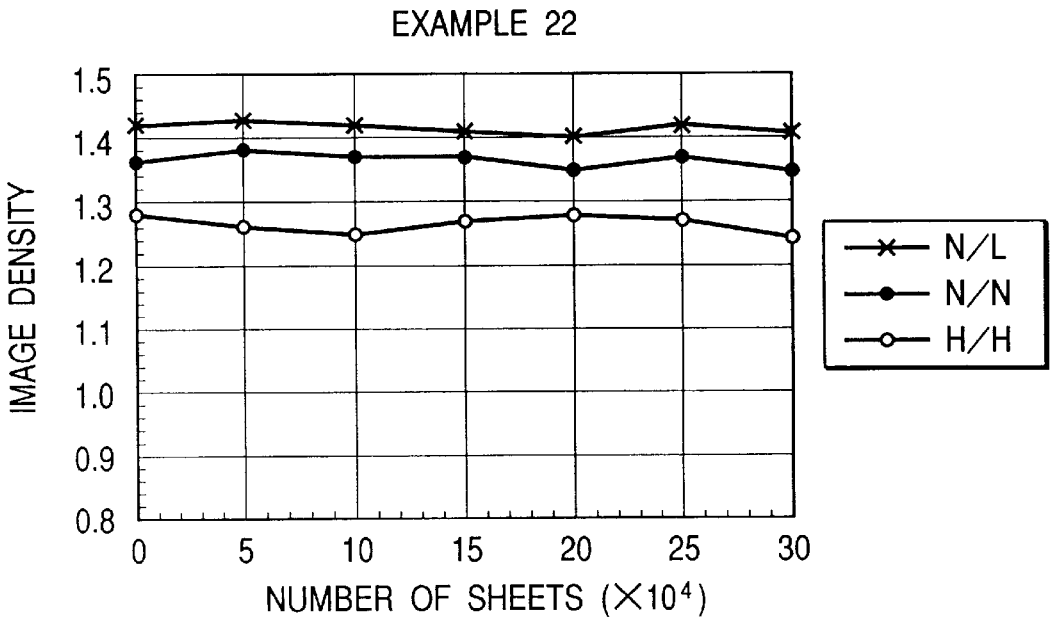
FIGS. 34A and 34B are graphs showing how image density and fog, respectively, undergo changes during running tests made in Example 22.
Figure 34B:
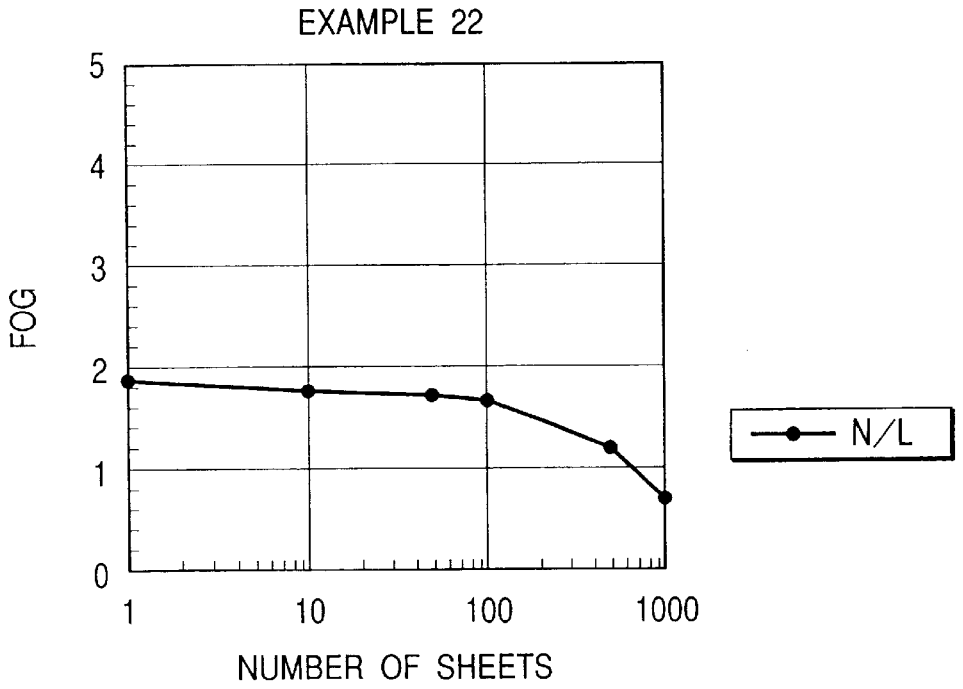

Then, using the developing sleeve 29 thus obtained, images were reproduced and evaluated in the same manner as in Example 13. As the result, as shown in Tables 6, 7 and 8 and FIGS. 34A and 34B, good results were obtained.

Example 23

A coating material type resin composition was obtained in the same formulation and procedure as in Example 21 except that the quaternary ammonium salt compound used therein, represented by the formula (1), was replaced with the quaternary ammonium salt compound positively chargeable to iron powder as used in Example 15, represented by the formula (3).

The resin composition thus obtained was composed of C/$MoS_2$/B/P=0.2/1.6/2.5/0.5. On this coating material type resin composition, its coating film volume resistivity was measured in the same manner as in Example 13 to find that it was 8.5×10 Ω·cm. This resin composition was coated on the same aluminum substrate as that used in Example 21, followed by heating and drying. Thus, developing sleeve 30 having a conductive resin coat layer on the surface was produced.

Figure 35A:
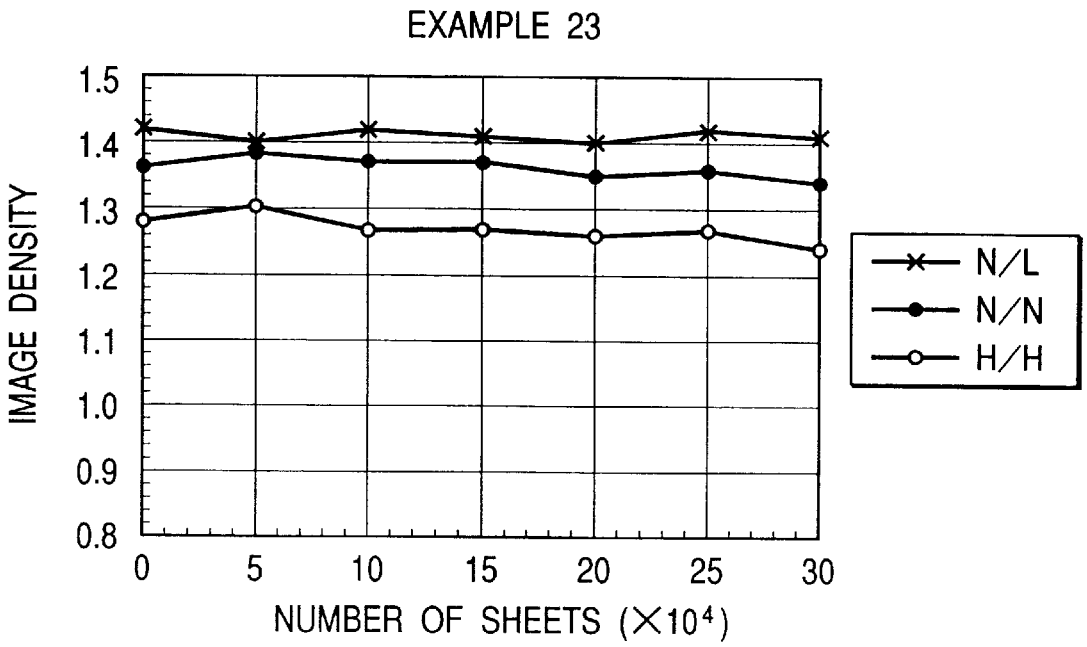
FIGS. 35A and 35B are graphs showing how image density and fog, respectively, undergo changes during running tests made in Example 23.
Figure 35B:
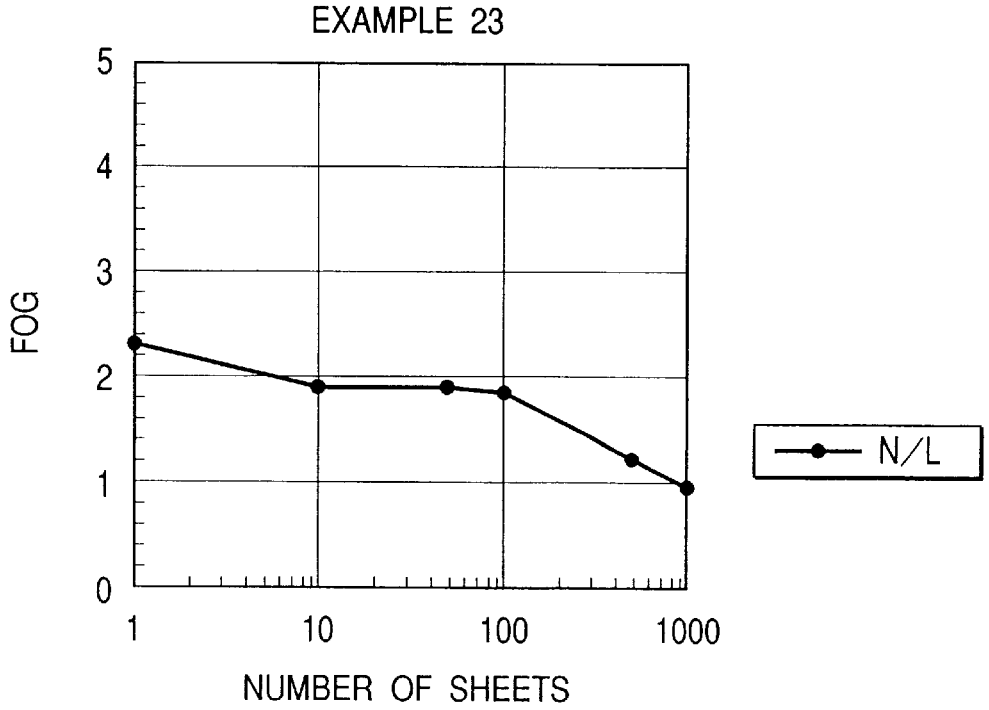

Then, using the developing sleeve 30 thus obtained, images were reproduced and evaluated in the same manner as in Example 13. As the result, as shown in Tables 6, 7 and 8 and FIGS. 35A and 35B, good results were obtained.

Example 24

A coating material type resin composition was obtained in the same formulation and procedure as in Example 21 except that the quaternary ammonium salt compound used therein, represented by the formula (1), was replaced with the quaternary ammonium salt compound positively chargeable to iron powder as used in Example 16, represented by the formula (4).

The resin composition thus obtained was composed of C/$MOS_2$/B/P=0.2/1.6/2.5/0.5. On this coating material type resin composition, its coating film volume resistivity was measured in the same manner as in Example 13 to find that it was 8.7×10 Ω·cm. This resin composition was coated on the same aluminum substrate as that used in Example 21, followed by heating and drying. Thus, developing sleeve 31 having a conductive resin coat layer on the surface was produced.

Figure 36A:
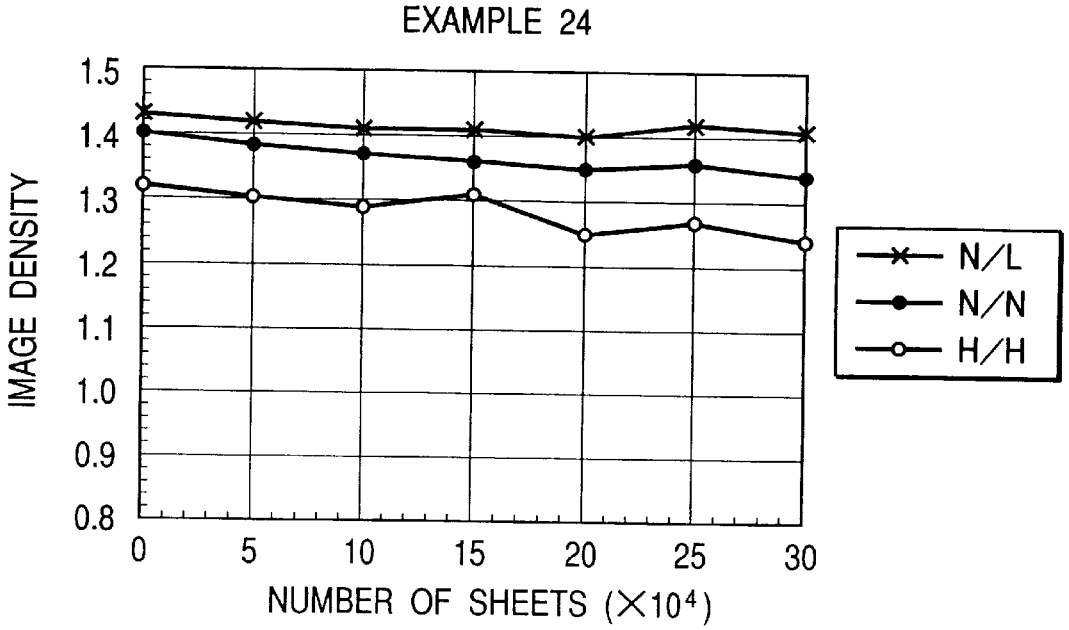
FIGS. 36A and 36B are graphs showing how image density and fog, respectively, undergo changes during running tests made in Example 24.
Figure 36B:
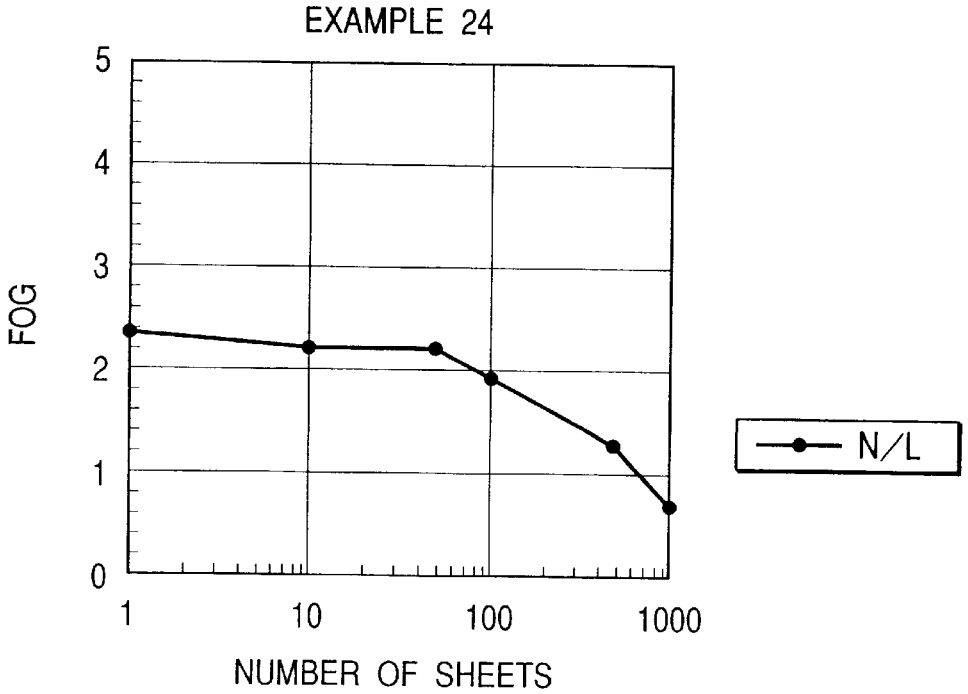

Then, using the developing sleeve 31 thus obtained, images were reproduced and evaluated in the same manner as in Example 13. As the result, as shown in Tables 6, 7 and 8 and FIGS. 36A and 36B, good results were obtained.

Comparative Example 8

The surface of the same cylindrical member of 20 mm diameter made of aluminum as that used in Examples was only treated by sand blasting with FGB #300. This was used as a developing sleeve 32.

Using this developing sleeve, images were reproduced and evaluated in the same manner as in Example 13. As the result, as shown in Tables 6 and 7, blotchy images occurred, and it was impossible to make image evaluation on the items other than this.

Comparative Example 9

A resin composition was obtained in the same manner as in Example 13 except that it was prepared in the following formulation. The resin composition thus obtained was in the form of a coating material, which was composed of C/GF/B/P=0.2/0.8/2.5/0

| | (by weight) |
|---|---|
| Carbon | 20 parts |
| Graphite | 80 parts |
| Copolymer of nylons composed chiefly of nylon 66 (solid content: 20%) | 1,250 parts |
| Methanol | 20 parts |

On this coating material type resin composition, its coating film volume resistivity was measured in the same manner as in Example 13 to find that it was 6.5×10 Ω·cm. This resin composition was further coated on the same aluminum substrate as that used in Example 13, followed by heating and drying. Thus, developing sleeve 33 having a conductive resin coat layer on the surface was produced.

Figure 37A:
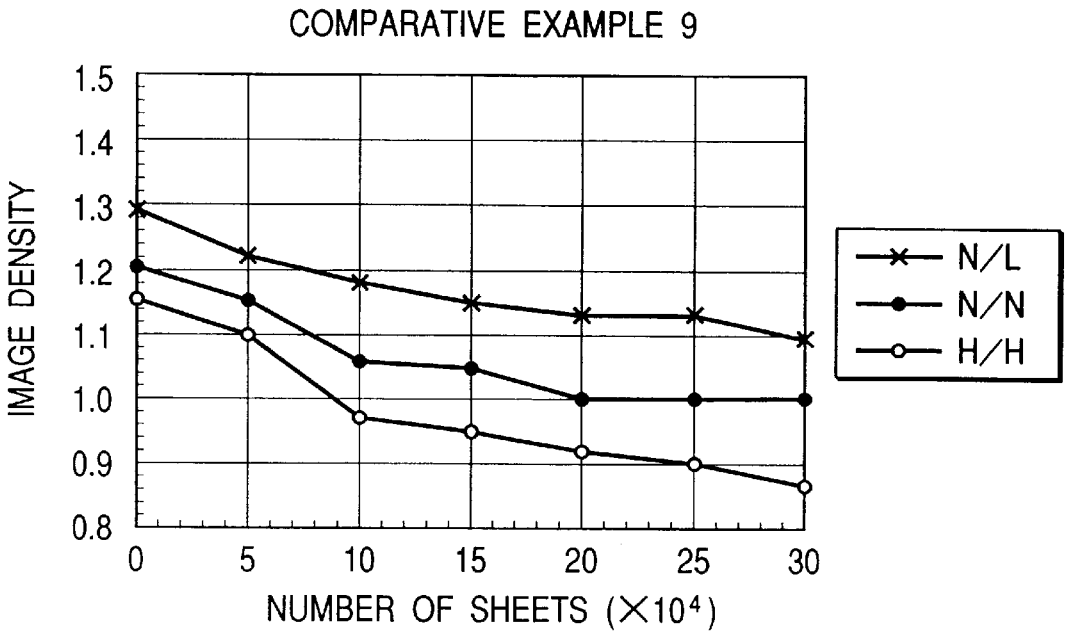
FIGS. 37A and 37B are graphs showing how image density and fog, respectively, undergo changes during running tests made in Comparative Example 9.
Figure 37B:
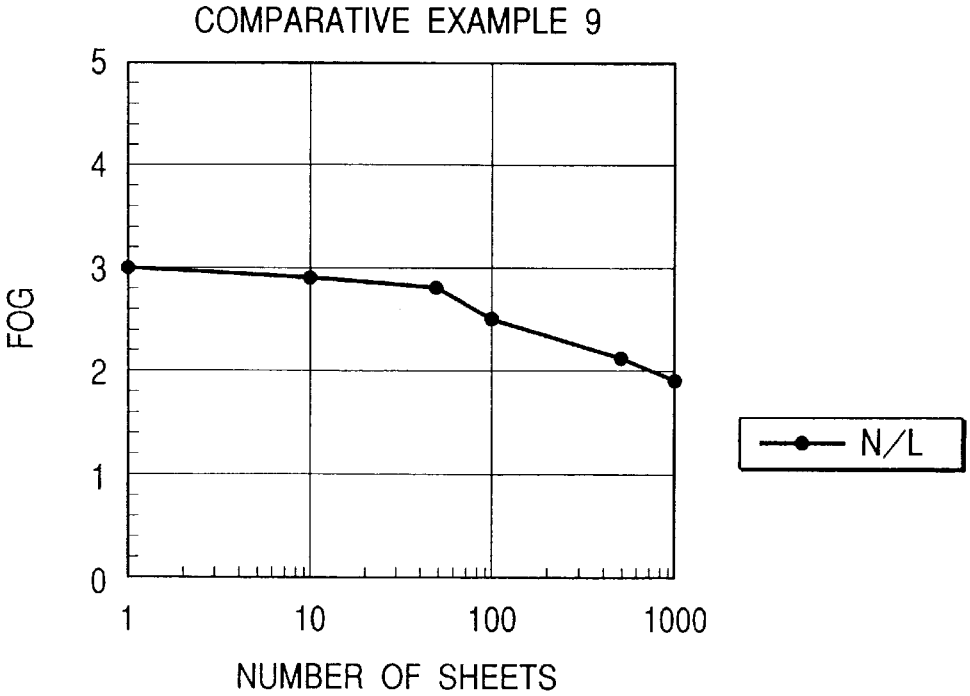

Using the developing sleeve 33 thus obtained, images were reproduced and evaluated in the same manner as in Example 13. As the result, as shown in Tables 6, 7 and 8 and FIGS. 37A and 37B, the result on fog was only a little poor at the initial stage only, but a decrease in image density was seen during running.

Comparative Example 10

A coating material resin composition was prepared in the same formulation and procedure as in Example 13 except that the quaternary ammonium salt compound used therein, represented by the formula (1), was replaced with a chromium complex (S) of azonaphthol containing chlorophenol. The resin composition thus obtained was composed of C/GF/B/S=0.2/0.8/2.5/0.5. Here, on this chromium complex (S) of azonaphthol containing chlorophenol, its polarity of triboelectricity to iron powder was measured by the blow-off process in the same manner as in Example 13 to find that it was negative polarity.

On the coating material type resin composition, its coating film volume resistivity was measured in the same manner as in Example 13 to find that it was 3.5×10 Ω·cm.

This resin composition was coated on the same aluminum substrate as that used in Example 13, followed by heating and drying. Thus, developing sleeve 34 having a conductive resin coat layer on the surface was produced.

Figure 38A:
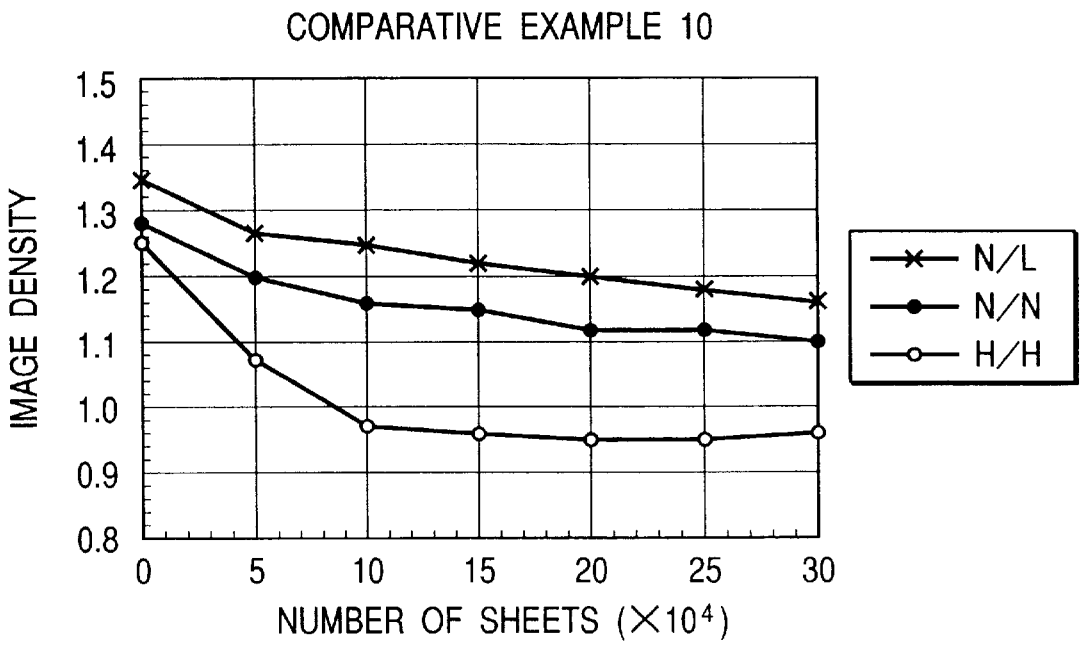
FIGS. 38A and 38B are graphs showing how image density and fog, respectively, undergo changes during running tests made in Comparative Example 10.
Figure 38B:
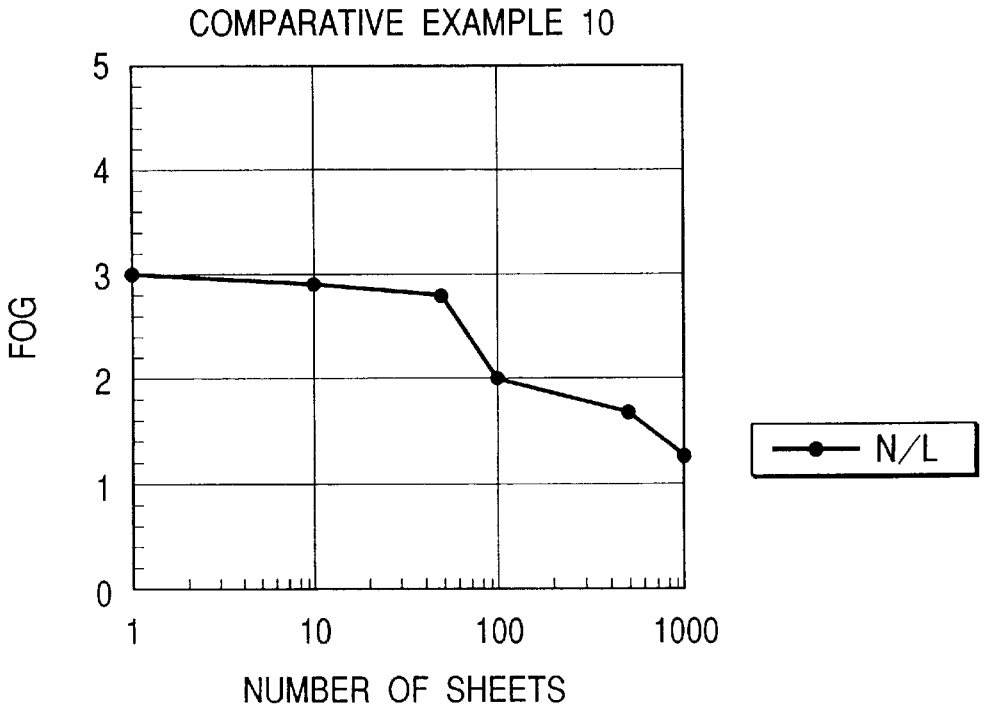

Using the developing sleeve 34 thus obtained, images were reproduced and evaluated in the same manner as in Example 13. As the result, as shown in Tables 6, 7 and 8 and FIGS. 38A and 38B, the result on fog was poor until image reproduction of about 50 sheets, and also a decrease in image density was seen during running.

Comparative Example 11

A coating material resin composition was prepared in the same formulation and procedure as in Example 13 except that the quaternary ammonium salt compound used therein, represented by the formula (1), was replaced with Nigrosine (N). The resin composition thus obtained was composed of C/GF/B/N=0.2/0.8/2.5/0.5. Here, on this Nigrosine (N), its polarity of triboelectricity to iron powder was measured by the blow-off process in the same manner as in Example 13 to find that it was positive polarity.

On the coating material type resin composition, its coating film volume resistivity was measured in the same manner as in Example 13 to find that it was 4.4×10 Ω·cm.

This resin composition was further coated on the same aluminum substrate as that used in Example 13, followed by heating and drying. Thus, developing sleeve 35 having a conductive resin coat layer on the surface was produced.

Figure 39A:
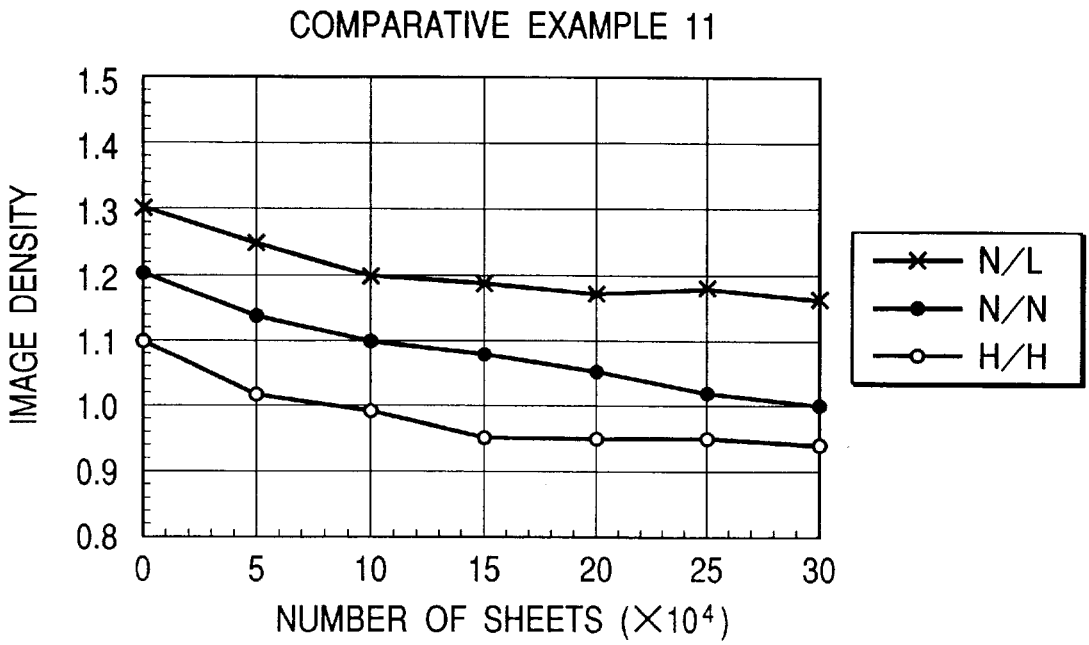
FIGS. 39A and 39B are graphs showing how image density and fog, respectively, undergo changes during running tests made in Comparative Example 11.
Figure 39B:
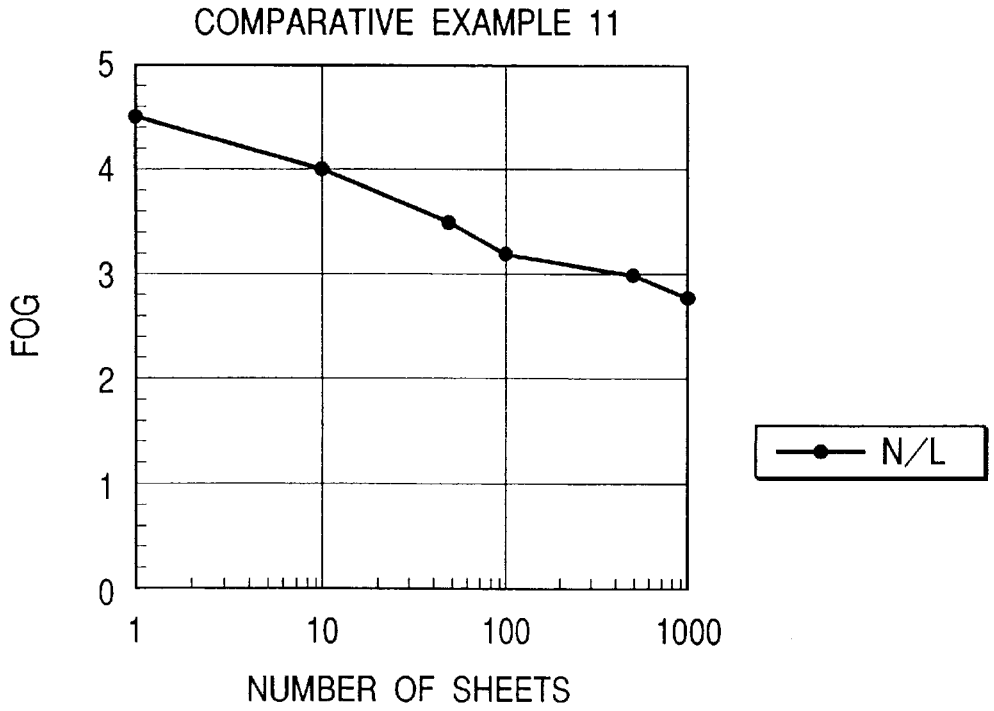

Using the developing sleeve 35 thus obtained, images were reproduced and evaluated in the same manner as in Example 13. As the result, as shown in Tables 6, 7 and 8 and FIGS. 39A and 39B, the result on fog was poor until image reproduction on about 1,000 sheets, and also a decrease in image density was seen at an early stage during running.

Comparative Example 12

A coating material resin composition was prepared in the same formulation and procedure as in Example 13 except that the quaternary ammonium salt compound used therein, represented by the formula (1), was replaced with a quaternary ammonium salt compound represented by the following formula (9). The resin composition thus obtained was composed of C/GF/B/P=0.2/0.8/2.5/0.5. Here, on this quaternary ammonium salt compound represented by the following formula (9), its polarity of triboelectricity to iron powder was also measured by the blow-off process in the same manner as in Example 13 to find that it was negative polarity, different from Example 13.

(9)

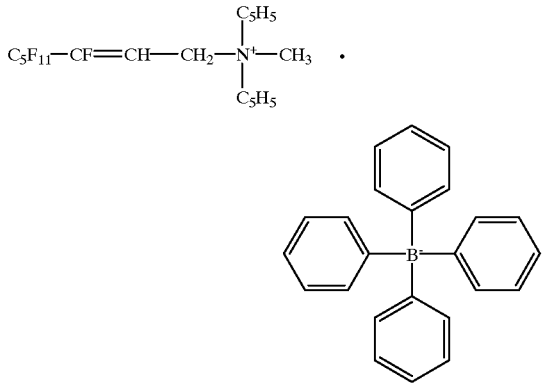

On the coating material type resin composition, its coating film volume resistivity was measured in the same manner as in Example 13 to find that it was 2.1×10 Ω·cm.

This resin composition was coated on the same aluminum substrate as that used in Example 13, followed by heating and drying. Thus, developing sleeve 36 having a conductive resin coat layer on the surface was produced.

Figure 40A:
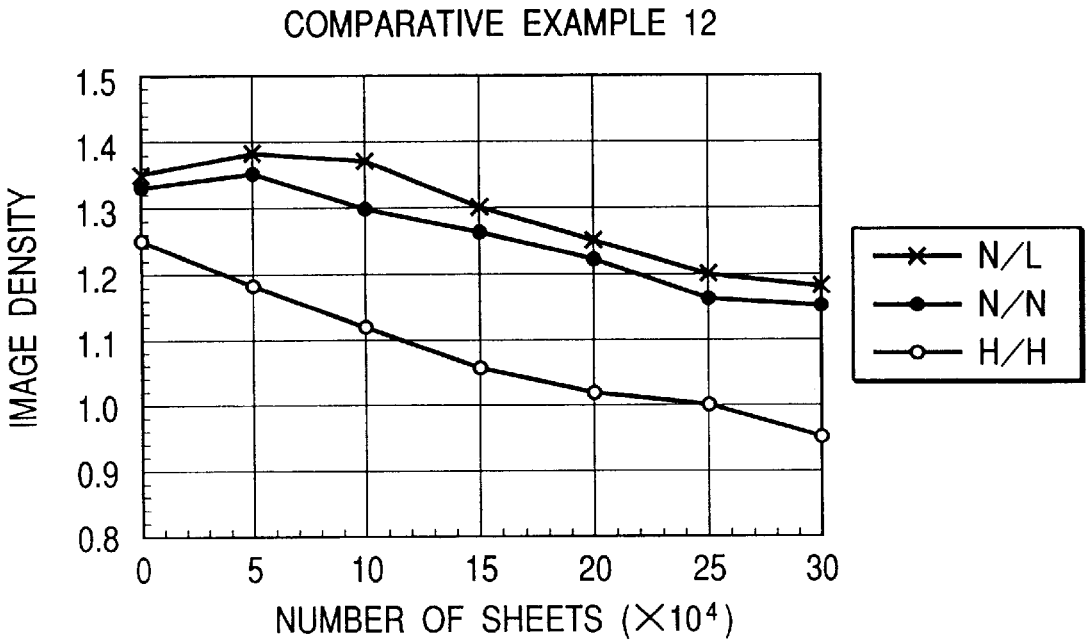
FIGS. 40A and 40B are graphs showing how image density and fog, respectively, undergo changes during running tests made in Comparative Example 12.
Figure 40B:
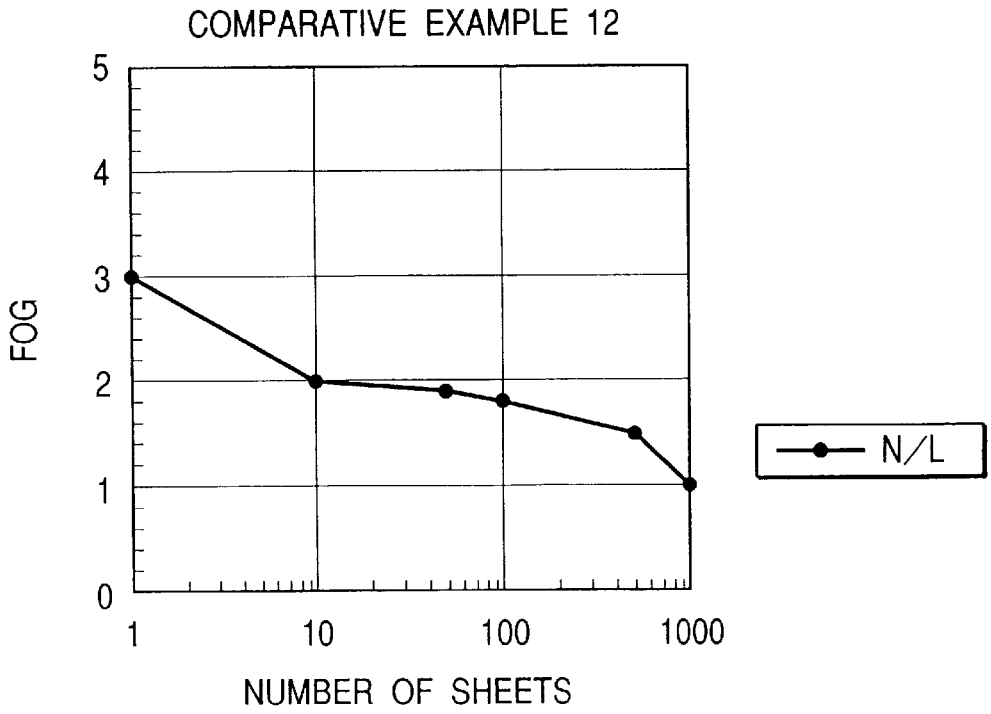

Using the developing sleeve 36 thus obtained, images were reproduced and evaluated in the same manner as in Example 13. As the result, as shown in Tables 6, 7 and 8 and FIGS. 40A and 40B, the result on fog was good after image reproduction on 10 sheets, but a decrease in image density was seen.

Comparative Example 13

A coating material resin composition was prepared in the same formulation and procedure as in Example 13 except that the copolymer of nylons composed chiefly of nylon 66 was replaced with PMMA resin.

On the coating material type resin composition, its coating film volume resistivity was measured in the same manner as in Example 13 to find that it was 3.1×10 Ω·cm.

This resin composition was further coated on the same aluminum substrate as that used in Example 13, followed by heating and drying. Thus, developing sleeve 37 having a conductive resin coat layer on the surface was produced.

Figure 41A:
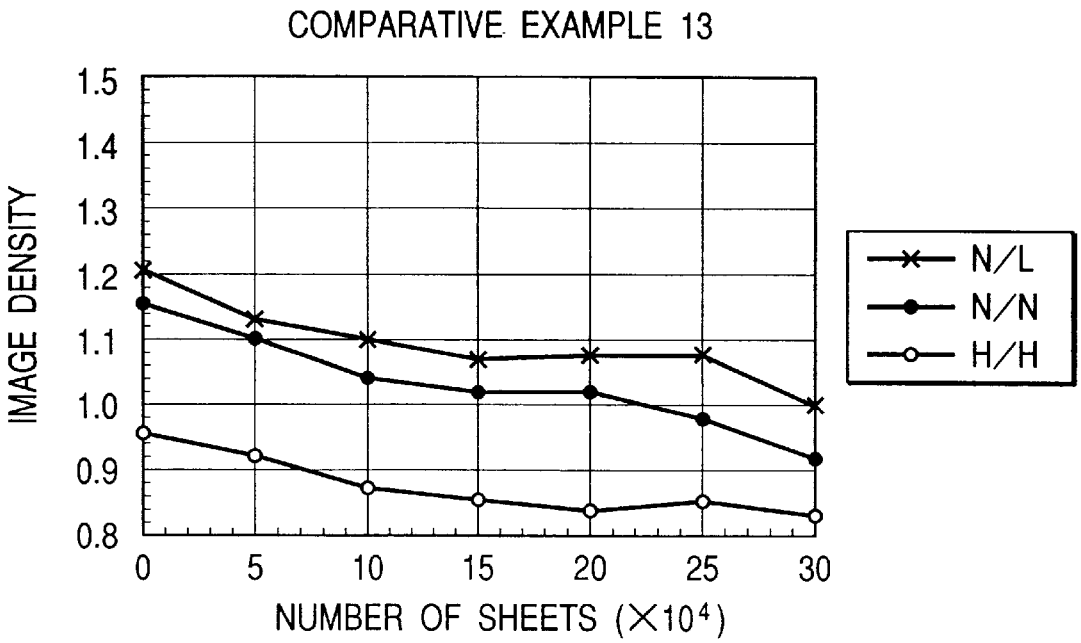
FIGS. 41A and 41B are graphs showing how image density and fog, respectively, undergo changes during running tests made in Comparative Example 13.
Figure 41B:
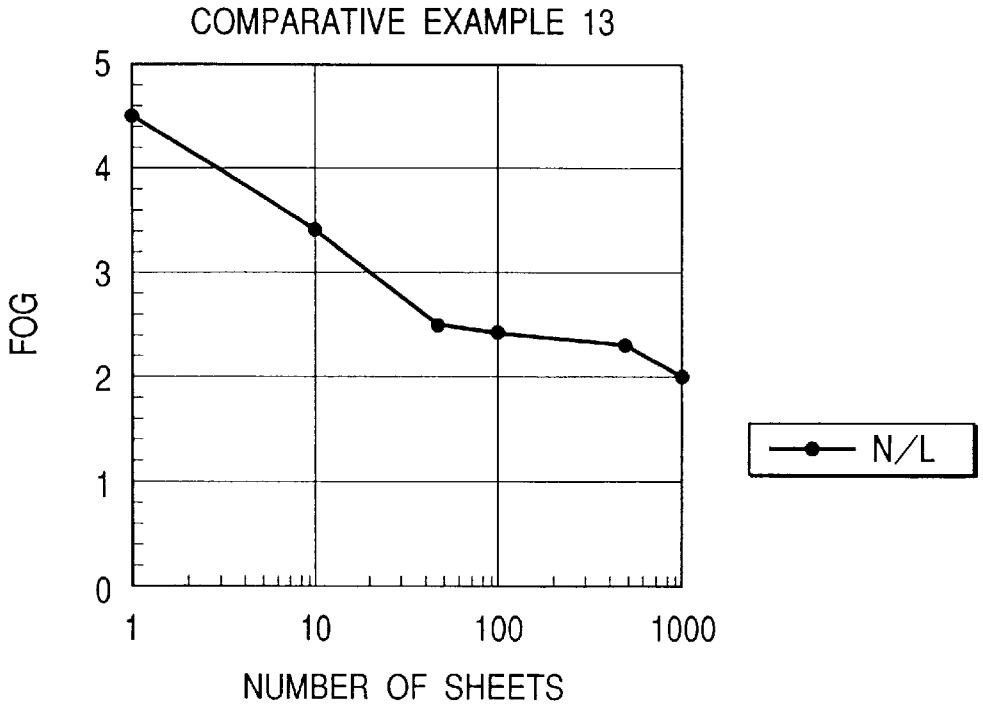

Using the developing sleeve 37 thus obtained, images were reproduced and evaluated in the same manner as in Example 13. As the result, as shown in Tables 6, 7 and 8 and FIGS. 41A and 41B, the result on fog was poor until image reproduction on 1,000 sheets, and the image density was poor from the beginning.

Comparative Example 14

A coating material resin composition was prepared in the same formulation and procedure as in Example 13 except that the copolymer of nylons composed chiefly of nylon 66 was replaced with a styrene-acrylate copolymer.

On the coating material type resin composition, its coating film volume resistivity was measured in the same manner as in Example 13 to find that it was 3.5×10 Ω·cm.

This resin composition was further coated on the same aluminum substrate as that used in Example 13, followed by heating and drying. Thus, developing sleeve 38 having a conductive resin coat layer on the surface was produced.

Figure 42A:
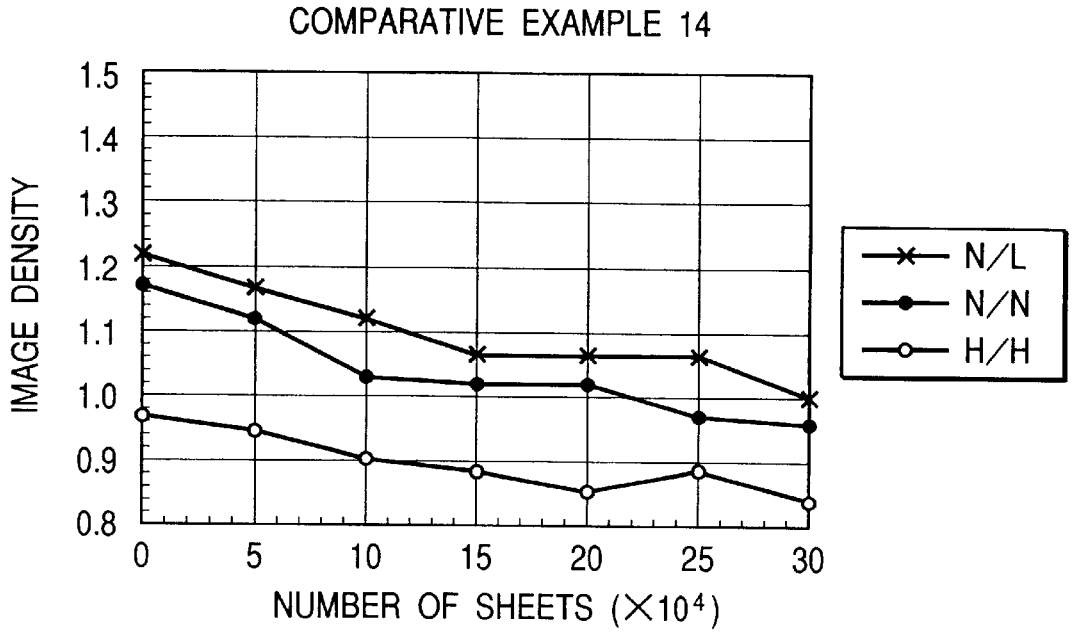
FIGS. 42A and 42B are graphs showing how image density and fog, respectively, undergo changes during running tests made in Comparative Example 14.
Figure 42B:
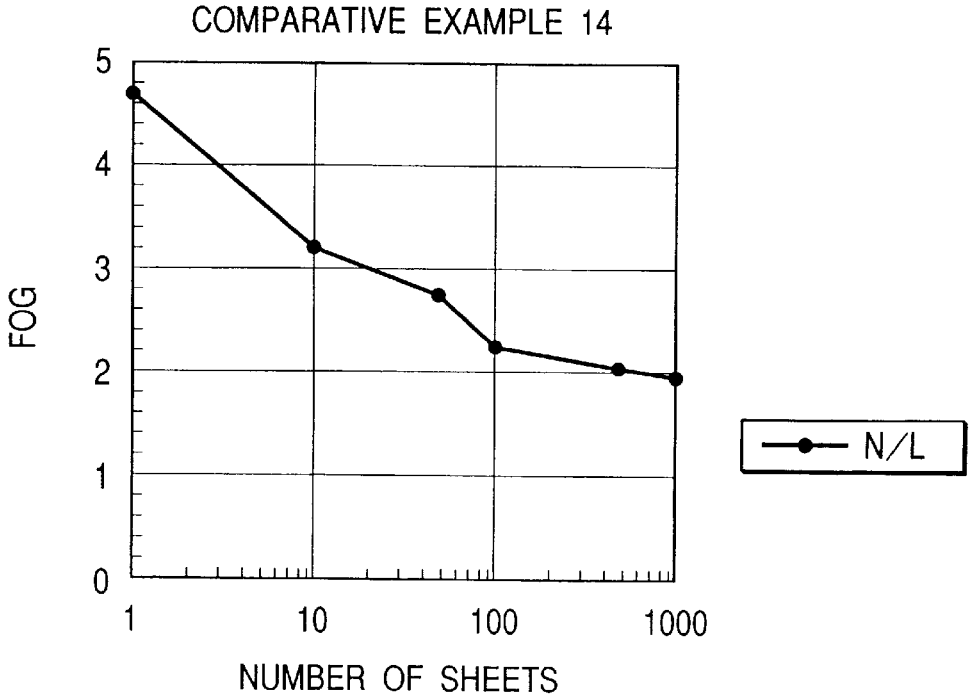

Using the developing sleeve 38 thus obtained, images were reproduced and evaluated in the same manner as in Example 13. As the result, as shown in Tables 6, 7 and 8 and FIGS. 42A and 42B, the result on fog was poor until image reproduction on 1,000 sheets, and the image density was poor from the beginning.

Example 25

Materials shown below were mixed, and then dispersed for 3 hours by means of a sand mill, using zirconia particles of 2 mm diameter as a packing material. Thereafter, the zirconia particles were separated by sieving, followed by addition of DMF (dimethylformamide) to adjust the solid content to 30%, thus a resin composition comprising urethane resin to which the quaternary ammonium salt compound positively chargeable for itself to iron powder has been added was obtained.

| | (by weight) |
|---|---|
| Carbon | 20 parts |
| Graphite | 80 parts |
| Urethane resin (solid content: 40%) | 625 parts |
| Quaternary ammonium salt compound represented by formula (1) below | 50 parts |
| DMF | 225 parts |

(1)

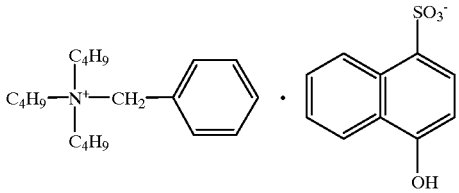

On the quaternary ammonium salt compound represented by the above formula (1), its polarity of triboelectricity to iron powder was measured by the blow-off process, using a commercially available triboelectric charge quantity measuring device (Model TB-200, manufactured by Toshiba Chemical Corporation) to find that it was positive polarity.

The resin composition thus obtained was in the form of a coating material, which was composed of C(carbon)/GF (graphite)/B(urethane resin)/P(quaternary ammonium salt compound)=0.2/0.8/2.5/0.5. The resin composition obtained was coated on an insulating sheet by means of a bar coater, followed by heating and hardening to form a coating film, which was then cut in a standard form, and its volume resistivity was measured with a low-resistivity meter loresta (manufactured by Mitsubishi Yuka Co.). As a result, the volume resistivity was found to be 1.9×10 Ω·cm.

Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 39 having a conductive resin coat layer on the surface was produced. Also, as to the developing sleeve resin coat layer from which carbon and graphite were removed, its polarity of triboelectricity to positive toner model particles was negative polarity.

The developing sleeve 39 thus obtained was set in a copying machine NP6035 (trade name), manufactured by CANON INC., and images were reproduced in three environments of normal temperature and normal humidity (N/N) of 24° C./65% RH, normal temperature and low humidity (N/L) of 24° C./10% RH and high temperature and high humidity (H/H) of 30° C./80% RH.

Here, as a developer used for the image reproduction, a developer was used which was obtained by a conventional method under the following formulation to form a positively chargeable toner having a weight-average particle diameter of 8.5 μm, having particles with diameters of 4.0 μm or smaller in a content of 10% by number and particles with diameters of 12.7 μm or larger in a content of 5.0% by volume, and to which 0.9% by weight of colloidal silica treated by coupling with trimethoxysilyl-γ-propylbenzylamine was further added externally as a positively chargeable external additive.

| | (by weight) |
|---|---|
| Styrene-acrylic resin (Tg: 56° C.) | 100 parts |
| Magnetite | 80 parts |
| Positive charge control agent (Copy Blue PR) | 2 parts |
| Low-molecular weight polypropylene | 4 parts |

- Evaluation -

Occurrence of blotchy images (caused by an uneven coat of the toner coat layer on the developer carrying member), occurrence of ghost and changes in density of 5 mm diameter images, during the image reproduction running were evaluated in the three environments of normal temperature and normal humidity (N/N), normal temperature and low humidity (N/L) and high temperature and high humidity (H/H), in the manner and ranking as shown below. With regard to reversal fog, evaluation was made in the environment of normal temperature and low humidity (N/L) in the manner and ranking as shown below.

(1) Blotchy Images

Solid black and halftone images formed by the image reproduction test were observed visually, and images formed after image reproduction on 1 sheet, 1,000 sheets and 100,000 sheets were evaluated according to the following ranks. As the result, as shown in Table 10, good results were obtained.

A: Excellent
B: Good
C: Average
D: Poor (2) Ghost

Halftone images of a ghost chart, formed by the image reproduction test were observed visually, and occurrence of ghost on images formed after image reproduction on 1 sheet, 1,000 sheets and 100,000 sheets was evaluated according to the following ranks. As the result, as shown in Table 11, good results were obtained.

A: Excellent
B: Good
C: Average
D: Poor (3) 5 mm Diameter Image Density

Figure 43A:
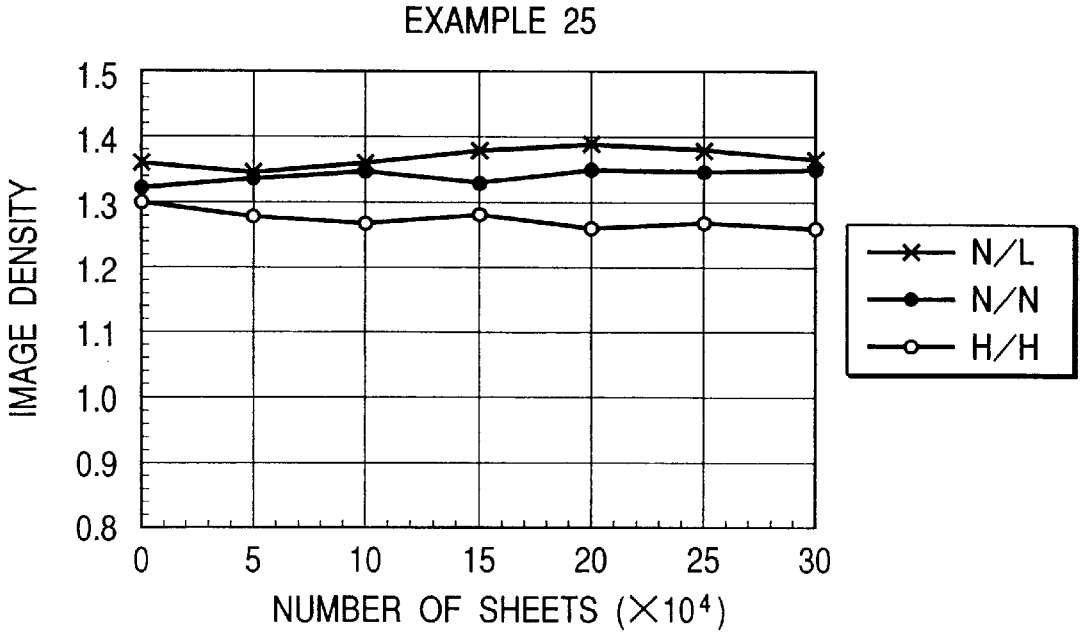
FIGS. 43A and 43B are graphs showing how image density and fog, respectively, undergo changes during running tests made in Example 25.

On 5 mm diameter images, image densities of solid black circles of 5 mm diameter formed after image reproduction on 1 sheet, 50,000 sheets, 100,000 sheets, 150,000 sheets, 200,000 sheets, 250,000 sheets and 300,000 sheets were measured with a reflection densitometer RD918 (manufactured by Macbeth Co.) to examine running performance from the viewpoint of image density. As the result, as shown in FIG. 43A, stable image density was attained also in long-term running.

(4) Reversal Fog

Figure 43B:
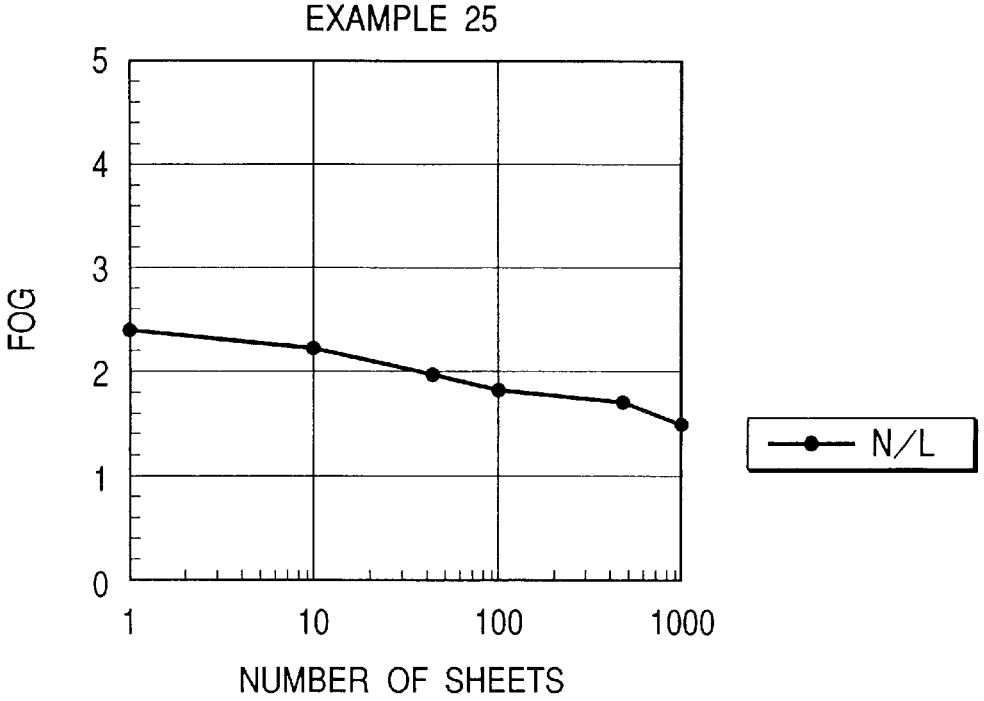

After image reproduction on 1 sheet, 10 sheets, 100 sheets and 1,000 sheets, reversal fog was examined. To examine the reversal fog, reflectance (D1) at solid white areas on a cardboard of 128 g/m$^2$ in basis weight on which images were formed by setting to the lowest density the density adjusting key on the main body of the copying machine was measured, and also reflectance (D2) on a virgin cardboard having the same cut size as the cardboard used in image formation. The value of D2−D1 was found at 5 points, and its average value was regarded as fog density. The reflectance was measured with TC-6 DS (manufactured by Tokyo Denshoku Co.). As the result, as shown in FIG. 43B, good results were obtained.

(5) Triboelectricity

Measurement of the value of triboelectricity by suction on the developer carrying member was made in the following way: Using a measuring container having a cylindrical filter paper, to which a suction tubing made of a metal and having an opening curved after the shape of the developer carrying member surface was attached, its suction pressure was so adjusted as to be able to suck up the developer layer on the developer carrying member surface in proper quantities and uniformly, immediately (preferably in 5 minutes) after image formation, thus the developer layer on the developer carrying member surface was sucked up. Quantity Q of electric charges of the developer sucked here was measured with a 616 digital electrometer (manufactured by Keithley Co.), and the mass M of this developer was also measured. The value of triboelectricity of the developer was calculated by Q/M (mC/kg). It was measured after image reproduction on 1,000 sheets. As the result, as shown in Table 5, good results were obtained.

(6) White Lines

Solid black and halftone images formed by the image reproduction test were observed visually, and images formed after image reproduction on 1 sheet, 1,000 sheets and 100,000 sheets were evaluated according to the following ranks. As the result, as shown in Table 12, good results were obtained.

A: Excellent
B: Good
C: Average
D: Poor

Example 26

A coating material type resin composition was obtained in the same formulation and procedure as in Example 25 except that the quaternary ammonium salt compound used therein, represented by the formula (1), was replaced with a quaternary ammonium salt compound represented by the following formula (2). On the quaternary ammonium salt compound represented by the above formula (2), its polarity of triboelectricity to iron powder was also measured by the blow-off process to find that it was positive polarity as in Example 25.

(2)

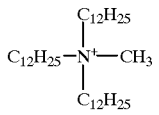

-continued

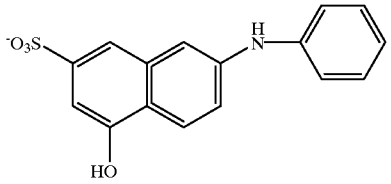

The resin composition thus obtained was composed of C/GF/B/P=0.2/0.8/2.5/0.5. On this coating material type resin composition, its coating film volume resistivity was measured in the same manner as in Example 25 to find that it was 2.2×10 Ω·cm. This resin composition was further coated on the same aluminum substrate as that used in Example 25, followed by heating and hardening. Thus, developing sleeve 40 having a conductive resin coat layer on the surface was produced.

Figure 44A:
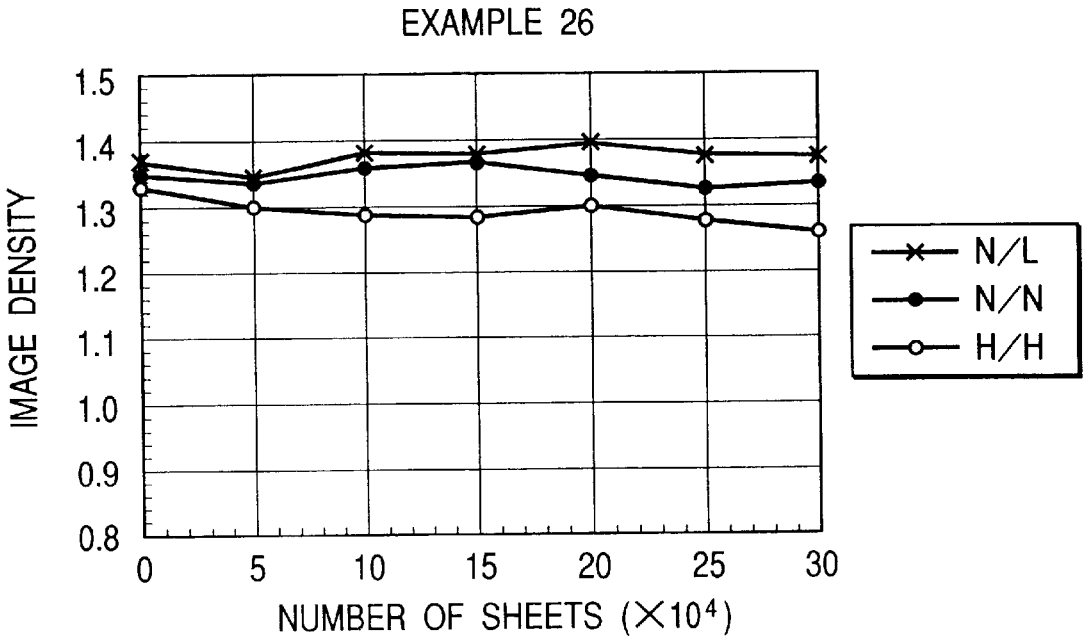
FIGS. 44A and 44B are graphs showing how image density and fog, respectively, undergo changes during running tests made in Example 26.
Figure 44B:
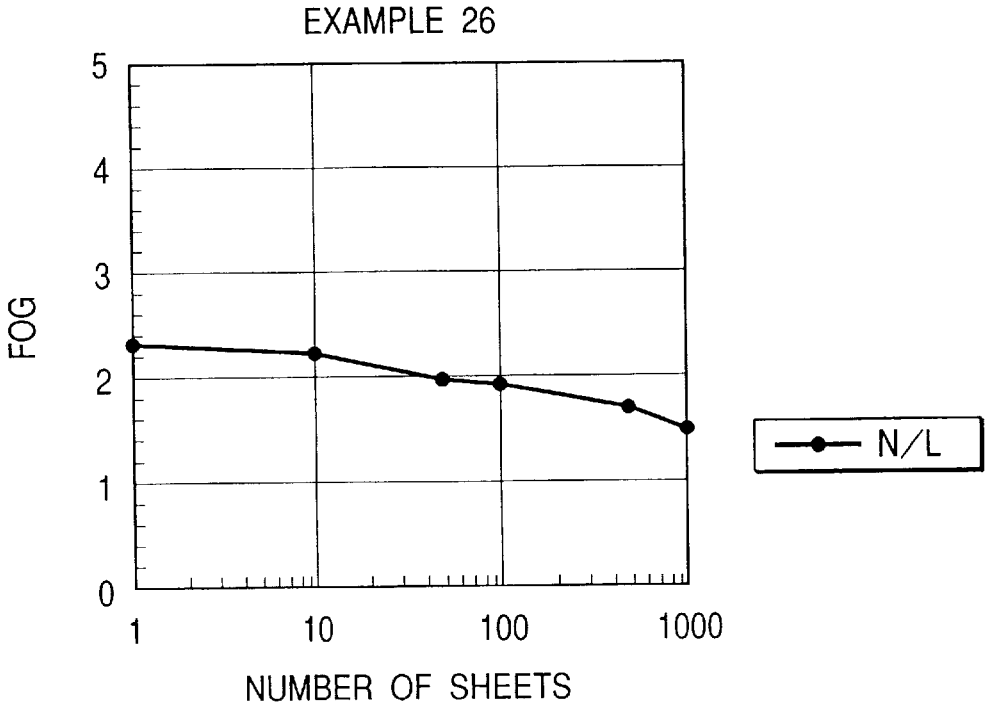

Then, using the developing sleeve 40 thus obtained, images were reproduced and evaluated in the same manner as in Example 25. As the result, as shown in Tables 10, 11 and 12 and FIGS. 44A and 44B, good results were obtained.

Example 27

A coating material type resin composition was obtained in the same formulation and procedure as in Example 25 except that the quaternary ammonium salt compound used therein, represented by the formula (1), was replaced with a quaternary ammonium salt compound represented by the following formula (3). On the quaternary ammonium salt compound represented by the above formula (3), its polarity of triboelectricity to iron powder was also measured by the blow-off process to find that it was positive polarity as in Example 25.

(3)

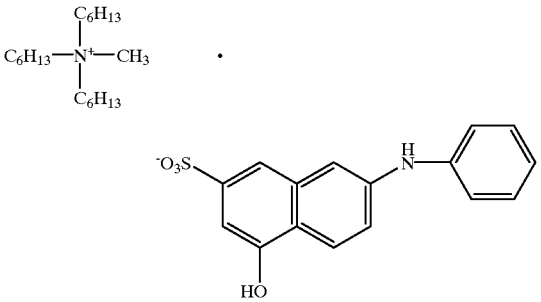

The resin composition thus obtained was composed of C/GF/B/P=0.2/0.8/2.5/0.5. On this coating material type resin composition, its coating film volume resistivity was measured in the same manner as in Example 25 to find that it was 2.5×10 Ω·cm. This resin composition was coated on the same aluminum substrate as that used in Example 25, followed by heating and hardening. Thus, developing sleeve 41 having a conductive resin coat layer on the surface was produced.

Figure 45A:
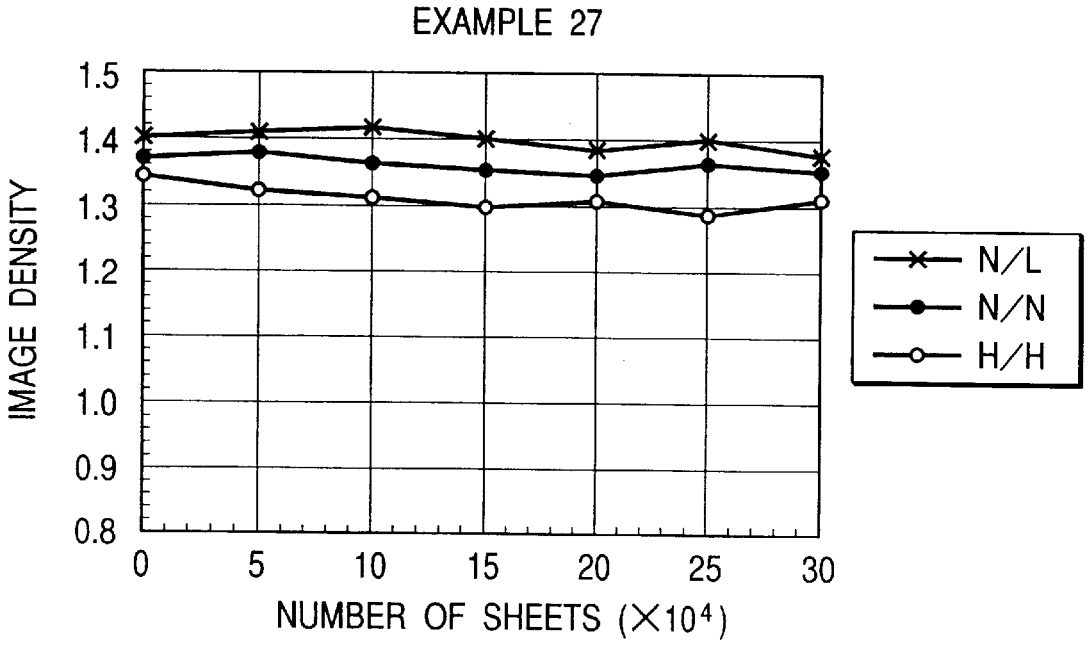
FIGS. 45A and 45B are graphs showing how image density and fog, respectively, undergo changes during running tests made in Example 27.
Figure 45B:
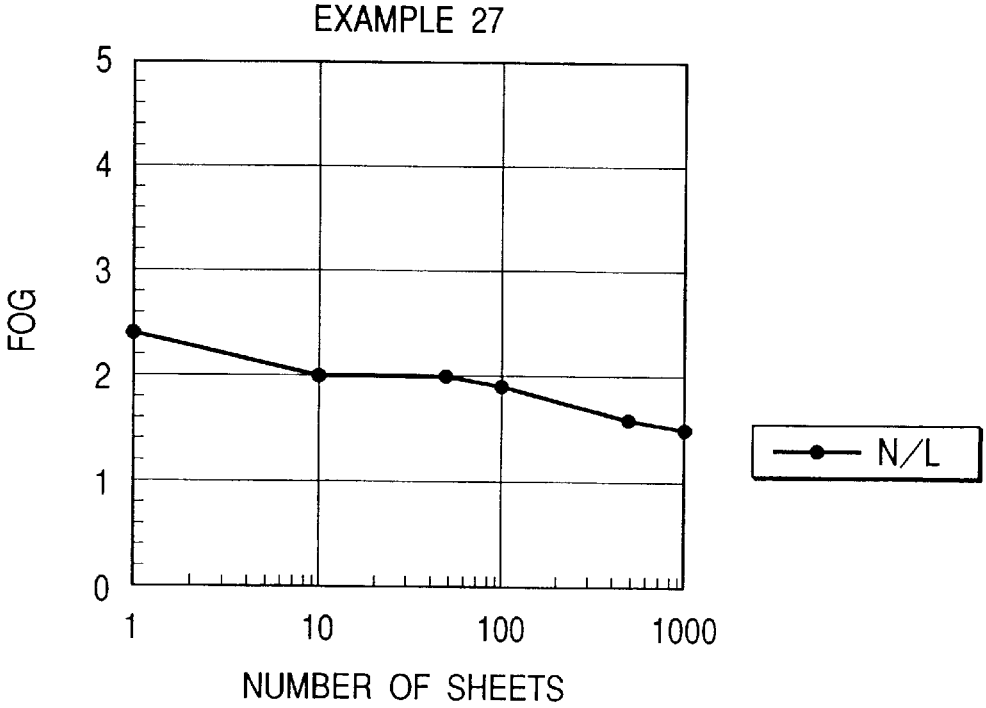

Then, using the developing sleeve 41 thus obtained, images were reproduced and evaluated in the same manner as in Example 25. As the result, as shown in Tables 10, 11 and 12 and FIGS. 45A and 45B, good results were obtained.

Example 28

A coating material type resin composition was obtained in the same formulation and procedure as in Example 25 except that the quaternary ammonium salt compound used therein, represented by the formula (1), was replaced with a quaternary ammonium salt compound represented by the following formula (4). On the quaternary ammonium salt compound represented by the above formula (4), its polarity of triboelectricity to iron powder was also measured by the blow-off process to find that it was positive polarity as in Example 25.

(4)

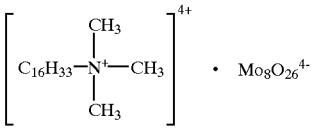

The resin composition thus obtained was composed of C/GF/B/P=0.2/0.8/2.5/0.5. On this coating material type resin composition, its coating film volume resistivity was measured in the same manner as in Example 25 to find that it was 3.1×10 Ω·cm. This resin composition was coated on the same aluminum substrate as that used in Example 25, followed by heating and hardening. Thus, developing sleeve 42 having a conductive resin coat layer on the surface was produced.

Figure 46A:
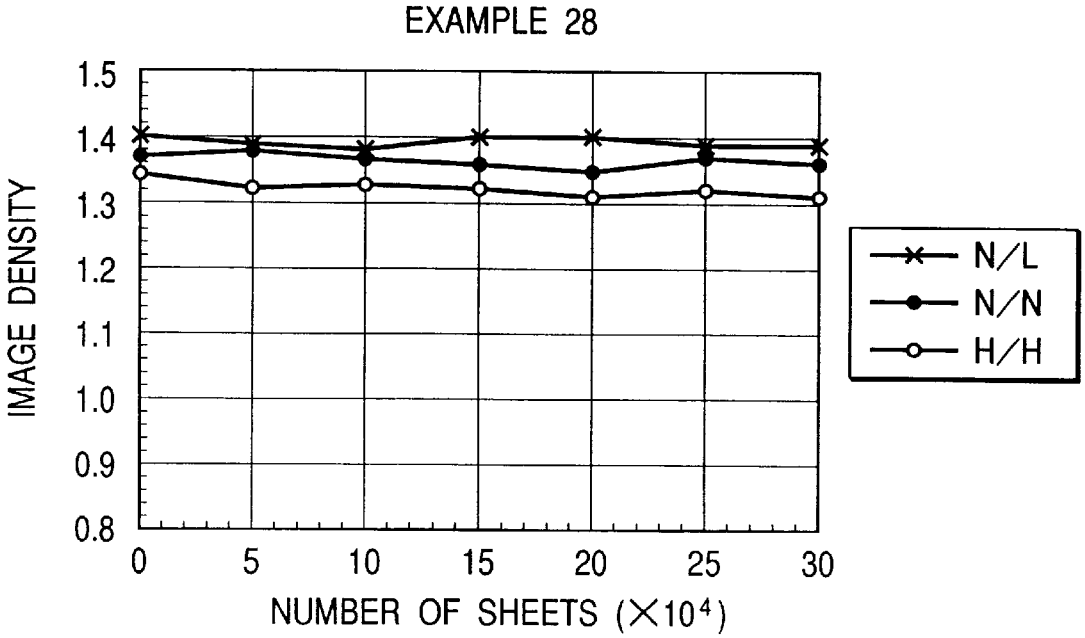
FIGS. 46A and 46B are graphs showing how image density and fog, respectively, undergo changes during running tests made in Example 28.
Figure 46B:
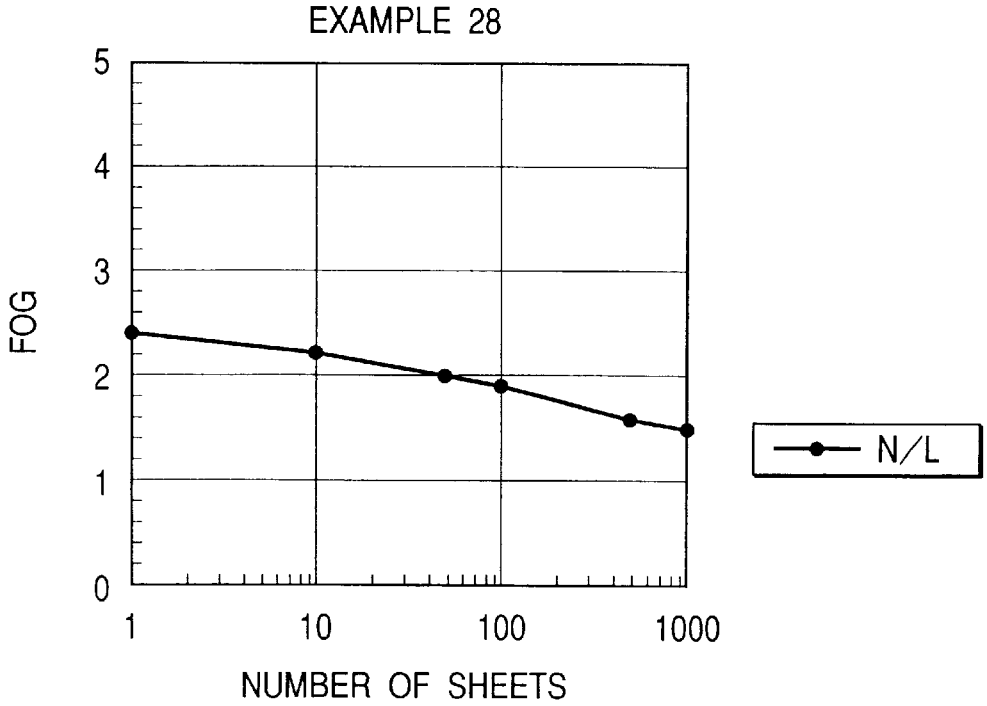

Then, using the developing sleeve 42 thus obtained, images were reproduced and evaluated in the same manner as in Example 25. As the result, as shown in Tables 10, 11 and 12 and FIGS. 46A and 46B, good results were obtained.

Example 29

Materials shown below were mixed, and then dispersed for 3 hours by means of a sand mill, using zirconia particles of 2 mm diameter as a packing material. Thereafter, the zirconia particles were separated by sieving, followed by addition of DMF to adjust the solid content to 30%, thus a resin composition comprising urethane resin to which the quaternary ammonium salt compound positively chargeable for itself to iron powder has been added was obtained.

| | (by weight) |
|---|---|
| Carbon | 40 parts |
| Boron nitride | 160 parts |
| Urethane resin (solid content: 40%) | 625 parts |

-continued

| | (by weight) |
|---|---|
| Quaternary ammonium salt compound represented by formula (1) below | 50 parts |
| DMF | 250 parts |

(1)

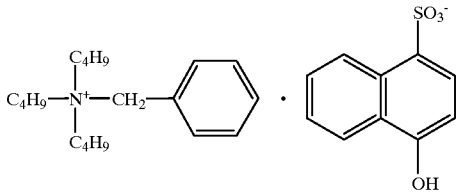

The resin composition thus obtained was in the form of a coating material, which was composed of C(carbon)/BN (boron nitride)/B(urethane resin)/P(quaternary ammonium salt compound)=0.4/1.6/2.5/0.5. This coating material was coated on an insulating sheet by means of a bar coater, followed by heating and hardening to form a coating film, which was then cut in a standard form, and its volume resistivity was measured with a low-resistivity meter loresta (manufactured by Mitsubishi Yuka Co.). As a result, the volume resistivity was found to be $6.0\times10^2$ Ω·cm.

Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 43 having a conductive resin coat layer on the surface was produced.

Figure 47A:
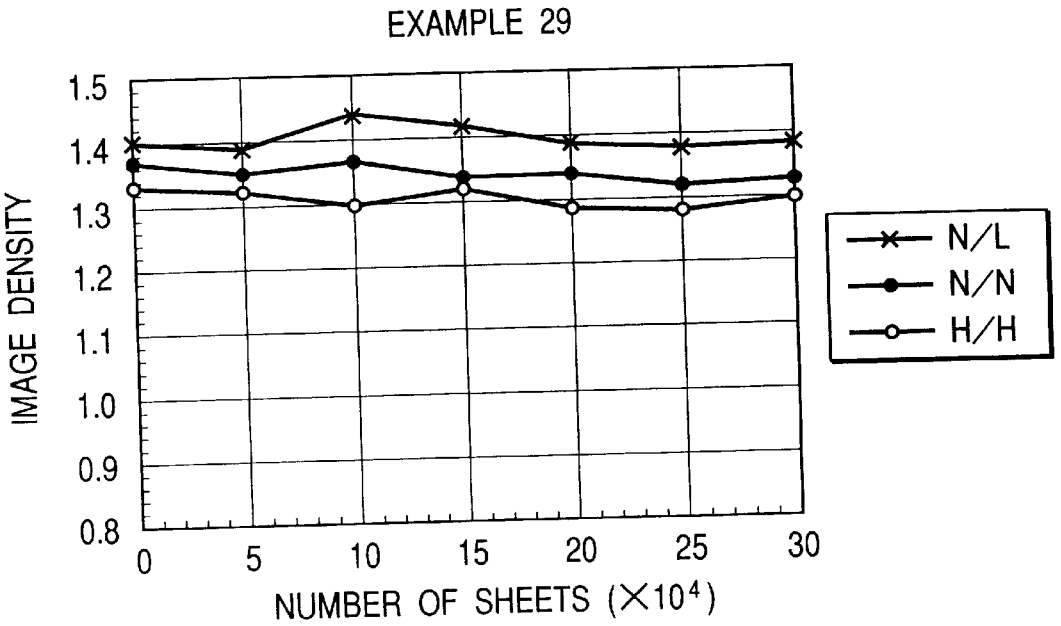
FIGS. 47A and 47B are graphs showing how image density and fog, respectively, undergo changes during running tests made in Example 29.
Figure 47B:
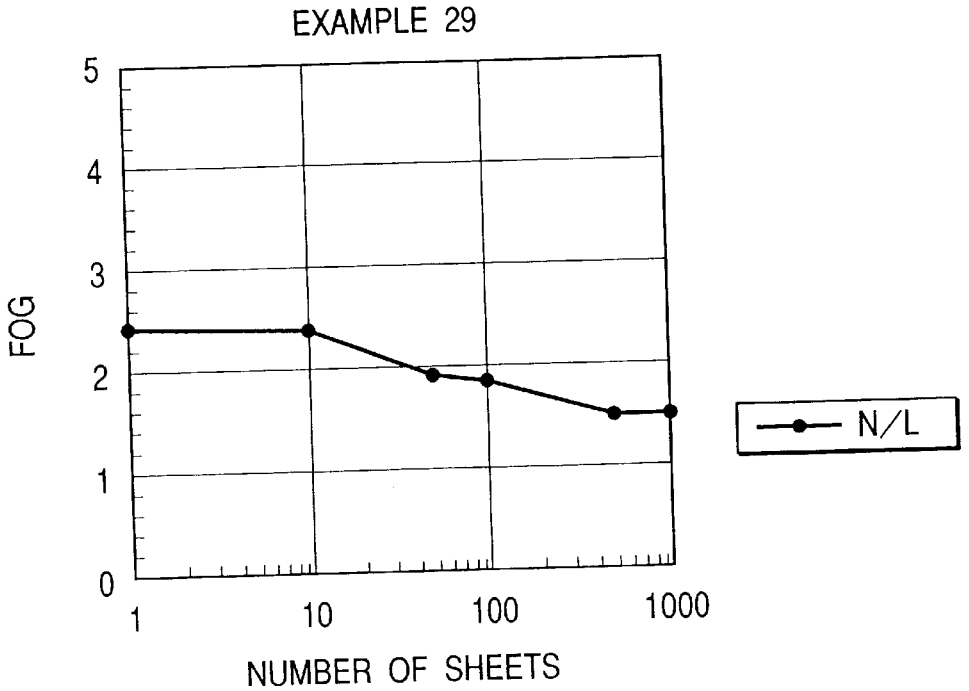

Then, using the developing sleeve 43 thus obtained, images were reproduced and evaluated in the same manner as in Example 25. As the result, as shown in Tables 10, 11 and 12 and FIGS. 47A and 47B, good results were obtained.

Example 30

A coating material type resin composition was obtained in the same formulation and procedure as in Example 29 except that the quaternary ammonium salt compound used therein, represented by the formula (1), was replaced with the quaternary ammonium salt compound positively chargeable to iron powder as used in Example 26, represented by the formula (2).

The resin composition thus obtained was composed of C/BN/B/P=0.4/1.6/2.5/0.5. On this coating material type resin composition, its coating film volume resistivity was measured in the same manner as in Example 25 to find that it was $7.1\times10^2$ Ω·cm. This resin composition was further coated on the same aluminum substrate as that used in Example 29, followed by heating and hardening. Thus, developing sleeve 44 having a conductive resin coat layer on the surface was produced.

Figure 48A:
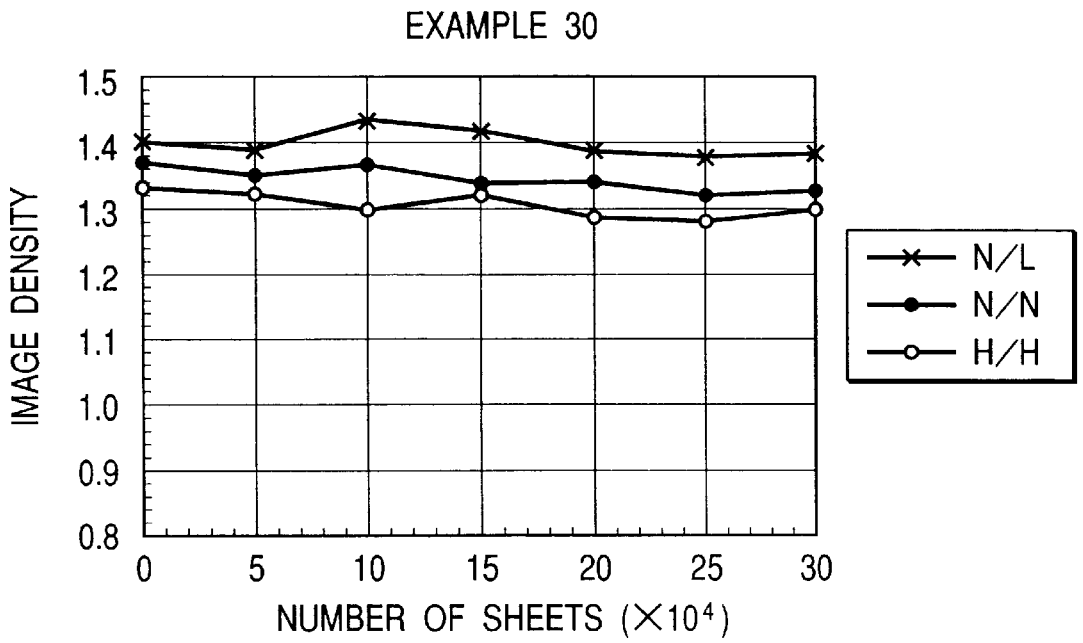
FIGS. 48A and 48B are graphs showing how image density and fog, respectively, undergo changes during running tests made in Example 30.
Figure 48B:
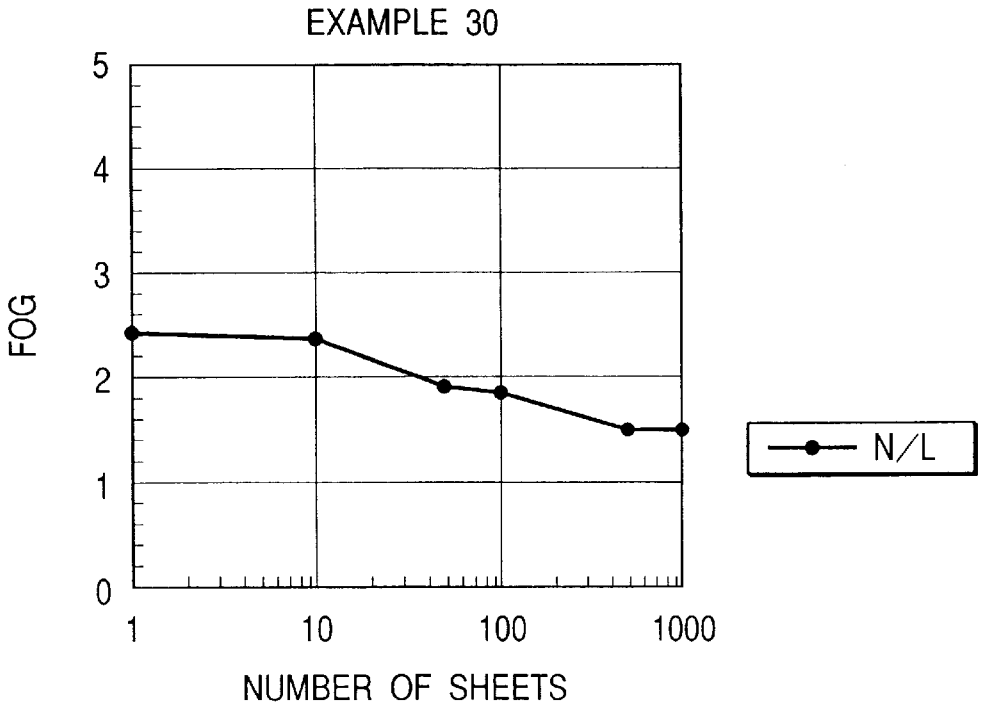

Then, using the developing sleeve 44 thus obtained, images were reproduced and evaluated in the same manner as in Example 25. As the result, as shown in Tables 10, 11 and 12 and FIGS. 48A and 48B, good results were obtained.

Example 31

A coating material type resin composition was obtained in the same formulation and procedure as in Example 29 except that the quaternary ammonium salt compound used therein, represented by the formula (1), was replaced with the quaternary ammonium salt compound used in Example 27, represented by the formula (3).

The resin composition thus obtained was composed of C/BN/B/P=0.4/1.6/2.5/0.5. On this coating material type resin composition, its coating film volume resistivity was measured in the same manner as in Example 25 to find that it was $5.9\times10^2$ Ω·cm. This resin composition was further coated on the same aluminum substrate as that used in Example 29, followed by heating and hardening. Thus, developing sleeve 45 having a conductive resin coat layer on the surface was produced.

Figure 49A:
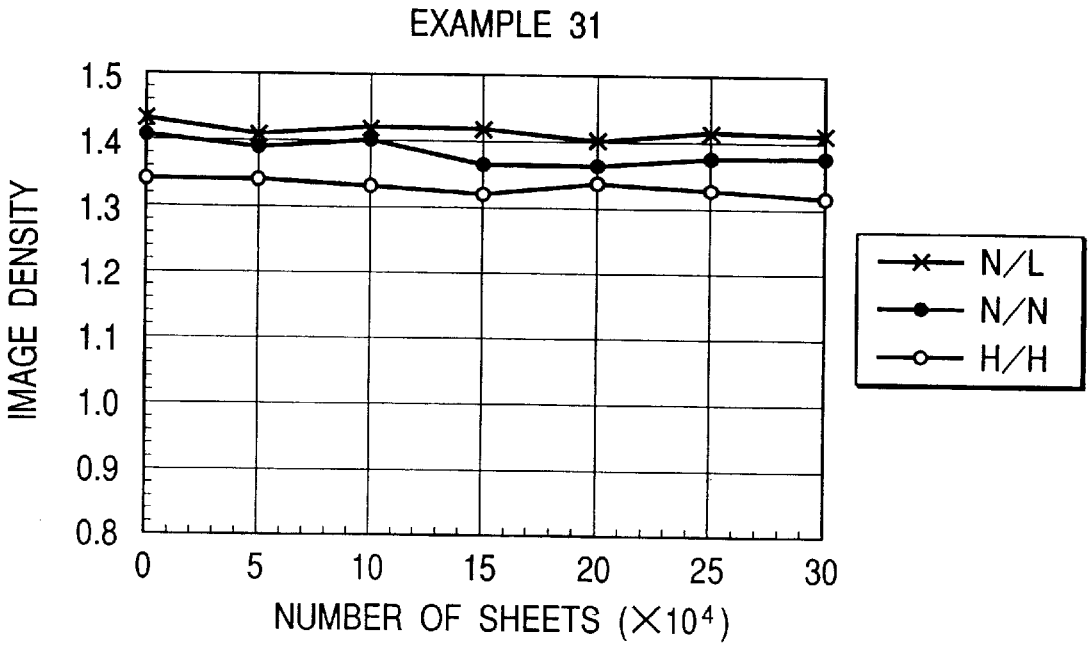
FIGS. 49A and 49B are graphs showing how image density and fog, respectively, undergo changes during running tests made in Example 31.
Figure 49B:
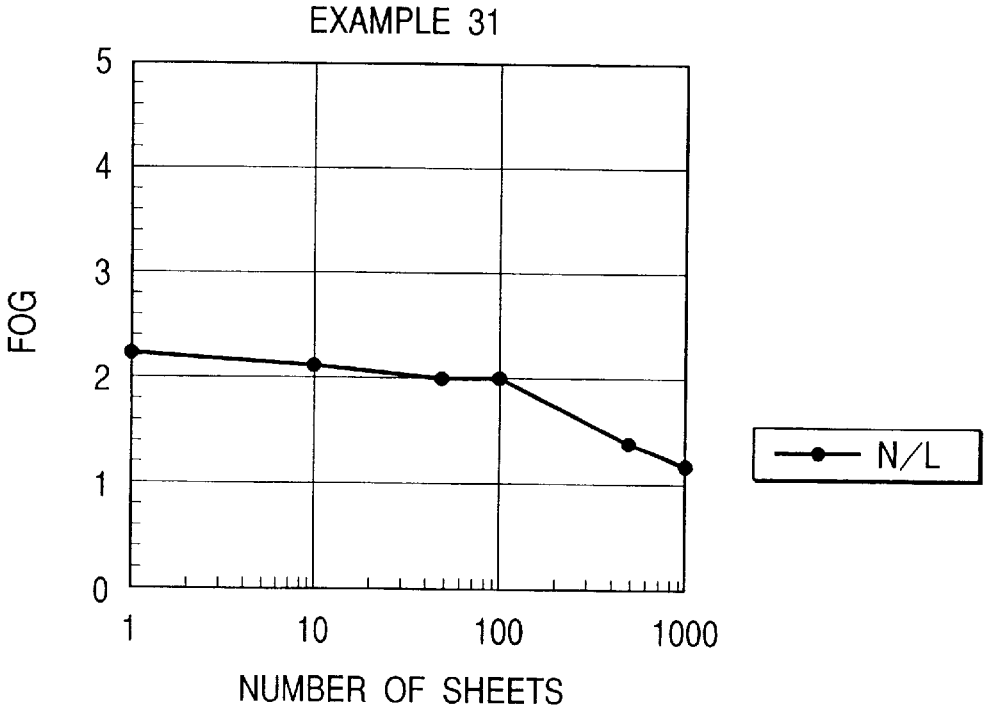

Then, using the developing sleeve 45 thus obtained, images were reproduced and evaluated in the same manner as in Example 25. As the result, as shown in Tables 10, 11 and 12 and FIGS. 49A and 49B, good results were obtained.

Example 32

A coating material type resin composition was obtained in the same formulation and procedure as in Example 29 except that the quaternary ammonium salt compound used therein, represented by the formula (1), was replaced with the quaternary ammonium salt compound used in Example 28, represented by the formula (4).

The resin composition thus obtained was composed of C/BN/B/P=0.4/1.6/2.5/0.5. On this coating material type resin composition, its coating film volume resistivity was measured in the same manner as in Example 25 to find that it was $9.7\times10^2$ Ω·cm. This resin composition was coated on the same aluminum substrate as that used in Example 29, followed by heating and hardening. Thus, developing sleeve 46 having a conductive resin coat layer on the surface was produced.

Figure 50A:
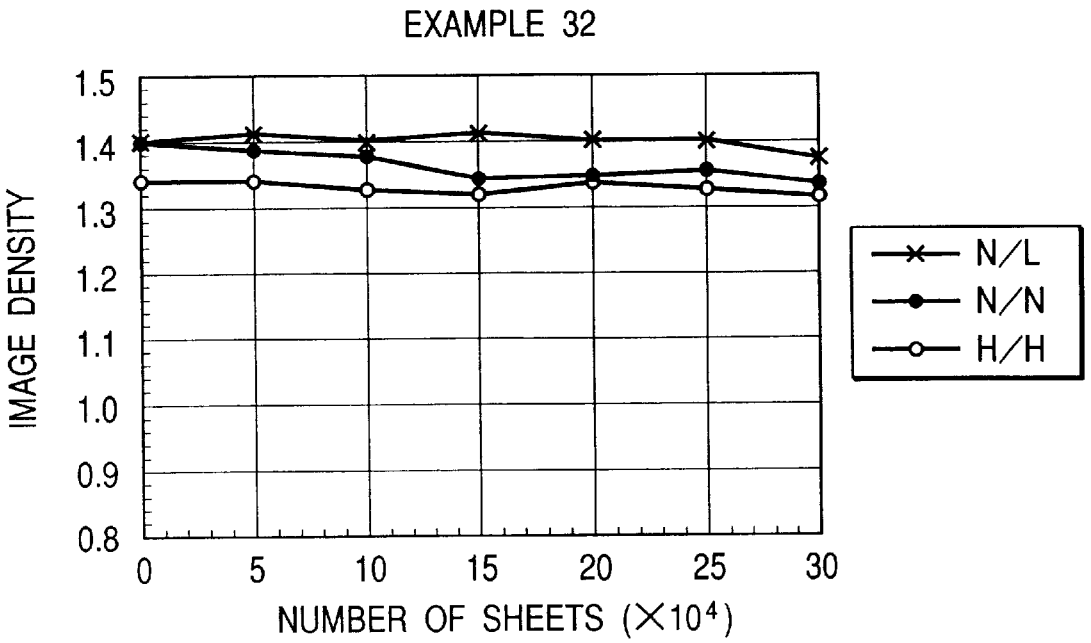
FIGS. 50A and 50B are graphs showing how image density and fog, respectively, undergo changes during running tests made in Example 32.
Figure 50B:
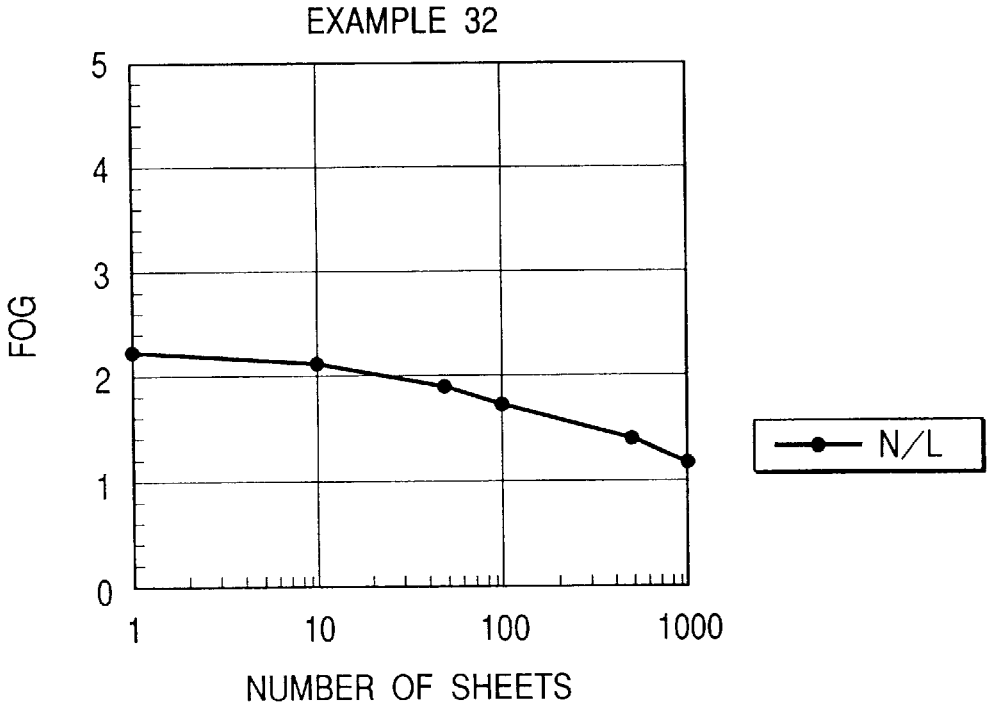

Then, using the developing sleeve 46 thus obtained, images were reproduced and evaluated in the same manner as in Example 25. As the result, as shown in Tables 10, 11 and 12 and FIGS. 50A and 50B, good results were obtained.

Example 33

Materials shown below were mixed, and then dispersed for 3 hours by means of a sand mill, using zirconia particles of 2 mm diameter as a packing material. Thereafter, the zirconia particles were separated by sieving, followed by addition of DMF to adjust the solid content to 30%, thus a resin composition comprising urethane resin to which the quaternary ammonium salt compound positively chargeable for itself to iron powder has been added was obtained.

| | (by weight) |
|---|---|
| Carbon | 20 parts |
| Molybdenum disulfide | 160 parts |
| Urethane resin (solid content: 40%) | 625 parts |
| Quaternary ammonium salt compound represented by formula (1) below | 50 parts |
| DMF | 220 parts |

(1)

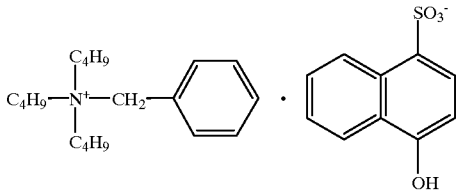

The resin composition thus obtained was in the form of a coating material, which was composed of C(carbon)/$MoS_2$ (molybdenum disulfide)/B(urethane resin)/P(quaternary ammonium salt compound)=0.2/1.6/2.5/0.5. This coating material was coated on an insulating sheet by means of a bar coater, followed by heating and hardening to form a coating film, which was then cut in a standard form, and its volume resistivity was measured with a low-resistivity meter loresta (manufactured by Mitsubishi Yuka Co.). As a result, the volume resistivity was found to be 9.2×10 Ω·cm.

Next, this resin composition was coated by spraying on a cylindrical member of 20 mm diameter made of aluminum, to form a coat layer of 10 μm thick, followed by heating and hardening at 150° C. for 30 minutes by means of a hot-air dryer. Thus, developing sleeve 47 having a conductive resin coat layer on the surface was produced.

Figure 51A:
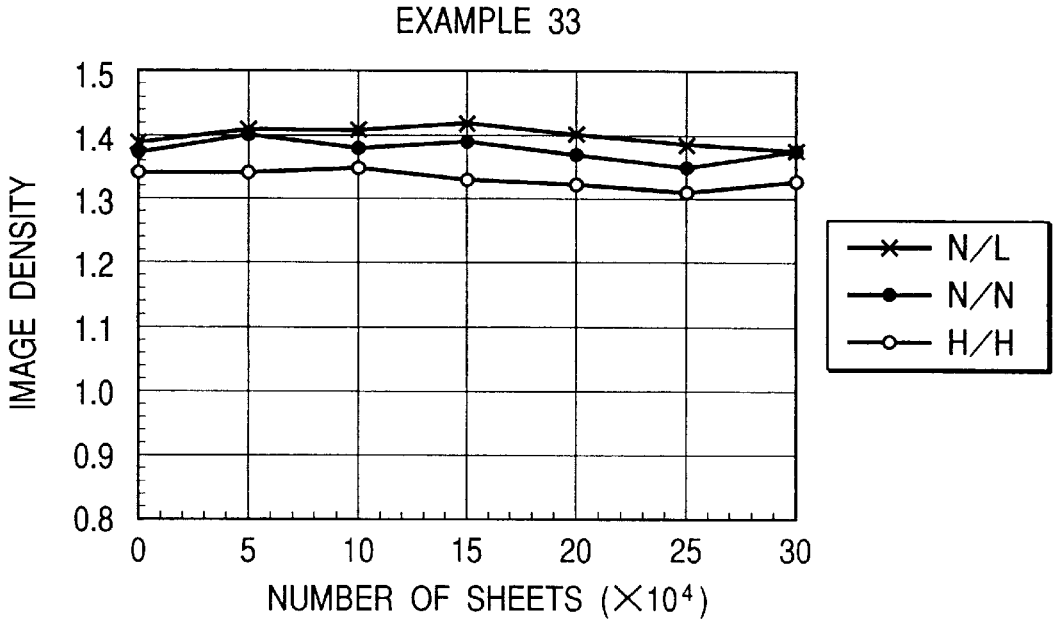
FIGS. 51A and 51B are graphs showing how image density and fog, respectively, undergo changes during running tests made in Example 33.
Figure 51B:
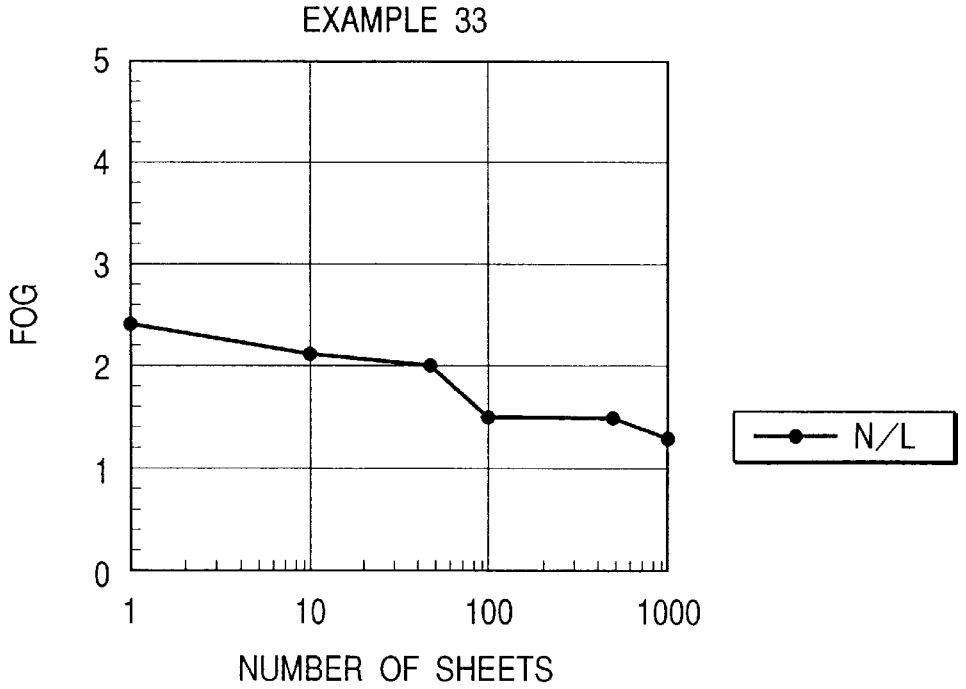

Then, using the developing sleeve 47 thus obtained, images were reproduced and evaluated in the same manner as in Example 25. As the result, as shown in Tables 10, 11 and 12 and FIGS. 51A and 51B, good results were obtained.

Example 34

A coating material type resin composition was obtained in the same formulation and procedure as in Example 33 except that the quaternary ammonium salt compound used therein, represented by the formula (1), was replaced with the quaternary ammonium salt compound positively chargeable to iron powder as used in Example 26, represented by the formula (4).

The resin composition thus obtained was composed of C/$MOS_2$/B/P=0.2/1.6/2.5/0.5. On this coating material type resin composition, its coating film volume resistivity was measured in the same manner as in Example 25 to find that it was 9.9×10 Ω·cm. This resin composition was further coated on the same aluminum substrate as that used in Example 33, followed by heating and hardening. Thus, developing sleeve 48 having a conductive resin coat layer on the surface was produced.

Figure 52A:
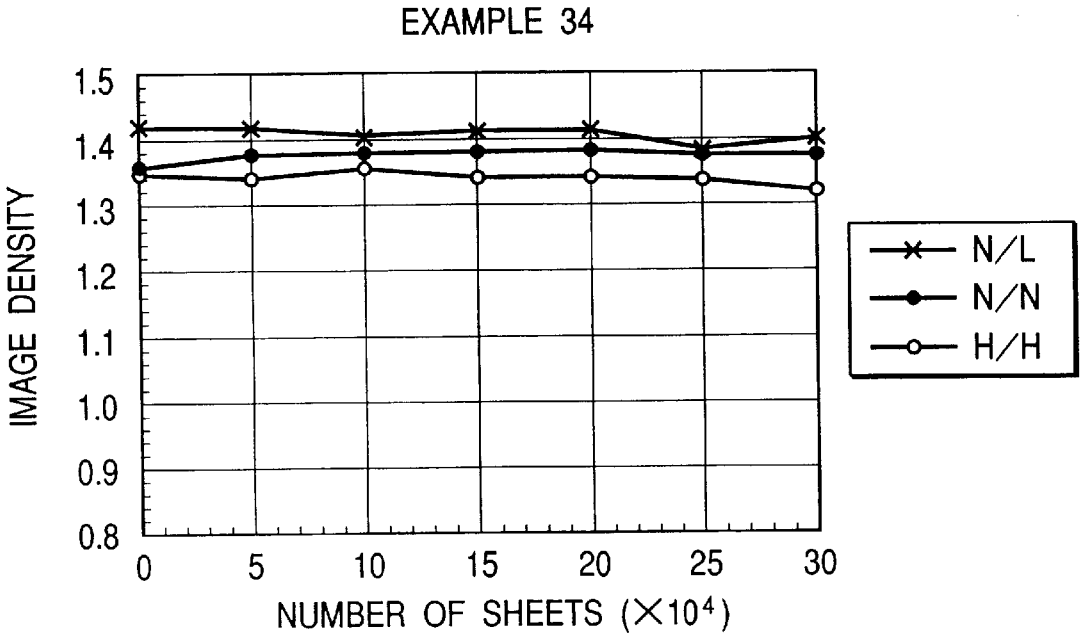
FIGS. 52A and 52B are graphs showing how image density and fog, respectively, undergo changes during running tests made in Example 34.
Figure 52B:
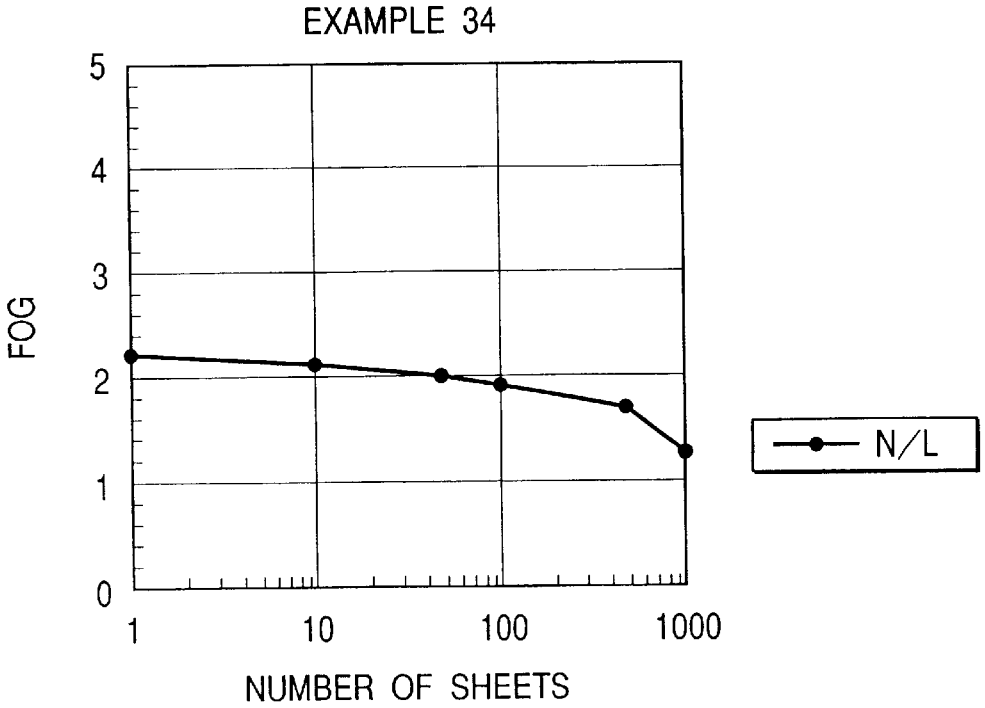

Then, using the developing sleeve 48 thus obtained, images were reproduced and evaluated in the same manner as in Example 25. As the result, as shown in Tables 10, 11 and 12 and FIGS. 52A and 52B, good results were obtained.

Example 35

A coating material type resin composition was obtained in the same formulation and procedure as in Example 33 except that the quaternary ammonium salt compound used therein, represented by the formula (1), was replaced with the quaternary ammonium salt compound positively chargeable to iron powder as used in Example 27, represented by the formula (3).

The resin composition thus obtained was composed of C/$MOS_2$/B/P=0.2/1.6/2.5/0.5. On this coating material type resin composition, its coating film volume resistivity was measured in the same manner as in Example 25 to find that it was 8.9×10 Ω·cm. This resin composition was further coated on the same aluminum substrate as that used in Example 33, followed by heating and hardening. Thus, developing sleeve 49 having a conductive resin coat layer on the surface was produced.

Figure 53A:
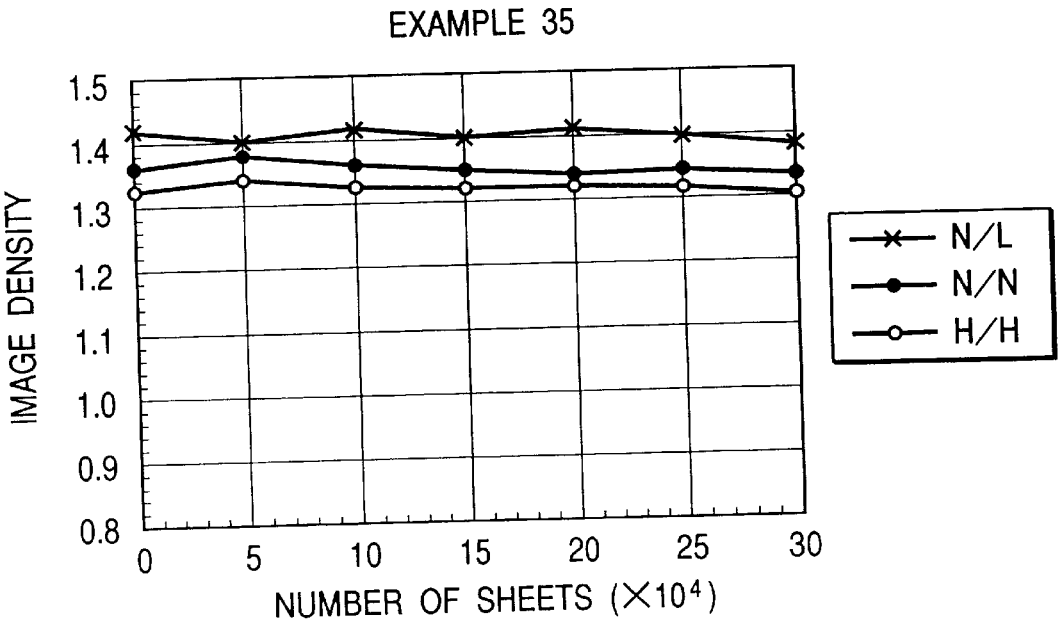
FIGS. 53A and 53B are graphs showing how image density and fog, respectively, undergo changes during running tests made in Example 35.
Figure 53B:
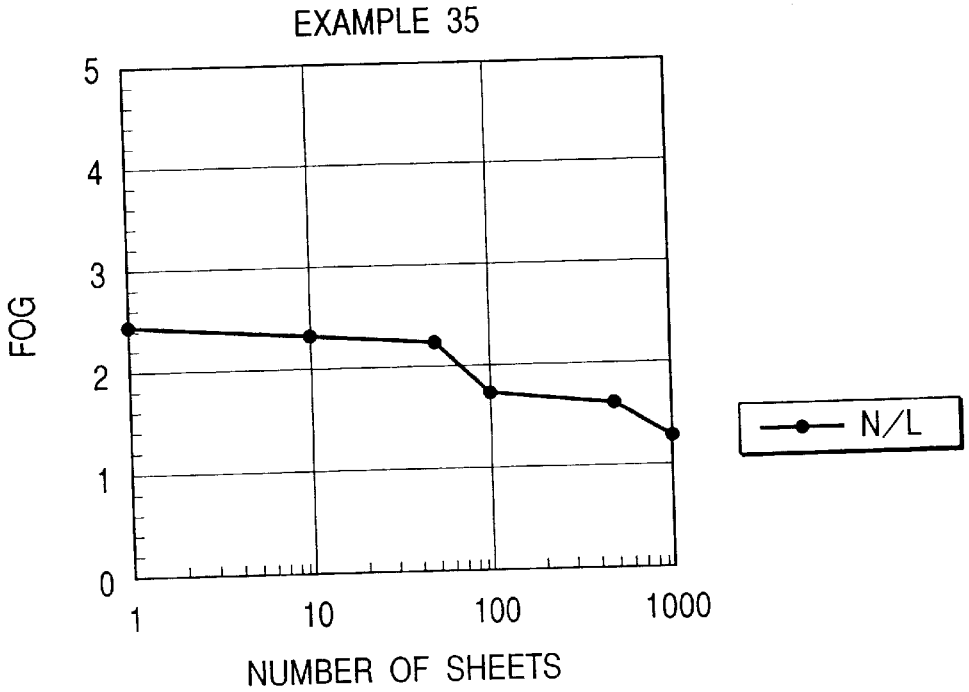

Then, using the developing sleeve 49 thus obtained, images were reproduced and evaluated in the same manner as in Example 25. As the result, as shown in Tables 10, 11 and 12 and FIGS. 53A and 53B, good results were obtained.

Example 36

A coating material type resin composition was obtained in the same formulation and procedure as in Example 33 except that the quaternary ammonium salt compound used therein, represented by the formula (1), was replaced with the quaternary ammonium salt compound positively chargeable to iron powder as used in Example 28, represented by the formula (4).

The resin composition thus obtained was composed of C/$MoS_2$/B/P=0.2/1.6/2.5/0.5. On this coating material type resin composition, its coating film volume resistivity was measured in the same manner as in Example 25 to find that it was 8.8×10 Ω·cm. This resin composition was further coated on the same aluminum substrate as that used in Example 33, followed by heating and hardening. Thus, developing sleeve 50 having a conductive resin coat layer on the surface was produced.

Figure 54A:
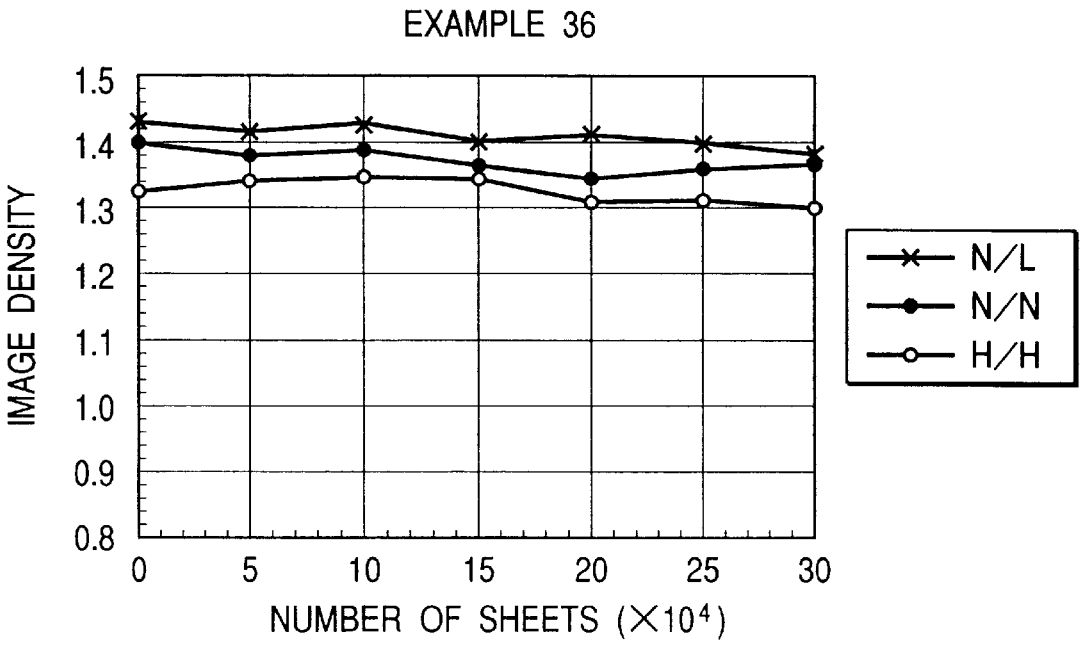
FIGS. 54A and 54B are graphs showing how image density and fog, respectively, undergo changes during running tests made in Example 36.
Figure 54B:
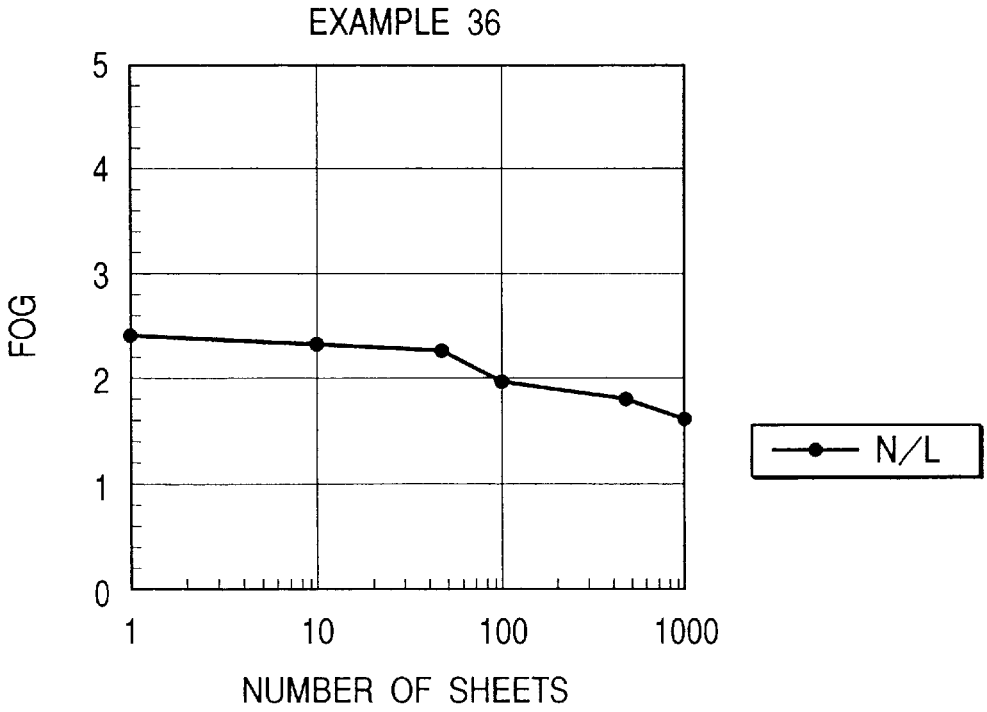

Then, using the developing sleeve 50 thus obtained, images were reproduced and evaluated in the same manner as in Example 25. As the result, as shown in Tables 10, 11 and 12 and FIGS. 54A and 54B, good results were obtained.

Comparative Example 15

The surface of the same cylindrical member of 20 mm diameter made of aluminum as that used in Example 25 was only treated by sand blasting with FGB #300. This was used as a developing sleeve 51.

Using this developing sleeve, images were reproduced and evaluated in the same manner as in Example 25. As the result, as shown in Tables 10 and 11, blotchy images occurred, and it was impossible to make image evaluation on the items other than this.

Comparative Example 16

A resin composition was obtained in the same manner as in Example 25 except that it was prepared in the following formulation. The resin composition thus obtained was in the form of a coating material, which was composed of C/GF/B/P=0.2/0.8/2.5/0

| | (by weight) |
|---|---|
| Carbon | 20 parts |
| Graphite | 80 parts |
| Urethane resin (solid content: 40%) | 625 parts |
| DMF | 150 parts |

On this coating material type resin composition, its coating film volume resistivity was measured in the same manner as in Example 25 to find that it was 7.2 Ω·cm. This resin composition was further coated on the same aluminum substrate as that used in Example 25, followed by heating and hardening. Thus, developing sleeve 52 having a conductive resin coat layer on the surface was produced.

Figure 55A:
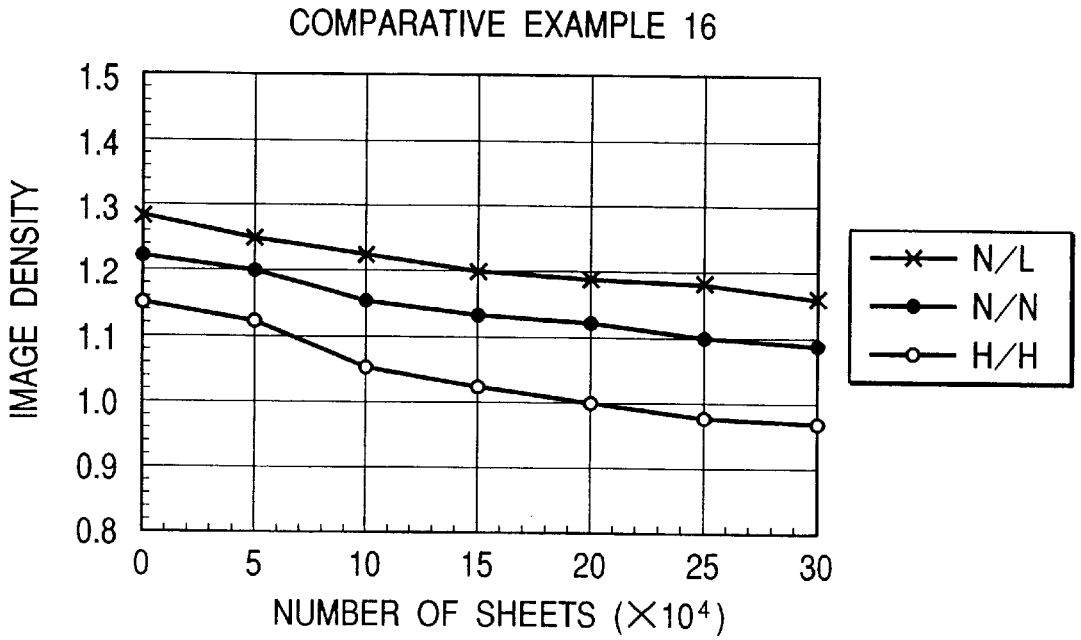
FIGS. 55A and 55B are graphs showing how image density and fog, respectively, undergo changes during running tests made in Comparative Example 16.
Figure 55B:
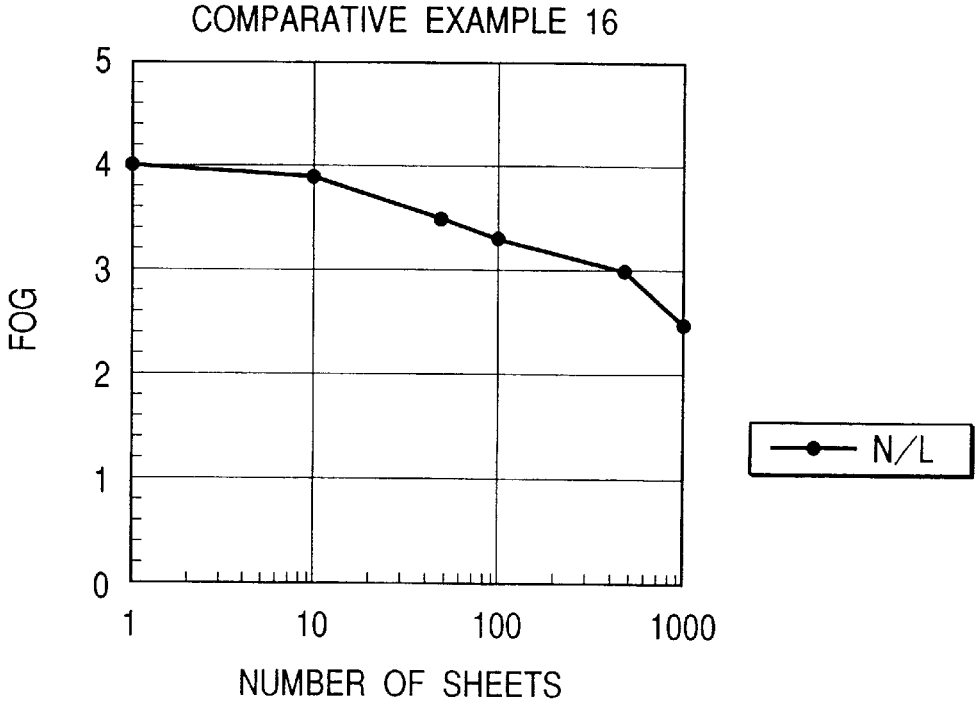

Then, using the developing sleeve 52 thus obtained, images were reproduced and evaluated in the same manner as in Example 25. As the result, as shown in Tables 10, 11 and 12 and FIGS. 55A and 55B, the result on fog was poor even after image reproduction on 1,000 sheets, and a decrease in image density was seen during running.

Comparative Example 17

A coating material resin composition was prepared in the same formulation and procedure as in Example 25 except that the quaternary ammonium salt compound used therein, represented by the formula (1), was replaced with a chromium complex (S) of azonaphthol containing chlorophenol. The resin composition thus obtained was composed of C/GF/B/S=0.2/0.8/2.5/0.5. Here, on this chromium complex (S) of azonaphthol containing chlorophenol, its polarity of triboelectricity to iron powder was measured by the blow-off process in the same manner as in Example 25 to find that it was negative polarity.

On the coating material type resin composition, its coating film volume resistivity was measured in the same manner as in Example 25 to find that it was 4.2×10 Ω·cm. This resin composition was coated on the same aluminum substrate as that used in Example 25, followed by heating and hardening. Thus, developing sleeve 53 having a conductive resin coat layer on the surface was produced.

Figure 56A:
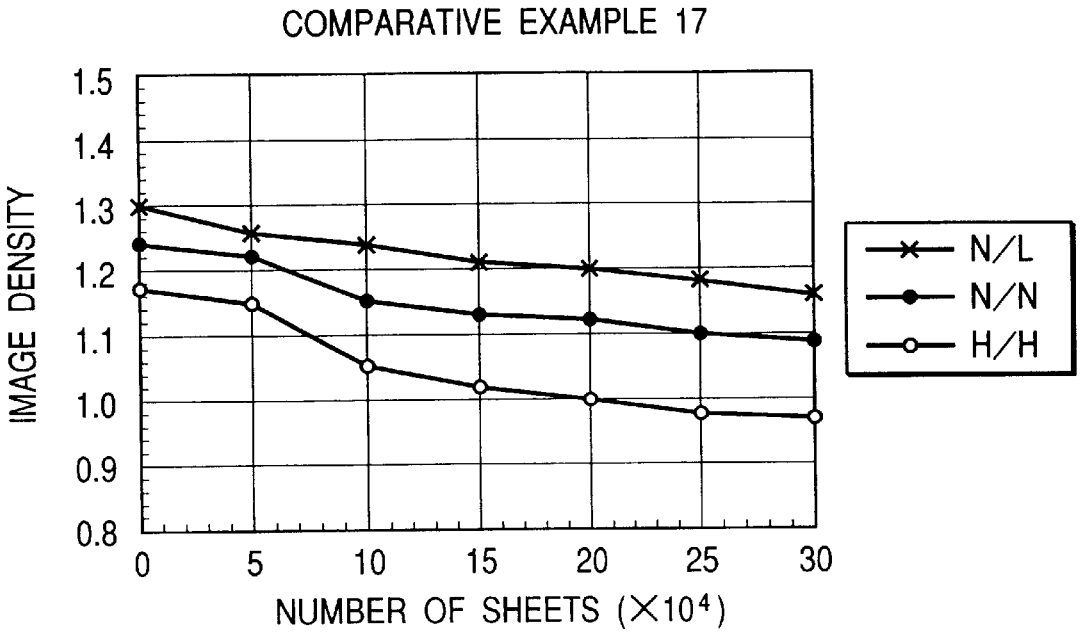
FIGS. 56A and 56B are graphs showing how image density and fog, respectively, undergo changes during running tests made in Comparative Example 17.
Figure 56B:
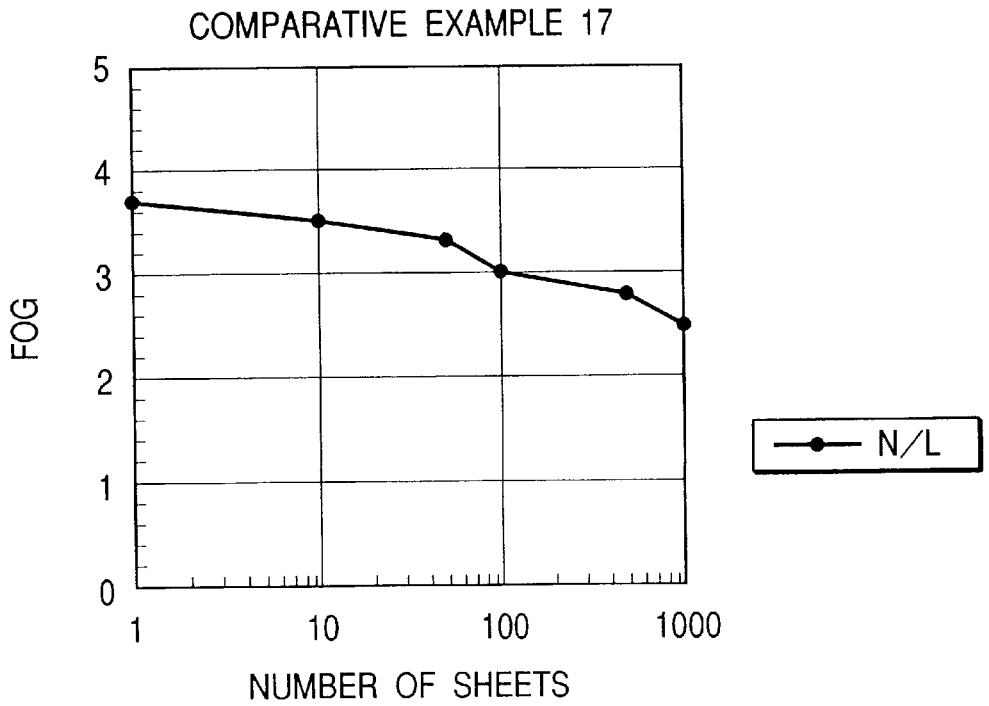

Then, using the developing sleeve 53 thus obtained, images were reproduced and evaluated in the same manner as in Example 25. As the result, as shown in Tables 10, 11 and 12 and FIGS. 56A and 56B, the result on fog was poor even at image reproduction on about 1,000 th sheet, and also a decrease in image density was seen during running.

Comparative Example 18

A coating material resin composition was prepared in the same formulation and procedure as in Example 25 except that the quaternary ammonium salt compound used therein, represented by the formula (1), was replaced with Nigrosine (N). The resin composition thus obtained was composed of C/GF/B/N=0.2/0.8/2.5/0.5. Here, on this Nigrosine (N), its polarity of triboelectricity to iron powder was measured by the blow-off process in the same manner as in Example 25 to find that it was positive polarity.

On the coating material type resin composition, its coating film volume resistivity was measured in the same manner as in Example 25 to find that it was 4.5×10 Ω·cm. This resin composition was further coated on the same aluminum substrate as that used in Example 25, followed by heating and hardening. Thus, developing sleeve 54 having a conductive resin coat layer on the surface was produced.

Figure 57A:
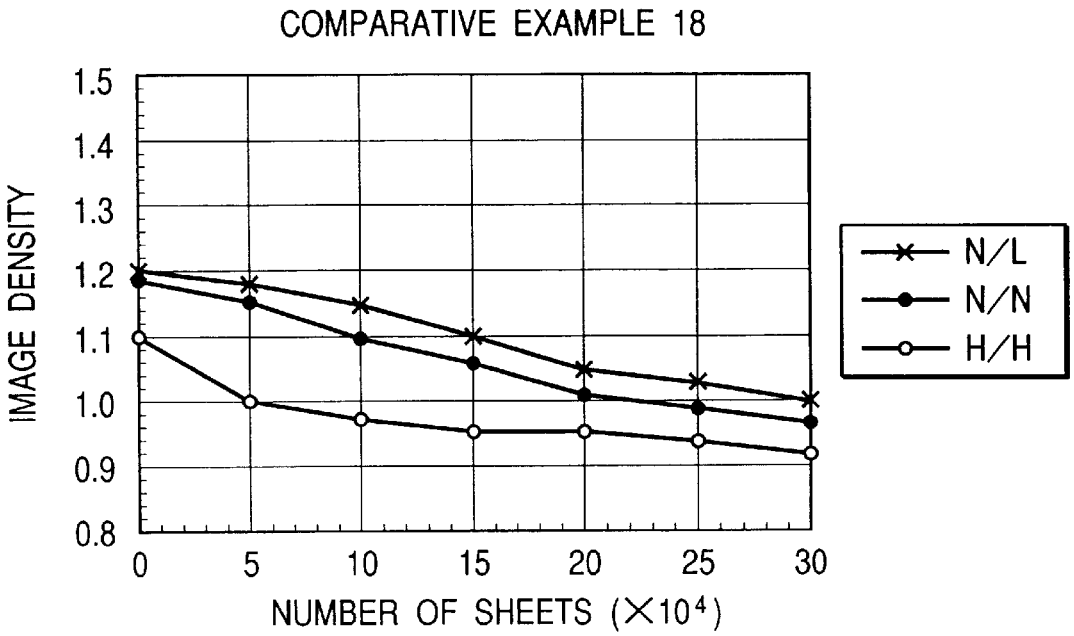
FIGS. 57A and 57B are graphs showing how image density and fog, respectively, undergo changes during running tests made in Comparative Example 18.
Figure 57B:
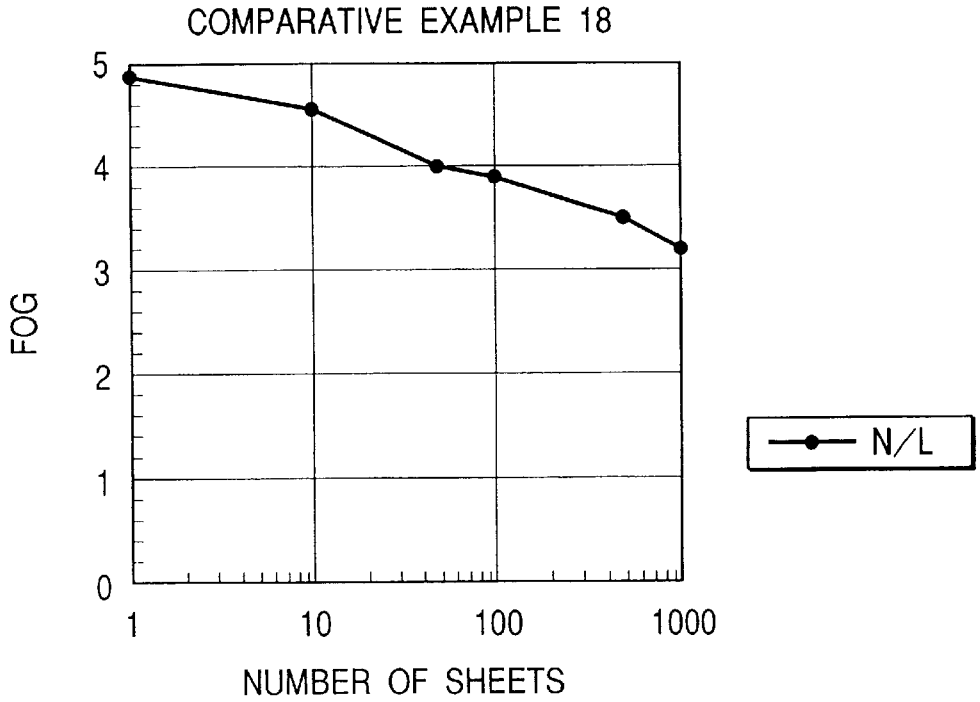

Using the developing sleeve 54 thus obtained, images were reproduced and evaluated in the same manner as in Example 25. As the result, as shown in Tables 10, 11 and 12 and FIGS. 57A and 57B, the result on fog was poor until image reproduction on about 1,000 sheets, and also a decrease in image density was seen at an early stage during running.

Comparative Example 19

A coating material resin composition was prepared in the same formulation and procedure as in Example 25 except that the quaternary ammonium salt compound used therein, represented by the formula (1), was replaced with a quaternary ammonium salt compound represented by the following formula (9). The resin composition thus obtained was composed of C/GF/B/P=0.2/0.8/2.5/0.5. Here, on this quaternary ammonium salt compound represented by the following formula (9), its polarity of triboelectricity to iron powder was also measured by the blow-off process in the same manner as in Example 25 to find that it was negative polarity, different from Example 25.

(9)

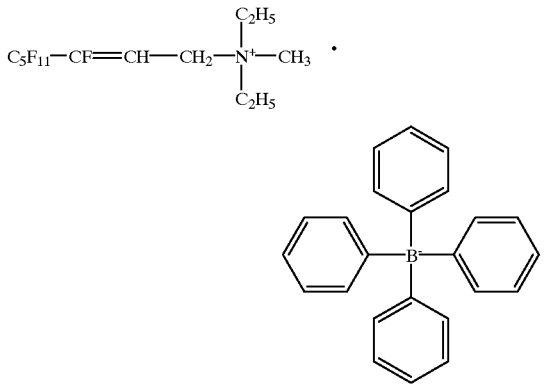

On the coating material type resin composition, its coating film volume resistivity was measured in the same manner as in Example 25 to find that it was 2.6×10 Ω·cm. This resin composition was further coated on the same aluminum substrate as that used in Example 25, followed by heating and hardening. Thus, developing sleeve 55 having a conductive resin coat layer on the surface was produced.

Figure 58A:
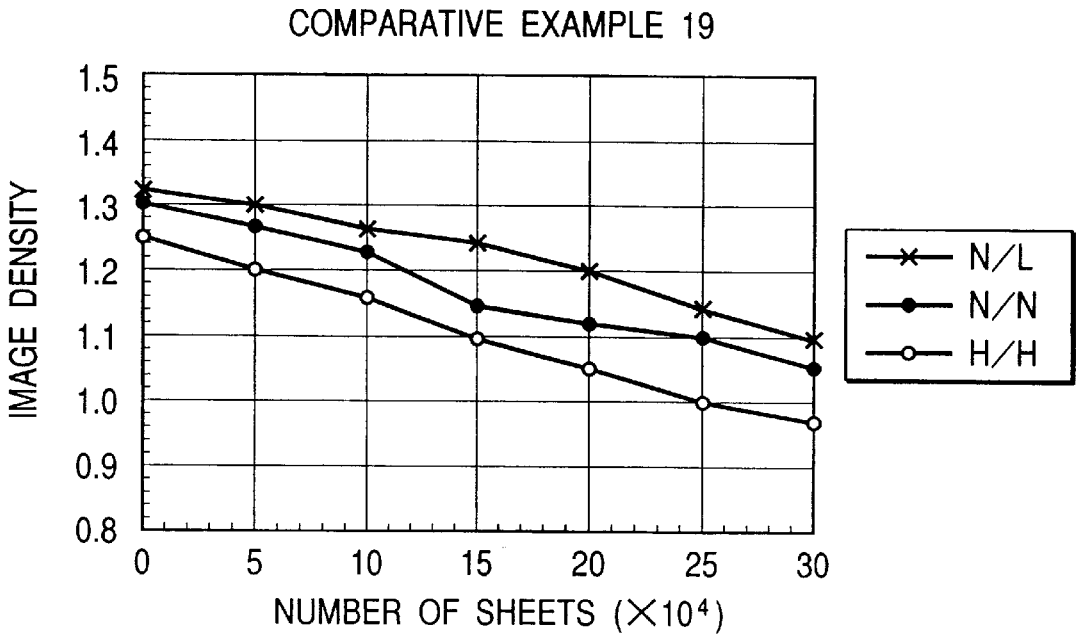
FIGS. 58A and 58B are graphs showing how image density and fog, respectively, undergo changes during running tests made in Comparative Example 19.
Figure 58B:
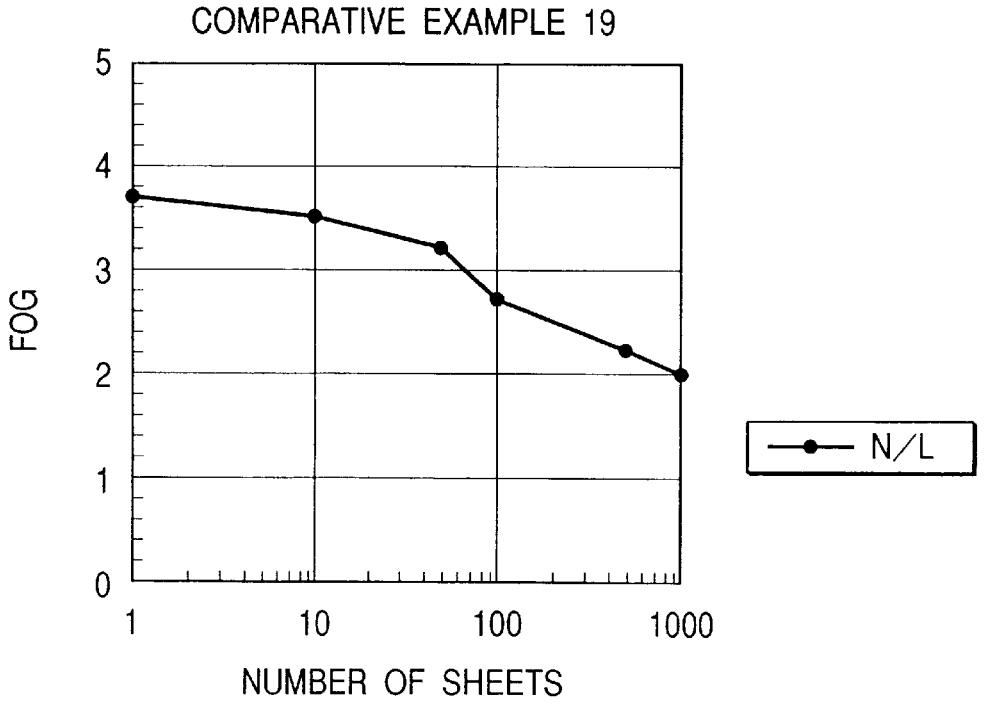

Using the developing sleeve 55 thus obtained, images were reproduced and evaluated in the same manner as in Example 25. As the result, as shown in Tables 10, 11 and 12 and FIGS. 58A and 58B, the result on fog was good at image reproduction on 1,000 th sheet, but a decrease in image density was seen.

Comparative Example 20

A coating material resin composition was prepared in the same formulation and procedure as in Example 25 except that the urethane resin was replaced with PMMA resin. On the coating material type resin composition, its coating film volume resistivity was measured in the same manner as in Example 25 to find that it was 3.1×10 Ω·cm. This resin composition was further coated on the same aluminum substrate as that used in Example 25, followed by heating and hardening. Thus, developing sleeve 56 having a conductive resin coat layer on the surface was produced.

Figure 59A:
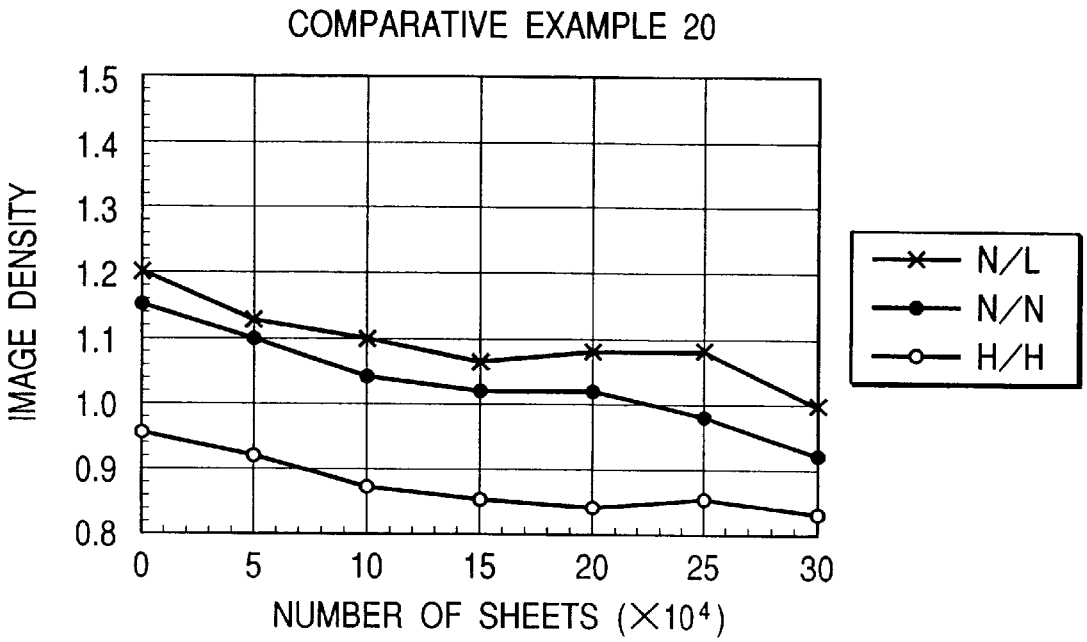
FIGS. 59A and 59B are graphs showing how image density and fog, respectively, undergo changes during running tests made in Comparative Example 20.
Figure 59B:
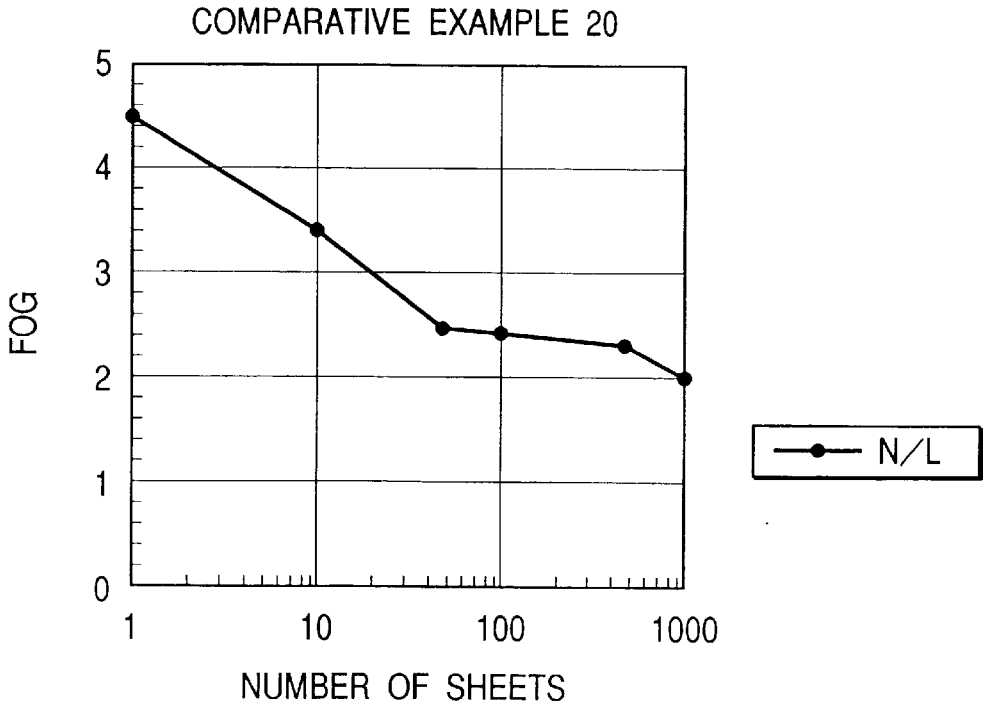

Using the developing sleeve 56 thus obtained, images were reproduced and evaluated in the same manner as in Example 25. As the result, as shown in Tables 10, 11 and 12 and FIGS. 59A and 59B, the result on fog was poor until image reproduction on 1,000 sheets, and the image density was poor from the beginning.

Comparative Example 21

A coating material resin composition was prepared in the same formulation and procedure as in Example 25 except that the urethane resin was replaced with a styrene-acrylate copolymer. On the coating material type resin composition, its coating film volume resistivity was measured in the same manner as in Example 25 to find that it was 3.5×10 Ω·cm. This resin composition was further coated on the same aluminum substrate as that used in Example 25, followed by heating and hardening. Thus, developing sleeve 57 having a conductive resin coat layer on the surface was produced.

Figure 60A:
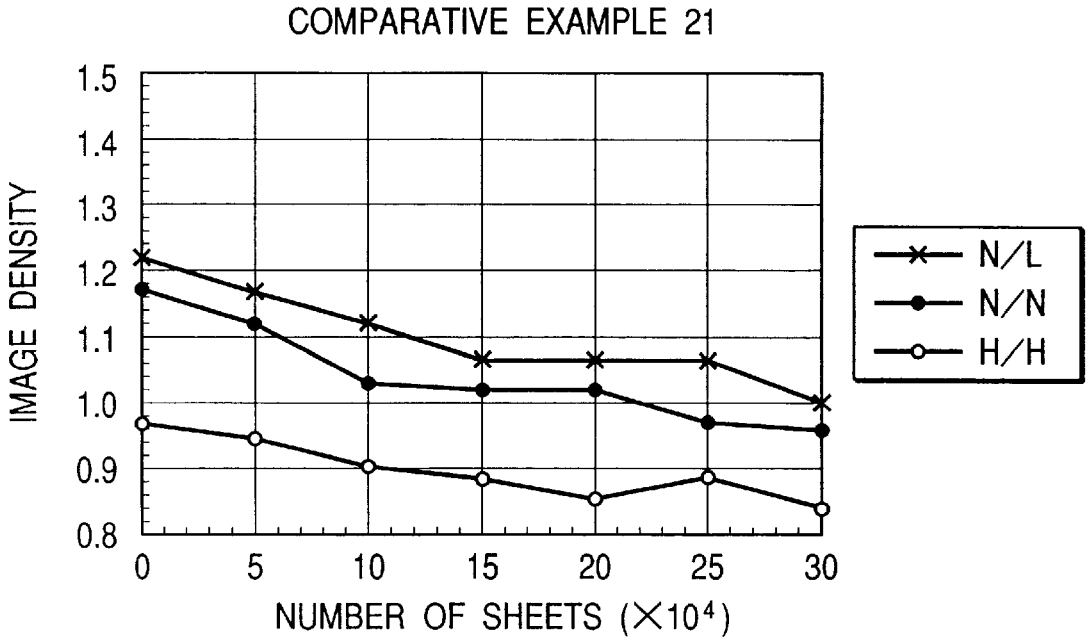
FIGS. 60A and 60B are graphs showing how image density and fog, respectively, undergo changes during running tests made in Comparative Example 21.
Figure 60B:
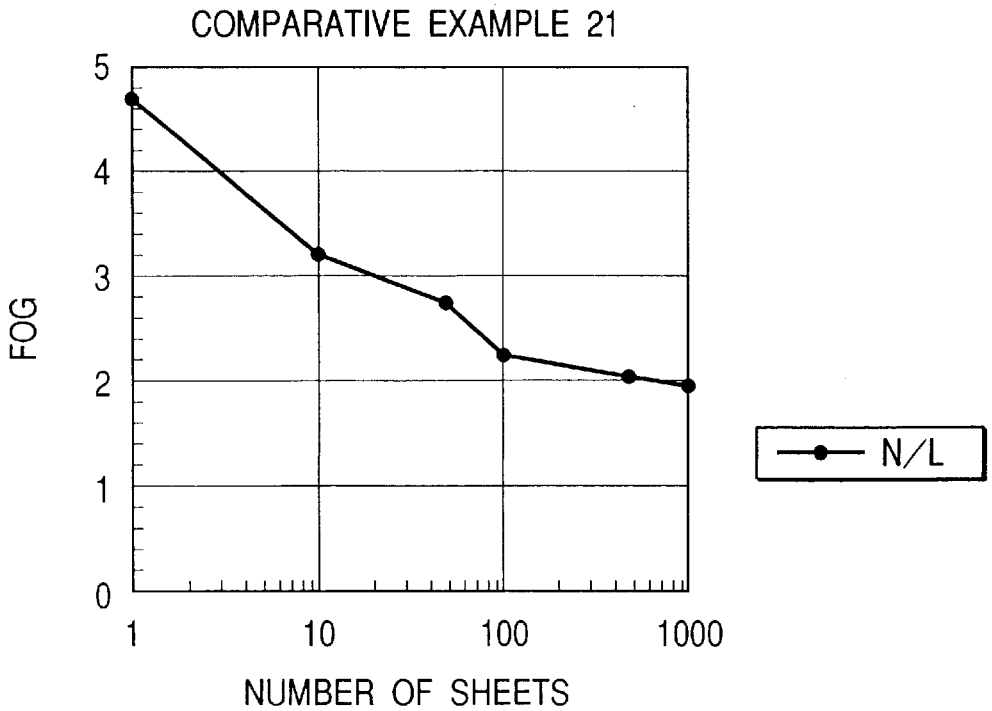

Then, using the developing sleeve 57 thus obtained, images were reproduced and evaluated in the same manner as in Example 25. As the result, as shown in Tables 10, 11 and 12 and FIGS. 60A and 60B, the result on fog was poor until image reproduction on 1,000 sheets, and the image density was poor from the beginning.

TABLE 1

| | Constitution of Developer Carrying Member | | | | | | | | | |
|---|---|---|---|---|---|---|---|---|---|---|
| | | Chief additive in coat layer | | | Phenol resin | | Developing sleeve *2 | | | |
| | Coat layer compositional ratio | Type | *1 Polarity of triboelectricity | Binder resin | production catalyst | Volume resistivity (Ω · cm) | Polarity of triboelectricity of coat layer | Developer triboelectricity (mC/kg) N/N | N/L | H/H |
| Example: | | | | | | | | | | |
| 1 | C/GF/B/P = 0.2/0.8/2.5/0.5 | Quaternary ammonium salt comp. (1) | Positive | Phenol resin | $NH_3$ | 1.5 × 10 | Negative | +15.3 | +16 | +14.5 |
| 2 | C/GF/B/P = 0.2/0.8/2.5/0.5 | Quaternary ammonium salt comp. (2) | Positive | Phenol resin | $NH_3$ | 2.1 × 10 | Negative | +15.7 | +16.2 | +15 |
| 3 | C/GF/B/P = 0.2/0.8/2.5/0.5 | Quaternary ammonium salt comp. (3) | Positive | Phenol resin | $NH_3$ | 1.7 × 10 | Negative | +15.9 | +16.5 | +15.4 |
| 4 | C/GF/B/P = 0.2/0.8/2.5/0.5 | Quaternary ammonium salt comp. (4) | Positive | Phenol resin | $NH_3$ | 1.9 × 10 | Negative | +16.2 | +16.7 | +15.6 |
| 5 | C/BN/B/P = 0.2/0.8/2.5/0.5 | Quaternary ammonium salt comp. (1) | Positive | Phenol resin | HMTA | $7.5 \times 10^2$ | Negative | +16.5 | +17.6 | +16 |
| 6 | C/BN/B/P = 0.2/0.8/2.5/0.5 | Quaternary ammonium salt comp. (2) | Positive | Phenol resin | TMAM | $8.6 \times 10^2$ | Negative | +17 | +17.5 | +16.5 |
| 7 | C/BN/B/P = 0.2/0.8/2.5/0.5 | Quaternary ammonium salt comp. (3) | Positive | Phenol resin | TEAM | $8.0 \times 10^2$ | Negative | +16.3 | +16.7 | +15.2 |
| 8 | C/BN/B/P = 0.2/0.8/2.5/0.5 | Quaternary ammonium salt comp. (4) | Positive | Phenol resin | Prdn | $7.7 \times 10^2$ | Negative | +17.6 | +18.7 | +16.7 |
| 9 | $C/MoS_2/B/P$ = 0.2/1.6/2.5/0.5 | Quaternary ammonium salt comp. (1) | Positive | Phenol resin | HMTA | 7.3 × 10 | Negative | +16.4 | +16.7 | +15.6 |
| 10 | $C/MoS_2/B/P$ = 0.2/1.6/2.5/0.5 | Quaternary ammonium salt comp. (2) | Positive | Phenol resin | TMAM | 8.9 × 10 | Negative | +17 | +17.2 | +16 |
| 11 | $C/MoS_2/B/P$ = 0.2/1.6/2.5/0.5 | Quaternary ammonium salt comp. (3) | Positive | Phenol resin | TEAM | 7.7 × 10 | Negative | +16.4 | +16.9 | +15.5 |
| 12 | $C/MoS_2/B/P$ = 0.2/1.6/2.5/0.5 | Quaternary ammonium salt comp. (4) | Positive | Phenol resin | Prdn | 9.5 × 10 | Negative | +16.5 | +17 | +15.9 |

TABLE 1-continued

| | Constitution of Developer Carrying Member | | | | | | | | | |
|---|---|---|---|---|---|---|---|---|---|---|
| | | Chief additive in coat layer | | | Phenol resin | | Developing sleeve *2 | | | |
| | Coat layer compositional ratio | Type | *1 Polarity of tribo-electric-ity | Binder resin | pro-duc-tion cata-lyst | Volume resis-tivity (Ω · cm) | Polarity of tribo-electric-ity of coat layer | Developer triboelectricity (mC/kg) N/N | N/L | H/H |
| Comparative Example: | | | | | | | | | | |
| 1 | No coat layer | None | — | None | — | — | — | +8.96 | +9.2 | +8.44 |
| 2 | C/GF/B = 0.2/0.8/2.5 | None | — | Phenol resin | None | 5.5 | Positive | +2.94 | +2.77 | +2.11 |
| 3 | C/GF/B/S = 0.2/0.8/2.5/0.5 | Chromium complex of azo-naphthol*3 | Negative | Phenol resin | $NH_3$ | 2.3 × 10 | Positive | +4.52 | +4.99 | +4.47 |
| 4 | C/GF/B/N = 0.2/0.8/2.5/0.5 | Nigro-sine | Positive | Phenol resin | $NH_3$ | 3.4 × 10 | Positive | +2.73 | +2.56 | +2.7 |
| 5 | C/GF/B/P = 0.2/0.8/2.5/0.5 | Quaternary ammonium salt comp. (9) | Negative | Phenol resin | $NH_3$ | 1.9 × 10 | Positive | +4.94 | +5.01 | +4.53 |
| 6 | C/GF/B/P = 0.2/0.8/2.5/0.5 | Quaternary ammonium salt comp. (1) | Positive | PMMA | — | 3.1 × 10 | Positive | +3.43 | +3.97 | +3.21 |
| 7 | C/GF/B/P = 0.2/0.8/2.5/0.5 | Quaternary ammonium salt comp. (1) | Positive | ST-A | — | 3.5 × 10 | Positive | +3.22 | +3.56 | +3.05 |

*1: Polarity of triboelectricity to iron powder
*2: Polarity of triboelectricity to positive toner model particles
HMTA: Hexamethylenetetramine;
TMAM: trimethylamine;
TEAM: triethylamine;
Prdn: Pyridine
PMMA: Polymethyl methacrylate resin;
ST-A: Styrene-acrylate resin

TABLE 2

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 1 | A | A | A | A | A | A | A | A | A |
| 2 | A | A | A | A | A | A | A | A | A |
| 3 | A | A | A | A | A | A | A | A | A |
| 4 | A | A | A | A | A | A | A | A | A |
| 5 | A | A | A | A | A | A | A | A | A |
| 6 | A | A | A | A | A | A | A | A | A |
| 7 | A | A | A | A | A | A | A | A | A |
| 8 | A | A | A | A | A | A | A | A | A |
| 9 | A | A | A | A | A | A | A | A | A |
| 10 | A | A | A | A | A | A | A | A | A |
| 11 | A | A | A | A | A | A | A | A | A |
| 12 | A | A | A | A | A | A | A | A | A |
| Comparative Example: | | | | | | | | | |
| 1 | D | D | D | D | D | D | D | D | D |
| 2 | B | B | B | B | B | B | A | A | A |

TABLE 2-continued

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| 3 | B | B | B | B | B | B | A | A | A |
| 4 | B | B | B | B | B | B | A | A | A |
| 5 | B | B | B | B | B | B | A | A | A |
| 6 | B | B | B | B | B | B | A | A | A |
| 7 | B | B | B | B | B | B | A | A | A |

TABLE 3

| | Evaluation Results (Ghost) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 1 | A | A | A | B | B | B | A | A | A |
| 2 | A | A | A | B | B | B | A | A | A |
| 3 | A | A | A | B | B | B | A | A | A |
| 4 | A | A | A | B | B | B | A | A | A |
| 5 | A | A | A | B | B | B | A | A | A |
| 6 | A | A | A | B | B | B | A | A | A |
| 7 | A | A | A | B | B | B | A | A | A |
| 8 | A | A | A | B | B | B | A | A | A |
| 9 | A | A | A | B | B | B | A | A | A |
| 10 | A | A | A | B | B | B | A | A | A |
| 11 | A | A | A | B | B | B | A | A | A |
| 12 | A | A | A | B | B | B | A | A | A |
| Comparative Example: | | | | | | | | | |
| 1 | Evaluation impossible | | | | | | | | |
| 2 | A | B | C | B | C | C | A | B | C |
| 3 | A | B | C | B | C | C | A | B | C |
| 4 | A | B | C | B | C | C | A | B | C |
| 5 | A | B | C | B | C | C | A | B | C |
| 6 | A | B | C | B | C | C | A | B | C |
| 7 | A | B | C | B | C | C | A | B | C |

TABLE 4

| | Evaluation Results (White Lines) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 1 | A | A | A | A | A | A | A | A | A |
| 2 | A | A | A | A | A | A | A | A | A |
| 3 | A | A | A | A | A | A | A | A | A |
| 4 | A | A | A | A | A | A | A | A | A |

TABLE 4-continued

| | Evaluation Results (White Lines) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| 5 | A | A | A | A | A | A | A | A | A |
| 6 | A | A | A | A | A | A | A | A | A |
| 7 | A | A | A | A | A | A | A | A | A |
| 8 | A | A | A | A | A | A | A | A | A |
| 9 | A | A | A | A | A | A | A | A | A |
| 10 | A | A | A | A | A | A | A | A | A |
| 11 | A | A | A | A | A | A | A | A | A |
| 12 | A | A | A | A | A | A | A | A | A |
| Comparative Example: | | | | | | | | | |
| 1 | | | | Evaluation impossible | | | | | |
| 2 | D | D | D | C | C | C | D | D | D |
| 3 | C | C | C | B | B | B | C | C | C |
| 4 | D | D | D | C | C | C | D | D | D |
| 5 | C | C | C | B | B | B | C | C | C |
| 6 | D | D | D | C | C | C | D | D | D |
| 7 | D | D | D | C | C | C | D | D | D |

TABLE 5

| | Constitution of Developer Carrying Member | | | | | | | | |
|---|---|---|---|---|---|---|---|---|---|
| | | Chief additive in coat layer | | | | Developing sleeve | | | |
| | Coat layer compositional ratio | Type | *1 Polarity of tribo-electric-ity | Binder resin | Volume resis-tivity (Ω · cm) | *2 Polarity of tribo-electric-ity of coat layer | Developer triboelectricity (mC/kg) N/N | N/L | H/H |
| Example: | | | | | | | | | |
| 13 | C/GF/B/P = 0.2/0.8/2.5/0.5 | Quaternary ammonium salt comp. (1) | Positive | Polya-mide resin | $1.6 \times 10$ | Negative | +15.9 | +17.0 | +15.0 |
| 14 | C/GF/B/P = 0.2/0.8/2.5/0.5 | Quaternary ammonium salt comp. (2) | Positive | Polya-mide resin | $1.9 \times 10$ | Negative | +16.3 | +17.2 | +15.5 |
| 15 | C/GF/B/P = 0.2/0.8/2.5/0.5 | Quaternary ammonium salt comp. (3) | Positive | Polya-mide resin | $2.1 \times 10$ | Negative | +16.5 | +17.5 | +15.9 |
| 16 | C/GF/B/P = 0.2/0.8/2.5/0.5 | Quaternary ammonium salt comp. (4) | Positive | Polya-mide resin | $2.7 \times 10$ | Negative | +16.8 | +17.7 | +16.1 |
| 17 | C/BN/B/P = 0.4/1.6/2.5/0.5 | Quaternary ammonium salt comp. (1) | Positive | Polya-mide resin | $5.4 \times 10^2$ | Negative | +17.1 | +18.6 | +16.5 |
| 18 | C/BN/B/P = 0.4/1.6/2.5/0.5 | Quaternary ammonium salt comp. (2) | Positive | Polya-mide resin | $6.7 \times 10^2$ | Negative | +17.6 | +18.5 | +17.0 |
| 19 | C/BN/B/P = 0.4/1.6/2.5/0.5 | Quaternary ammonium salt comp. (3) | Positive | Polya-mide resin | $5.1 \times 10^2$ | Negative | +16.9 | +17.7 | +15.7 |
| 20 | C/BN/B/P = 0.4/1.6/2.5/0.5 | Quaternary ammonium salt comp. (4) | Positive | Polya-mide resin | $9.7 \times 10^2$ | Negative | +18.2 | +19.7 | +17.2 |

TABLE 5-continued

| | Constitution of Developer Carrying Member | | | | | | | | |
|---|---|---|---|---|---|---|---|---|---|
| | | Chief additive in coat layer | | | | Developing sleeve | | | |
| | Coat layer compositional ratio | Type | *1 Polarity of triboelectricity | Binder resin | Volume resistivity (Ω · cm) | *2 Polarity of triboelectricity of coat layer | Developer triboelectricity (mC/kg) N/N | N/L | H/H |
| 21 | $C/MoS_2/B/P$ = 0.2/1.6/2.5/0.5 | Quaternary ammonium salt comp. (1) | Positive | Polyamide resin | 8.4 × 10 | Negative | +17.0 | +17.7 | +16.1 |
| 22 | $C/MoS_2/B/P$ = 0.2/1.6/2.5/0.5 | Quaternary ammonium salt comp. (2) | Positive | Polyamide resin | 9.9 × 10 | Negative | +17.6 | +18.2 | +16.5 |
| 23 | $C/MoS_2/B/P$ = 0.2/1.6/2.5/0.5 | Quaternary ammonium salt comp. (3) | Positive | Polyamide resin | 8.5 × 10 | Negative | +17.0 | +17.9 | +16.0 |
| 24 | $C/MoS_2/B/P$ = 0.2/1.6/2.5/0.5 | Quaternary ammonium salt comp. (4) | Positive | Polyamide resin | 8.7 × 10 | Negative | +17.1 | +18.0 | +16.4 |
| Comparative Example: | | | | | | | | | |
| 8 | No coat layer | None | — | None | — | — | +9.56 | +10.2 | +8.94 |
| 9 | C/GF/B = 0.2/0.8/2.5 | None | — | Polyamide resin | 6.5 | Positive | +3.54 | +3.77 | +2.61 |
| 10 | C/GF/B/S = 0.2/0.8/2.5/0.5 | Chromium complex of azo-naphthol*3 | Negative | Polyamide resin | 3.5 × 10 | Positive | +5.12 | +5.99 | +4.97 |
| 11 | C/GF/B/N = 0.2/0.8/2.5/0.5 | Nigrosine | Positive | Polyamide resin | 4.4 × 10 | Positive | +3.33 | +3.56 | +3.20 |
| 12 | C/GF/B/P = 0.2/0.8/2.5/0.5 | Quaternary ammonium salt comp. (9) | Negative | Polyamide resin | 2.1 × 10 | Positive | +5.54 | +6.01 | +5.03 |
| 13 | C/GF/B/P = 0.2/0.8/2.5/0.5 | Quaternary ammonium salt comp. (1) | Positive | PMMA | 3.1 × 10 | Positive | +3.43 | +3.97 | +3.21 |
| 14 | C/GF/B/P = 0.2/0.8/2.5/0.5 | Quaternary ammonium salt comp. (1) | Positive | ST-A | 3.5 × 10 | Positive | +3.22 | +3.56 | +3.05 |

*1: Polarity of triboelectricity to iron powder
*2: Polarity of triboelectricity to positive toner model particles
*3: containing chlorophenol
PMMA: Polymethyl methacrylate resin;
ST-A: Styrene-acrylate resin

TABLE 6

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 13 | A | A | A | A | A | A | A | A | A |
| 14 | A | A | A | A | A | A | A | A | A |
| 15 | A | A | A | A | A | A | A | A | A |
| 16 | A | A | A | A | A | A | A | A | A |
| 17 | A | A | A | A | A | A | A | A | A |

TABLE 6-continued

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| 18 | A | A | A | A | A | A | A | A | A |
| 19 | A | A | A | A | A | A | A | A | A |
| 20 | A | A | A | A | A | A | A | A | A |
| 21 | A | A | A | A | A | A | A | A | A |
| 22 | A | A | A | A | A | A | A | A | A |
| 23 | A | A | A | A | A | A | A | A | A |
| 24 | A | A | A | A | A | A | A | A | A |
| Comparative Example: | | | | | | | | | |
| 8 | D | D | D | D | D | D | D | D | D |
| 9 | B | B | B | B | B | B | A | A | A |
| 10 | B | B | B | B | B | B | A | A | A |
| 11 | B | B | B | B | B | B | A | A | A |
| 12 | B | B | B | B | B | B | A | A | A |
| 13 | B | B | B | B | B | B | A | A | A |
| 14 | B | B | B | B | B | B | A | A | A |

TABLE 7

| | Evaluation Results (Ghost) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 13 | A | A | A | B | B | B | A | A | A |
| 14 | A | A | A | B | B | B | A | A | A |
| 15 | A | A | A | B | B | B | A | A | A |
| 16 | A | A | A | B | B | B | A | A | A |
| 17 | A | A | A | B | B | B | A | A | A |
| 18 | A | A | A | B | B | B | A | A | A |
| 19 | A | A | A | B | B | B | A | A | A |
| 20 | A | A | A | B | B | B | A | A | A |
| 21 | A | A | A | B | B | B | A | A | A |
| 22 | A | A | A | B | B | B | A | A | A |
| 23 | A | A | A | B | B | B | A | A | A |
| 24 | A | A | A | B | B | B | A | A | A |
| Comparative Example: | | | | | | | | | |
| 8 | Evaluation impossible | | | | | | | | |
| 9 | A | B | C | B | C | C | A | B | C |
| 10 | A | B | C | B | C | C | A | B | C |
| 11 | A | B | C | B | C | C | A | B | C |
| 12 | A | B | C | B | C | C | A | B | C |
| 13 | A | B | C | B | C | C | A | B | C |
| 14 | A | B | C | B | C | C | A | B | C |

TABLE 8

| | Evaluation Results (White Lines) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 1 | A | A | A | A | A | A | A | A | A |
| 2 | A | A | A | A | A | A | A | A | A |
| 3 | A | A | A | A | A | A | A | A | A |
| 4 | A | A | A | A | A | A | A | A | A |
| 5 | A | A | A | A | A | A | A | A | A |
| 6 | A | A | A | A | A | A | A | A | A |
| 7 | A | A | A | A | A | A | A | A | A |
| 8 | A | A | A | A | A | A | A | A | A |
| 9 | A | A | A | A | A | A | A | A | A |
| 10 | A | A | A | A | A | A | A | A | A |
| 11 | A | A | A | A | A | A | A | A | A |
| 12 | A | A | A | A | A | A | A | A | A |
| Comparative Example: | | | | | | | | | |
| 1 | B | B | B | B | B | B | B | B | B |
| 2 | D | D | D | C | C | C | D | D | D |
| 3 | C | C | C | B | B | B | C | C | C |
| 4 | D | D | D | C | C | C | D | D | D |
| 5 | C | C | C | B | B | B | C | C | C |
| 6 | D | D | D | C | C | C | D | D | D |
| 7 | D | D | D | C | C | C | D | D | D |

TABLE 9

| | Constitution of Developer Carrying Member | | | | | | | | |
|---|---|---|---|---|---|---|---|---|---|
| | | Chief additive in coat layer | | | | Developing sleeve | | | |
| | Coat layer compositional ratio | Type | *1 Polarity of tribo-electric-ity | Binder resin | Volume resis-tivity (Ω · cm) | *2 Polarity of tribo-electric-ity of coat layer | Developer triboelectricity (mC/kg) N/N | N/L | H/H |
| Example: | | | | | | | | | |
| 25 | C/GF/B/P = 0.2/0.8/2.5/0.5 | Quaternary ammonium salt comp. (1) | Positive | PU | 1.9 × 10 | Negative | +10.6 | +11.3 | +10.0 |
| 26 | C/GF/B/P = 0.2/0.8/2.5/0.5 | Quaternary ammonium salt comp. (2) | Positive | PU | 2.2 × 10 | Negative | +10.9 | +11.5 | +10.3 |
| 27 | C/GF/B/P = 0.2/0.8/2.5/0.5 | Quaternary ammonium salt comp. (3) | Positive | PU | 2.5 × 10 | Negative | +11.0 | +11.7 | +10.6 |
| 28 | C/GF/B/P = 0.2/0.8/2.5/0.5 | Quaternary ammonium salt comp. (4) | Positive | PU | 3.1 × 10 | Negative | +11.2 | +11.8 | +10.7 |
| 29 | C/BN/B/P = 0.4/1.6/2.5/0.5 | Quaternary ammonium salt comp. (1) | Positive | PU | $6.0 \times 10^2$ | Negative | +11.4 | +12.4 | +11.0 |
| 30 | C/BN/B/P = 0.4/1.6/2.5/0.5 | Quaternary ammonium salt comp. (2) | Positive | PU | $7.1 \times 10^2$ | Negative | +11.7 | +12.3 | +11.3 |
| 31 | C/BN/B/P = 0.4/1.6/2.5/0.5 | Quaternary ammonium salt comp. (3) | Positive | PU | $5.9 \times 10^2$ | Negative | +11.3 | +11.8 | +10.5 |
| 32 | C/BN/B/P = 0.4/1.6/2.5/0.5 | Quaternary ammonium salt comp. (4) | Positive | PU | $9.7 \times 10^2$ | Negative | +12.1 | +13.1 | +11.5 |

TABLE 9-continued

| | Constitution of Developer Carrying Member | | | | | | | | |
|---|---|---|---|---|---|---|---|---|---|
| | | Chief additive in coat layer | | | | Developing sleeve | | | |
| | Coat layer compositional ratio | Type | *1 Polarity of tribo-electric-ity | Binder resin | Volume resis-tivity (Ω · cm) | *2 Polarity of tribo-electric-ity of coat layer | Developer triboelectricity (mC/kg) N/N | N/L | H/H |
| 33 | $C/MoS_2/B/P$ = 0.2/1.6/2.5/0.5 | Quaternary ammonium salt comp. (1) | PU | Polya-mide | 9.2 × 10 | Negative | +11.3 | +11.8 | +10.7 |
| 34 | $C/MoS_2/B/P$ = 0.2/1.6/2.5/0.5 | Quaternary ammonium salt comp. (2) | PU | Polya-mide | 9.9 × 10 | Negative | +11.7 | +12.1 | +11.0 |
| 35 | $C/MoS_2/B/P$ = 0.2/1.6/2.5/0.5 | Quaternary ammonium salt comp. (3) | PU | Polya-mide | 8.9 × 10 | Negative | +11.3 | +11.9 | +10.7 |
| 36 | $C/MoS_2/B/P$ = 0.2/1.6/2.5/0.5 | Quaternary ammonium salt comp. (4) | PU | Polya-mide | 8.8 × 10 | Negative | +11.4 | +12.0 | +10.9 |
| Comparative Example: | | | | | | | | | |
| 15 | No coat layer | None | — | None | — | — | +9.56 | +10.2 | +8.94 |
| 16 | C/GF/B = 0.2/0.8/2.5 | None | — | PU | 7.2 | Positive | +2.36 | +2.51 | +1.74 |
| 17 | C/GF/B/S = 0.2/0.8/2.5/0.5 | Chromium complex of azo-naphthol*3 | Negative | PMMA | 4.2 × 10 | Positive | +3.41 | +3.99 | +3.31 |
| 18 | C/GF/B/N = 0.2/0.8/2.5/0.5 | Nigrosine | Positive | PMMA | 4.5 × 10 | Positive | +2.22 | +2.37 | +2.13 |
| 19 | C/GF/B/P = 0.2/0.8/2.5/0.5 | Quaternary ammonium salt comp. (9) | Negative | PMMA | 2.6 × 10 | Positive | +3.69 | +4.00 | +3.35 |
| 20 | C/GF/B/P = 0.2/0.8/2.5/0.5 | Quaternary ammonium salt comp. (1) | Positive | PMMA | 3.1 × 10 | Positive | +3.43 | +3.97 | +3.21 |
| 21 | C/GF/B/P = 0.2/0.8/2.5/0.5 | Quaternary ammonium salt comp. (1) | Positive | ST-A | 3.5 × 10 | Positive | +3.22 | +3.56 | +3.05 |

*1: Polarity of triboelectricity to iron powder
*2: Polarity of triboelectricity to positive toner model particles
*3: containing chlorophenol
PU: Polyurethatne;
PMMA: Polymethyl methacrylate resin;
ST-A: Styrene-acrylate resin

TABLE 10

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 25 | A | A | A | A | A | A | A | A | A |
| 26 | A | A | A | A | A | A | A | A | A |
| 27 | A | A | A | A | A | A | A | A | A |
| 28 | A | A | A | A | A | A | A | A | A |
| 29 | A | A | A | A | A | A | A | A | A |
| 30 | A | A | A | A | A | A | A | A | A |
| 31 | A | A | A | A | A | A | A | A | A |

TABLE 10-continued

| | Evaluation Results (Blotchy Images) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| 32 | A | A | A | A | A | A | A | A | A |
| 33 | A | A | A | A | A | A | A | A | A |
| 34 | A | A | A | A | A | A | A | A | A |
| 35 | A | A | A | A | A | A | A | A | A |
| 36 | A | A | A | A | A | A | A | A | A |
| Comparative Example: | | | | | | | | | |
| 15 | D | D | D | D | D | D | D | D | D |
| 16 | B | B | B | B | B | B | A | A | A |
| 17 | B | B | B | B | B | B | A | A | A |
| 18 | B | B | B | B | B | B | A | A | A |
| 19 | B | B | B | B | B | B | A | A | A |
| 20 | B | B | B | B | B | B | A | A | A |
| 21 | B | B | B | B | B | B | A | A | A |

TABLE 11

| | Evaluation Results (Ghost) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 25 | A | A | A | B | B | B | A | A | A |
| 26 | A | A | A | B | B | B | A | A | A |
| 27 | A | A | A | B | B | B | A | A | A |
| 28 | A | A | A | B | B | B | A | A | A |
| 29 | A | A | A | B | B | B | A | A | A |
| 30 | A | A | A | B | B | B | A | A | A |
| 31 | A | A | A | B | B | B | A | A | A |
| 32 | A | A | A | B | B | B | A | A | A |
| 33 | A | A | A | B | B | B | A | A | A |
| 34 | A | A | A | B | B | B | A | A | A |
| 35 | A | A | A | B | B | B | A | A | A |
| 36 | A | A | A | B | B | B | A | A | A |
| Comparative Example: | | | | | | | | | |
| 15 | Evaluation impossible | | | | | | | | |
| 16 | A | B | C | B | C | C | A | B | C |
| 17 | A | B | C | B | C | C | A | B | C |
| 18 | A | B | C | B | C | C | A | B | C |
| 19 | A | B | C | B | C | C | A | B | C |
| 20 | A | B | C | B | C | C | A | B | C |
| 21 | A | B | C | B | C | C | A | B | C |

TABLE 12

| | Evaluation Results (White Lines) | | | | | | | | |
|---|---|---|---|---|---|---|---|---|---|
| | After image reproduction on: | | | | | | | | |
| | N/N | | | N/L | | | H/H | | |
| | 1 sheet | 1,000 sheets | 100,000 sheets | 1 sheet | 1,000 sheets | 100,000 sheets | 1 sheet | 1,000 sheets | 100,000 sheets |
| Example: | | | | | | | | | |
| 25 | A | A | A | A | A | A | A | A | A |
| 26 | A | A | A | A | A | A | A | A | A |
| 27 | A | A | A | A | A | A | A | A | A |
| 28 | A | A | A | A | A | A | A | A | A |
| 29 | A | A | A | A | A | A | A | A | A |
| 30 | A | A | A | A | A | A | A | A | A |
| 31 | A | A | A | A | A | A | A | A | A |
| 32 | A | A | A | A | A | A | A | A | A |
| 33 | A | A | A | A | A | A | A | A | A |
| 34 | A | A | A | A | A | A | A | A | A |
| 35 | A | A | A | A | A | A | A | A | A |
| 36 | A | A | A | A | A | A | A | A | A |
| Comparative Example: | | | | | | | | | |
| 15 | B | B | B | B | B | B | B | B | B |
| 16 | D | D | D | C | C | C | D | D | D |
| 17 | C | C | C | B | B | B | C | C | C |
| 18 | D | D | D | C | C | C | D | D | D |
| 19 | C | C | C | B | B | B | C | C | C |
| 20 | D | D | D | C | C | C | D | D | D |
| 21 | D | D | D | C | C | C | D | D | D |

What is claimed is:

1. A developing apparatus comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a phenol resin, (ii) a conductive material and (iii) a quaternary ammonium salt compound which is positively chargeable to iron powder.

2. The developing sleeve apparatus according to claim 1, wherein said quaternary ammonium salt compound comprises a compound represented by the following general formula:

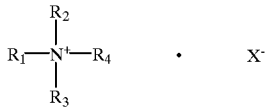

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

3. The developing sleeve apparatus according to claim 2, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

4. The developing apparatus according to claim 1, wherein said resin coat layer contains said quaternary ammonium salt compound in an amount of from 1 part by weight to 100 parts by weight based on 100 parts by weight of the phenol resin.

5. The developing sleeve apparatus according to claim 1, wherein said phenol resin is a phenol resin produced in the presence of a nitrogen-containing compound as a catalyst.

6. The developing sleeve apparatus according to claim 5, wherein said nitrogen-containing compound comprises an acidic catalyst selected from the group consisting of an ammonium salt and an amine salt.

7. The developing sleeve apparatus according to claim 5, wherein said nitrogen-containing compound comprises a basic catalyst selected from the group consisting of ammonia, an amino compound and a nitrogen-containing heterocyclic compound.

8. The developing apparatus according to claim 1, wherein said resin coat layer has a center-line surface roughness Ra of from 0.1 $\mu$m to 3.5 $\mu$m.

9. The developing apparatus according to claim 1, wherein said positively chargeable developer comprises a positively chargeable toner.

10. The developing apparatus according to claim 9, wherein said positively chargeable toner contains a magnetic material in an amount of from 15% by weight to 70% by weight based on the weight of the toner.

11. The developing apparatus according to claim 9, wherein said positively chargeable toner contains a release agent.

12. The developing apparatus according to claim 9, wherein said positively chargeable toner contains a positive charge control agent.

13. The developing apparatus according to claim 9, wherein said positively chargeable toner has a weight-average particle diameter of from 3 μm to 12 μm, and has a particle size distribution that toner particles with diameters of 4.0 μm or smaller are in a content of 30% by number or less and toner particles with diameters of 12.7 μm or larger are in a content of 12.0% by volume or less.

14. The developing apparatus according to claim 9, wherein said positively chargeable toner has a weight-average particle diameter of from 5 μm to 10 μm, and has a particle size distribution that toner particles with diameters of 4.0 μm or smaller are in a content of from 5% by number to 20% by number and toner particles with diameters of 12.7 μm or larger are in a content of 10.0% by volume or less.

15. The developing apparatus according to claim 1, wherein said positively chargeable developer comprises a positively chargeable toner and an inorganic fine powder added externally to the positively chargeable toner.

16. The developing apparatus according to claim 1, wherein said positively chargeable developer is a magnetic one-component type developer having a positively chargeable magnetic toner.

17. The developing apparatus according to claim 1, wherein said positively chargeable developer is a non-magnetic one-component type developer having a positively chargeable non-magnetic toner.

18. The developing apparatus according to claim 1, wherein said positively chargeable developer is a two-component type developer having a positively chargeable non-magnetic toner and a carrier.

19. The developing apparatus according to claim 1, wherein the thickness of the positively chargeable developer layer to be formed on said developer carrying member is smaller than the minimum gap between the surface of said developer carrying member and the surface of a latent image bearing member.

20. The developing apparatus according to claim 1, which comprises a power source for applying a bias voltage to said developer carrying member.

21. The developing apparatus according to claim 20, wherein said bias voltage has an alternating bias voltage on which a direct current voltage component has been superimposed.

22. A developing apparatus comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a urethane resin, (ii) a conductive material and (iii) a quaternary ammonium salt compound which is positively chargeable to iron powder.

23. The developing apparatus according to claim 22, wherein said quaternary ammonium salt compound comprises a compound represented by the following general formula:

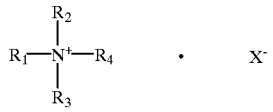

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

24. The developing apparatus according to claim 23, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

25. The developing apparatus according to claim 22, wherein said resin coat layer contains said quaternary ammonium salt compound in an amount of from 1 part by weight to 100 parts by weight based on 100 parts by weight of the urethane resin.

26. The developing apparatus according to claim 22, wherein said urethane resin is a resin containing a urethane linkage.

27. The developing apparatus according to claim 26, wherein said urethane linkage is obtained by polyaddition reaction of a polyisocyanate with a polyol.

28. The developing apparatus according to claim 22, wherein said resin coat layer has a center-line surface roughness Ra of from 0.1 μm to 3.5 μm.

29. The developing apparatus according to claim 22, wherein said positively chargeable developer comprises a positively chargeable toner.

30. The developing apparatus according to claim 29, wherein said positively chargeable toner contains a magnetic material in an amount of from 15% by weight to 70% by weight based on the weight of the toner.

31. The developing apparatus according to claim 29, wherein said positively chargeable toner contains a release agent.

32. The developing apparatus according to claim 29, wherein said positively chargeable toner contains a positive charge control agent.

33. The developing apparatus according to claim 29, wherein said positively chargeable toner has a weight-average particle diameter of from 3 μm to 12 μm, and has a particle size distribution that toner particles with diameters of 4.0 μm or smaller are in a content of 30% by number or less and toner particles with diameters of 12.7 μm or larger are in a content of 12.0% by volume or less.

34. The developing apparatus according to claim 29, wherein said positively chargeable toner has a weight-average particle diameter of from 5 μm to 10 μm, and has a particle size distribution that toner particles with diameters of 4.0 μm or smaller are in a content of from 5% by number to 20% by number and toner particles with diameters of 12.7 μm or larger are in a content of 10.0% by volume or less.

35. The developing apparatus according to claim 22, wherein said positively chargeable developer comprises a positively chargeable toner and an inorganic fine powder added externally to the positively chargeable toner.

36. The developing apparatus according to claim 22, wherein said positively chargeable developer is a magnetic one-component type developer having a positively chargeable magnetic toner.

37. The developing apparatus according to claim 22, wherein said positively chargeable developer is a non-magnetic one-component type developer having a positively chargeable non-magnetic toner.

38. The developing apparatus according to claim 22, wherein said positively chargeable developer is a two-component type developer having a positively chargeable non-magnetic toner and a carrier.

39. The developing apparatus according to claim 22, wherein the thickness of the positively chargeable developer layer to be formed on said developer carrying member is smaller than the minimum gap between the surface of said developer carrying member and the surface of a latent image bearing member.

40. The developing apparatus according to claim 22, which comprises a power source for applying a bias voltage to said developer carrying member.

41. The developing apparatus according to claim 40, wherein said bias voltage has an alternating bias voltage on which a direct current voltage component has been superimposed.

42. An apparatus unit detachably mountable on the main assembly of an image forming apparatus, comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a phenol resin, (ii) a conductive material and (iii) a quaternary ammonium salt compound which is positively chargeable to iron powder.

43. The apparatus unit according to claim 42, wherein said quaternary ammonium salt compound comprises a compound represented by the following general formula:

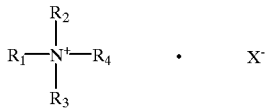

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

44. The apparatus unit according to claim 43, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

45. The apparatus unit according to claim 42, wherein said resin coat layer contains said quaternary ammonium said compound in an amount of from 1 part by weight to 100 parts by weight based on 100 parts by weight of the phenol resin.

46. The apparatus unit according to claim 42, wherein said phenol resin is a phenol resin produced in the presence of a nitrogen-containing compound as a catalyst.

47. The apparatus unit according to claim 46, wherein said nitrogen-containing compound comprises an acidic catalyst selected from the group consisting of an ammonium salt and an amine salt.

48. The apparatus unit according to claim 46, wherein said nitrogen-containing compound comprises a basic catalyst selected from the group consisting of ammonia, an amino compound and a nitrogen-containing heterocyclic compound.

49. The apparatus unit according to claim 42, wherein said resin coat layer has a center-line surface roughness Ra of from 0.1 μm to 3.5 μm.

50. The apparatus unit according to claim 42, wherein said positively chargeable developer comprises a positively chargeable toner.

51. The apparatus unit according to claim 50, wherein said positively chargeable toner contains a magnetic material in an amount of from 15% by weight to 70% by weight based on the weight of the toner.

52. The apparatus unit according to claim 50, wherein said positively chargeable toner contains a release agent.

53. The apparatus unit according to claim 50, wherein said positively chargeable toner contains a positive charge control agent.

54. The apparatus unit according to claim 50, wherein said positively chargeable toner has a weight-average particle diameter of from 3 μm to 12 μm, and has a particle size distribution that toner particles with diameters of 4.0 μm or smaller are in a content of 30% by number or less and toner particles with diameters of 12.7 μm or larger are in a content of 12.0% by volume or less.

55. The apparatus unit according to claim 50, wherein said positively chargeable toner has a weight-average particle diameter of from 5 μm to 10 μm, and has a particle size distribution that toner particles with diameters of 4.0 μm or smaller are in a content of from 5% by number to 20% by number and toner particles with diameters of 12.7 μm or larger are in a content of 10.0% by volume or less.

56. The apparatus unit according to claim 42, wherein said positively chargeable developer comprises a positively chargeable toner and an inorganic fine powder added externally to the positively chargeable toner.

57. The apparatus unit according to claim 42, wherein said positively chargeable developer is a magnetic one-component type developer having a positively chargeable magnetic toner.

58. The apparatus unit according to claim 42, wherein said positively chargeable developer is a non-magnetic one-component type developer having a positively chargeable non-magnetic toner.

59. The apparatus unit according to claim 42, wherein said positively chargeable developer is a two-component type developer having a positively chargeable non-magnetic toner and a carrier.

60. The apparatus unit according to claim 42, wherein the thickness of the positively chargeable developer layer to be formed on said developer carrying member is smaller than the minimum gap between the surface of said developer carrying member and the surface of a latent image bearing member.

61. The apparatus unit according to claim 42, which comprises a power source for applying a bias voltage to said developer carrying member.

62. The apparatus unit according to claim 61, wherein said bias voltage has an alternating bias voltage on which a direct current voltage component has been superimposed.

63. The apparatus unit according to claim 42, which further comprises a latent image bearing member joined as one unit.

64. An apparatus unit detachably mountable on the main assembly of an image forming apparatus, comprising;

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a urethane resin, (ii) a conductive material and (iii) a quaternary ammonium salt compound which is positively chargeable to iron powder.

65. The apparatus unit according to claim 64, wherein said quaternary ammonium salt compound comprises a compound represented by the following general formula:

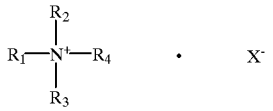

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

66. The apparatus unit according to claim 65, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

67. The apparatus unit according to claim 64, wherein said resin coat layer contains said quaternary ammonium salt compound in an amount of from 1 part by weight to 100 parts by weight based on 100 parts by weight of the urethane resin.

68. The apparatus unit according to claim 64, wherein said urethane resin is a resin containing a urethane linkage.

69. The apparatus unit according to claim 68, wherein said urethane linkage is obtained by polyaddition reaction of a polyisocyanate with a polyol.

70. The apparatus unit according to claim 64, wherein said resin coat layer has a center-line surface roughness Ra of from 0.1 $\mu$m to 3.5 $\mu$m.

71. The apparatus unit according to claim 64, wherein said positively chargeable developer comprises a positively chargeable toner.

72. The apparatus unit according to claim 71, wherein said positively chargeable toner contains a magnetic material in an amount of from 15% by weight to 70% by weight based on the weight of the toner.

73. The apparatus unit according to claim 71, wherein said positively chargeable toner contains a release agent.

74. The apparatus unit according to claim 71, wherein said positively chargeable toner contains a positive charge control agent.

75. The apparatus unit according to claim 71, wherein said positively chargeable toner has a weight-average particle diameter of from 3 $\mu$m to 12 $\mu$m, and has a particle size distribution that toner particles with diameters of 4.0 $\mu$m or smaller are in a content of 30% by number or less and toner particles with diameters of 12.7 $\mu$m or larger are in a content of 12.0% by volume or less.

76. The apparatus unit according to claim 71, wherein said positively chargeable toner has a weight-average particle diameter of from 5 $\mu$m to 10 $\mu$m, and has a particle size distribution that toner particles with diameters of 4.0 $\mu$m or smaller are in a content of from 5% by number to 20% by number and toner particles with diameters of 12.7 $\mu$m or larger are in a content of 10.0% by volume or less.

77. The apparatus unit according to claim 64, wherein said positively chargeable developer comprises a positively chargeable toner and an inorganic fine powder added externally to the positively chargeable toner.

78. The apparatus unit according to claim 64, wherein said positively chargeable developer is a magnetic one-component type developer having a positively chargeable magnetic toner.

79. The apparatus unit according to claim 64, wherein said positively chargeable developer is a non-magnetic one-component type developer having a positively chargeable non-magnetic toner.

80. The apparatus unit according to claim 64, wherein said positively chargeable developer is a two-component type developer having a positively chargeable non-magnetic toner and a carrier.

81. The apparatus unit according to claim 64, wherein the thickness of the positively chargeable developer layer to be formed on said developer carrying member is smaller than the minimum gap between the surface of said developer carrying member and the surface of a latent image bearing member.

82. The apparatus unit according to claim 64, which comprises a power source for applying a bias voltage to said developer carrying member.

83. The apparatus unit according to claim 64, wherein said bias voltage has an alternating bias voltage on which a direct current voltage component has been superimposed.

84. The apparatus unit according to claim 64, which further comprises a latent image bearing member joined as one unit.

85. An image forming method comprising the steps of:

a latent image forming step of forming an electrostatic latent image on a latent image bearing member; and a developing step of developing the electrostatic latent image by the use of a positively chargeable developer of a developing apparatus;

wherein, in said developing step, the electrostatic latent image is developed by means of said developing apparatus, which comprises;

a developer container for holding a developer;

a developer carrying member for carrying a positively chargeable developer held in the developer container and transporting the developer to a developing zone;

wherein said developer carrying member has at least a substrate and a resin coat layer formed of a resin composition on the surface of the substrate; said resin composition containing at least (i) a phenol resin, (ii) a conductive material and (iii) a quaternary ammonium salt compound which is positively chargeable to iron powder; and a developer layer-thickness regulating member for regulating the thickness of a positively chargeable developer layer to be formed on the developer carrying member;

said positively chargeable developer being triboelectrically charged by its friction with the surface of said developer carrying member so that positive triboelectric charges are imparted to said positively chargeable developer, and the electrostatic latent image being developed by the use of the positively chargeable developer to which the positive triboelectric charges have been imparted.

86. The method according to claim 85, wherein said quaternary ammonium salt compound comprises a compound represented by the following general formula:

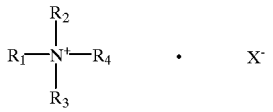

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

87. The method according to claim 86, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

88. The method according to claim 85, wherein said resin coat layer contains said quaternary ammonium salt compound in an amount of from 1 part by weight to 100 parts by weight based on 100 parts by weight of the phenol resin.

89. The method according to claim 85, wherein said phenol resin is a phenol resin produced in the presence of a nitrogen-containing compound as a catalyst.

90. The method according to claim 89, wherein said nitrogen-containing compound comprises an acidic catalyst selected from the group consisting of an ammonium salt and an amine salt.

91. The method according to claim 89, wherein said nitrogen-containing compound comprises a basic catalyst selected from the group consisting of ammonia, an amino compound and a nitrogen-containing heterocyclic compound.

92. The method according to claim 85, wherein said resin coat layer has a center-line surface roughness Ra of from 0.1 μm to 3.5 μm.

93. The method according to claim 85, wherein said positively chargeable developer comprises a positively chargeable toner.

94. The method according to claim 93, wherein said positively chargeable toner contains a magnetic material in an amount of from 15% by weight to 70% by weight based on the weight of the toner.

95. The method according to claim 93, wherein said positively chargeable toner contains a release agent.

96. The method according to claim 93, wherein said positively chargeable toner contains a positive charge control agent.

97. The method according to claim 93, wherein said positively chargeable toner has a weight-average particle diameter of from 3 μm to 12 μm, and has a particle size distribution that toner particles with diameters of 4.0 μm or smaller are in a content of 30% by number or less and toner particles with diameters of 12.7 μm or larger are in a content of 12.0% by volume or less.

98. The method according to claim 93, wherein said positively chargeable toner has a weight-average particle diameter of from 5 μm to 10 μm, and has a particle size distribution that toner particles with diameters of 4.0 μm or smaller are in a content of from 5% by number to 20% by number and toner particles with diameters of 12.7 μm or larger are in a content of 10.0% by volume or less.

99. The method according to claim 85, wherein said positively chargeable developer comprises a positively chargeable toner and an inorganic fine powder added externally to the positively chargeable toner.

100. The method according to claim 85, wherein said positively chargeable developer is a magnetic one-component type developer having a positively chargeable magnetic toner.

101. The method according to claim 85, wherein said positively chargeable developer is a non-magnetic one-component type developer having a positively chargeable non-magnetic toner.

102. The method according to claim 85, wherein said positively chargeable developer is a two-component type developer having a positively chargeable non-magnetic toner and a carrier.

103. The method according to claim 85, wherein the thickness of the positively chargeable developer layer to be formed on said developer carrying member is smaller than the minimum gap between the surface of said developer carrying member and the surface of a latent image bearing member.

104. The method according to claim 85, wherein, in said developing step, the electrostatic latent image is developed under application of a bias voltage to said developer carrying member.

105. The method according to claim 104, wherein said bias voltage has an alternating bias voltage on which a direct current voltage component has been superimposed.

106. The method according to claim 85, wherein said latent image bearing member comprises an electrophotographic photosensitive member.

107. An image forming method comprising the steps of;

a latent image forming step of forming an electrostatic latent image on a latent image bearing member; and a developing step of developing the electrostatic latent image by the use of a positively chargeable developer of a developing apparatus;

wherein, in said developing step, the electrostatic latent image is developed by means of said developing apparatus, which comprises;

a developer container for holding a developer;

a developer carrying member for carrying a positively chargeable developer held in the developer container and transporting the developer to a developing zone;

wherein said developer carrying member has at least a substrate and a resin coat layer formed of a resin composition on the surface of the substrate; said resin composition containing at least (i) a urethane resin, (ii) a conductive material and (iii) a quaternary ammonium salt compound which is positively chargeable to iron powder; and a developer layer-thickness regulating member for regulating the thickness of a positively chargeable developer layer to be formed on the developer carrying member;

said positively chargeable developer being triboelectrically charged by its friction with the surface of said developer carrying member so that positive triboelectric charges are imparted to said positively chargeable developer, and the electrostatic latent image being developed by the use of the positively chargeable developer to which the positive triboelectric charges have been imparted.

108. The method according to claim 107, wherein said quaternary ammonium salt compound comprises a compound represented by the following general formula:

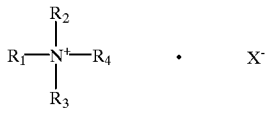

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

109. The method according to claim 108, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

110. The method according to claim 107, wherein said resin coat layer contains said quaternary ammonium salt compound in an amount of from 1 part by weight to 100 parts by weight based on 100 parts by weight of the urethane resin.

111. The method according to claim 107, wherein said urethane resin is a resin containing a urethane linkage.

112. The method according to claim 111, wherein said urethane linkage is obtained by polyaddition reaction of a polyisocyanate with a polyol.

113. The method according to claim 107, wherein said resin coat layer has a center-line surface roughness Ra of from 0.1 μm to 3.5 μm.

114. The method according to claim 107, wherein said positively chargeable developer comprises a positively chargeable toner.

115. The method according to claim 114, wherein said positively chargeable toner contains a magnetic material in an amount of from 15% by weight to 70% by weight based on the weight of the toner.

116. The method according to claim 114, wherein said positively chargeable toner contains a release agent.

117. The method according to claim 114, wherein said positively chargeable toner contains a positive charge control agent.

118. The method according to claim 114, wherein said positively chargeable toner has a weight-average particle diameter of from 3 μm to 12 μm, and has a particle size distribution that toner particles with diameters of 4.0 μm or smaller are in a content of 30% by number or less and toner particles with diameters of 12.7 μm or larger are in a content of 12.0% by volume or less.

119. The method according to claim 114, wherein said positively chargeable toner has a weight-average particle diameter of from 5 μm to 10 μm, and has a particle size distribution that toner particles with diameters of 4.0 μm or smaller are in a content of from 5% by number to 20% by number and toner particles with diameters of 12.7 μm or larger are in a content of 10.0% by volume or less.

120. The method according to claim 107, wherein said positively chargeable developer comprises a positively chargeable toner and an inorganic fine powder added externally to the positively chargeable toner.

121. The method according to claim 107, wherein said positively chargeable developer is a magnetic one-component type developer having a positively chargeable magnetic toner.

122. The method according to claim 107, wherein said positively chargeable developer is a non-magnetic one-component type developer having a positively chargeable non-magnetic toner.

123. The method according to claim 107, wherein said positively chargeable developer is a two-component type developer having a positively chargeable non-magnetic toner and a carrier.

124. The method according to claim 107, wherein the thickness of the positively chargeable developer layer to be formed on said developer carrying member is smaller than the minimum gap between the surface of said developer carrying member and the surface of a latent image bearing member.

125. The method according to claim 124, wherein, in said developing step, the electrostatic latent image is developed under application of a bias voltage to said developer carrying member.

126. The method according to claim 125, wherein said bias voltage has an alternating bias voltage on which a direct current voltage component has been superimposed.

127. The method according to claim 107, wherein said latent image bearing member comprises an electrophotographic photosensitive member.

128. A developing apparatus comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a polyamide resin, (ii) a conductive material and (iii) a quaternary ammonium salt compound which is positively chargeable to iron powder.

129. The developing apparatus according to claim 128, wherein said quaternary ammonium salt compound comprises a compound represented by the following general formula:

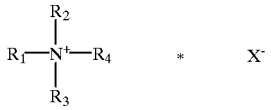

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

130. The developing apparatus according to claim 129, wherein said anion represented by $X^-$ in the formula comprises a member selected from the group consisting of an organic sulfate ion, an organic sulfonate ion, an organic phosphate ions, a molybdate ion, a tungstate ion, a heteropolyacid in containing a molybdenum atom, and a heteropolyacid ion containing a tungsten atom.

131. The developing apparatus according to claim 130, wherein said resin coat layer contains said quaternary ammonium salt compound in an amount of from 1 part by weight to 100 parts by weight based on 100 parts by weight of the polyamide resin.

132. The developing apparatus according to claim 128 wherein said polyamide resin is a polyamide resin produced in the presence of a nitrogen-containing compound as a catalyst.

133. The developing apparatus according to claim 132, wherein said nitrogen-containing compound comprises an acidic catalyst selected from the group consisting of an ammonium salt and an amine salt.

134. The developing apparatus according to claim 132, wherein said nitrogen-containing compound comprises a basic catalyst selected from the group consisting of ammonia, an amino compound and a nitrogen-containing heterocyclic compound.

135. The developing apparatus according to claim 128, wherein said polyamide resin comprises a resin selected from the group consisting of a nylon selected from the group consisting of nylon 6, nylon 66, nylon 610, nylon 11, nylon 12, nylon 9, nylon 13 and nylon Q2, a copolymer nylon composed chiefly of any of these nylons, a resin modified with a polyamide, and an epoxy resin making use of a polyamide as a curing agent.

136. The developing apparatus according to claim 128, wherein said polyamide resin comprises a resin selected from the group consisting of a nylon selected from the group consisting of nylon 6, nylon 66, nylon 610, nylon 11, nylon 12, nylon 9, nylon 13 and nylon Q2, and a copolymer nylon composed chiefly of any of these nylons.

137. The developing apparatus according to claim 128, wherein said resin coat layer has a center-line surface roughness Ra of from 0.1 $\mu$m to 3.5 $\mu$m.

138. The developing apparatus according to claim 128, wherein said positively chargeable developer comprises a positively chargeable toner.

139. The developing apparatus according to claim 138, wherein said positively chargeable toner contains a magnetic material in an amount of from 15% by weight to 70% by weight based on the weight of the toner.

140. The developing apparatus according to claim 138, wherein said positively chargeable toner contains a release agent.

141. The developing apparatus according to claim 138, wherein said positively chargeable toner contains a positive charge control agent.

142. The developing apparatus according to claim 138, wherein said positively chargeable toner has a weight-average particle diameter of from 3 $\mu$m to 12 $\mu$m, and has a particle size distribution such that toner particles with diameters of 4.0 $\mu$m or smaller are in a content of 30% by number or less and toner particles with diameters of 12.7 $\mu$m or larger are in a content of 12.0% by volume or less.

143. The developing apparatus according to claim 138, wherein said positively chargeable toner has a weight-average particle diameter of from 5 $\mu$m to 10 $\mu$m, and has a particle size distribution such that toner particles with diameters of 4.0 $\mu$m or smaller are in a content of from 5% by number to 20% by number and toner particles with diameters of 12.7 $\mu$m or larger are in a content of 10.0% by volume or less.

144. The developing apparatus according to claim 128, wherein said positively chargeable developer comprises a positively chargeable toner and an inorganic fine powder added externally to the positively chargeable toner.

145. The developing apparatus according to claim 128, wherein said positively chargeable developer is a magnetic one-component type developer having a positively chargeable magnetic toner.

146. The developing apparatus according to claim 128, wherein said positively chargeable developer is a non-magnetic one-component type developer having a positively chargeable non-magnetic toner.

147. The developing apparatus according to claim 128, wherein said positively chargeable developer is a two-component type developer having a positively chargeable non-magnetic toner and a carrier.

148. The developing apparatus according to claim 128, wherein the thickness of the positively chargeable developer layer to be formed on said developer carrying member is smaller then the minimum gap between the surface of said developer carrying member and the surface of a latent image bearing member.

149. The developing apparatus according to claim 128, which comprises a power source for applying a bias voltage to said developer carrying member.

150. The developing apparatus according to claim 149, wherein said bias voltage has an alternating bias voltage on which a direct current voltage component has been superimposed.

151. An apparatus unit detachably mountable on the main assembly of an image forming apparatus, comprising:

a developer container for holding a developer;

a developer carrying member for carrying a positively chargeable developer held in the developer container and transporting the developer to a developing zone; and a developer layer-thickness regulating member for regulating the thickness of a positively chargeable developer layer to be formed on the developer carrying member;

wherein said developer carrying member has at least a substrate and a resin coat layer formed of a resin composition on the surface of the substrate;

said resin composition containing at least (i) a polyamide resin, (ii) a conductive material and (iii) a quaternary ammonium salt compound which is positively chargeable to iron powder.

152. The apparatus unit according to claim 151, wherein said quaternary ammonium salt compound comprises a compound represented by the following general formula:

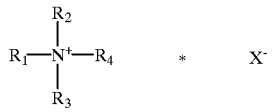

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

153. The apparatus unit according to claim 152, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

154. The apparatus unit according to claim 151, wherein said resin coat layer contains said quaternary ammonium salt compound in an amount of from 1 part by weight to 100 parts by weight based on 100 parts by weight of the polyamide resin.

155. The apparatus unit according to claim 151, wherein said polyamide resin is a polyamide resin produced in the presence of a nitrogen-containing compound as a catalyst.

156. The apparatus unit according to claim 155, wherein said nitrogen-containing compound comprises an acidic catalyst selected from the group consisting of an ammonium salt and an amine salt.

157. The apparatus unit according to claim 155, wherein said nitrogen-containing compound comprises a basic catalyst selected from the group consisting of ammonia, an amino compound and a nitrogen-containing heterocyclic compound.

158. The apparatus unit according to claim 151, wherein said polyamide resin comprises a resin selected from the group consisting of a nylon selected from the group consisting of nylon 6, nylon 66, nylon 610, nylon 11, nylon 12, nylon 9, nylon 13 and nylon Q2, a copolymer nylon composed chiefly of any of these nylons, a resin modified with a polyamide, and an epoxy resin making use of a polyamide as a curing agent.

159. The apparatus unit according to claim 151, wherein said polyamide resin comprises a resin selected from the group consisting of a nylon selected from the group consisting of nylon 6, nylon 66, nylon 610, nylon 11, nylon 12, nylon 9, nylon 13 and nylon Q2, and a copolymer nylon composed chiefly of any of these nylons.

160. The apparatus unit according to claim 151, wherein said resin coat layer has a center-line surface roughness Ra of from 0.1 $\mu$m to 3.5 $\mu$m.

161. The apparatus unit according to claim 151, wherein said positively chargeable developer comprises a positively chargeable toner.

162. The apparatus unit according to claim 161, wherein said positively chargeable toner contains a magnetic material in an amount of from 15% by weight to 70% by weight based on the weight of the toner.

163. The apparatus unit according to claim 161, wherein said positively chargeable toner contains a release agent.

164. The apparatus unit according to claim 161, wherein said positively chargeable toner contains a positive charge control agent.

165. The apparatus unit according to claim 161, wherein said positively chargeable toner has a weight-average particle diameter of from 3 $\mu$m to 12 $\mu$m, and has a particle size distribution such that toner particles with diameters of 4.0 $\mu$m or smaller are in a content of 30% by number or less and toner particles with diameters of 12.7 $\mu$m or larger are in a content of 12.0% by volume or less.

166. The apparatus unit according to claim 161, wherein said positively chargeable toner has a weight-average particle diameter of from 5 $\mu$m to 10 $\mu$m and has a particle size distribution such that toner particles with diameters of 4.0 $\mu$m or smaller are in a content of from 5% by number to 20% by number and toner particles with diameters of 12.7 $\mu$m or larger are in a content of 10.0% by volume or less.

167. The apparatus unit according to claim 151, wherein said positively chargeable developer comprises a positively chargeable toner and an inorganic fine powder added externally to the positively chargeable toner.

168. The apparatus unit according to claim 151, wherein said positively chargeable developer is a magnetic one-component type developer having a positively chargeable magnetic toner.

169. The apparatus unit according to claim 151, wherein said positively chargeable developer is a non-magnetic one-component type developer having a positively chargeable non-magnetic toner.

170. The apparatus unit according to claim 151, wherein said positively chargeable developer is a two-component type developer having a positively chargeable non-magnetic toner and a carrier.

171. The apparatus unit according to claim 151, wherein the thickness of the positively chargeable developer layer to be formed on said developer carrying member is smaller than the minimum gap between the surface of said developer carrying member and the surface of a latent image bearing member.

172. The apparatus unit according to claim 151, which comprises a power source for applying a bias voltage to said developer carrying member.

173. The apparatus unit according to claim 172, wherein said bias voltage has an alternating bias voltage on which a direct current voltage component has been superimposed.

174. The apparatus unit according to claim 151, which further comprises a latent image bearing member joined as one unit.

175. An image forming method comprising the steps of:

a latent image forming step of forming an electrostatic latent image on a latent image bearing member; and a developing step of developing the electrostatic latent image by the use of a positively chargeable developer of a developing apparatus;

wherein, in said developing step, the electrostatic latent image is developed by means of said developing apparatus, which comprises;

a developer container for holding a developer;

a developer carrying member for carrying a positively chargeable developer held in the developer container and transporting the developer to a developing zone;

wherein said developer carrying member has at least a substrate and a resin coat layer formed of a resin composition on the surface of the substrate; said resin composition containing at least (i) a polyamide resin, (ii) a conductive material and (iii) a quaternary ammonium salt compound which is positively chargeable to iron powder; and a developer layer-thickness regulating member for regulating the thickness of a positively chargeable developer layer to be formed on the developer carrying member;

said positively chargeable developer being triboelectrically charged by its friction with the surface of said developer carrying member so that positive triboelectric charges are imparted to said positively chargeable developer, and the electrostatic latent image being developed by the use of the positively chargeable developer to which the positive triboelectric charges have been imparted.

176. The method according to claim 175, wherein said quaternary ammonium salt compound comprises a compound represented by the following general formula:

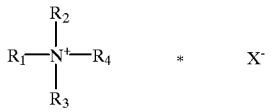

wherein $R_1$, $R_2$, $R_3$ and $R_4$ each represent an alkyl group which may have a substituent, an aryl group which may have a substituent, or an aralkyl group which may have a substituent, and may be the same or different from one another; and $X^-$ represents an anion.

177. The method according to claim 176, wherein said anion represented by $X^-$ in the formula comprises a member selected from the group consisting of an organic sulfate ion, an organic sulfonate ion, an organic phosphate ions, a molybdate ion, a tungstate ion, a heteropolyacid ion containing a molybdenum atom, and a heteropolyacid ion containing a tungsten atom.

178. The method according to claim 175, wherein said resin coat layer contains said quaternary ammonium salt compound in an amount of from 1 part by weight to 100 parts by weight based on 100 parts by weight of the polyamide resin.

179. The method according to claim 175, wherein said polyamide resin is a polyamide resin produced in the presence of a nitrogen-containing compound as a catalyst.

180. The method according to claim 179, wherein said nitrogen-containing compound comprises an acidic catalyst selected from the group consisting of an ammonium salt and an amine salt.

181. The method according to claim 179, wherein said nitrogen-containing compound comprises a basic catalyst selected from the group consisting of ammonia, an amino compound and a nitrogen-containing heterocyclic compound.

182. The method according to claim 175, wherein said polyamide resin comprises a resin selected from the group consisting of a nylon selected from the group consisting of nylon 6, nylon 66, nylon 610, nylon 1, nylon 12, nylon 9, nylon 13 and nylon Q2, a copolymer nylon composed chiefly of any of these nylons, a resin modified with a polyamide, and an epoxy resin making use of a polyamide as a curing agent.

183. The method according to claim 175, wherein said polyamide resin comprises a resin selected from the group consisting of a nylon selected from the group consisting of nylon 6, nylon 66, nylon 610, nylon 11, nylon 12, nylon 9, nylon 13 and nylon Q2, and a copolymer nylon composed chiefly of any of these nylons.

184. The method according to claim 175, wherein said resin coat layer has a center-line surface roughness Ra of from 0.1 $\mu$m to 3.5 $\mu$m.

185. The method according to claim 175, wherein said positively chargeable developer comprises a positively chargeable toner.

186. The method according to claim 185, wherein said positively chargeable toner contains a magnetic material in an amount of from 15% by weight to 70% by weight based on the weight of the toner.

187. The method according to claim 185, wherein said positively chargeable toner contains a release agent.

188. The method according to claim 185, wherein said positively chargeable toner contains a positive charge control agent.

189. The method according to claim 185, wherein said positively chargeable toner has a weight-average particle diameter of from 3 $\mu$m to 12 $\mu$m, and has a particle size distribution such that toner particles with diameters of 4.0 $\mu$m or smaller are in a content of 30% by number or less and toner particles with diameters of 12.7 $\mu$m or larger are in a content of 12.0% by volume or less.

190. The method according to claim 185, wherein said positively chargeable toner has a weight-average particle diameter of from 5 $\mu$m to 10 $\mu$m, and has a particle size distribution such that toner particles with diameters of 4.0 $\mu$m or smaller are in a content of from 5% by number to 20% by number and toner particles with of 12.7 $\mu$m or larger are in a content of 10.0% by volume or less.

191. The method according to claim 175, wherein said positively chargeable developer comprises a positively chargeable toner and an inorganic fine powder added externally to the positively chargeable toner.

192. The method according to claim 175, wherein said positively chargeable developer is a magnetic one-component type developer having a positively chargeable magnetic toner.

193. The method according to claim 175, wherein said positively chargeable developer is a non-magnetic one-component type developer having a positively chargeable non-magnetic toner.

194. The method according to claim 175, wherein said positively chargeable developer is a two-component type developer having a positively chargeable non-magnetic toner and a carrier.

195. The method according to claim 175, wherein the thickness of the positively chargeable developer layer to be formed on said developer carrying member is smaller than the minimum gap between the surface of said developer carrying member and the surface of a latent image bearing member.

196. The method according to claim 175, wherein, in said developing step, the electrostatic latent image is developed under application of a bias voltage to said developer carrying member.

197. The method according to claim 196, wherein said bias voltage has an alternating bias voltage on which direct current voltage component has been superimposed.

198. The method according to claim 175, wherein said latent image bearing member comprises an electrophotographic photosensitive member.

* * * * *

UNITED STATES PATENT AND TRADEMARK OFFICE

CERTIFICATE OF CORRECTION

PATENT NO. : 6,154,625
DATED : November 28, 2000
INVENTOR(S) : Kazunori Saiki et al.

It is certified that error appears in the above-identified patent and that said Letters Patent is hereby corrected as shown below:

Column 2,
Line 64, "preferably when" should read -- and preferably when and --.

Column 3,
Line 2, "at" (second occurrence) should read -- at a --.

Column 15,
Line 2, "much less adhere" should read -- adhere much less --.

Column 16,
Line 18, "complicacy of" should read -- a complicated --.

Column 22,
Line 38, "is" should read -- are --.

Column 23,
Line 45, "shaked" should read -- shaken --.

Column 33,
Line 9, "C/MOS$_2$/B/P" should read -- C/MoS$_2$/B/P --;
Line 34, "C/MOS$_2$/B/P" should read -- C/MoS$_2$/B/P --; and
Line 60, "C/MOS$_2$/B/P" should read -- C/MoS$_2$/B/P --.

Column 44,
Line 63, "C/MOS$_2$/B/P" should read -- C/MoS$_2$/B/P --.

Column 46,
Line 50, "

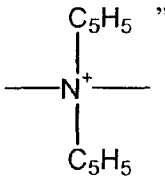

" should read --

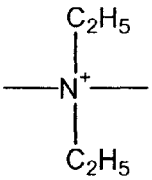

--.

Column 48,
Line 54, "loresta" should read -- Loresta --.

UNITED STATES PATENT AND TRADEMARK OFFICE

CERTIFICATE OF CORRECTION

PATENT NO. : 6,154,625
DATED : November 28, 2000
INVENTOR(S) : Kazunori Saiki et al.

It is certified that error appears in the above-identified patent and that said Letters Patent is hereby corrected as shown below:

Column 55,
Line 28, "loresta" should read -- Loresta --; and
Line 52, "C/MOS$_2$/B/P" should read -- C/MoS$_2$/B/P --.

Column 56,
Line 27, "C/MOS$_2$/B/P" should read -- C/MoS$_2$/B/P --.

Column 73,
Table 9,

| | | | |
|---|---|---|---|
| "PU | Polya-mide | | -- Positive PU |
| PU | Polya-mide | should read | Positive PU |
| PU | Polya-mide | | Positive PU |
| PU | Polya-mide" | | Positive PU --. |

Column 78,
Line 37, "ions," should read -- ion, --.

Column 80,
Line 16, "ions," should read -- ion, --.

Column 81,
Line 56, "ions," should read -- ion, --; and
Line 61, "said" (second occurrence) should read -- salt --.

Column 83,
Line 37, "ions," should read -- ion, --.

Column 84,
Line 38, "claim 64," should read -- claim 82, --.

Column 85,
Line 29, "ions," should read -- ion, --.

UNITED STATES PATENT AND TRADEMARK OFFICE

CERTIFICATE OF CORRECTION

PATENT NO. : 6,154,625
DATED : November 28, 2000
INVENTOR(S) : Kazunori Saiki et al.

It is certified that error appears in the above-identified patent and that said Letters Patent is hereby corrected as shown below:

Column 89,
Line 5, "ions," should read -- ion, --;
Line 6, "in" should read -- ion --; and
Line 13, "claim 128" should read -- claim 128, --.

Column 91,
Line 3, "ions," should read -- ion, --.

Column 93,
Line 16, "ions," should read -- ion, --.

Signed and Sealed this

Nineteenth Day of August, 2003

JAMES E. ROGAN
*Director of the United States Patent and Trademark Office*